US008803926B2

(12) United States Patent
Kobayashi

(10) Patent No.: US 8,803,926 B2
(45) Date of Patent: Aug. 12, 2014

(54) DISPLAY DRIVE DEVICE, DISPLAY DEVICE, DRIVING CONTROL METHOD, AND ELECTRONIC DEVICE STORING CORRECTION DATA FOR CORRECTING IMAGE DATA AND DISPLAYING THE CORRECTED IMAGE DATA IN ONE OF VARIOUS DISPLAY MODES

(75) Inventor: Kenji Kobayashi, Hino (JP)

(73) Assignee: Casio Computer Co., Ltd., Tokyo (JP)

( * ) Notice: Subject to any disclaimer, the term of this patent is extended or adjusted under 35 U.S.C. 154(b) by 214 days.

(21) Appl. No.: 13/249,993

(22) Filed: Sep. 30, 2011

(65) Prior Publication Data

US 2012/0081381 A1 Apr. 5, 2012

(30) Foreign Application Priority Data

Sep. 30, 2010 (JP) ..... 2010-220371
Sep. 30, 2010 (JP) ..... 2010-220652

(51) Int. Cl.

| | |
|---|---|
| ***G09G 5/10*** | (2006.01) |
| ***G09G 5/00*** | (2006.01) |
| ***G09G 5/39*** | (2006.01) |
| ***G09G 3/32*** | (2006.01) |

(52) U.S. Cl.

CPC ..... *G09G 3/32* (2013.01)
USPC ..... 345/690; 345/531; 345/204

(58) Field of Classification Search

None
See application file for complete search history.

(56) References Cited

U.S. PATENT DOCUMENTS

| | | | | |
|---|---|---|---|---|
| 6,226,016 | B1 | 5/2001 | Chee et al. | |
| 6,313,816 | B1 * | 11/2001 | Kojima et al. | 345/83 |
| 6,765,581 | B2 | 7/2004 | Cheng | |
| 6,917,367 | B2 * | 7/2005 | Ohtsuka et al. | 345/589 |
| 6,946,310 | B2 * | 9/2005 | Koyama | 438/27 |
| 7,227,519 | B1 * | 6/2007 | Kawase et al. | 345/77 |
| 7,333,097 | B2 | 2/2008 | Chee et al. | |
| 7,474,293 | B2 * | 1/2009 | Tanaka et al. | 345/94 |
| 7,667,676 | B2 * | 2/2010 | Aoki | 345/87 |

(Continued)

FOREIGN PATENT DOCUMENTS

| | | | |
|---|---|---|---|
| CN | 1495616 | A | 5/2004 |
| CN | 101551970 | A | 10/2009 |

(Continued)

OTHER PUBLICATIONS

Japanese Office Action dated Sep. 7, 2012 (and English translation thereof) in counterpart Japanese Application No. 2010-220371.

(Continued)

*Primary Examiner* — David Zarka
*Assistant Examiner* — Jason Pringle-Parker
(74) *Attorney, Agent, or Firm* — Holtz Holtz Goodman & Chick PC

(57) ABSTRACT

A display drive device includes a correction data memory circuit, a data reading control circuit, and an image data correction circuit. The correction data memory circuit stores a plurality of pieces of correction data according to characteristics of pixels in association with positions where the pixels are arranged in a display panel. The data reading control circuit sets a reading order of the plurality of pieces of correction data to an order corresponding to a display form and reads the correction data in the set reading order. The image data correction circuit associates the image data with each of the plurality of pieces of correction data and generates corrected image data obtained by correcting the image data using the corresponding correction data.

18 Claims, 71 Drawing Sheets

(56) References Cited

U.S. PATENT DOCUMENTS

| | | | | |
|---|---|---|---|---|
| 7,701,472 | B2 | 4/2010 | Obinata | |
| 8,022,908 | B2 | 9/2011 | Mizukoshi et al. | |
| 8,305,373 | B2 | 11/2012 | Ogura et al. | |
| 8,442,313 | B2 * | 5/2013 | Kondo et al. | 382/167 |
| 2003/0045043 | A1 * | 3/2003 | Koyama | 438/200 |
| 2004/0051684 | A1 * | 3/2004 | Ishizuka | 345/76 |
| 2004/0179029 | A1 * | 9/2004 | Ogawa et al. | 345/690 |
| 2005/0264512 | A1 * | 12/2005 | Hamada | 345/100 |
| 2007/0210996 | A1 * | 9/2007 | Mizukoshi et al. | 345/77 |
| 2007/0273701 | A1 | 11/2007 | Mizukoshi et al. | |
| 2008/0100638 | A1 | 5/2008 | Chee et al. | |
| 2008/0231625 | A1 * | 9/2008 | Minami et al. | 345/212 |
| 2010/0134482 | A1 | 6/2010 | Ogura et al. | |
| 2011/0007102 | A1 * | 1/2011 | Ogura et al. | 345/690 |

FOREIGN PATENT DOCUMENTS

| | | | |
|---|---|---|---|
| JP | 4-315195 | A | 11/1992 |
| JP | 8-330600 | A | 12/1996 |
| JP | 2003-296095 | A | 10/2003 |
| JP | 2007-279290 | A | 10/2007 |
| JP | 2009-265621 | A | 11/2009 |
| JP | 2010-128399 | A | 6/2010 |
| KR | 10-2005-0041989 | A | 5/2005 |
| WO | 2010/061978 | A1 | 6/2010 |

OTHER PUBLICATIONS

Japanese Office Action dated Sep. 7, 2012 (and English translation thereof) in counterpart Japanese Application No. 2010-220652.

Korean Office Action dated Mar. 26, 2013 (and English translation thereof) in counterpart Korean Application No. 10-2011-0099276.

Japanese Office Action dated Aug. 5, 2013 (and English translation thereof) in counterpart Japanese Application No. 2010-220652.

Chinese Office Action dated Jan. 13, 2014 (and English translation thereof) in counterpart Chinese Application No. 201110301891.0.

* cited by examiner

FIG.7

<RELATIONSHIP OF ADDRESSES BETWEEN IMAGE DATA AND CORRECTION DATA>
(NORMAL DISPLAY)

IMAGE DATA
(COLUMN ADDRESS)

| | FIRST COLUMN | SECOND COLUMN | . . . . . | 959TH COLUMN | 960TH COLUMN |
|---|---|---|---|---|---|
| FIRST ROW | (1, 1) | (1, 2) | . . . . . | (1, 959) | (1, 960) |
| SECOND ROW | (2, 1) | (2, 2) | . . . . . | (2, 959) | (2, 960) |
| . . . . . | . . . . . | . . . . . | | . . . . . | . . . . . |
| 539TH ROW | (539, 1) | (539, 2) | . . . . . | (539, 959) | (539, 960) |
| 540TH ROW | (540, 1) | (540, 2) | . . . . . | (540, 959) | (540, 960) |

IMAGE DATA
(ROW ADDRESS)

CORRECTION DATA
(ROW, COLUMN ADDRESSES)

FIG.10

<RELATIONSHIP OF ADDRESSES BETWEEN IMAGE DATA AND CORRECTION DATA>
(HORIZONTALLY REVERSED DISPLAY)

IMAGE DATA (COLUMN ADDRESS)

IMAGE DATA (ROW ADDRESS)

| | FIRST COLUMN | SECOND COLUMN | . . . . . | 959TH COLUMN | 960TH COLUMN |
|---|---|---|---|---|---|
| FIRST ROW | (1, 960) | (1, 959) | . . . . . | (1, 2) | (1, 1) |
| SECOND ROW | (2, 960) | (2, 959) | . . . . . | (2, 2) | (2, 1) |
| . . . . . | . . . . . | . . . . . | | . . . . . | . . . . . |
| 539TH ROW | (539, 960) | (539, 959) | . . . . . | (539, 2) | (539, 1) |
| 540TH ROW | (540, 960) | (540, 959) | . . . . . | (540, 2) | (540, 1) |

CORRECTION DATA (ROW, COLUMN ADDRESSES)

FIG.13

<RELATIONSHIP OF ADDRESSES BETWEEN IMAGE DATA AND CORRECTION DATA>
(VERTICALLY REVERSED DISPLAY)

IMAGE DATA (COLUMN ADDRESS)

| | FIRST COLUMN | SECOND COLUMN | . . . | 959TH COLUMN | 960TH COLUMN |
|---|---|---|---|---|---|
| FIRST ROW | (540, 1) | (540, 2) | . . . | (540, 959) | (540, 960) |
| SECOND ROW | (539, 1) | (539, 2) | . . . | (539, 959) | (539, 960) |
| . . . | . . . | . . . | . . . | . . . | . . . |
| 539TH ROW | (2, 1) | (2, 2) | . . . | (2, 959) | (2, 960) |
| 540TH ROW | (1, 1) | (1, 2) | . . . | (1, 959) | (1, 960) |

IMAGE DATA (ROW ADDRESS)

CORRECTION DATA (ROW, COLUMN ADDRESSES)

FIG.16

<RELATIONSHIP OF ADDRESSES BETWEEN IMAGE DATA AND CORRECTION DATA>
(HORIZONTALLY AND VERTICALLY REVERSED DISPLAY)

IMAGE DATA (COLUMN ADDRESS)

IMAGE DATA (ROW ADDRESS)

| | FIRST COLUMN | SECOND COLUMN | . . . . . | 959TH COLUMN | 960TH COLUMN |
|---|---|---|---|---|---|
| FIRST ROW | (540, 960) | (540, 959) | . . . . . | (540, 2) | (540, 1) |
| SECOND ROW | (539, 960) | (539, 959) | . . . . . | (539, 2) | (539, 1) |
| . | . | . | | . | . |
| . | . | . | | . | . |
| . | . | . | | . | . |
| . | . | . | | . | . |
| . | . | . | | . | . |
| . | . | . | | . | . |
| . | . | . | | . | . |
| 539TH ROW | (2, 960) | (2, 959) | . . . . . | (2, 2) | (2, 1) |
| 540TH ROW | (1, 960) | (1, 959) | . . . . . | (1, 2) | (1, 1) |

CORRECTION DATA (ROW, COLUMN ADDRESSES)

FIG.20

<RELATIONSHIP OF ADDRESSES BETWEEN IMAGE DATA AND CORRECTION DATA>
(NORMAL DISPLAY)

L SIDE IMAGE DATA (COLUMN ADDRESS) | R SIDE IMAGE DATA (ROW ADDRESS)

IMAGE DATA (ROW ADDRESS)

| | FIRST COLUMN | SECOND COLUMN | . . . . . | 480TH COLUMN | 481ST COLUMN | . . . . . | 959TH COLUMN | 960TH COLUMN |
|---|---|---|---|---|---|---|---|---|
| FIRST ROW | (1, 1) | (1, 2) | . . . . . | (1, 480) | [1, 1] (1, 481) | . . . . . | [1, 479] (1, 959) | [1, 480] (1, 960) |
| SECOND ROW | (2, 1) | (2, 2) | . . . . . | (2, 480) | [2, 1] (2, 481) | . . . . . | [2, 479] (2, 959) | [2, 480] (2, 960) |
| . | . | . | | . | . | | . | . |
| . | . | . | | . | . | | . | . |
| . | . | . | | . | . | | . | . |
| . | . | . | | . | . | | . | . |
| . | . | . | | . | . | | . | . |
| . | . | . | | . | . | | . | . |
| . | . | . | | . | . | | . | . |
| 539TH ROW | (539, 1) | (539, 2) | . . . . . | (539, 480) | [539, 1] (539, 481) | . . . . . | [539, 479] (539, 959) | [539, 480] (539, 960) |
| 540TH ROW | (540, 1) | (540, 2) | . . . . . | (540, 480) | [540, 1] (540, 481) | . . . . . | [540, 479] (540, 959) | [540, 480] (540, 960) |

L SIDE CORRECTION DATA (ROW, COLUMN ADDRESSES) | R SIDE CORRECTION DATA (ROW, COLUMN ADDRESSES)

FIG.23

<RELATIONSHIP OF ADDRESSES BETWEEN IMAGE DATA AND CORRECTION DATA>
(HORIZONTALLY REVERSED DISPLAY)

| IMAGE DATA (ROW ADDRESS) | L SIDE IMAGE DATA (COLUMN ADDRESS) | | | | R SIDE IMAGE DATA (ROW ADDRESS) | | | |
|---|---|---|---|---|---|---|---|---|
| | 481ST COLUMN | · · · · · | 959TH COLUMN | 960TH COLUMN | FIRST COLUMN | SECOND COLUMN | · · · · · | 480TH COLUMN |
| FIRST ROW | (1, 480) | · · · · · | (1, 2) | (1, 1) | [1, 480] (1, 960) | [1, 479] (1, 959) | · · · · · | [1, 1] (1, 481) |
| SECOND ROW | (2, 480) | · · · · · | (2, 2) | (2, 1) | [2, 480] (2, 960) | [2, 479] (2, 959) | · · · · · | [2, 1] (2, 481) |
| · · · · · · · · · | · · · · · · · · · | | · · · · · · · · · | · · · · · · · · · | · · · · · · · · · | · · · · · · · · · | | · · · · · · · · · |
| 539TH ROW | (539, 480) | · · · · · | (539, 2) | (539, 1) | [539, 480] (539, 960) | [539, 479] (539, 959) | · · · · · | [539, 1] (539, 481) |
| 540TH ROW | (540, 480) | · · · · · | (540, 2) | (540, 1) | [540, 480] (540, 960) | [540, 479] (540, 959) | · · · · · | [540, 1] (540, 481) |

L SIDE CORRECTION DATA (ROW, COLUMN ADDRESSES) | R SIDE CORRECTION DATA (ROW, COLUMN ADDRESSES)

FIG.26

<RELATIONSHIP OF ADDRESSES BETWEEN IMAGE DATA AND CORRECTION DATA>
(VERTICALLY REVERSED DISPLAY)

L SIDE IMAGE DATA (COLUMN ADDRESS) | R SIDE IMAGE DATA (ROW ADDRESS)

IMAGE DATA (ROW ADDRESS)

| | FIRST COLUMN | SECOND COLUMN | . . . . . | 480TH COLUMN | 481ST COLUMN | . . . . . | 959TH COLUMN | 960TH COLUMN |
|---|---|---|---|---|---|---|---|---|
| FIRST ROW | (540, 1) | (540, 2) | . . . . . | (540, 480) | [540, 1]<br>(540, 481) | . . . . . | [540, 479]<br>(540, 959) | [540, 480]<br>(540, 960) |
| SECOND ROW | (539, 1) | (539, 2) | . . . . . | (539, 480) | [539, 1]<br>(539, 481) | . . . . . | [539, 479]<br>(539, 959) | [539, 480]<br>(539, 960) |
| . . . . . | . . . . . | . . . . . | | . . . . . | . . . . . | | . . . . . | . . . . . |
| 539TH ROW | (2, 1) | (2, 2) | . . . . . | (2, 480) | [2, 1]<br>(2, 481) | . . . . . | [2, 479]<br>(2, 959) | [2, 480]<br>(2, 960) |
| 540TH ROW | (1, 1) | (1, 2) | . . . . . | (1, 480) | [1, 1]<br>(1, 481) | . . . . . | [1, 479]<br>(1, 959) | [1, 480]<br>(1, 960) |

L SIDE CORRECTION DATA (ROW, COLUMN ADDRESSES) | R SIDE CORRECTION DATA (ROW, COLUMN ADDRESSES)

FIG.29

<RELATIONSHIP OF ADDRESSES BETWEEN IMAGE DATA AND CORRECTION DATA>
(HORIZONTALLY AND VERTICALLY REVERSED DISPLAY)

| IMAGE DATA (ROW ADDRESS) | L SIDE IMAGE DATA (COLUMN ADDRESS) | | | | R SIDE IMAGE DATA (ROW ADDRESS) | | | |
|---|---|---|---|---|---|---|---|---|
| | 481ST COLUMN | · · · · · · | 959TH COLUMN | 960TH COLUMN | FIRST COLUMN | SECOND COLUMN | · · · · · · | 480TH COLUMN |
| FIRST ROW | (540, 480) | · · · · · · | (540, 2) | (540, 1) | [540, 480] (540, 960) | [540, 479] (540, 959) | · · · · · · | [540, 1] (540, 481) |
| SECOND ROW | (539, 480) | · · · · · · | (539, 2) | (539, 1) | [539, 480] (539, 960) | [539, 479] (539, 959) | · · · · · · | [539, 1] (539, 481) |
| · · · · · · · · | · · · · · · · · | | · · · · · · · · | · · · · · · · · | · · · · · · · · | · · · · · · · · | | · · · · · · · · |
| 539TH ROW | (2, 480) | · · · · · · | (2, 2) | (2, 1) | [2, 480] (2, 960) | [2, 479] (2, 959) | · · · · · · | [2, 1] (2, 481) |
| 540TH ROW | (1, 480) | · · · · · · | (1, 2) | (1, 1) | [1, 480] (1, 960) | [1, 479] (1, 959) | · · · · · · | [1, 1] (1, 481) |
| | L SIDE CORRECTION DATA (ROW, COLUMN ADDRESSES) | | | | R SIDE CORRECTION DATA (ROW, COLUMN ADDRESSES) | | | |

FIG.33

| ADDRESS | HORIZONTAL | 153L (PIXEL 1 TO PIXEL 384) | | | | 153R (PIXEL 385 TO PIXEL 960) | | | |
|---|---|---|---|---|---|---|---|---|---|
| 0 | | R0 Δβη | R0 nth | G0 nth | B0 nth | R384 Δβη | R384 nth | G384 nth | B384 nth |
| 1 | | R1 Δβη | R1 nth | G1 nth | B1 nth | R385 Δβη | R385 nth | G385 nth | B385 nth |
| 2 | | R2 Δβη | R2 nth | G2 nth | B2 nth | R386 Δβη | R386 nth | G386 nth | B386 nth |
| 3 | | R3 Δβη | R3 nth | G3 nth | B3 nth | R387 Δβη | R387 nth | G387 nth | B387 nth |
| ⋮ | | ⋮ | ⋮ | ⋮ | ⋮ | ⋮ | ⋮ | ⋮ | ⋮ |
| 17E | L1 | R382 Δβη | R382 nth | G382 nth | B382 nth | R766 Δβη | R766 nth | G766 nth | B766 nth |
| 17F | | R383 Δβη | R383 nth | G383 nth | B383 nth | R767 Δβη | R767 nth | G767 nth | B767 nth |
| 180 | | | | | | R768 Δβη | R768 nth | G768 nth | B768 nth |
| 181 | | | | | | R769 Δβη | R769 nth | G769 nth | B769 nth |
| ⋮ | | ⋮ | ⋮ | ⋮ | ⋮ | ⋮ | ⋮ | ⋮ | ⋮ |
| 23F | | | | | | R959 Δβη | R959 nth | G959 nth | B959 nth |
| 240 | L2 | R0 Δβη | R0 nth | G0 nth | B0 nth | R384 Δβη | R384 nth | G384 nth | B384 nth |
| ⋮ | | ⋮ | ⋮ | ⋮ | ⋮ | ⋮ | ⋮ | ⋮ | ⋮ |
| 4BEFF | L540 | | | | | R959 Δβη | R959 nth | G959 nth | B959 nth |
| | | | | | | | | | |
| 4C000 | | G0 Δβη | G1 Δβη | B0 Δβη | B1 Δβη | G384 Δβη | G385 Δβη | B384 Δβη | B385 Δβη |
| 4C001 | | G2 Δβη | G3 Δβη | B2 Δβη | B3 Δβη | G386 Δβη | G387 Δβη | B386 Δβη | B387 Δβη |
| ⋮ | | ⋮ | ⋮ | ⋮ | ⋮ | ⋮ | ⋮ | ⋮ | ⋮ |
| 4C0BE | L1 | G380 Δβη | G381 Δβη | B380 Δβη | B381 Δβη | G764 Δβη | G765 Δβη | B764 Δβη | B765 Δβη |
| 4C0BF | | G382 Δβη | G383 Δβη | B382 Δβη | B383 Δβη | G766 Δβη | G767 Δβη | B766 Δβη | B767 Δβη |
| 4C0C0 | | | | | | G768 Δβη | G769 Δβη | B768 Δβη | B769 Δβη |
| ⋮ | | ⋮ | ⋮ | ⋮ | ⋮ | ⋮ | ⋮ | ⋮ | ⋮ |
| 4C11F | | | | | | G958 Δβη | G959 Δβη | B958 Δβη | B959 Δβη |
| 4C120 | L2 | G0 Δβη | G1 Δβη | B0 Δβη | B1 Δβη | G384 Δβη | G385 Δβη | B384 Δβη | B385 Δβη |
| ⋮ | | ⋮ | ⋮ | ⋮ | ⋮ | ⋮ | ⋮ | ⋮ | ⋮ |
| 71F7F | L540 | | | | | G958 Δβη | G959 Δβη | B958 Δβη | B959 Δβη |

FIG.35

<RELATIONSHIP OF ADDRESSES BETWEEN IMAGE DATA AND CORRECTION DATA>
(NORMAL DISPLAY)

L SIDE IMAGE DATA (COLUMN ADDRESS) | R SIDE IMAGE DATA (ROW ADDRESS)

IMAGE DATA (ROW ADDRESS)

| | FIRST COLUMN | SECOND COLUMN | . . . | 384TH COLUMN | 385TH COLUMN | . . . . . | 959TH COLUMN | 960TH COLUMN |
|---|---|---|---|---|---|---|---|---|
| FIRST ROW | (1, 1) | (1, 2) | . . . | (1, 384) | [1, 1] (1, 385) | . . . . . | [1, 575] (1, 959) | [1, 576] (1, 960) |
| SECOND ROW | (2, 1) | (2, 2) | . . . | (2, 384) | [2, 1] (2, 385) | . . . . . | [2, 575] (2, 959) | [2, 576] (2, 960) |
| . . . . . | . . . . . | . . . . . | | . . . . . | . . . . . | | . . . . . | . . . . . |
| 539TH ROW | (539, 1) | (539, 2) | . . . | (539, 384) | [539, 1] (539, 385) | . . . . . | [539, 575] (539, 959) | [539, 576] (539, 960) |
| 540TH ROW | (540, 1) | (540, 2) | . . . | (540, 384) | [540, 1] (540, 385) | . . . . . | [540, 575] (540, 959) | [540, 576] (540, 960) |

L SIDE CORRECTION DATA (ROW, COLUMN ADDRESSES) | R SIDE CORRECTION DATA (ROW, COLUMN ADDRESSES)

FIG.39

<RELATIONSHIP OF ADDRESSES BETWEEN IMAGE DATA AND CORRECTION DATA>
(HORIZONTALLY REVERSED DISPLAY)

| IMAGE DATA (ROW ADDRESS) | L SIDE IMAGE DATA (COLUMN ADDRESS) | | | | R SIDE IMAGE DATA (ROW ADDRESS) | | | |
|---|---|---|---|---|---|---|---|---|
| | 577TH COLUMN | . . . | 959TH COLUMN | 960TH COLUMN | FIRST COLUMN | SECOND COLUMN | . . . . . | 576TH COLUMN |
| FIRST ROW | (1, 384) | . . . | (1, 2) | (1, 1) | [1, 576] (1, 960) | [1, 575] (1, 959) | . . . . . | [1, 1] (1, 385) |
| SECOND ROW | (2, 384) | . . . | (2, 2) | (2, 1) | [2, 576] (2, 960) | [2, 575] (2, 959) | . . . . . | [2, 1] (2, 385) |
| . . . . . | . . . . . | | . . . . . | . . . . . | . . . . . | . . . . . | | . . . . . |
| 539TH ROW | (539, 384) | . . . | (539, 2) | (539, 1) | [539, 576] (539, 960) | [539, 575] (539, 959) | . . . . . | [539, 1] (539, 385) |
| 540TH ROW | (540, 384) | . . . | (540, 2) | (540, 1) | [540, 576] (540, 960) | [540, 575] (540, 959) | . . . . . | [540, 1] (540, 385) |
| | L SIDE CORRECTION DATA (ROW, COLUMN ADDRESSES) | | | | R SIDE CORRECTION DATA (ROW, COLUMN ADDRESSES) | | | |

FIG.42

<RELATIONSHIP OF ADDRESSES BETWEEN IMAGE DATA AND CORRECTION DATA>
(VERTICALLY REVERSED DISPLAY)

L SIDE IMAGE DATA (COLUMN ADDRESS) | R SIDE IMAGE DATA (ROW ADDRESS)

IMAGE DATA (ROW ADDRESS)

| | FIRST COLUMN | SECOND COLUMN | . . . | 384TH COLUMN | 385TH COLUMN | . . . . . | 959TH COLUMN | 960TH COLUMN |
|---|---|---|---|---|---|---|---|---|
| FIRST ROW | (540, 1) | (540, 2) | . . . | (540, 384) | [540, 1] (540, 385) | . . . . . | [540, 575] (540, 959) | [540, 576] (540, 960) |
| SECOND ROW | (539, 1) | (539, 2) | . . . | (539, 384) | [539, 1] (539, 385) | . . . . . | [539, 575] (539, 959) | [539, 576] (539, 960) |
| . . . . . | . . . . . | . . . . . | | . . . . . | . . . . . | | . . . . . | . . . . . |
| 539TH ROW | (2, 1) | (2, 2) | . . . | (2, 384) | [2, 1] (2, 385) | . . . . . | [2, 575] (2, 959) | [2, 576] (2, 960) |
| 540TH ROW | (1, 1) | (1, 2) | . . . | (1, 384) | [1, 1] (1, 385) | . . . . . | [1, 575] (1, 959) | [1, 576] (1, 960) |

L SIDE CORRECTION DATA (ROW, COLUMN ADDRESSES) | R SIDE CORRECTION DATA (ROW, COLUMN ADDRESSES)

FIG.45

<RELATIONSHIP OF ADDRESSES BETWEEN IMAGE DATA AND CORRECTION DATA>
(HORIZONTALLY AND VERTICALLY REVERSED DISPLAY)

| IMAGE DATA (ROW ADDRESS) | L SIDE IMAGE DATA (COLUMN ADDRESS) | | | | R SIDE IMAGE DATA (ROW ADDRESS) | | | |
|---|---|---|---|---|---|---|---|---|
| | 577TH COLUMN | . . . | 959TH COLUMN | 960TH COLUMN | FIRST COLUMN | SECOND COLUMN | . . . . . | 576TH COLUMN |
| FIRST ROW | (540, 384) | . . . | (540, 2) | (540, 1) | [540, 576] (540, 960) | [540, 575] (540, 959) | . . . . . | [540, 1] (540, 385) |
| SECOND ROW | (539, 384) | . . . | (539, 2) | (539, 1) | [539, 576] (539, 960) | [539, 575] (539, 959) | . . . . . | [539, 1] (539, 385) |
| . . . . . | . . . . . | | . . . . . | . . . . . | . . . . . | . . . . . | | . . . . . |
| 539TH ROW | (2, 384) | . . . | (2, 2) | (2, 1) | [2, 576] (2, 960) | [2, 575] (2, 959) | . . . . . | [2, 1] (2, 385) |
| 540TH ROW | (1, 384) | . . . | (1, 2) | (1, 1) | [1, 576] (1, 960) | [1, 575] (1, 959) | . . . . . | [1, 1] (1, 385) |

L SIDE CORRECTION DATA (ROW, COLUMN ADDRESSES)

R SIDE CORRECTION DATA (ROW, COLUMN ADDRESSES)

DISPLAY DRIVE DEVICE, DISPLAY DEVICE, DRIVING CONTROL METHOD, AND ELECTRONIC DEVICE STORING CORRECTION DATA FOR CORRECTING IMAGE DATA AND DISPLAYING THE CORRECTED IMAGE DATA IN ONE OF VARIOUS DISPLAY MODES

CROSS-REFERENCE TO RELATED APPLICATIONS

This application is based upon and claims the benefit of priority from prior Japanese Patent Applications No. 2010-220371, filed Sep. 30, 2010; and No. 2010-220652, filed Sep. 30, 2010, the entire contents of all of which are incorporated herein by reference.

BACKGROUND OF THE INVENTION

1. Field of the Invention

The present invention relates to a display drive device, a display device having this display drive device, a driving control method therefor, and an electronic device having this display device.

2. Description of the Related Art

In recent years, a light emitting element-type display device having a display panel (pixel array) arranged with light emitting elements in a matrix form has drawn attention as a next-generation display device, successor to a liquid crystal display device. Known examples of such light emitting elements include current-driven light emitting elements such as an organic electroluminescent element (organic EL element), an inorganic electroluminescent element (inorganic EL element), and a light emitting diode (LED).

A light emitting element-type display device using an active matrix-type drive method has a higher display response speed than a well-known liquid crystal display device, and hardly has any field angle, dependency, thus having excellent display characteristics capable of achieving high brightness, high contrast, high resolution of display quality, and the like. Unlike the liquid crystal display device, the light emitting element-type display device does not need any back light or light guiding plate, thus having extremely excellent characteristics that enable itself to be thinner and lighter than ever before. Therefore, the light emitting element-type display device is expected to be applied to various electronic devices in the future.

For example, an organic EL display device as described in Jpn. Pat. Appln. KOKAI Publication No. H8-330600 is known as such light emitting element-type display device. In this organic EL display device, a circuit including a current control thin film transistor for passing a current to an organic EL element serving as a light emitting element and a switch thin film transistor for performing switching to provide a voltage signal to a gate of the current control thin film transistor in accordance with image data is provided for each pixel.

In the organic EL display device, electric characteristics of the thin film transistor in each pixel may change and vary over time, and light emitting characteristics of the organic EL element in each pixel may change and vary over time.

Further, for example, some of electronic devices such as a digital video camera, a mobile phone, and a personal computer are equipped with a movable (variable angle type) and pivotable display panel capable of freely changing attachment angle and direction with respect to the main body of the device and thereby changing the display form of the display panel to various kinds of display forms such as a horizontally reversed display and a vertically reversed display, and some of them are capable of displaying at a fast speed, e.g., double speed display operation when a motion picture is played back.

When the electronic device uses correction data for each pixel stored in a memory circuit to make correction in order to compensate change and variation of the electric characteristics of the thin film transistor in each pixel and change and variation of the light emitting characteristic of the light emitting element in each pixel as described above, it used to be difficult to perform the above correction operation using the correction data in a relatively short time when the display panel was operated at the fast speed or when the display panel was changed to various kinds of display forms.

BRIEF SUMMARY OF THE INVENTION

The present invention relates to a display drive device, a display device, and a driving control method for displaying image information on a display panel, which has an advantage in that, even when the display form of the image information displayed on the display panel is switched to various forms or when the image information is displayed at a fast speed, e.g., double speed display operation, the image data supplied to each pixel of the display panel can be well corrected using the correction data according to characteristic of each pixel, and high quality image can be obtained.

According to an aspect of the invention, there is provided a display drive device that displays image information according to image data in a display region of a display panel in which a plurality of pixels are arranged, the display drive device comprising: at least one correction data memory circuit that stores a plurality of pieces of correction data according to characteristics of the plurality of pixels in association with positions where the pixels are arranged in the display panel; a data reading control circuit that sets a reading order of the plurality of pieces of correction data stored in the correction data memory circuit to an order corresponding to a display form that is set externally, the set display form being any one of a plurality of display forms in which directions of the image information are different with respect to the display region, and reads the correction data from the correction data memory circuit in the set reading order of the correction data; and an image data correction circuit that associates the image data with each of the plurality of pieces of correction data which are read by the data reading control circuit, and generates corrected image data obtained by correcting the image data using the corresponding correction data.

According to an aspect of the invention, there is provided a display device that displays image information according to image data, comprising: a display panel that includes a display region in which a plurality of pixels are arranged; and a display drive device that displays the image information in the display region of the display panel, wherein the display drive device comprises: at least one correction data memory circuit that stores a plurality of pieces of correction data according to characteristics of the plurality of pixels in association with positions where the pixels are arranged in the display panel; a data reading control circuit that sets a reading order of the plurality of pieces of correction data stored in the correction data memory circuit to an order corresponding to the display form that is set externally, the set display form being any one of a plurality of display forms in which directions of the image information are different with respect to the display region, and reads the correction data from the correction data memory circuit in the set reading order of the correction data; and an image data correction circuit that associates the image data with the plurality of pieces of correction data which are read by the data reading control circuit, and generates corrected image data obtained by correcting the image data using the corresponding correction data.

According to an aspect of the invention, there is provided an electronic device in which a display device according to claim 9 is implemented in a display unit for displaying the image information.

According to an aspect of the invention, there is provided a driving control method for a display device that displays image information according to image data in a display region of a display panel in which a plurality of pixels are arranged, the driving control method comprising: setting a reading order of the pieces of correction data from at least one correction data memory circuit storing the plurality of pieces of correction data according to characteristics of the plurality of pixels, so that the reading order of the correction data is set to an order corresponding to a display form that is set externally, the set display form being any one of a plurality of display forms in which directions of the image information are different with respect to the display region; reading the correction data from the correction data memory circuit in the set reading order; associating the image data with each of the pieces of correction data which are read, and generating corrected image data obtained by correcting the image data using the corresponding correction data; and supplying a gradation signal according to the corrected image data to the display panel, and displaying the image information on the display panel in the display form.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 7 is a schematic diagram illustrating relationship of addresses between each piece of image data and correction data used for correction processing, in the normal display mode in the display device according to the first embodiment;

FIG. 10 is a schematic diagram illustrating relationship of addresses between each piece of image data and correction data used for correction processing, in the horizontally reversed display mode in the display device according to the first embodiment;

FIG. 13 is a schematic diagram illustrating relationship of addresses between each piece of image data and correction data used for correction processing, in the vertically reversed display mode in the display device according to the first embodiment;

FIG. 16 is a schematic diagram illustrating relationship of addresses between each piece of image data and correction data used for correction processing, in the horizontally and vertically reversed display mode in the display device according to the first embodiment;

FIG. 20 is a schematic diagram illustrating relationship of addresses between each piece of image data and correction data used for correction processing, in the normal display mode in the display device according to the second embodiment;

FIG. 23 is a schematic diagram illustrating relationship of addresses between each piece of image data and correction data used for correction processing, in the horizontally reversed display mode in the display device according to the second embodiment;

FIG. 26 is a schematic diagram illustrating relationship of addresses between each piece of image data and correction data used for correction processing, in the vertically reversed display mode in the display device according to the second embodiment;

FIG. 29 is a schematic diagram illustrating relationship of addresses between each piece of image data and correction data used for correction processing, in the horizontally and vertically reversed display mode in the display device according to the second embodiment;

FIG. 33 is a schematic diagram illustrating an image showing how correction data in a correction data memory circuit according to the third embodiment are stored;

FIG. 35 is a schematic diagram illustrating relationship of addresses between each piece of image data and correction data used for correction processing, in the normal display mode in the display device according to the third embodiment;

FIG. 39 is a schematic diagram illustrating relationship of addresses between each piece of image data and correction data used for correction processing, in the horizontally reversed display mode in the display device according to the third embodiment;

FIG. 42 is a schematic diagram illustrating relationship of addresses between each piece of image data and correction data used for correction processing, in the vertically reversed display mode in the display device according to the third embodiment;

FIG. 45 is a schematic diagram illustrating relationship of addresses between each piece of image data and correction data used for correction processing, in the horizontally and vertically reversed display mode in the display device according to the third embodiment;

DETAILED DESCRIPTION OF THE INVENTION

Hereinafter, a display drive device, a display device, a driving control method therefor, and an electronic device according to the present invention will be explained in detail by showing embodiments.

First Embodiment

First, a schematic configuration of a display device having a display drive device according to the present invention will be explained with reference to the drawings.

(Display Device)

Figure 1:
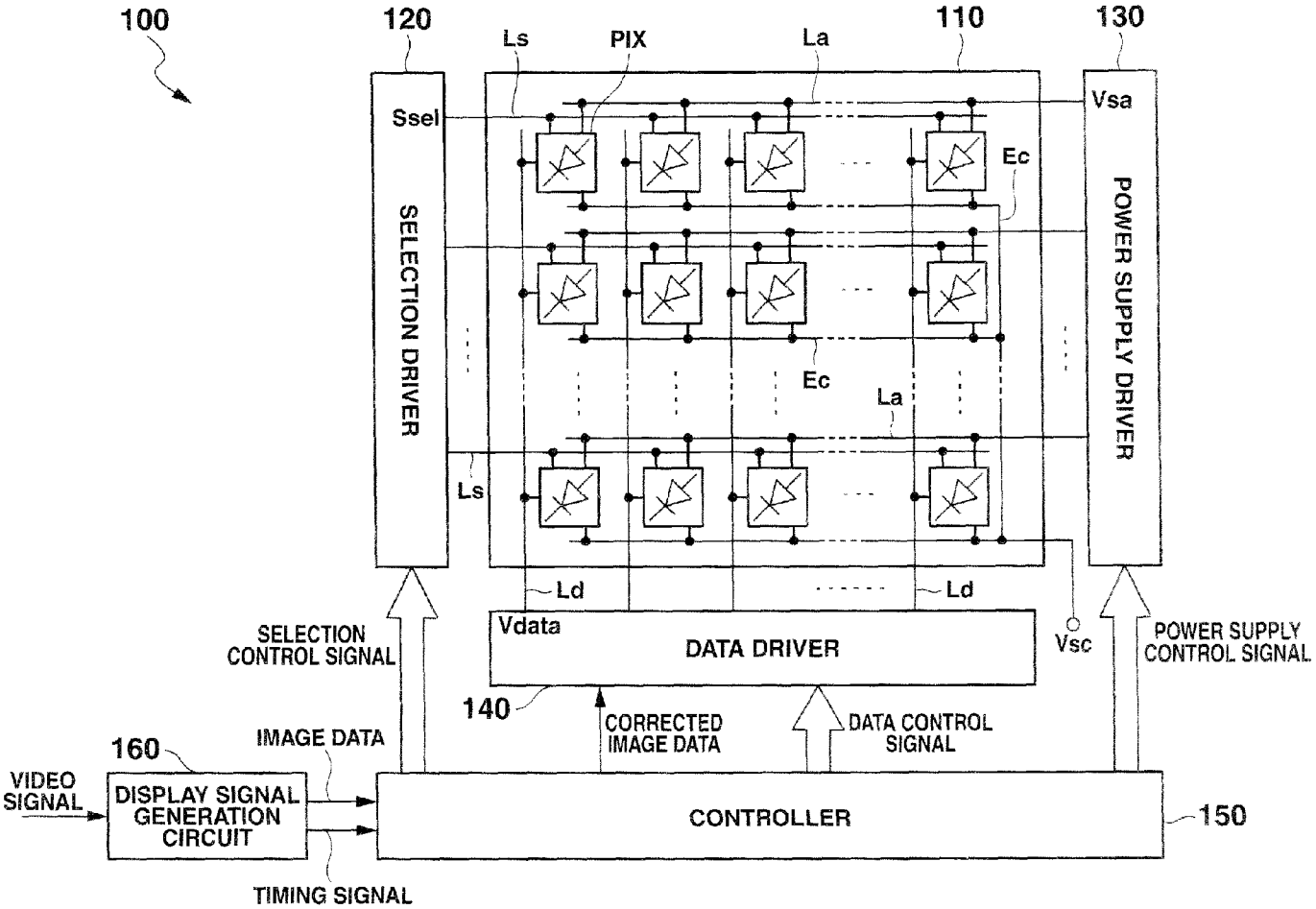
FIG. 1 is a schematic configuration diagram of a display device according to the present invention.

FIG. 1 is a schematic configuration diagram of a display device according to the present invention.

As shown in FIG. 1, a display device 100 mainly includes a display panel (light emitting panel) 110, a selection driver 120, a power supply driver 130, a data driver 140, a controller 150, and a display signal generation circuit 160.

The selection driver 120, the data driver 140, and the controller 150 correspond to the display drive device of the present invention.

As shown in FIG. 1, the display panel 110 includes a light emitting region (display region) in which a plurality of pixels PIX are arranged two-dimensionally (for example, p rows×q columns, where p, q are positive integers) in a row direction (in the figure, horizontal direction) and in a column direction (in the figure, vertical direction), a plurality of selection lines Ls and a plurality of power supply lines La disposed to be connected to the pixels PIX respectively arranged in the row direction, a common electrode Ec commonly provided for all the pixels PIX, and a plurality of data lines Ld disposed to be connected to the pixels PIX arranged in the column direction.

As explained later, the pixel PIX includes a current driven-type light emitting element and a light emitting drive circuit for generating a current for driving and lighting the light emitting element.

The selection driver 120 is connected to each of the selection lines Ls arranged in the row direction on the display panel 110.

The selection driver 120 sequentially applies a selection signal Ssel at a predetermined voltage level (a selective level or a nonselective level) to the selection line Ls in each row with a predetermined timing, on the basis of a selection control signal supplied from the later-described controller 150, thus making the pixels PIX in each row in the selective state in order.

For example, the selection driver 120 is applied a configuration including a shift register and an output circuit.

The shift register sequentially outputs a shift signal corresponding to the selection line Ls in each row, on the basis of the selection control signal (a scanning clock signal and a scanning start signal) supplied from the controller 150. The output circuit converts the shift signal provided by the shift register into a predetermined signal level (a selective level: e.g., a high level) to be sequentially output as a selection signal Ssel to the selection line Ls in each row, on the basis of the selection control signal (output enable signal) provided by the controller 150.

Further, the selection driver 120 applied to the present embodiment is configured to control switching of the order of output of the shift signal from the shift register (shift direction) to a forward direction or a backward direction, on the basis of the selection control signal (shift switch signal) provided by the controller 150.

With this configuration, the selection driver 120 is set and switched to either forward direction sequential output state or backward direction sequential output state. In the forward direction sequential output state, the selection signal Ssel is sequentially output starting from the selection line Ls in the first row of the display panel 110 and proceeding in the forward direction toward the selection line Ls in the last row. In the backward direction sequential output state, the selection signal Ssel is sequentially output starting from the selection line Ls in the last row and proceeding in the backward direction toward the selection line Ls in the first row. Specific output control of the selection signal Ssel in the selection driver 120 will be explained later.

The power supply driver 130 is connected with each power supply line La arranged in the display panel 110 in the row direction.

The power supply driver 130 applies a power supply voltage Vsa at a predetermined voltage level (a light-emitting level or a non-light-emitting level) to the power supply line La in each row with a predetermined timing, on the basis of a power supply control signal (e.g., an output control signal) supplied from the later-described controller 150.

The data driver 140 is connected with each data line Ld on the display panel 110 in the column direction.

The data driver 140 generates a gradation signal (a gradation voltage Vdata) according to image data during display operation (light-emitting operation) on the basis of a data control signal supplied from the later-described controller 150 and supplies the generated signal to each pixel PIX through each data line Ld.

Figure 2:
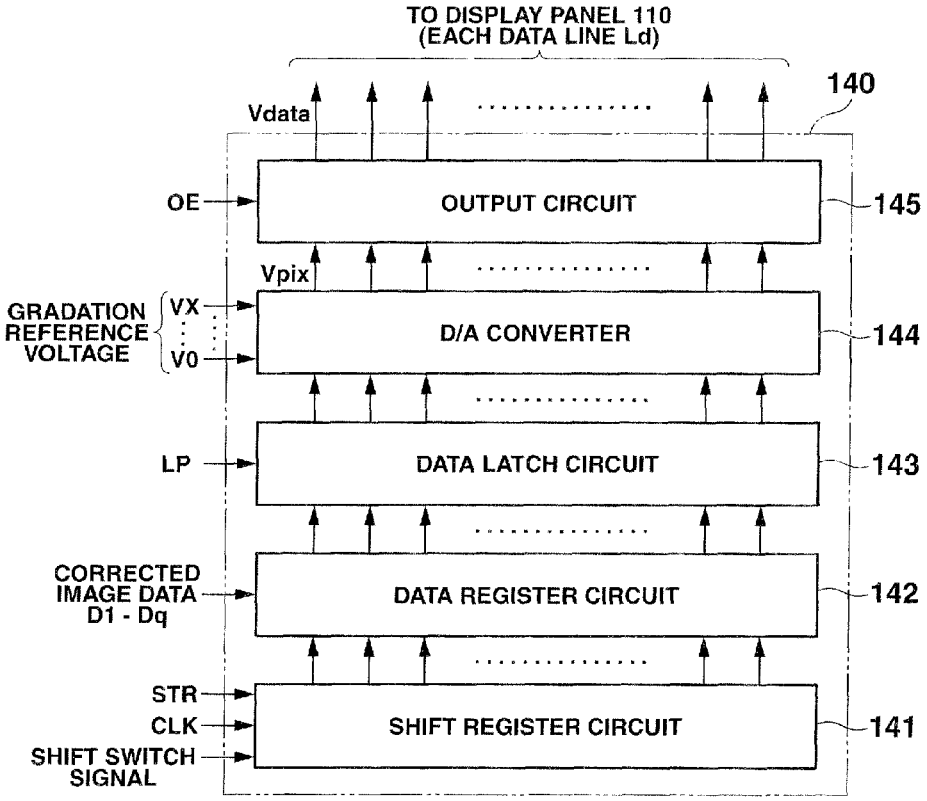
FIG. 2 is a schematic block diagram illustrating an example of a data driver applied to the display device.

FIG. 2 is a schematic block diagram illustrating an example of a data driver applied to the display device.

For example, as shown in FIG. 2, the data driver 140 mainly includes a shift register circuit 141, a data register circuit 142, a data latch circuit 143, a D/A converter 144, and an output circuit 145.

The shift register circuit 141 generates a shift signal on the basis of a data control signal (a shift clock signal CLK and a sampling start signal STR) fed from the controller 150 to be sequentially output to the data register circuit 142.

The data register circuit 142 includes registers whose number is equal to the number of columns (q) of the pixels PIX arranged in the display panel 110. The data register circuit 142 sequentially fetches pieces of corrected image data D1 to Dq corresponding to one row provided by the controller 150, on the basis of input timings of the shift signals supplied from the shift register circuit 141. In this case, image data D1 to Dq are serial data comprising digital signals.

The data latch circuit 143 holds the pieces of corrected image data D1 to Dq corresponding to one row fetched to the data register circuit 142 in accordance with data control signal (data latch pulse signal LP).

The D/A converter 144 converts the corrected image data D1 to Dq, i.e., digital signal, into an analog signal voltage Vpix, on the basis of a gradation reference voltage V0 to VX supplied from power supply providing means.

The output circuit 145 converts the corrected image data D1 to Dq converted into the analog signal voltage Vpix into gradation voltage Vdata at a predetermined signal level, and outputs the gradation voltage Vdata to the data line Ld in each column at a time, on the basis of the data control signal (output enable signal OE) provided by the controller 150.

Further, in the data driver 140 applied to the present embodiment is configured to control switching of the order of output of the shift signal from the shift register circuit 141 (shift direction) to a forward direction or a backward direction, on the basis of the data control signal (shift switch signal) provided by the controller 150. With this configuration, the data driver 140 is set and switched to either forward direction sequential capturing state or backward direction sequential capturing state. In the forward direction sequential capturing state, the corrected image data D1 to Dq in the data register circuit 142 are sequentially captured starting from the data line Ld in the first column of the display panel 110 and proceeding in the forward direction toward the in the data line Ld in the last column. In the backward direction sequential capturing state, the corrected image data D1 to Dq in the data register circuit 142 are sequentially captured starting from the data line Ld in the last column and proceeding in the backward direction toward the data line Ld in the first column.

Specific capturing control of the corrected image data D1 to Dq in the data driver 140 will be explained later.

In this explanation, the data driver 140 has a data driver function for capturing the corrected image data during display operation of the display panel 110, generating the gradation signal (gradation voltage Vdata) according to the corrected image data, and outputting the gradation signal to each data line Ld. However, the present invention is not limited to this configuration.

As shown in an example below, the data driver 140 that can be applied to the present embodiment may further include a voltage detection function for extracting voltage component (detection voltage) of characteristic of the pixel PIX when obtaining the correction data (characteristic parameter) for correcting the image data in accordance with the characteristic of the pixel PIX.

The controller 150 has a function for generating and providing the selection control signal in order to control the operating state of the selection driver 120, the power supply driver 130, and the data driver 140 explained above (driver control function), the power supply control signal, and the data control signal.

The controller 150 according to the present embodiment has a function for correcting the image data using the correction data according to the characteristic of each pixel PIX and outputting the corrected image data to the data driver 140 (image data correction function).

In addition, the controller 150 according to the present embodiment has a function of management of capturing, writing, and reading operations of the image data and the correction data in each memory circuit (an image data holding circuit, a correction data storage circuit, and a correction data memory circuit, explained later) in accordance with the display form (display pattern) of the image information on the display panel 110 (memory management function).

The driver control function of the controller 150 generates the selection control signal, the power supply control signal, and the data control signal explained above, on the basis of the timing signal provided from the display signal generation circuit 160 such as a video engine module, and provides them to the selection driver 120, the power supply driver 130, and the data driver 140, respectively.

Accordingly, the controller 150 controls the operating state of each driver, executes writing operation of the gradation signal to each pixel PIX arranged in display panel 110 and executes light-emitting operation of each pixel PIX at a predetermined timing, and displays predetermined image information based on the image data on the display panel 110.

Figure 3:
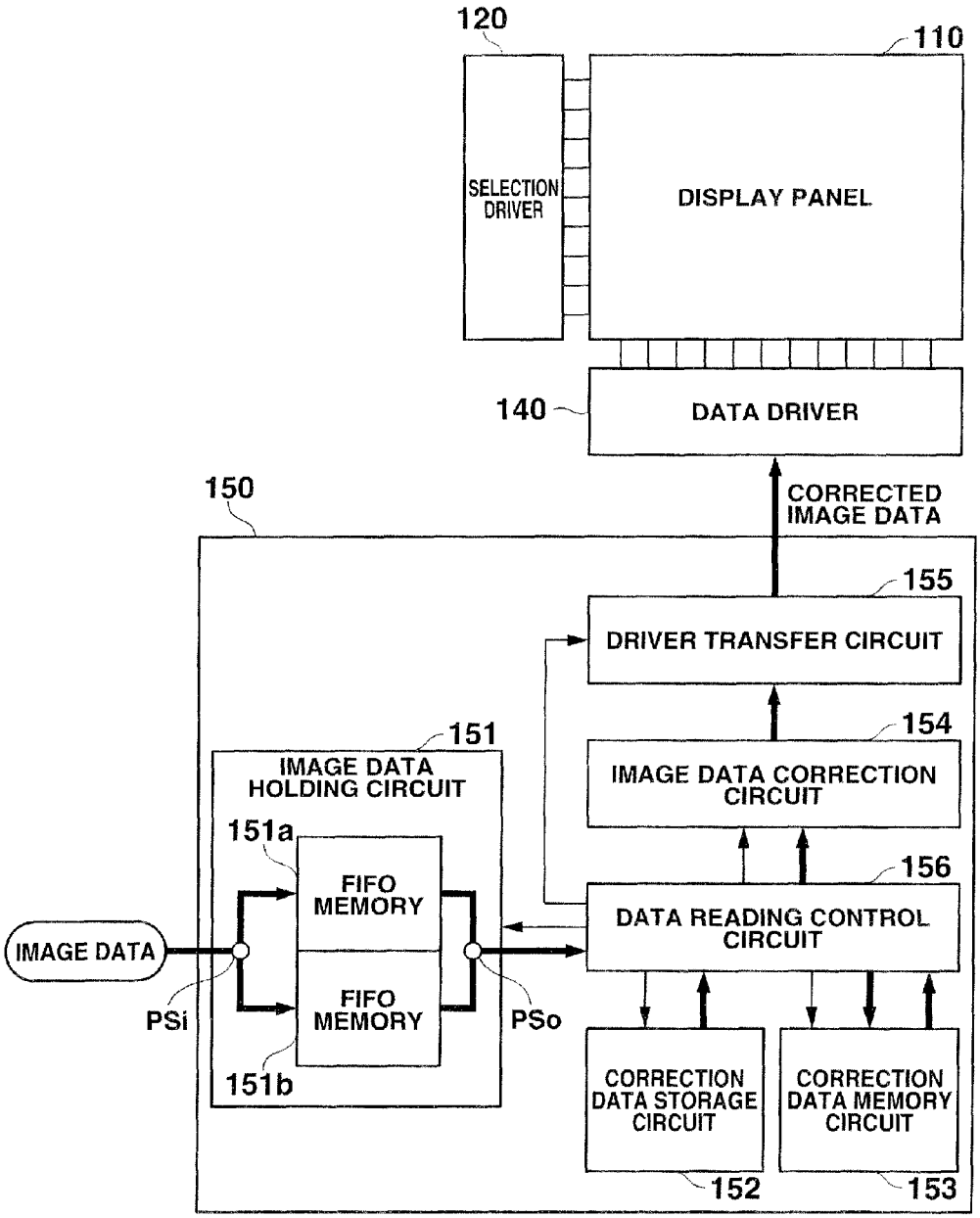
FIG. 3 is a schematic block diagram illustrating a first embodiment of a display device according to the present invention.

FIG. 3 is a schematic block diagram illustrating a first embodiment of a display device according to the present invention.

FIG. 3 shows a configuration for achieving the image data correction function and the memory management function peculiar to the present embodiment in the controller. In FIG. 3, the configuration for achieving the above driver control function is omitted.

It is to be noted that, in FIG. 3, flows of data and signals between respective functional blocks are all indicated by solid arrows for the sake of convenience. However, any one of these data flows is actually activated in accordance with an operating state of the controller 150 as will be described later. In this case, in the figure, arrows in thin lines represent control signals given by the data reading control circuit 156, and arrows in thick lines represent flows of various kinds of data.

For example, as shown in FIG. 3, the controller 150 includes an image data holding circuit 151, a correction data storage circuit 152, a correction data memory circuit 153, an image data correction circuit 154, a driver transfer circuit 155, and a data reading control circuit 156.

The image data holding circuit 151 is configured to have one or more FIFO (First-In/First-out) memories having a memory region corresponding to the plurality of pixels PIX arranged in the display panel 110 for one screen of image information displayed on the display panel 110.

In the present embodiment, as shown in FIG. 3, the image data holding circuit 151 is configured to have two FIFO memories 151*a*, 151*b* connected in parallel.

A switch contact point PSi is provided at the input side of the two FIFO memories 151*a*, 151*b*, and a switch contact point PSo is provided at the output side thereof.

The switch contact points PSi and PSo are switched and controlled in synchronization. More specifically, when an input path is set in one of the FIFO memories 151*a*, 151*b* by the switch contact point PSi, an output path is set in the other of the FIFO memories 151*a*, 151*b* by the switch contact point PSo.

Accordingly, the following two operations are executed in parallel. (i) Operation for sequentially capturing the image data supplied as serial data from the later-described display signal generation circuit 160 into one of the FIFO memories 151*a*, 151*b* via the switch contact point PSi and holding one screen of image data. (ii) Operation for sequentially reading the image data held in the other of FIFO memories 151*a*, 151*b* via the switch contact point PSo and providing the image data to the image data correction circuit 154 explained later.

The above operation is alternately, repeatedly executed by the two FIFO memories 151*a*, 151*b*, so that the image data are continuously captured screen by screen.

In the present embodiment, the image data holding circuit 151 includes two (or more) FIFO memories 151*a*, 151*b* connected in parallel. This is because, as described above, operation of capturing and holding the image data in one of the FIFO memories 151*a*, 151*b* and the operation of sequentially reading the image data held in the other of the FIFO memories 151*a*, 151*b* are executed in parallel, so that the device can support double speed display operation and the like of the image information. Therefore, the present embodiment has a configuration effective for a case where image information displayed on the display panel 110 is a moving one, e.g., a motion picture.

Alternatively, when image information displayed on the display panel 110 is not a moving one, e.g., a still image and character information, the image data holding circuit 151 may be configured to include only one FIFO memory.

The correction data storage circuit 152 has a nonvolatile memory. For example, before the display drive operation of the display device 100, correction data according to characteristic of each pixel PIX arranged in the display panel 110 are obtained in advance, and the correction data are stored (memorized) at address corresponding to the position of the respective pixel PIX in the correction data storage circuit 152. In other words, the correction data storage circuit 152 separately stores the correction data according to each pixel PIX for one screen of image information displayed on the display panel 110.

The method for acquiring correction data will be explained later.

The correction data memory circuit 153 has a volatile memory. The correction data memory circuit 153 previously reads and temporarily stores all or a portion of the correction data stored in the correction data storage circuit 152.

Then, in the correction processing of the image data explained later, the correction data are read and used as necessary.

Alternatively, the correction data storage circuit 152 may not be provided, and for example, the correction data memory circuit 153 may have a nonvolatile memory, so that the obtained correction data are directly saved to the correction data memory circuit 153.

The image data correction circuit 154 captures the image data via the image data holding circuit 151, reads the correction data according to the characteristic of each pixel PIX of the display panel 110 from the correction data memory circuit 153, uses the correction data to correct the image data thereby generating corrected image data.

The method for correcting the image data will be explained later.

The driver transfer circuit 155 transfers the image data (corrected image data) generated and corrected by the image data correction circuit 154 to the data driver 140 at a predetermined timing.

In this case, the corrected image data corresponding to one row (denoted as D1 to Dq in FIG. 2) are output as serial data from the driver transfer circuit 155 in synchronization with input timing of the shift signal sent from shift register circuit 141 to the data register circuit 142 in the data driver 140.

As shown in FIG. 2, the data driver 140 sequentially captures the corrected image data D1 to Dq of the serial data corresponding to one row, and holds the data in the data latch circuit 143.

The data reading control circuit 156 controls operations, i.e., the capturing operation of the image data in the image data holding circuit 151, the reading/writing (writing, reading) operation of the correction data in the correction data storage circuit 152 and the correction data memory circuit 153, the correction processing of the image data in the image data correction circuit 154 explained later, and the transfer processing of the corrected image data to the data driver 140 in the driver transfer circuit 155.

Specific operation control in the data reading control circuit 156 will be explained later.

In FIG. 3, a data bus is provided in the data reading control circuit 156, so that the image data read from the image data holding circuit 151 and transmitted to the image data correction circuit 154, the correction data read from the correction data storage circuit 152 and written to the correction data memory circuit 153, and the correction data read from the correction data memory circuit 153 and transmitted to the image data correction circuit 154 are configured to be sent by way of the data reading control circuit 156. However, the present invention is not limited to this configuration.

The image data read from the image data holding circuit 151 may be directly transmitted to the image data correction circuit 154. The correction data read from the correction data storage circuit 152 may directly be written to the correction data memory circuit 153. The correction data read from the correction data memory circuit 153 may directly be transmitted to the image data correction circuit 154.

FIG. 3 mainly shows the configuration for achieving the image data correction function and the memory management function peculiar to the present embodiment. In FIG. 3, the configuration for achieving the above driver control function is omitted. The driver control function is achieved using a well-known timing signal generation circuit and the like.

In the present embodiment, the driver control function, the image data correction function, and the memory management function are configured to be provided in the single controller 150. However, the present invention is not limited to this configuration.

The display device 100 according to the present invention may include at least one of the driver control function, the image data correction function, and the memory management function or for example, a portion of each function may be provided separately from the controller 150. For example, the correction data storage circuit 152 and the correction data memory circuit 153 managed by the memory management function may be a storage device independently provided outside of the controller 150.

The display signal generation circuit 160 extracts a luminance gradation signal component from a video signal provided from outside of the display device 100, coverts the luminance gradation signal component into a digital signal as serial data, and provides the luminance gradation signal component as image data to the controller 150 (image data holding circuit 151). The image data provided from the display signal generation circuit 160 comprises a digital signal corresponding to the luminance gradation signal component of each color component, i.e., red (R), green (G), blue (B), in each pixel PIX.

The display signal generation circuit 160 extracts a signal component defining display timing of image information included in the video signal, and provides the signal component as a timing signal (such as vertical synchronization signal and horizontal synchronization signal) to the controller 150.

Now, an example of configuration of a pixel that can be applied to the display device according to the present embodiment will be explained.

Figure 4:
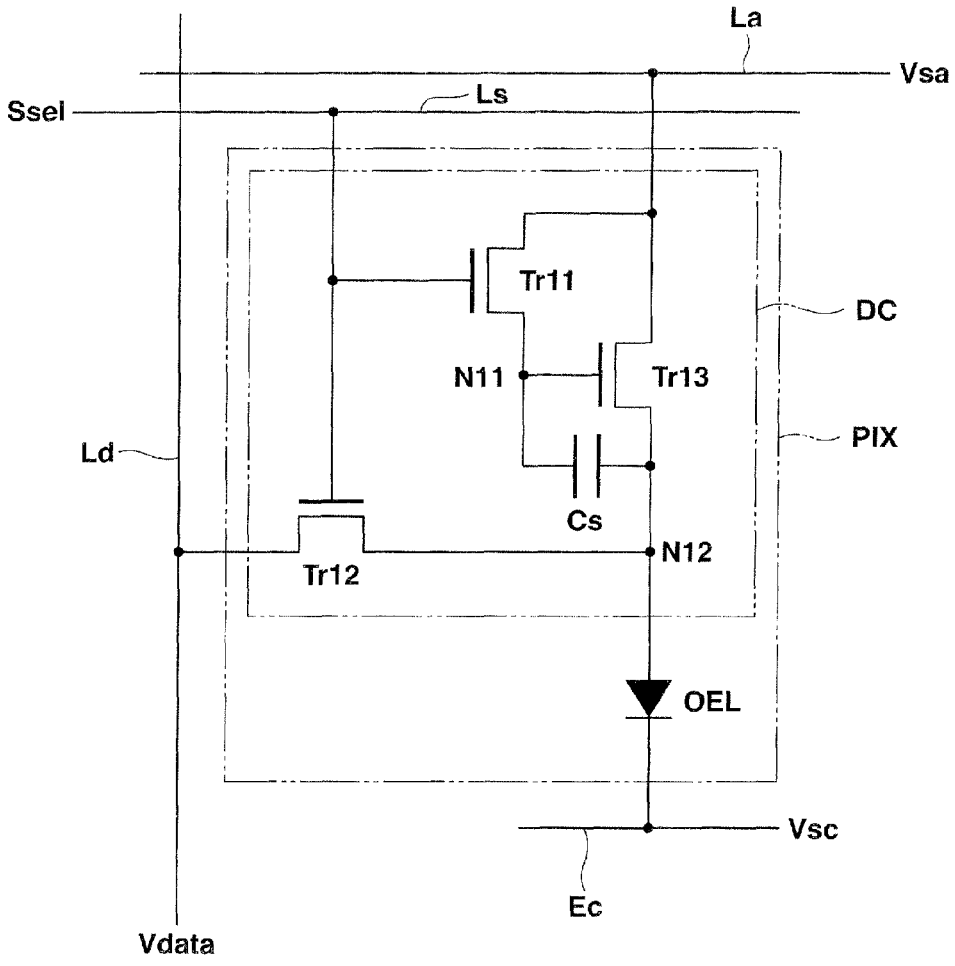
FIG. 4 is circuit configuration diagram illustrating an example of pixel applied to a display panel according to the first embodiment.

FIG. 4 is a circuit configuration diagram illustrating an example of pixel applied to the display panel according to the present embodiment.

In the explanation below, the pixel has a configuration corresponding to an active matrix-type drive method, and an organic EL element is employed as a light emitting element.

As shown in FIG. 4, the pixel PIX applied to the display panel 110 according to the present embodiment is provided in proximity to each intersecting point of a selection line Ls connected to the selection driver 120 and a data line Ld connected to the data driver 140.

Each pixel PIX includes an organic EL element OEL serving as a current, driven-type light emitting element and a light emitting drive circuit DC for generating a current for driving the organic EL element OEL to cause the organic EL element OEL to emit light.

The light emitting drive circuit DC as shown in FIG. 4 has a circuit configuration mainly including transistors Tr11 to Tr13 and a capacitor Cs.

The transistor Tr11 has a gate terminal connected with the selection line Ls, a drain terminal connected with the power supply line La, and a source terminal connected with a connection point N11.

The transistor Tr12 has a gate terminal connected with the selection line Ls, a source terminal connected with the data line Ld, and a drain terminal connected with a connection point N12.

The transistor (a drive control element) Tr13 has a gate terminal connected with the connection point N11, a drain terminal connected with the power supply line La, and a source terminal connected with a connection point N12.

Further, the capacitor (a capacitance element) Cs is connected between the gate terminal (the connection point N11) and the source terminal (the connection point N12) of the transistor Tr13.

The capacitor Cs may be a parasitic capacitance formed between the source-gate terminals of the transistor Tr13 or may be a capacitance obtained by connecting different capacitance elements in parallel between the connection point N11 and the connection point N12 in addition to the parasitic capacitance.

Furthermore, the organic EL element OEL has an anode (an anode electrode) connected with the connection point N12 of the light-emitting drive circuit DC and a cathode (a cathode electrode) connected with the common electrode Ec. The common electrode Ec is connected with a voltage source and receives a predetermined reference voltage Vsc (for example, a ground voltage GND).

It is to be noted that, in the pixel PIX depicted in FIG. 4, thin film transistors (TFT) having the same channel type can be applied to the transistors Tr11 to Tr13, for example. Each of the transistors Tr11 to Tr13 may be an amorphous silicon thin film transistor or may be a polysilicon thin film transistor.

In particular, as shown in FIG. 4, when an n-channel type thin film transistor is applied as each of the transistors Tr11 to Tr13 and an amorphous silicon thin film transistor is applied as each of the transistor Tr11 to Tr13, an already established amorphous silicon manufacturing technology can be applied to realize each transistor having uniform and stable operation characteristics (e.g., electron mobility) in a manufacturing process simpler than that of a polycrystal type or single-crystal type silicon thin film transistor.

Figure 6:
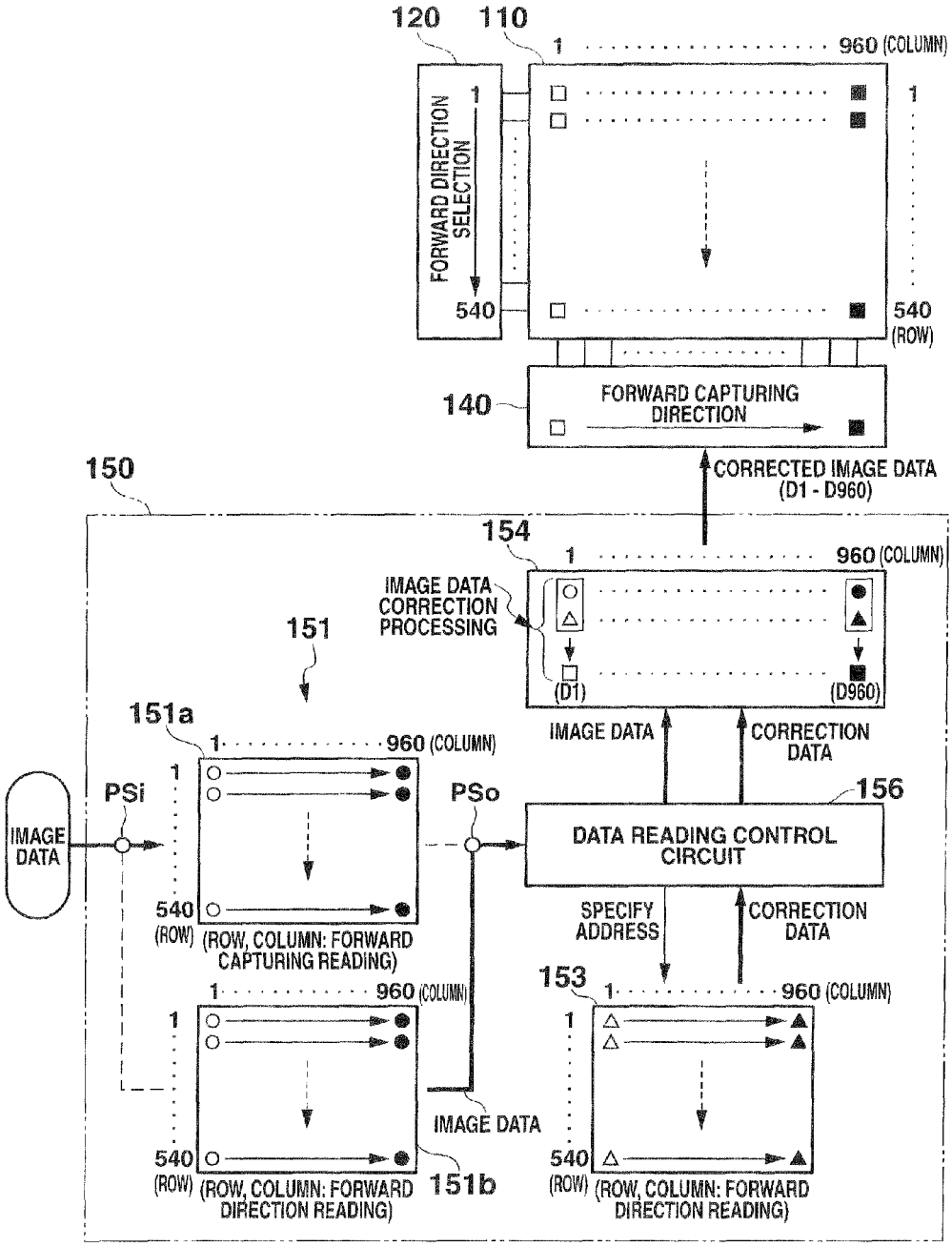
FIG. 6 is a schematic diagram illustrating a memory management method in the normal display mode performed by the display device according to the first embodiment.

When the transistors Tr11 to Tr13 are polysilicon thin film transistors, the transistors Tr11 to Tr13 may be p-channel type thin film transistors. In this case, the terminals of the light emitting drive circuit DC as shown in FIG. 6 explained above are disposed such that the source terminal and the drain terminal are oppositely disposed in each of the transistors Tr11 to Tr13.

The above pixel PIX has the circuit configuration in which three transistors Tr11 to Tr13 are provided as the light emitting drive circuit DC and the organic EL element OEL is applied as the light emitting element. However, the present invention is not limited to this embodiment. The light emitting drive circuit DC may have other circuit configurations in which there are three or more transistors. The light emitting element driven and caused to emit light by the light emitting drive circuit DC may be other light emitting elements such as a light emitting diode as long as it is a current driven-type light emitting element.

Display operation of the display device having the pixel PIX having the above circuit configuration will briefly be explained.

First, in the selection period, the selection voltage Vsel at the selective level (for example, high level) is applied from the selection driver 120 to a selection line Ls in a particular row, and the power supply voltage Vsa of the non-light-emitting level (voltage level equal to or less than reference voltage Vsc; for example, negative voltage) is applied from the power supply driver 130 to the power supply line La of the row in question. Accordingly, the transistors Tr11, Tr12 of the pixels PIX are turned on, and the pixels PIX in the rows are set in the selective state. In synchronization with this timing, the gradation voltage Vdata of a negative voltage value according to the image data is applied from the data driver 140 to the data line Ld of each column, so that the voltage according to the gradation voltage Vdata is applied to the connection point N12 of each pixel PIX.

Accordingly, the transistor Tr13 of each pixel PIX is turned on, and a write current according to a potential difference generated between the gate and the source of the transistor Tr13 flows from the power supply line La to the data line Ld via the transistor Tr13, the connection point N12, the transistor Tr12. At this occasion, charge according to a potential difference generated between the contacts N11 and N12 is accumulated in the capacitor Cs of each pixel PIX.

In this case, the power supply voltage Vsa equal to or less than the reference voltage Vsc is applied to the power supply line La, and further, the write current is set to be withdrawn from the pixel PIX to the data line Ld. Accordingly, the potential of the anode (connection point N12) of the organic EL element OEL is less than the potential of the cathode (reference voltage Vsc). Accordingly, no current flows in the organic EL element OEL, and the organic EL element OEL does not emit light (non-light-emitting operation light). This writing operation is sequentially executed on the pixels PIX of all the rows arranged two-dimensionally on the display panel 110.

Subsequently, in the non-selection period, the selection voltage Vsel at the non-selective level (for example, low level) is applied from the selection driver 120 to the selection line Ls, so that the transistors Tr11, Tr12 of the pixels PIX are turned off, and the pixel PIX in the row is set in the non-selective state. At this occasion, the charge accumulated in the selection period is held in the capacitor Cs of each pixel PIX, and accordingly the transistor Tr13 maintains ON-state. Then, the power supply voltage Vsa at the light-emitting level (voltage level higher than the reference voltage Vsc) is applied from the power supply driver 130 to the power supply line La, so that a predetermined light-emitting drive current flows from the power supply line La to the organic EL element OEL via the transistor Tr13 and the connection point N12.

At this occasion, the charge accumulated in the capacitor Cs of each pixel PIX (voltage component) corresponds to the potential difference when the write current corresponding to the gradation voltage Vdata is passed by the transistor Tr13, and therefore, the light-emitting drive current flowing through the organic EL element OEL has about the same current value as the write current. Accordingly, the organic EL element OEL of each pixel PIX emits light with luminance gradation according to the image data (gradation voltage Vdata) written during the writing operation. As a result, desired image information is displayed on the display panel 110.

The method for acquiring the correction data (characteristic parameter) and the drive method including the light-emitting operation at the pixel PIX having the circuit configuration shown in FIG. 4 will be explained in detail using an example of a driving control method for the display device explained later.

(Display Drive Method)

Subsequently, the display drive method for each display form (display pattern) of image information in the display device according to the present embodiment will be explained with reference to the drawings.

The display form includes (1) a normal display mode for displaying image information based on a video signal in usual direction as an ordinary image, (2) a horizontally reversed display mode in which image information is displayed upon reversed horizontally, (3) a vertically reversed display mode in which image information is displayed upon reversed vertically, and (4) a horizontally and vertically reversed display mode in which image information is displayed upon reversed horizontally and vertically.

In this case, the memory management method with the controller 150 will be mainly explained.

Now, it is assumed that 960×540 pixels PIX are arranged in a matrix form in a row direction and a column direction in the light emitting region (display region) of the display panel 110. It is also assumed that the image data are provided as a form corresponding to the matrix of 960 columns×540 rows of the display panel 110.

(1) Normal Display Mode

Figure 5:
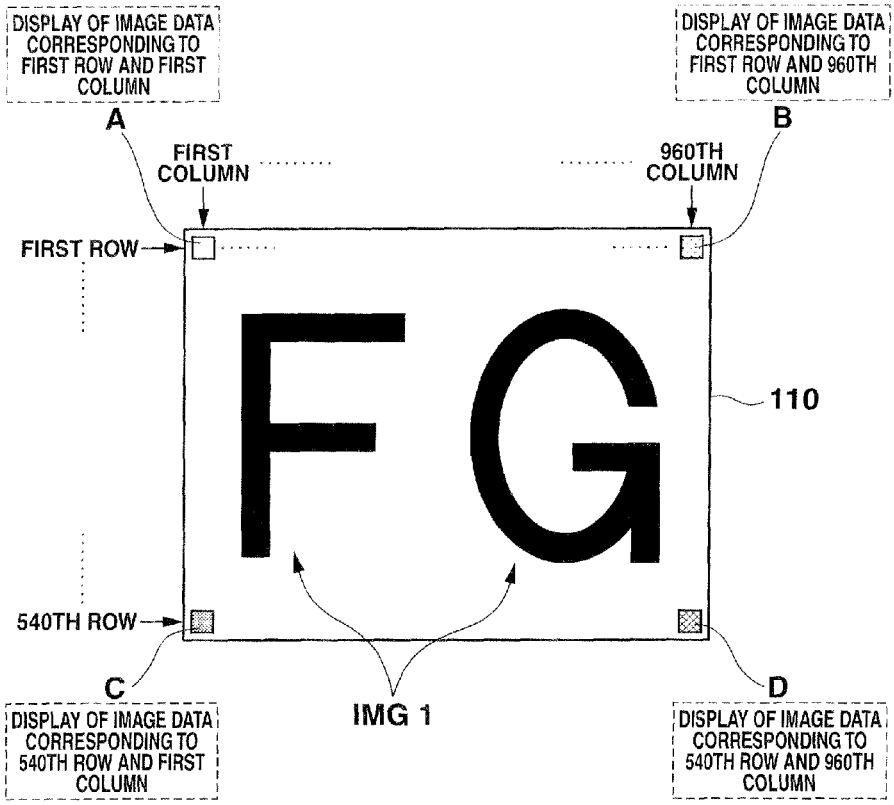
FIG. 5 is a figure illustrating a display form in a normal display mode, in which image information is displayed on the display panel in a normal manner during display drive operation performed by the display device according to the first embodiment.

FIG. 5 is a figure illustrating a display form in the normal display mode, in which image information is displayed on the display panel in a normal manner and usual direction during display drive operation performed by the display device according to the present embodiment.

In FIG. 5, an IMG 1 is an example of image information displayed in the display region of the display panel 110 on the basis of image data in the normal display mode. In this case, a case where the image information has a character pattern "FG" is shown. However, the image information is not limited thereto. Any image may be employed.

When the image information is displayed in the arrangement as shown in FIG. 5 on the display panel 110, the image displayed on the display panel 110 is referred to as an ordinary image.

In FIG. 5, reference symbol A denotes a display of the image data corresponding to the first row and the first column of the display panel 110. Reference symbol B denotes a display of the image data corresponding to the first row and the 960th column. Reference symbol C denotes a display of the image data corresponding to the 540th row and the first column. Reference symbol D denotes a display of the image data corresponding to the 540th row and the 960th column.

As shown in FIG. 5, in the normal display mode, the display A based on the image data corresponding to the first row and the first column is displayed in the first row and the first column of the display panel 110.

The display B based on the image data corresponding to the first row and the 960th column is displayed at the position in the first row and the 960th column of the display panel 110.

The display C based on the image data corresponding to the 540th row and the first column is displayed at the position in the 540th row and the first column of the display panel 110.

The display C based on the image data corresponding to the 540th row and the 960th column is displayed at the position in the 540th row and the 960th column of the display panel 110.

FIG. 6 is a schematic diagram illustrating a memory management method in the normal display mode performed by the display device according to the present embodiment.

FIG. 7 is a schematic diagram illustrating relationship of addresses between each piece of image data and correction data used for correction processing, in the normal display mode in the display device according to the present embodiment.

In FIG. 6, symbols are defined as follows for the sake of convenience in order to simplify the explanation about the memory management method.

In the figure, in the image data holding circuit 151 and the image data correction circuit 154, ○ (white circle) denotes image data corresponding to pixels PIX located in the first column among the image data in each row (corresponding to one row) constituting the image information.

● (black circle) denotes image data corresponding to pixels PIX located in the 960th column, i.e., the last column, in the image data.

Arrows shown in the image data holding circuit 151 represents the capturing order (that is, capturing direction) or the reading order (that is, reading direction) of the image data.

In the correction data memory circuit 153 and the image data correction circuit 154 in FIG. 6, Δ (white triangle) denotes correction data according to the characteristics of the pixels PIX located in the first column among the pixels PIX in each row (corresponding to one row) arranged in the display panel 110.

▲ (black triangle) denotes correction data according to the characteristics of the pixels PIX located in the 960th column, i.e., the last column, among the pixels PIX.

Arrows shown in the correction data memory circuit 153 denote the reading order (that is, reading direction) of the correction data.

In the image data correction circuit 154 and the data driver 140, display panel 110 in the FIG. 6, □ (white rectangle) denotes corrected image data supplied to pixels PIX located in the first column among the corrected image data supplied to the pixels PIX in each row (corresponding to one row) arranged in the display panel 110.

■ (black rectangle) denotes corrected image data supplied to pixels PIX located in the 960th column, i.e., the last column, among the corrected image data.

Arrows shown in the data driver 140 denote the capturing order (that is, capturing direction) of the corrected image data supplied from the controller 150.

The above definition is commonly applied to each display form as listed below in the present embodiment.

In the normal display mode, the following series of operation is executed by the controller 150.

First, at the system activation of the display device 100, the data reading control circuit 156 of the controller 150 sequentially reads the correction data stored in the correction data storage circuit 152 corresponding to each pixel PIX arranged in the display panel 110 in advance, and the correction data are transferred to the correction data memory circuit 153.

The correction data transferred to the correction data memory circuit 153 are saved at addresses corresponding to positions of pixels PIX arranged in the display panel 110. The correction data memory circuit 153 saves the correction data of the pixels PIX for one screen of image information to be displayed on the display panel 110.

Subsequently, as shown in FIG. 6, the data reading control circuit 156 sequentially captures and holds the image data of the digital signal supplied as the serial data from the display signal generation circuit 160 into any one of the two FIFO memories 151*a*, 151*b* provided in the image data holding circuit 151 via the switch contact point PSi.

At this occasion, the image data holding circuit 151 sequentially captures the image data corresponding to the respective column positions in the direction extending from the first column in each row to the 960th column, i.e., the last column, (forward direction).

The image data holding circuit 151 repeats this operation for each row in the forward direction from the first row to the 540th row, i.e., the last row, and holds the image data for one screen in any one of the two FIFO memories 151*a*, 151*b*.

In parallel with the capturing operation of the image data, as shown in FIG. 6, the image data holding circuit 151 executes reading operation of the image data for sequentially reading, column by column, the image data held in the other of the FIFO memories 151*a*, 151*b* via the switch contact point PSo in the direction extending from the first column to the 960th column in each row (forward direction).

The read image data are supplied to the image data correction circuit 154 in units of rows (see arrows shown in the image data holding circuit 151 in FIG. 6).

On the other hand, as shown in FIG. 6, the data reading control circuit 156 sequentially reads the correction data corresponding to pixels PIX, to which the image data corresponding to one row is supplied, captured into the image data correction circuit 154 via the image data holding circuit 151, among the correction data stored in the correction data memory circuit 153, and the correction data are supplied to image data correction circuit 154 in units of rows.

The correction data read from the correction data memory circuit 153 are sequentially read, pixel by pixel, in the direction extending from the first row to the 540th row, i.e., the last row (forward direction; first reading order) and in the direction extending from the first column to the 960th column in each row (forward direction) (see arrows shown in the correction data memory circuit 153 in FIG. 6).

Subsequently, the image data correction circuit 154 sequentially corrects, pixel by pixel, the image data at each column position of one row captured via the image data holding circuit 151, on the basis of the correction data according to the characteristics of the pixels PIX in each column of one row of the display panel 110 that are supplied from the correction data memory circuit 153.

As shown in the image data correction circuit 154 in FIG. 6 and as schematically shown in FIG. 7, the correction processing of the image data correction circuit 154 is executed by performing calculation on each pieces of image data corresponding to each column position from the first column to the 960th column in each row (see addresses of the image data in FIG. 7), on the basis of a predetermined correction expression using each pieces of correction data corresponding to each pixel PIX from the first column to the 960th column in each row of the display panel 110 (see addresses of the correction data in FIG. 7).

The example of the correction processing method for the image data will be explained in detail using the example of the driving control method for the display device explained later.

Subsequently, the corrected image data (corrected image data D1 to Dq: q=960) are transferred by the data reading control circuit 156, pixel by pixel, to the data driver 140 via the driver transfer circuit 155 in units of rows.

The corrected image data D1 to D960 transferred via the driver transfer circuit 155 of the controller 150 are sequentially captured, pixel by pixel, in the direction extending from the first column to the 960th column (forward direction; first capturing order) in the data driver 140 (see arrows shown in the data driver 140 in FIG. 6).

Subsequently, the selection driver 120 sequentially applies the selection signal Ssel at the selective level to the selection lines Ls in the order from the first row to the 540th row, i.e., the last row, (forward direction; first scanning direction), and sets the pixel PIX in each row to the selective state in order.

Then, in synchronization with the timing when the pixel PIX in each row is set in the selective state, the data driver 140 applies the gradation signal (gradation voltage Vdata) based on the captured corrected image data corresponding to one row to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the normal display mode, as shown in the image data correction circuit 154, the data driver 140, and the display panel 110 in FIG. 6 and as schematically shown in FIG. 7, each gradation signal based on the corrected image data D1 to D960 obtained by correcting the image data corresponding to each column position from the first column to the 960th column in each row of the image information (see addresses of the image data in FIG. 7) using the correction data corresponding to each pixel PIX from the first column to the 960th column in each row of the display panel 110 (see addresses of the correction data in FIG. 7) is written to each pixel PIX from the first column to the 960th column in each row of the display panel 110.

After this writing operation of the gradation signal is sequentially executed to the pixels PIX in each of all the rows of the display panel 110, the power supply voltage Vsa at the predetermined light-emitting level is applied to each pixel PIX, so that the light emitting element (organic EL element OEL) provided on each pixel PIX emits light with the luminance gradation according to the gradation signal at a time, and as a result, the image information is displayed on the display panel 110. At this occasion, as shown in FIG. 5, the image information is displayed as the ordinary image on the display panel 110.

The case where the image data are corrected on the basis of the correction data according to the characteristic of each pixel PIX has been hereinabove explained. However, when it is not necessary to correct the image data, e.g., when the display device is in initial state such as factory default state or when correction data according to characteristic of each pixel PIX are not obtained, the image data are transferred to the data driver 140 via the driver transfer circuit 155 without correcting the image data (that is, bypassing the image data correction circuit 154).

(2) Horizontally Reversed Display Mode

Figure 8:
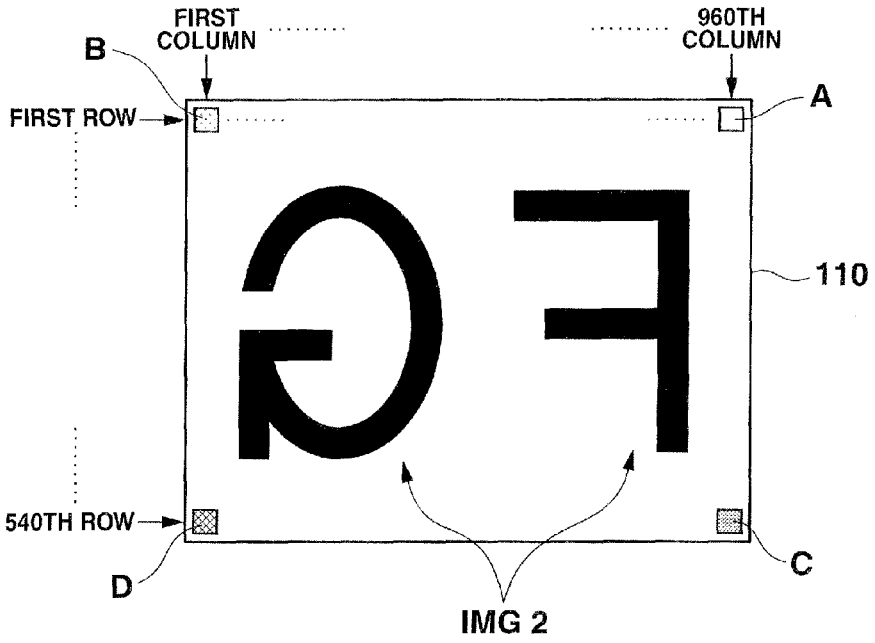
FIG. 8 is a figure illustrating a display form in a horizontally reversed display mode in which image information is displayed on the display panel in a horizontally reversed manner during display drive operation performed by the display device according to the first embodiment.

FIG. 8 is a figure illustrating a display form in the horizontally reversed display mode in which image information is displayed on the display panel in a horizontally reversed manner during display drive operation performed by the display device according to the present embodiment.

In FIG. 8, an IMG 2 is an example of image information displayed, in the horizontally reversed display mode, in the display region of the display panel 110 on the basis of the same image data as that used in the normal display mode. The IMG 2 is a horizontally reversed image obtained by horizontally reversing the IMG 1 of FIG. 5.

As shown in FIG. 8, in the horizontally reversed display mode, the display A based on the image data corresponding to the first row and the first column is displayed in the first row and the 960th column of the display panel 110.

The display B based on the image data corresponding to the first row and the 960th column is displayed in the first row and the first column of the display panel 110.

The display C based on the image data corresponding to the 540th row and the first column is displayed in the 540th row and the 960th column of the display panel 110.

The display D based on the image data corresponding to the 540th row and the 960th column is displayed in the 540th row and the first column of the display panel 110.

Figure 9:
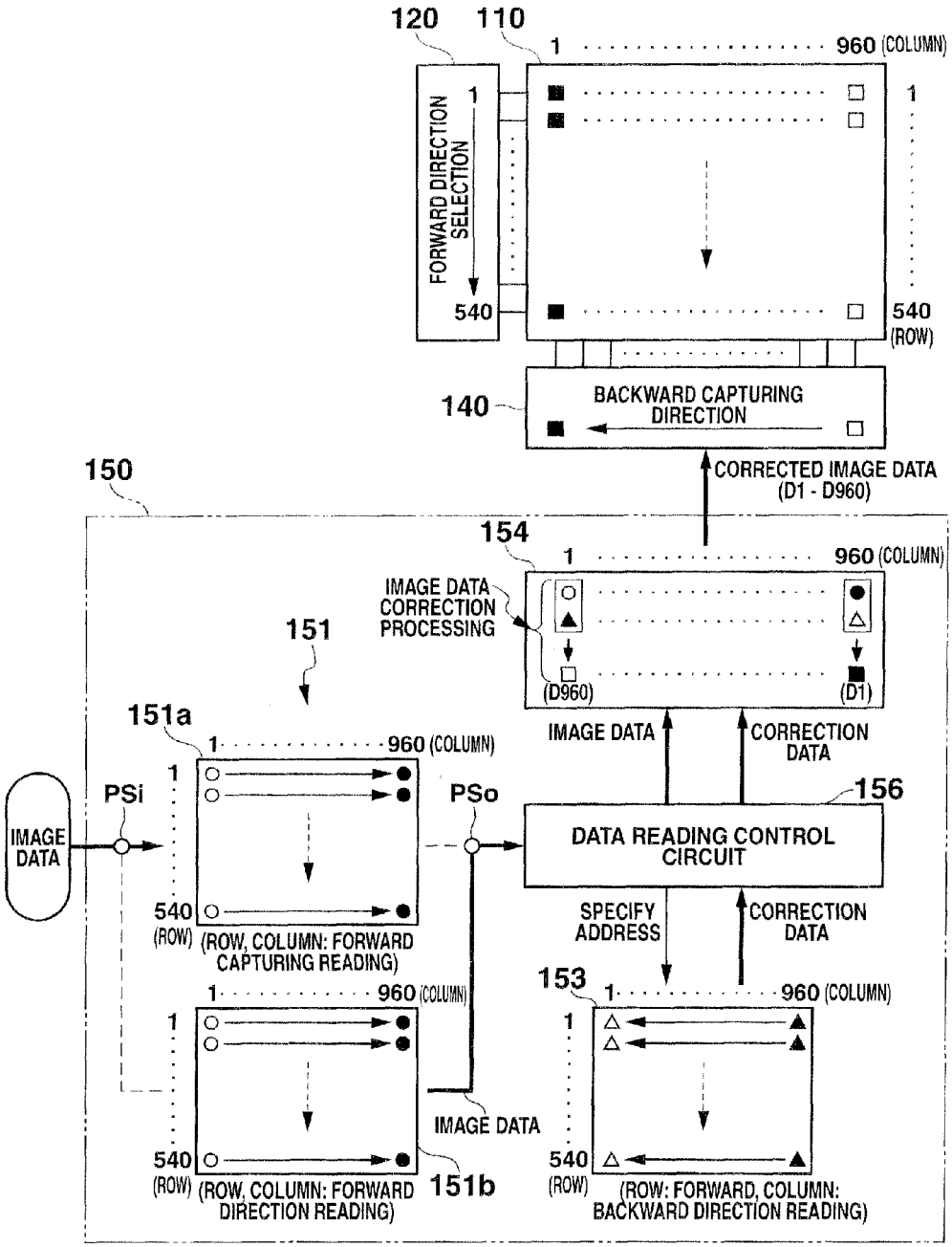
FIG. 9 is a schematic diagram illustrating a memory management method in the horizontally reversed display mode performed by the display device according to the first embodiment.

FIG. 9 is a schematic diagram illustrating a memory management method in the horizontally reversed display mode performed by the display device according to the present embodiment.

FIG. 10 is a schematic diagram illustrating relationship of addresses between each piece of image data and correction data used for correction processing, in the horizontally reversed display mode in the display device according to the present embodiment.

Description about the same configuration, method, and concept as those of the above normal display mode is simplified.

In the horizontally reversed display mode, the following series of operations are executed by the controller 150.

First, like the normal display mode explained above, at the system activation of the display device 100, the correction data corresponding to each pixel PIX for one screen arranged in the display panel 110 are transferred from the correction data storage circuit 152 to the correction data memory circuit 153 in advance, and the correction data are temporarily stored in the correction data memory circuit 153.

Subsequently, as shown in FIG. 9, like the above normal display mode, the image data holding circuit 151 executes, in parallel, the operation of sequentially capturing the image data supplied as serial data from the display signal generation circuit 160 into one of the two FIFO memories 151*a*, 151*b* and the operation of sequentially reading, pixel by pixel, the image data held in the other of the FIFO memories 151*a*, 151*b* in the direction extending from the first column to the 960th column in each row (forward direction) to supply the image data to the image data correction circuit 154 in units of rows (see arrows shown in the image data holding circuit 151 in FIG. 9).

On the other hand, as shown in FIG. 9, the correction data corresponding to pixels PIX, to which the image data corresponding to one row is supplied, captured into the image data correction circuit 154, among the correction data stored in the correction data memory circuit 153, are sequentially read out and supplied to the image data correction circuit 154.

The correction data read from the correction data memory circuit 153 are sequentially read, pixel by pixel, in the direction extending from the first row to the 540th row, i.e., the last row (forward direction; first reading order) and in the direction extending from the 960th column, i.e., the last column, to the first column in each row (backward direction) (see arrows shown in the correction data memory circuit 153 in FIG. 9).

Subsequently, the image data correction circuit 154 sequentially corrects the image data captured via the image data holding circuit 151, on the basis of the correction data according to the characteristic of each pixel PIX of the display panel 110 that are supplied from the correction data memory circuit 153.

As shown in the image data correction circuit 154 in FIG. 9 and as schematically shown in FIG. 10, the correction processing of the image data correction circuit 154 is executed by performing calculation on each pieces of image data corresponding to each column position from the first column to the 960th column in each row (see addresses of the image data in FIG. 10), on the basis of a predetermined correction expression using each pieces of correction data corresponding to each pixel PIX from the 960th column to the first column in each row of the display panel 110 (see addresses of the correction data in FIG. 10).

Subsequently, the corrected image data (corrected image data D1 to D960) are transferred, pixel by pixel, to the data driver 140 via the driver transfer circuit 155 in units of rows.

The data driver 140 sets the capturing direction of the corrected image data D1 to D960 to the backward direction on the basis of the data control signal (scan switching signal) supplied from the controller 150.

The corrected image data D1 to D960 supplied from the controller 150 are sequentially captured, pixel by pixel, in the direction extending from the 960th column to the first column in each row (backward direction; second capturing order) (see arrows shown in the data driver 140 in FIG. 9).

Subsequently, the selection driver 120 sequentially applies the selection signal Ssel at the selective level to the selection lines Ls in the order from the first row to the 540th row, i.e., the last row, (forward direction; first scanning direction), and sets the pixel PIX in each row to the selective state in order.

Then, in synchronization with the timing when the pixel PIX in each row is set in the selective state, the data driver 140 applies the gradation signal (gradation voltage Vdata) based on the captured corrected image data D1 to D960 corresponding to one row to the data line Ld arranged in each column of the display panel 110 at time.

Accordingly, the voltage component according to the gradation signal is held in each pixel PIX in the row set in the selective state by way of each data line Ld (that is, the gradation signal is written).

In this case, in the horizontally reversed display mode, as shown in the image data correction circuit 154, the data driver 140, and the display panel 110 in FIG. 9 and as schematically shown in FIG. 10, each gradation signal based on the corrected image data D1 to D960 obtained by correcting the image data corresponding to each column position from the 960th column to the first column in each row of the image information (see addresses of the image data in FIG. 10) using the correction data corresponding to each pixel PIX from the first column to the 960th column in each row of the display panel 110 (see addresses of the correction data in FIG. 10) is written to each pixel SIX from the first column to the 960th column in each row of the display panel 110.

After this writing operation of the gradation signal is sequentially executed to the pixels PIX in each of all the rows of the display panel 110, the light emitting element (organic EL element OEL) provided on each pixel PIX emits light with the luminance gradation according to the gradation signal at a time, and as a result, the image information is displayed on the display panel 110. At this occasion, as shown in FIG. 8, the image information is displayed as the horizontally reversed image on the display panel 110.

(3) Vertically Reversed Display Mode

Figure 11:
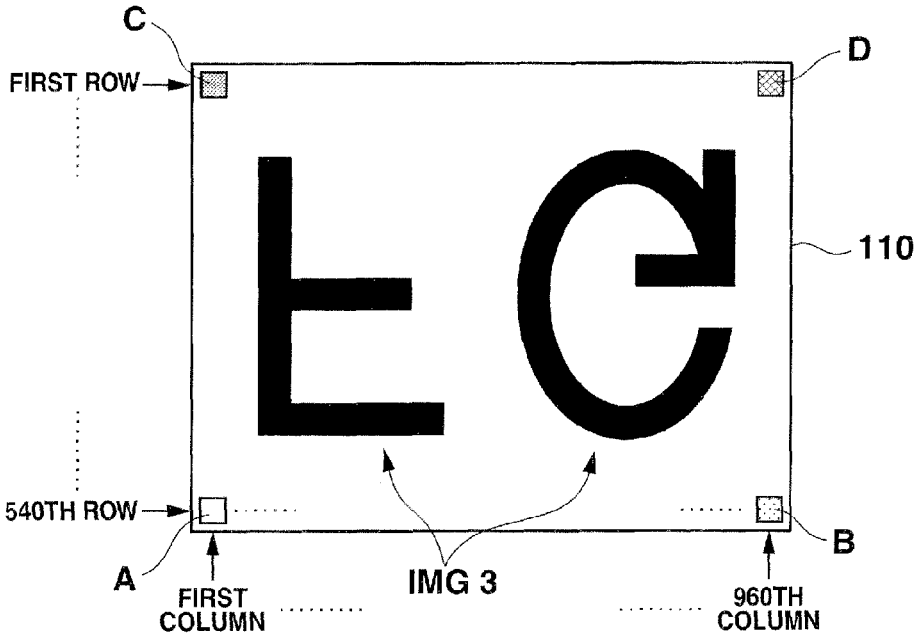
FIG. 11 is a figure illustrating a display form in a vertically reversed display mode, in which image information is displayed on the display panel in a vertically reversed manner during display drive operation performed by the display device according to the first embodiment.

FIG. 11 is a figure illustrating a display form in the vertically reversed display mode, in which image information is displayed on the display panel in a vertically reversed manner during display drive operation performed by the display device according to the present embodiment.

In FIG. 11, an IMG 3 is an example of image information displayed, in the vertically reversed display mode, in the display region of the display panel 110 on the basis of the same image data as that used in the normal display mode. The IMG 3 is a vertically reversed image obtained by vertically reversing the IMG 1 of FIG. 5.

As shown in FIG. 11, in the vertically reversed display mode, the display A based on the image data corresponding to the first row and the first column is displayed in the 540th row and the first column of the display panel 110.

The display B based on the image data corresponding to the first row and the 960th column is displayed at the position in the 540th row and the 960th column of the display panel 110.

The display C based on the image data corresponding to the 540th row and the first column is displayed in the first row and the first column of the display panel 110.

The display D based on the image data corresponding to the 540th row and the 960th column is displayed in the first row and the 960th column of the display panel 110.

Figure 12:
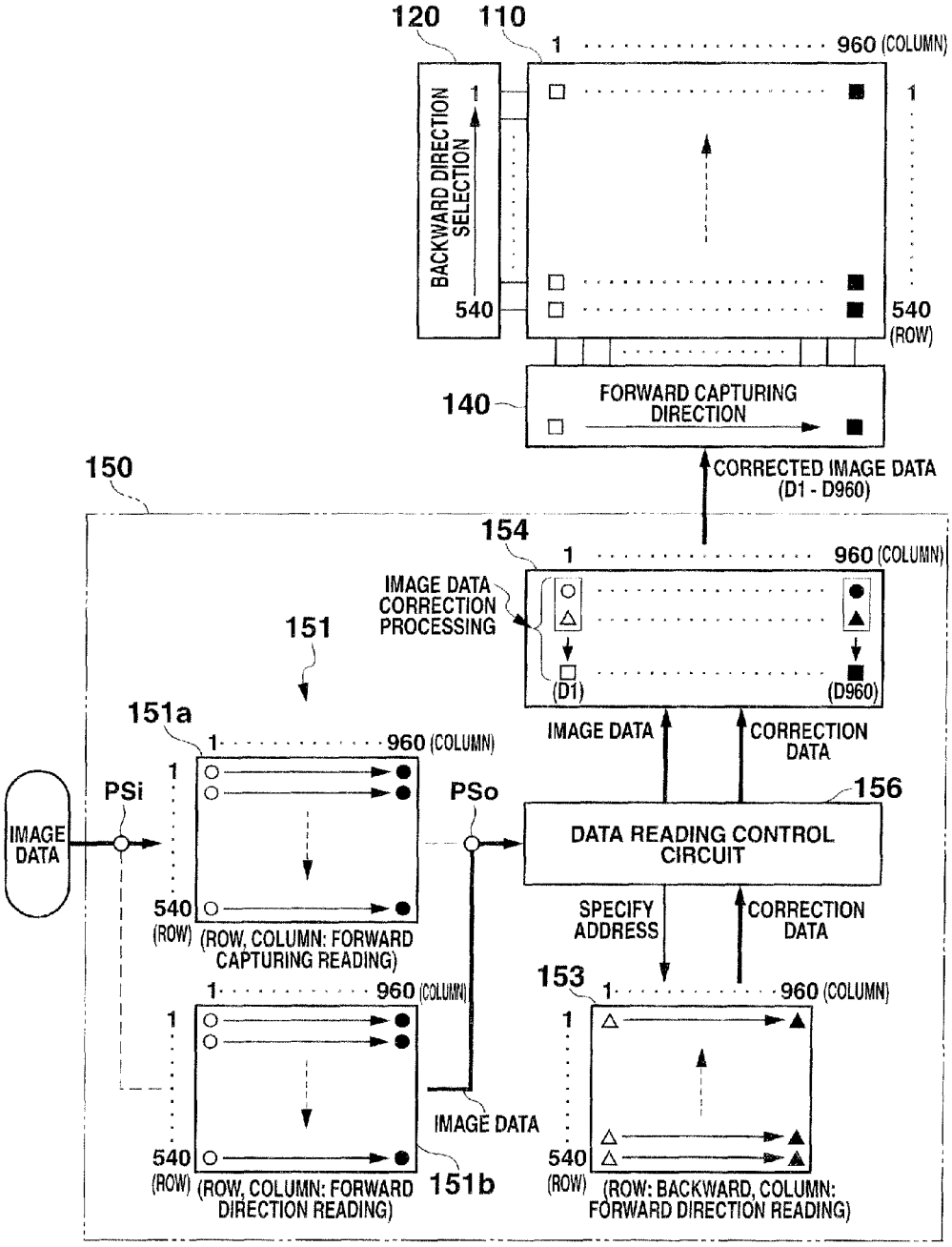
FIG. 12 is a schematic diagram illustrating a memory management method in the vertically reversed display mode performed by the display device according to the first embodiment.

FIG. 12 is a schematic diagram illustrating a memory management method in the vertically reversed display mode performed by the display device according to the present embodiment.

FIG. 13 is a schematic diagram illustrating relationship of addresses between each piece of image data and correction data used for correction processing, in the vertically reversed display mode in the display device according to the present embodiment.

Description about the same configuration, method, and concept as those of the above normal display mode and the horizontally reversed display mode is simplified.

In the vertically reversed display mode, the following series of operations are executed by the controller 150.

First, like the normal display mode explained above, at the system activation of the display device 100, the correction data corresponding to each pixel PIX for one screen arranged in the display panel 110 are transferred from the correction data storage circuit 152 to the correction data memory circuit 153 in advance, and the correction data are temporarily stored in the correction data memory circuit 153.

Subsequently, as shown in FIG. 12, like the above normal display mode, the image data holding circuit 151 executes, in parallel, the operation of sequentially capturing the image data supplied from the display signal generation circuit 160 into one of the two FIFO memories 151*a*, 151*b* and the operation of sequentially reading, pixel by pixel, the image data held in the other of the FIFO memories 151*a*, 151*b* in the direction extending from the first column to the 960th column in each row (forward direction) to supply the image data to the image data correction circuit 154 in units of rows (see arrows shown in the image data holding circuit 151 in FIG. 12).

On the other hand, as shown in FIG. 12, the correction data corresponding to pixels PIX, to which the image data corresponding to one row is supplied, captured into the image data correction circuit 154, among the correction data stored in the correction data memory circuit 153, are sequentially read out and supplied to the image data correction circuit 154.

The correction data read from the correction data memory circuit 153 are sequentially read, pixel by pixel, in the direction extending from the 540th row, i.e., the last row, to the first row (backward direction; second reading order) and in the direction extending from the first column to the 960th column in each row (forward direction) (see arrows shown in the correction data memory circuit 153 in FIG. 12).

Subsequently, the image data correction circuit 154 corrects the image data captured via the image data holding circuit 151, on the basis of the correction data according to the characteristic of each pixel PIX of the display panel 110 that are supplied from the correction data memory circuit 153.

As shown in the image data correction circuit 154 in FIG. 12 and as schematically shown in FIG. 13, the correction processing of the image data correction circuit 154 is executed by performing calculation on each pieces of image data corresponding to each column position from the first column to the 960th column in each row from the first row to the 540th row (see addresses of the image data in FIG. 13), on the basis of a predetermined correction expression using each pieces of correction data corresponding to each pixel PIX from the first column to the 960th column in each row from the 540th row to the first row of the display panel 110 (see addresses of the correction data in FIG. 13).

Subsequently, the corrected image data (corrected image data D1 to D960) are transferred, pixel by pixel, to the data driver 140 via the driver transfer circuit 155 in units of rows.

The corrected image data D1 to D960 transferred from the controller 150 are sequentially captured, pixel by pixel, in the direction extending from the first column to the 960th column (forward direction; first capturing order) in the data driver 140 (see arrows shown in the data driver 140 in FIG. 12).

Subsequently, the selection driver 120 sequentially applies the selection signal Ssel at the selective level to the selection lines Ls in the order from the 540th row, i.e., the last row, to the first row (backward direction; second scanning direction), and sets the pixel PIX in each row to the selective state in order.

Then, in synchronization with the timing when the pixel PIX in each row is set in the selective state, the data driver 140 applies the gradation signal (gradation voltage Vdata) based on the captured corrected image data D1 to D960 corresponding to one row to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the vertically reversed display mode, as shown in the image data correction circuit 154, the data driver 140, and the display panel 110 in FIG. 12 and as schematically shown in FIG. 13, each gradation signal based on the corrected image data D1 to D960 obtained by correcting the image data corresponding to each column position from the first column to the 960th column in each row from the first row to the 540th row of the image information (see addresses of the image data in FIG. 13) using the correction data corresponding to each pixel PIX from the first column to the 960th column in each row from the 540th row to the first row of the display panel 110 (see addresses of the correction data in FIG. 13) is written to each pixel PIX from the first column to the 960th column in each row from the 540th row to the first row of the display panel 110.

After this writing operation of the gradation signal is sequentially executed to the pixels PIX in each of all the rows of the display panel 110, the light emitting element (organic EL element OEL) provided on each pixel PIX emits light with the luminance gradation according to the gradation signal at a time, and as a result, the image information is displayed on the display panel 110. At this occasion, as shown in FIG. 11, the image information is displayed as the vertically reversed image on the display panel 110.

(4) Horizontally and Vertically Reversed Display Mode

Figure 14:
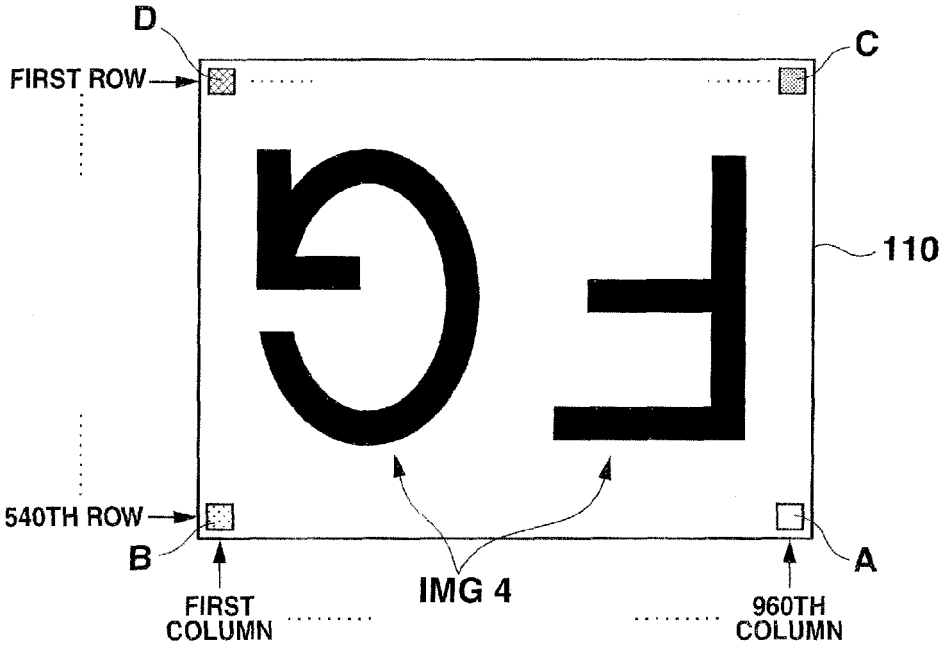
FIG. 14 is a figure illustrating a display form in a horizontally and vertically reversed display mode, in which image information is displayed on the display panel in a horizontally and vertically reversed manner during display drive operation performed by the display device according to the first embodiment.

FIG. 14 is a figure illustrating a display form in the horizontally and vertically reversed display mode, in which image information is displayed on the display panel in a horizontally and vertically reversed manner during display drive operation performed by the display device according to the present embodiment.

In FIG. 14, an IMG 4 is an example of image information displayed, in the horizontally and vertically reversed display mode, in the display region of the display panel 110 on the basis of the same image data as that used in the normal display mode. The IMG 4 is a horizontally and vertically reversed image obtained by horizontally and vertically reversing the IMG 1 of FIG. 5.

As shown in FIG. 14, in the horizontally and vertically reversed display mode, the display A based on the image data corresponding to the first row and the first column is displayed in the 540th row and the 960th column of the display panel 110.

The display B based on the image data corresponding to the first row and the 960th column is displayed at the position in the 540th row and the first column of the display panel 110.

The display C based on the image data corresponding to the 540th row and the first column is displayed in the first row and the 960th column of the display panel 110.

The display D based on the image data corresponding to the 540th row and the 960th column is displayed in the first row and the first column of the display panel 110.

Figure 15:
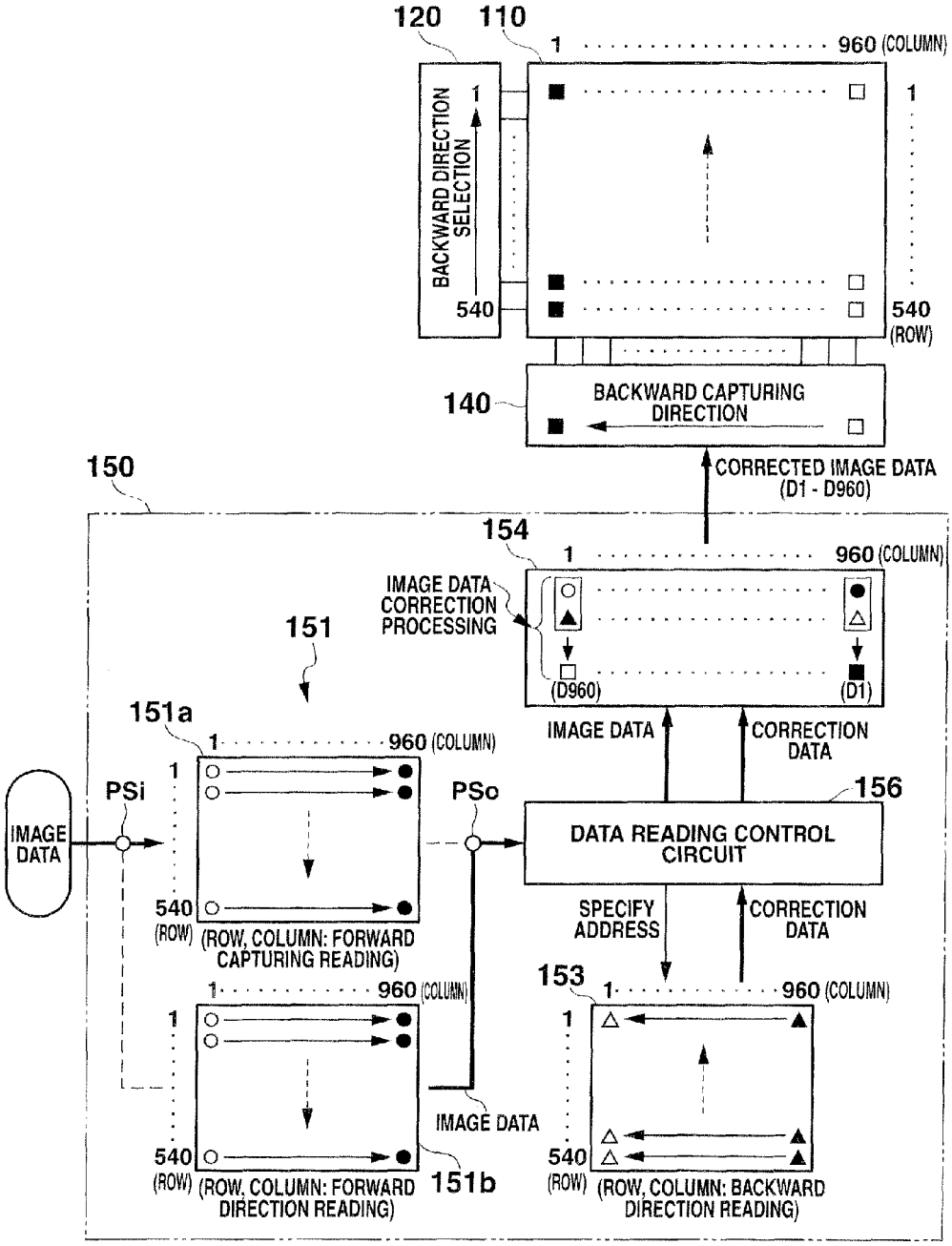
FIG. 15 is a schematic diagram illustrating a memory management method in the horizontally and vertically reversed display mode performed by the display device according to the first embodiment.

FIG. 15 is a schematic diagram illustrating a memory management method in the horizontally and vertically reversed display mode performed by the display device according to the present embodiment.

FIG. 16 is a schematic diagram illustrating relationship of addresses between each piece of image data and correction data used for correction processing, in the horizontally and vertically reversed display mode in the display device according to the present embodiment.

Description about the same configuration, method, and concept as those of the above normal display mode, the horizontally reversed display mode, and the vertically reversed display mode is simplified.

In the horizontally and vertically reversed display mode, the following series of operations are executed by the controller 150.

First, like the normal display mode explained above, at the system activation of the display device 100, the correction data corresponding to each pixel PIX for one screen arranged in the display panel 110 are transferred from the correction data storage circuit 152 to the correction data memory circuit 153 in advance, and the correction data are temporarily stored in the correction data memory circuit 153.

Subsequently, as shown in FIG. 15, like the above normal display mode, the image data holding circuit 151 executes, in parallel, the operation of sequentially capturing the image data supplied from the display signal generation circuit 160 into one of the two FIFO memories 151*a*, 151*b* and the operation of sequentially reading, pixel by pixel, the image data held in the other of the FIFO memories 151*a*, 151*b* in the direction extending from the first column to the 960th column in each row (forward direction) to supply the image data to the image data correction circuit 154 in units of rows (see arrows shown in the image data holding circuit 151 in FIG. 15).

On the other hand, as shown in FIG. 15, the correction data corresponding to pixels PIX, to which the image data corresponding to one row is supplied, captured into the image data correction circuit 154, among the correction data stored in the correction data memory circuit 153, are sequentially read out and supplied to the image data correction circuit 154.

The correction data read from the correction data memory circuit 153 are sequentially read, pixel by pixel, in the direction extending from the 540th row, i.e., the last row, to the first row (backward direction; second reading order) and in the direction extending from the 960th column to the first column in each row (backward direction) (see arrows shown in the correction data memory circuit 153 in FIG. 15).

Subsequently, the image data correction circuit 154 corrects the image data captured via the image data holding circuit 151, on the basis of the correction data according to the characteristic of each pixel PIX of the display panel 110 that are supplied from the correction data memory circuit 153.

As shown in the image data correction circuit 154 in FIG. 15 and as schematically shown in FIG. 16, the correction processing of the image data correction circuit 154 is executed by performing calculation on each pieces of image data corresponding to each column position from the first column to the 960th column in each row from the first row to the 540th row (see addresses of the image data in FIG. 16), on the basis of a predetermined correction expression using each pieces of correction data corresponding to each pixel PIX from the 960th column to the first column in each row from the 540th row to the first row of the display panel 110 (see addresses of the correction data in FIG. 16).

Subsequently, the corrected image data (corrected image data D1 to D960) are transferred, pixel by pixel, to the data driver 140 via the driver transfer circuit 155 in units of rows.

In the horizontally and vertically reversed display mode, the data driver 140 sets the capturing direction of the corrected image data D1 to 9960 to the backward direction on the basis of the data control signal (scan switching signal) supplied from the controller 150.

Accordingly, the corrected image data D1 to D960 supplied from the controller 150 are sequentially captured, pixel by pixel, in the direction extending from the 960th column to the first column in each row (backward direction; second capturing order) (see arrows shown in the data driver 140 in FIG. 15).

Subsequently, the selection driver 120 sequentially applies the selection signal Ssel at the selective level to the selection lines Ls in the order from the 540th row, i.e., the last row, to the first row (backward direction; second scanning direction), and sets the pixel PIX in each row to the selective state in order.

Then, in synchronization with the timing when the pixel PIX in each row is set in the selective state, the data driver 140 applies the gradation signal (gradation voltage Vdata) based on the captured corrected image data D1 to D960 corresponding to one row to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the horizontally and vertically reversed display mode, as shown in the image data correction circuit 154, the data driver 140, and the display panel 110 in FIG. 15 and as schematically shown in FIG. 16, each gradation signal based on the corrected image data D1 to D960 obtained by correcting the image data corresponding to each column position from the first column to the 960th column in each row from the first row to the 540th row of the image information (see addresses of the image data in FIG. 16) using the correction data corresponding to each pixel PIX from the first column to the 960th column in each row from the 540th row to the first row of the display panel 110 (see addresses of the correction data in FIG. 16) is written to each pixel PIX from the first column to the 960th column in each row from the 540th row to the first row of the display panel 110.

After this writing operation of the gradation signal is sequentially executed to the pixels PIX in each of all the rows of the display panel 110, the light emitting element (organic FL element OEL) provided on each pixel PIX emits light with the luminance gradation according to the gradation signal at a time, and as a result, the image information is displayed on the display panel 110. At this occasion, as shown in FIG. 14, the image information is displayed as the horizontally and vertically reversed image on the display panel 110.

As described above, according to the display device 100 of the present embodiment, the memory management method can be achieved in which the correction data according to the characteristic of each pixel PIX of the display panel 110 can appropriately be read/written to/from the memory circuit in accordance with various display forms (normal display and various kinds of reversed display S based on image information).

Accordingly, according to the present embodiment, for example, in accordance with a display switch signal that is input from the outside of the display device 100 (for example, a signal based on pivoting angle or direction of the display device 100, switch operation of the image display performed by a user, or the like), image information displayed on the display panel 110 can be displayed in various kinds of display forms (display patterns) and in high quality by using a simple method for appropriately switching the reading direction, of the correction data in the controller 150, the capturing direction of the corrected image data in the data driver 140, and the row selection direction in the selection driver 120 (the display drive method for the display device including the memory management method for the correction data).

In this case, the display switch signal is based on, for example, a detection signal of an angle and a direction of the display panel. Therefore, even when a movable or tilt-type display panel (monitor panel) is changed to any angle and direction in an electronic device such as a digital video camera and a digital camera, image information can be displayed with high visibility in the normal display or various kinds of reversed displays (display in a horizontally reversed manner, display in a vertically reversed manner, and the like) in accordance with the display switch signal defined in advance on the basis of the angle and the like of the display panel.

In the above series of drive control operation of the display device, the memory management function (memory management control) performed in the controller 150 can be executed on the basis of the vertical synchronization signal and the horizontal synchronization signal included in the timing signal supplied from the display signal generation circuit 160 to the controller 150, and therefore, the memory management function (memory management control) can apply simple and inexpensive device configuration without relying on any micro processing unit (MPU).

However, the display drive method performed by the display device according to the present embodiment is not limited to the above method. For example, the reading operation of the image data from the FIFO memories 151*a*, 151*b* may be executed with a displacement for one screen of the vertical synchronization signal supplied as the timing signal from the display signal generation circuit 160, and regardless of the capturing operation of the image data into the FIFO memories 151*a*, 151*b*, the corrected image data D1 to Dq corrected by the image data correction circuit 154 may be transferred via the driver transfer circuit 155 to the data driver 140.

According to this configuration, writing cycle of the gradation signal to each pixel PIX of the display panel 110 can be set at any cycle, and therefore, the scalability of the double speed display operation of the image information can be improved.

Second Embodiment

Subsequently, a second embodiment of a display device according to the present invention will be explained with reference to the drawings. Description about the same configuration and control method as those of the above first embodiment is simplified.

(Display Device)

Figure 17:
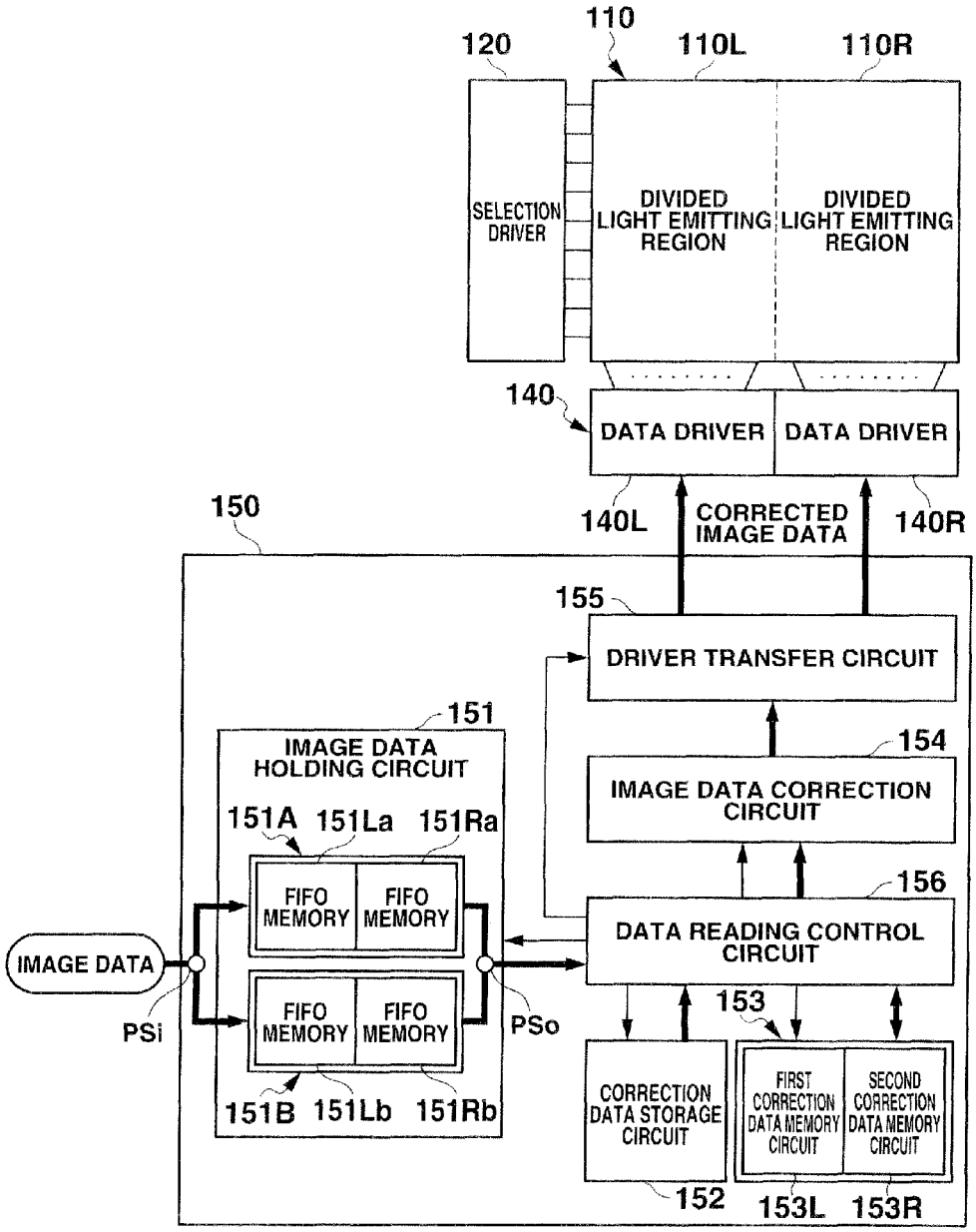
FIG. 17 is a schematic block diagram illustrating a second embodiment of a display device according to the present invention.

FIG. 17 is a schematic block diagram illustrating the second embodiment of the display device according to the present invention.

FIG. 17 shows a portion of configuration peculiar to the display device according to the second embodiment in a concrete manner, which is different from the display device as shown in the above first embodiment (see FIGS. 1 to 4).

FIG. 17 shows a configuration for achieving the image data correction function and the memory management function of the controller applied to the display device according to the second embodiment.

In this case, like the above first embodiment (see FIG. 3), flows of data and signals between respective functional blocks are all indicated by solid arrows for the sake of convenience in FIG. 17. However, any one of these data flows is actually activated in accordance with an operating state of a controller 150 as will be described later. In this case, in the figure, arrows in thin lines represent controls signals given by a data reading control circuit 156, and arrows in thick lines represent flows of various kinds of data.

As shown in FIG. 17, like the first embodiment (see FIGS. 1 and 3), a display device 100 according to the present embodiment mainly includes a display panel 110, a selection driver 120, a power supply driver (see FIG. 1) 130, two data drivers 140L, 140R, a controller 150, and a display signal generation circuit (see FIG. 1) 160.

As shown in FIG. 17, for example, the display panel 110 includes a plurality of pixels PIX arranged two-dimensionally in a row direction (in the figure, horizontal direction) and in a column direction (in the figure, vertical direction) (see FIG. 1). The light emitting region (display region) in which the plurality of pixels PIX are arranged two-dimensionally is divided into two parts in the row direction to define a divided light emitting region (the divided display region) 110L at the left side of the figure and a divided light emitting region (the divided display region) 110R at the right side of the figure.

As shown in FIG. 4, the plurality of pixels PIX arranged in the display panel 110 are connected to the plurality of selection lines Ls arranged in the row direction of the display panel 110 and the plurality of data lines Ld arranged in the column direction.

The selection driver 120 is connected to the selection line Ls in each row, and the pixels PIX in each row are sequentially set in the selective state by applying a selection signal at a selective level to the pixels PIX in each row via each selection line Ls at a predetermined timing.

The data driver 140L is connected to the data line Ld arranged in the divided light emitting region 110L at the left side of the figure of the display panel 110. The data driver 140R is connected to the data line Ld arranged in the divided light emitting region 110R at the right side of the figure of the display panel 110.

Each of the data drivers 140L, 140R is driven based on a data control signal provided by the controller 150, to generate a gradation signal (a gradation voltage Vdata) according to image data during display operation (light-emitting operation), and supply the generated signal to each pixel PIX of the divided light emitting regions 110L, 110R through each data line Ld at a time.

Like the data driver 140 shown in the above first embodiment, the data drivers 140L, 140R may have not only a data driver function for capturing the image data or the corrected image data during display operation of the display panel 110, generating the gradation signal (gradation voltage Vdata), and outputting the gradation signal to each data line Ld but also a voltage detection function for extracting voltage component (detection voltage) of characteristic of the pixel PIX when obtaining the correction data (characteristic parameter) for correcting the image data in accordance with the characteristic of the pixel PIX.

Like the first embodiment, the controller 150 includes the driver control function, the characteristic parameter acquiring function, the image data correction function, and the memory management function.

The driver control function generates and supplies the selection control signal, the power supply control signal, and the data control signal in order to control the operating state of the selection driver 120, the power supply driver 130, and the data drivers 140L, 140R.

The characteristic parameter acquiring function obtains a parameter (correction data) for compensating variation of the light emitting characteristics of the pixels PIX of the display panel 110.

The image data correction function corrects the image data using the correction data obtained by the characteristic parameter acquiring function and outputs the corrected image data as a corrected image data to the data drivers 140L, 140R.

The memory management function manages capturing, writing, and reading operations of the image data and the correction data in the image data holding circuit 151, the correction data storage circuit 152, and the correction data memory circuit 153 in accordance with the display form (display pattern) of the image information on the display panel 110.

Like the first embodiment, as shown in FIG. 17, the controller 150 includes an image data holding circuit 151, a correction data storage circuit 152, a correction data memory circuit 153, an image data correction circuit 154, a driver transfer circuit 155, and a data reading control circuit 156.

The image data holding circuit 151 includes memory circuit 151A having FIFO memories 151La, 151Ra and a memory circuit 151B having FIFO memories 151Lb, 151Rb, which are connected in parallel. Each of the memory circuits 151A, 151B has a memory region corresponding to the pixels PIX for one screen of the image information.

In this case, the FIFO memories 151La, 151Lb in the memory circuits 151A, 151B have memory regions corresponding to the pixels PIX at the divided light emitting region 110L. The FIFO memories 151Ra and 151Rb have memory regions corresponding to the pixels PIX at the divided light emitting region 110R of the above display panel 110 divided into two parts.

In each of the memory circuits 151A, 151B, image data for one screen of image information are divided and captured into each memory region of the FIFO memories 151La and 151Ra or each memory region of the FIFO memories 151Lb and 151Rb.

A switch contact point PSi is commonly provided at the input side of each of the memory circuits 151A, 151B, and a switch contact point PSo is commonly provided at the output side thereof. The switch contact points PSi and PSo are switched and controlled in synchronization. When an input path is set in one of the memory circuits 151A, 151B by the switch contact point PSi, an output path is set in the other of the memory circuits 151A, 151B by the switch contact point PSo.

Accordingly, operation of sequentially capturing the image data supplied as serial data from the display signal generation circuit 160 into one of the memory circuits 151A, 151B via the switch contact point PSi to hold one screen of image data and operation of sequentially reading the image data held in the other of the memory circuits 151A, 151B via the switch contact point PSo to provide the image data to the image data correction circuit 154 are executed in parallel.

The above operation is alternately, repeatedly executed by the two memory circuits 151A, 151B, so that the image data are continuously captured screen by screen.

In the image data holding circuit 151 according to the present embodiment, when the image data are captured and held as explained later, the FIFO memories 151La and 151Ra or the FIFO memories 151Lb and 151Rb constituting the memory circuits 151A, 151B are, visually, controlled and switched into a state for operating as separate memory regions and a state for operating as if they make a continuous, integrated memory region, in accordance with the display form (display pattern) of the image information.

When the FIFO memories 151La and 151Ra or the FIFO memories 151Lb and 151Rb operate as an integrated memory region, the FIFO memories 151La and 151Ra or the FIFO memories 151Lb and 151Rb operate as follows. In capturing process of the image data, for example, first, continuous image data are sequentially stored to the memory region having continuous addresses in the FIFO memory 151La, and subsequently, the continuous image data are sequentially stored to the memory region having continuous addresses in the FIFO memory 151Ra. In reading process of the image data, reading is carried out in the same order as the capturing process of the image data. That is, first, the image data are sequentially read from the continuous addresses in the FIFO memory 151La, and subsequently, the image data are sequentially read from the continuous addresses in the FIFO memory 151Ra.

On the other hand, when the FIFO memories 151La and 151Ra or the FIFO memories 151Lb and 151Rb operate as separate memory regions, the FIFO memories 151La and 151Ra or the FIFO memories 151Lb and 151Rb operate as follows. In capturing process of the image data, for example, first, continuous image data are sequentially stored to the memory region having continuous addresses in the FIFO memory 151Ra, and subsequently, the continuous image data are sequentially stored to the memory region having continuous addresses in the FIFO memory 151La. In reading process of the image data, reading is carried out in the same order as the capturing process of the image data. That is, first, the image data are sequentially read from the continuous addresses in the FIFO memory 151Ra, and subsequently, the image data are sequentially read from the continuous addresses in the FIFO memory 151La.

The read image data are supplied to the image data correction circuit 154 via the data reading control circuit 156 in units of rows.

The present embodiment shows the configuration in which the image data holding circuit 151 includes two (or a plurality of) memory circuits 151A (FIFO memories 151La, 151Ra), 151B (FIFO memories 151Lb, 151Rb), which are connected in parallel. This is because, as described in the above first embodiment, consideration is given to support double speed display operation and the like of image information (in particular, motion picture) by executing operation of capturing and holding the image data and operation of reading the image data in parallel.

Therefore, when image information displayed on the display panel 110 is a still image, character information, and the like, only one memory circuit including the same number of FIFO memories as the number of divided light emitting regions may be provided as the image data holding circuit 151.

The correction data storage circuit 152 has a nonvolatile memory, and for example, before the display drive operation of the display device 100, the correction data according to the characteristic of each pixel PIX arranged in the display panel 110 are obtained in advance, and the correction data are stored separately in advance.

The correction data memory circuit 153 includes two circuits, i.e., a first correction data memory circuit 153L and a second correction data memory circuit 153R having volatile memories.

In this case, the first correction data memory circuit 153L includes a memory region for storing (memorizing) the correction data according to the characteristics of the pixels PIX arranged at the side of the divided light emitting region 110L of the display panel 110 divided into two parts, and the second correction data memory circuit 153R has a memory region for storing (memorizing) the correction data according to the characteristics of the pixels PIX arranged at the side of the divided light emitting region 110R thereof.

All or some of the correction data according to the characteristics of the pixels PIX arranged in the display panel 110 that are stored in the correction data storage circuit 152 are divided and captured into the memory regions of the first and second correction data memory circuits 153L, 153R.

When the correction data according to the characteristics of the pixels PIX arranged in the display panel 110 that are stored in the correction data storage circuit 152 are read and temporarily stored in the correction data memory circuit 153 according to the present embodiment (first and second correction data memory circuits 153L, 153R) as explained later, the first and second correction data memory circuits 153L, 153R are used as an integrated memory region, and the correction data are sequentially stored.

On the other hand, when the correction data corresponding to the pixels PIX to which the image data captured via the image data holding circuit 151 are supplied are read, the first and second correction data memory circuits 153L, 153R are treated as separate memory regions, and in accordance with the display form (display pattern) of the image information, the correction data are sequentially read for each memory region (that is, first correction data memory circuit 153L, second correction data memory circuit 153R).

The read correction data are supplied to the image data correction circuit 154 via the data reading control circuit 156 in units of rows.

Alternatively, the correction data storage circuit 152 may not be provided, and for example, the first and second correction data memory circuits 153L, 153R may have nonvolatile memories, so that the obtained correction data are directly saved to the first and second correction data memory circuits 153L, 153R.

The image data correction circuit 154 generates corrected image data obtained by correcting the image data of the serial data captured via the image data holding circuit 151 using the correction data according to the characteristic of each pixel SIX of the display panel 110 that are read from the correction data memory circuit 153.

In the image data correction circuit 154 according to the present embodiment, the image data sequentially read in a predetermined order from the FIFO memories 151La and 151Ra or the FIFO memories 151Lb and 151Rb constituting the memory circuits 151A, 151B of the above image data holding circuit 151 in accordance with the display form (display pattern) of the image information are captured in units of rows.

In the image data correction circuit 154, the correction data sequentially read in a predetermined order from the above first and second correction data memory circuits 153L, 153R in accordance with the display form (display pattern) of the image information are captured in units of rows.

The correction processing is sequentially executed, pixel by pixel, on each piece of the image data, on the basis of the correction data associated in accordance with the display form of the image information.

The driver transfer circuit 155 transfers the image data (corrected image data D1 to Dq) corrected by the image data correction circuit 154 to the data drivers 140L, 140R at a predetermined timing.

The corrected image data D1 to Dq are output from the driver transfer circuit 155 as serial data for each row, and are sequentially captured and held in a predetermined order by the data drivers 140L, 140R.

The data reading control circuit 156 controls operations, i.e., the capturing operation of the image data in the memory circuits 151A, 151B of the image data holding circuit 151, the reading/writing (writing, reading) operation of the correction data in the correction data storage circuit 152 and the correction data memory circuit 153 (the first correction data memory circuit 153L and the second correction data memory circuit 153R), the correction processing of the image data in the image data correction circuit 154 explained later, and the transfer processing of the corrected image data to the data drivers 140L, 140R in the driver transfer circuit 155.

Specific operation control in the data reading control circuit 156 will be explained later.

Like the first embodiment, FIG. 17 shows the configuration in which the image data read from the image data holding circuit 151, the correction data read from the correction data storage circuit 152 and written to the correction data memory circuit 153, and the correction data read from the correction data memory circuit 153 are passed by way of the data reading control circuit 156. However, the present invention is not limited to this configuration.

Alternatively, the image data and the correction data may directly be transmitted to the image data correction circuit 154. The correction data may directly be written from the correction data storage circuit 152 to the correction data memory circuit 153. The correction data read from the correction data memory circuit 153 may directly be transmitted to the image data correction circuit 154.

(Display Drive Method)

Subsequently, the display drive method for each display form (display pattern) of image information in the display device according to the present embodiment will be explained with reference to the drawings.

Like the first embodiment, the display form includes (1) a normal display mode for displaying image information based on a video signal in usual direction as an ordinary image, (2) a horizontally reversed display mode in which image information is displayed upon reversed horizontally, (3) a vertically reversed display mode in which image information is displayed upon reversed vertically, and (4) a horizontally and vertically reversed display mode in which image information is displayed upon reversed horizontally and vertically.

In this case, the memory management method with the controller 150 will mainly be explained.

Now, it is assumed that 960×540 pixels PIX are arranged in a matrix form in a row direction and a column direction in the light emitting region (display region) of the display panel 110.

It is assumed that the plurality of pixels PIN arranged in the display panel 110 are equally divided into two parts in the horizontal direction of FIG. 17, and the pixels PIX in the first to the 480th columns are arranged at the side of the divided light emitting region (the divided display region) 110L and the pixels PIX in the 480th to 960th columns are arranged at the side of the divided light emitting region (the divided display region) 110R.

It is also assumed that the image data are provided as a form corresponding to the matrix of 960 columns×540 rows of the display panel 110.

(1) Normal Display Mode

Figure 18:
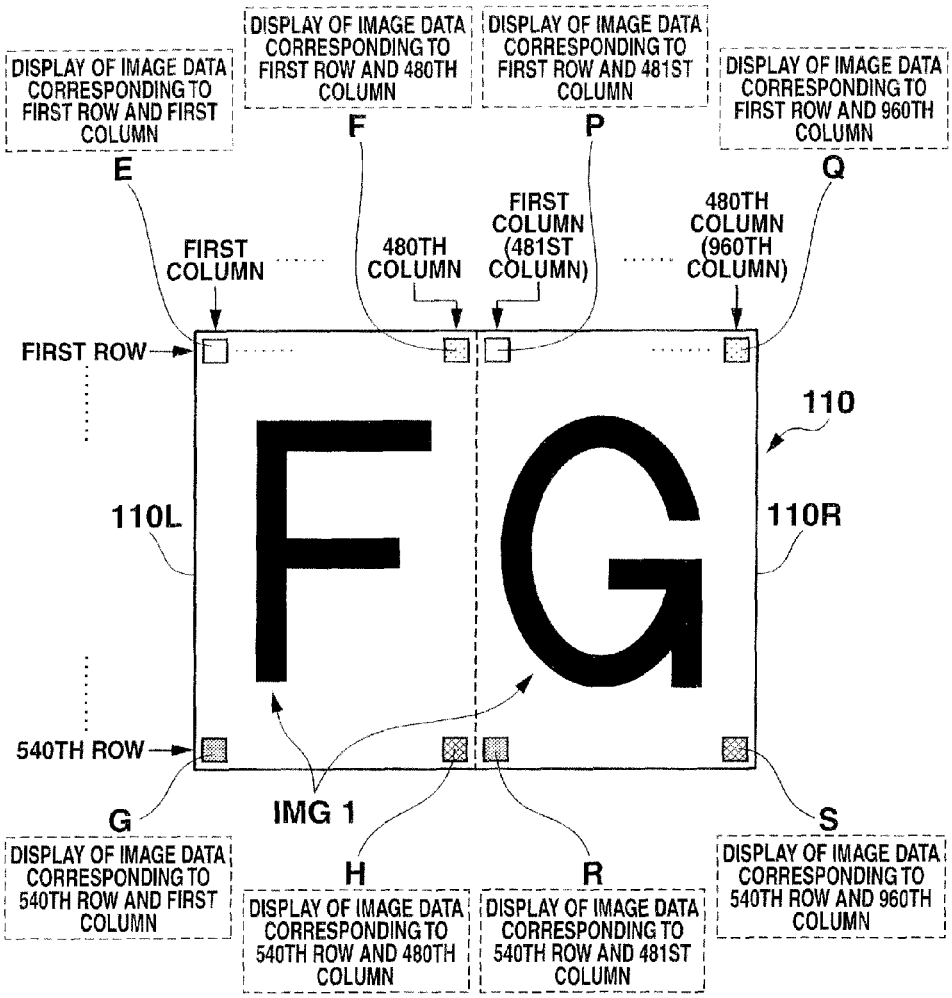
FIG. 18 is a figure illustrating a display form in a normal display mode, in which image information is displayed on the display panel in a normal manner during display drive operation performed by the display device according to the second embodiment.

FIG. 18 is a figure illustrating a display form in the normal display mode, in which image information is displayed on the display panel in a normal manner and usual direction during display drive operation performed by the display device according to the present embodiment.

In FIG. 18, an IMG 1 is an example of image information displayed in the display region of the display panel 110 on the basis of image data in the normal display mode. It is assumed that the image information is the same as the image information as shown in FIG. 5, and in the normal display mode, it is displayed as an ordinary image.

In FIG. 18, reference symbol E denotes a display of the image data corresponding to the first row and the first column of the display panel 110 (the divided light emitting region 110L).

Reference symbol F denotes a display of the image data corresponding to the first row and the 480th column of the display panel. Reference symbol G denotes a display of the image data corresponding to the 540th row and the first column.

Reference symbol H denotes a display of the image data corresponding to the 540th row and the 480th column.

Reference symbol P denotes a display of the image data corresponding to the first row and the 481st column of the display panel 110 (the first row and the first column in the divided light emitting region 110R).

Reference symbol Q denotes a display of the image data corresponding to the first row and the 480th column (the first row and the 480th column in the divided light emitting region 110R).

Reference symbol R denotes a display of the image data corresponding to the 540th row and the 481st column (the 540th row and the 481st column in the divided light emitting region 110R).

Reference symbol S denotes a display of the image data corresponding to the 540th row and the 960th column (the 540th row and the 480th column in the divided light emitting region 110R).

As shown in FIG. 18, in the normal display mode, the display E based on the image data corresponding to the first row and the first column is displayed in the first row and the first column of the display panel 110 (the divided light emitting region 110L).

The display F based on the image data corresponding to the first row and the 480th column is displayed in the first row and the 480th column of the display panel 110 (the divided light emitting region 110L).

The display G based on the image data corresponding to the 540th row and the first column is displayed in the 540th row and the first column of the display panel 110 (the divided light emitting region 110L).

The display H based on the image data corresponding to the 540th row and the 480th column is displayed in the 540th row and the 480th column of the display panel 110 (the divided light emitting region 110L).

The display P based on the image data corresponding to the first row and the 481st column is displayed in the first row and the 481st column of the display panel 110 (the first row and the first column in the divided light emitting region 110R).

The display Q based on the image data corresponding to the first row and the 960th column is displayed at the position in the first row and the 960th column of the display panel 110 (the first row and the 480th column in the divided light emitting region 110R).

The display R based on the image data corresponding to the 540th row and the 481st column is displayed at the position in the 540th row and the 481st column of the display panel 110 (the 540th row and the 481st column in the divided light emitting region 110R).

The display S based on the image data corresponding to the 540th row and the 960th column is displayed at the position in the 540th row and the 960th column of the display panel 110 (the 540th row and the 480th column in the divided light emitting region 110R).

Figure 19:
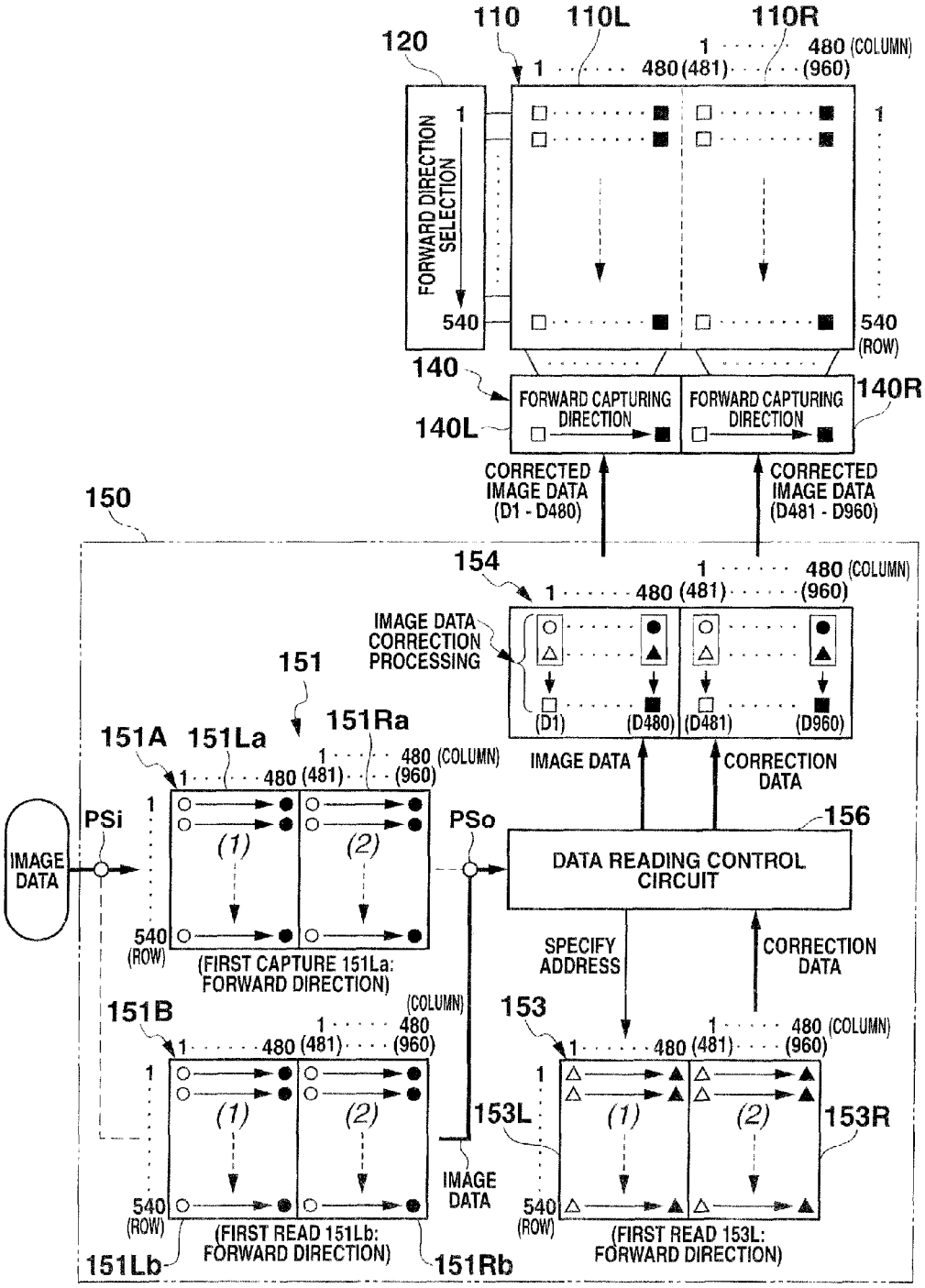
FIG. 19 is a schematic diagram illustrating a memory management method in the normal display mode performed by the display device according to the second embodiment.

FIG. 19 is a schematic diagram illustrating a memory management method in the normal display mode performed by the display device according to the present embodiment.

FIG. 20 is a schematic diagram illustrating relationship of addresses between each piece of image data and correction data used for correction processing, in the normal display mode in the display device according to the present embodiment.

In FIG. 19, symbols are defined as follows for the sake of convenience in order to simplify the explanation about the memory management method.

In the figure, in the image data holding circuit 151 and the image data correction circuit 154, ○ (white circle) denotes image data corresponding to pixels PIX located in the first column (or the 481st column in the serial number) among the image data in each row (corresponding to one row) constituting the image information.

● (black circle) denotes image data corresponding to pixels PIX located in the 480th column, i.e., the last column, (or the 960th column in the serial number) in the image data.

Arrows shown in the image data holding circuit 151 represents the capturing order (that is, capturing direction) or the reading order (that is, reading direction) of the image data.

In the correction data memory circuit 153 and the image data correction circuit 154 in FIG. 19, Δ (white triangle) denotes correction data according to the characteristics of the pixels PIX located in the first column (or the 481st column in the serial number) among the pixels PIX in each row (corresponding to one row) arranged in the display panel 110.

▲ (black triangle) denotes correction data according to the characteristics of the pixels PIX located in the 480th column, i.e., the last column, (or the 960th column in the serial number) among the pixels PIX.

Arrows shown in the correction data memory circuit 153 denote the reading order (that is, reading direction) of the correction data.

In the image data correction circuit 154, the data drivers 140L, 140R, the display panel 110 in the FIG. 19, □ (white rectangle) denotes the corrected image data or the gradation signal supplied to pixels PIX located in the first column (or the 481st column in the serial number) among the corrected image data supplied to the pixels PIX in each row (corresponding to one row) arranged in the display panel 110.

■ (black rectangle) denotes corrected image data supplied to pixels PIX located in the 480th column, i.e., the last column, (or the 960th column in the serial number) among the corrected image data.

Arrows shown in the data drivers 140L, 140R denote the capturing order (that is, capturing direction) of the corrected image data supplied from the controller 150.

The above definition is commonly applied to each display form as listed below in the present embodiment.

In the normal display mode, the following series of operations are executed by the controller 150.

First, at the system activation of the display device 100, the data reading control circuit 156 of the controller 150 sequentially reads the correction data stored in the correction data storage circuit 152 corresponding to each pixel PIX arranged in the display panel 110 in advance, and the correction data are transferred to the first correction data memory circuit 153L and the second correction data memory circuit 153R of the correction data memory circuit 153, so that they are temporarily saved in the first correction data memory circuit 153L and the second correction data memory circuit 153R.

The correction data transferred to the correction data memory circuit 153 are saved at addresses corresponding to positions of pixels PIX arranged in the display panel 110 by causing the first and second correction data memory circuits 153L, 153R to visually operate as if they make a continuous, integrated memory region.

For example, the correction data according to the characteristics of the pixels PIX arranged in each column from the first to the 960th column in the first row of the display panel 110 are saved to the memory region in each column from the first to the 480th columns in the first row of the first correction data memory circuit 153L and to the memory region in each column from the first to the 480th columns (the 481st to 960th columns in the serial number) in the first row of the second correction data memory circuit 153R.

The correction data memory circuit 153 saves the correction data of the pixels PIX for one screen of image information to be displayed on the display panel 110.

Subsequently, as shown in FIG. 19, the data reading control circuit 156 sequentially captures and holds the image data of the digital signal supplied as the serial data from the display signal generation circuit 160 into any one of the two memory circuits 151A, 151B provided in the image data holding circuit 151 via the switch contact point PSi.

At this occasion, in the normal display mode, the image data holding circuit 151 causes the FIFO memories 151La and 151Ra or the FIFO memories 151Lb and 151Rb constituting the memory circuits 151A, 151B to visually operate as if they make a continuous, integrated memory region. That is, for example, in the memory circuit 151A, first, the image data continuous in the direction extending from the first column to the 480th column, i.e., the last column, (forward direction) in the first row of the FIFO memory 151La are sequentially captured, and subsequently, the image data continuous in the direction extending from the first column (or the 481st column in the serial number) to the 480th column, i.e., the last column, (or the 960th column in the serial number) (forward direction) in the first row of the FIFO memory 151Ra are sequentially captured and stored.

The image data holding circuit 151 repeats this operation of each row in the forward direction from the first row to the 540th row, i.e., the last row, and holds the image data for one screen in any one of the two memory circuits 151A, 151B.

In parallel with the capturing operation of the image data, as shown in FIG. 19, the image data holding circuit 151 executes reading operation of the image data for sequentially reading the image data held in the other of the memory circuits 151A, 151B via the switch contact point PSo.

In this reading operation of the image data, the FIFO memories 151La and 151Ra or the FIFO memories 151Lb and 151Rb constituting the memory circuits 151A, 151B are caused to visually operate as if they make a continuous, integrated memory region, and the reading operation of the image data is executed in the same order and the same direction as those of the above capturing operation of the image data.

The read image data are supplied to the image data correction circuit 154 in units of rows (see arrows and circled numbers shown in the image data holding circuit 151 in FIG. 19).

On the other hand, as shown in FIG. 19, the data reading control circuit 156 sequentially reads the correction data corresponding to pixels PIX, to which the image data corresponding to one row is supplied, captured into the image data correction circuit 154 via the image data holding circuit 151, among the correction data stored in the first correction data memory circuit 153L and the second correction data memory circuit 153R of the correction data memory circuit 153, and the correction data are supplied to image data correction circuit 154 in units of rows.

The correction data memory circuit 153 causes the first and second correction data memory circuits 153L, 153R constituting the correction data memory circuit 153 to visually operate as if they make a continuous, integrated memory region. That is, operation of sequentially reading the correction data in the direction extending from the first column to the 480th column, i.e., the last column, (forward direction; first reading order) in the first row of the first correction data memory circuit 153L and subsequently sequentially reading the correction data in the direction extending from the first column (or the 481st column in the serial number) to the 480th columns, i.e., the last column, (or the 960th column in the serial number) in the first row of the second correction data memory circuit 153R (forward direction; first reading order) is sequentially repeated in the direction extending from the first row to the 540th row, i.e., the last row, (forward direction) (see arrows and circled numbers shown in the correction data memory circuit 153 in FIG. 19).

Subsequently, the image data correction circuit 154 sequentially corrects, pixel by pixel, the image data at each column position of one row captured via the image data holding circuit 151, on the basis of the correction data according to the characteristics of the pixels PIX in each column of one row of the display panel 110 that are supplied from the correction data memory circuit 153.

As shown in the image data correction circuit 154 in FIG. 19 and as schematically shown in FIG. 20, the correction processing of the image data correction circuit 154 is executed by performing calculation on each pieces of image data corresponding to each column position from the first column to the 960th column in each row (see addresses of the image data in FIG. 20), on the basis of a predetermined correction expression using each pieces of correction data corresponding to each pixel PIX from the first column to the 960th column in each row of the display panel 110 (see addresses of the correction data in FIG. 20).

The FIFO memories 151La and 151Ra or 151Lb and 151Rb constituting the memory circuits 151A, 151B of the image data holding circuit 151 are caused to operate as the integrated memory region. The image data of the serial data are sequentially captured and held in the forward direction in the order of the FIFO memories 151La, 151Ra or 151Lb, 151Rb, and are sequentially read in the forward direction in the order of the FIFO memories 151La, 151Ra or 151Lb, 151Rb.

The two correction data memory circuits, i.e., the first and second correction data memory circuits 153L, 153R constituting the correction data memory circuit 153, are caused to operate as the integrated memory region, and the reading operation is performed in the forward direction in the order of the first correction data memory circuit 153L and the second correction data memory circuit 153R.

Then, the correction processing is executed on each piece of the read image data in one row (the image data in the first to the 480th columns at the side of the FIFO memory 151La or 151Lb (denoted as "L side" in the figure) and the first to the 480th columns at the side of the FIFO memory 151Ra or 151Rb (denoted as "R side" in the figure) (the 481st to the 960th column in the serial number)), using each piece of the correction data corresponding to one row sequentially read in the forward direction from the correction data memory circuit 153 (the correction data in the first to the 480th columns at the side of the first correction data memory circuit 153L (denoted as "L side" in the figure) and in the first to the 480th columns at the side of the second correction data memory circuit 153R (denoted as "R side" in the figure) (the 481st to the 960th columns in the serial number)).

The example of the correction processing method for the image data will be explained in detail using the example of the driving control method for the display device explained later.

Subsequently, the corrected image data (corrected image data D1 to Dq: q=960) are transferred by the data reading control circuit 156, pixel by pixel, to the data drivers 140L, 140R via the driver transfer circuit 155 in units of rows.

The corrected image data D1 to D960 are transferred via the driver transfer circuit 155 as follows. The corrected image data D1 to D480 corresponding to the pixels PIX from the first column to the 480th column arranged in the divided light emitting region 110L of the display panel 110 are transferred to the data driver 140L, and the corrected image data D481 to D960 corresponding to the pixels PIX from the first column to the 480th column arranged in the divided light emitting region 110R are transferred to the data driver 140R (from the 481st column to the 960th column in the serial number).

At this occasion, the corrected image data D1 to D480 are sequentially captured, pixel by pixel, in the direction extending from the first column to the 480th column of the divided light emitting region 110L (forward direction; first capturing order) in the data driver 140L. The corrected image data D481 to D960 are sequentially captured, pixel by pixel, in the direction extending from the first column to the 480th column of the divided light emitting region 110R (from the 481st column to the 960th column in the serial number) (forward direction; first capturing order) in the data driver 140R (see arrows shown in the data driver 140 in FIG. 19).

Subsequently, the selection driver 120 sequentially applies the selection signal Ssel at the selective level to the selection lines Ls in the order from the first row to the 540th row, i.e., the last row, (forward direction; first scanning direction), and sets the pixel PIX in each row to the selective state in order.

Then, in synchronization with the timing when the pixel PIX in each row is set in the selective state, the data drivers 140L, 140R apply the gradation signal (gradation voltage Vdata) based on the captured corrected image data D1 to D960 corresponding to one row (from the first to the 480th columns and from the 481st to the 960th columns in the serial number) to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the normal display mode, as shown in the image data correction circuit 154, the data drivers 140L, 140R, and the display panel 110 in FIG. 19 and as schematically shown in FIG. 20, each gradation signal based on the corrected image data D1 to D960 obtained by correcting the image data corresponding to each column position from the first column to the 960th column in each row of the image information (see addresses of the image data in FIG. 20) using the correction data corresponding to each pixel PIX from the first column to the 960th column in each row of the display panel 110 (see addresses of the correction data in FIG. 20) is written to each pixel PIX from the first column to the 480th column in each row of each of the divided light emitting regions 110L, 110R of the display panel 110 (from the first column to the 480th column and from the 481st column to the 960th column in the serial number).

After this writing operation of the gradation signal is sequentially executed to the pixels PIX in each of all the rows of the display panel 110, the power supply voltage Vsa at the predetermined light-emitting level is applied to each pixel PIX, so that the light emitting element (organic EL element OEL) provided on each pixel PIX emits light with the luminance gradation according to the gradation signal at a time, and as a result, the image information is displayed on the display panel 110. At this occasion, as shown in FIG. 18, the image information is displayed as the ordinary image on the display panel 110.

Like the above first embodiment, when it is not necessary to correct the image data, e.g., when the display device is in initial state such as factory default state or when correction data according to characteristic of each pixel PIX are not obtained, the image data are transferred to the data driver 140 via the driver transfer circuit 155 without correcting the image data (that is, bypassing the image data correction circuit 154).

(2) Horizontally Reversed Display Mode

Figure 21:
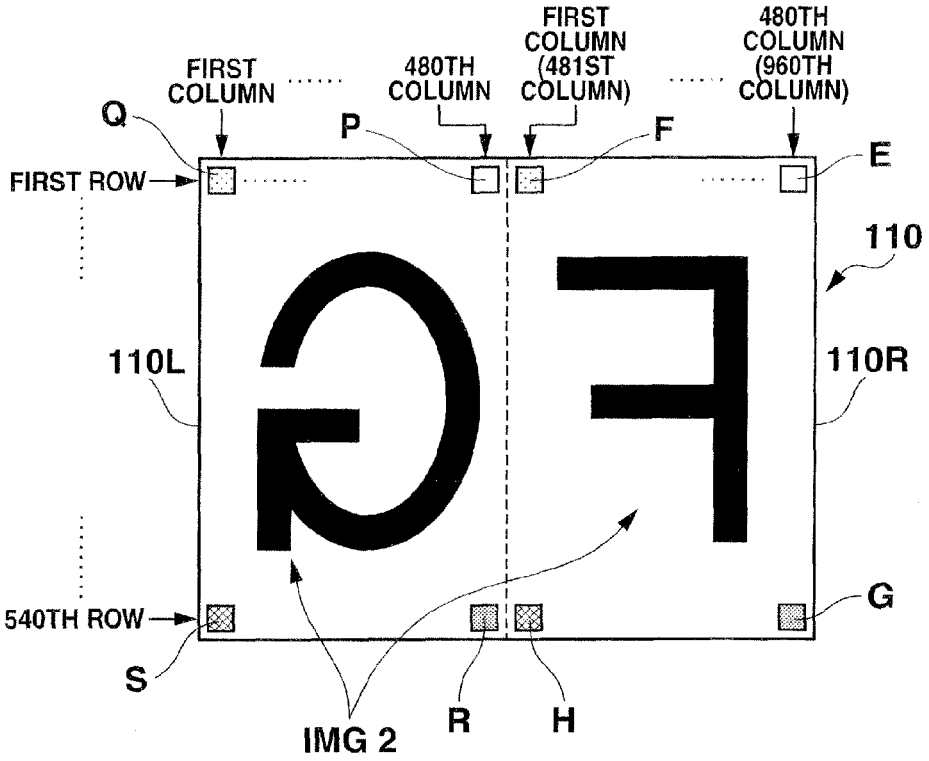
FIG. 21 is a figure illustrating a display form in a horizontally reversed display mode in which image information is displayed on the display panel in a horizontally reversed manner during display drive operation performed by the display device according to the second embodiment.

FIG. 21 is a figure illustrating a display form in the horizontally reversed display mode in which image information is displayed on the display panel in a horizontally reversed manner during display drive operation performed by the display device according to the present embodiment.

In FIG. 21, an IMG 2 is an example of image information displayed, in the horizontally reversed display mode, in the display region of the display panel 110 on the basis of the same image data as that used in the normal display mode. The IMG 2 is a horizontally reversed image obtained by horizontally reversing the IMG 1 of FIG. 18.

As shown in FIG. 21, in the horizontally reversed display mode, the display E based on the image data corresponding to the first row and the first column is displayed in the first row and the 960th column of the display panel 110 (the first row and the 480th column in the divided light emitting region 110R).

The display F based on the image data corresponding to the first row and the 480th column is displayed at the position in the first row and the 481st column of the display panel 110 (the first row and the first column in the divided light emitting region 110R).

The display G based on the image data corresponding to the 540th row and the first column is displayed at the position in the 540th row and the 960th column of the display panel 110 (the 540th row and the 480th column in the divided light, emitting region 110R).

The display H based on the image data corresponding to the 540th row and the 480th column is displayed at the position in the 540th row and the 481st column of the display panel 110 (the 540th row and the first column in the divided light emitting region 110R).

The display P based on the image data corresponding to the first row and the 481st column is displayed at the position in the first row and the 480th column of the display panel 110 (the divided light emitting region 110L).

The display Q based on the image data corresponding to the first row and the 960th column is displayed at the position in the first row and the first column of the display panel 110 (the divided light emitting region 110L).

The display R based on the image data corresponding to the 540th row and the 481st column is displayed at the position in the 540th row and the 480th column of the display panel 110 (the divided light emitting region 110L).

The display S based on the image data corresponding to the 540th row and the 960th column is displayed at the position in the 540th row and the first column of the display panel 110 (the divided light emitting region 110L).

Figure 22:
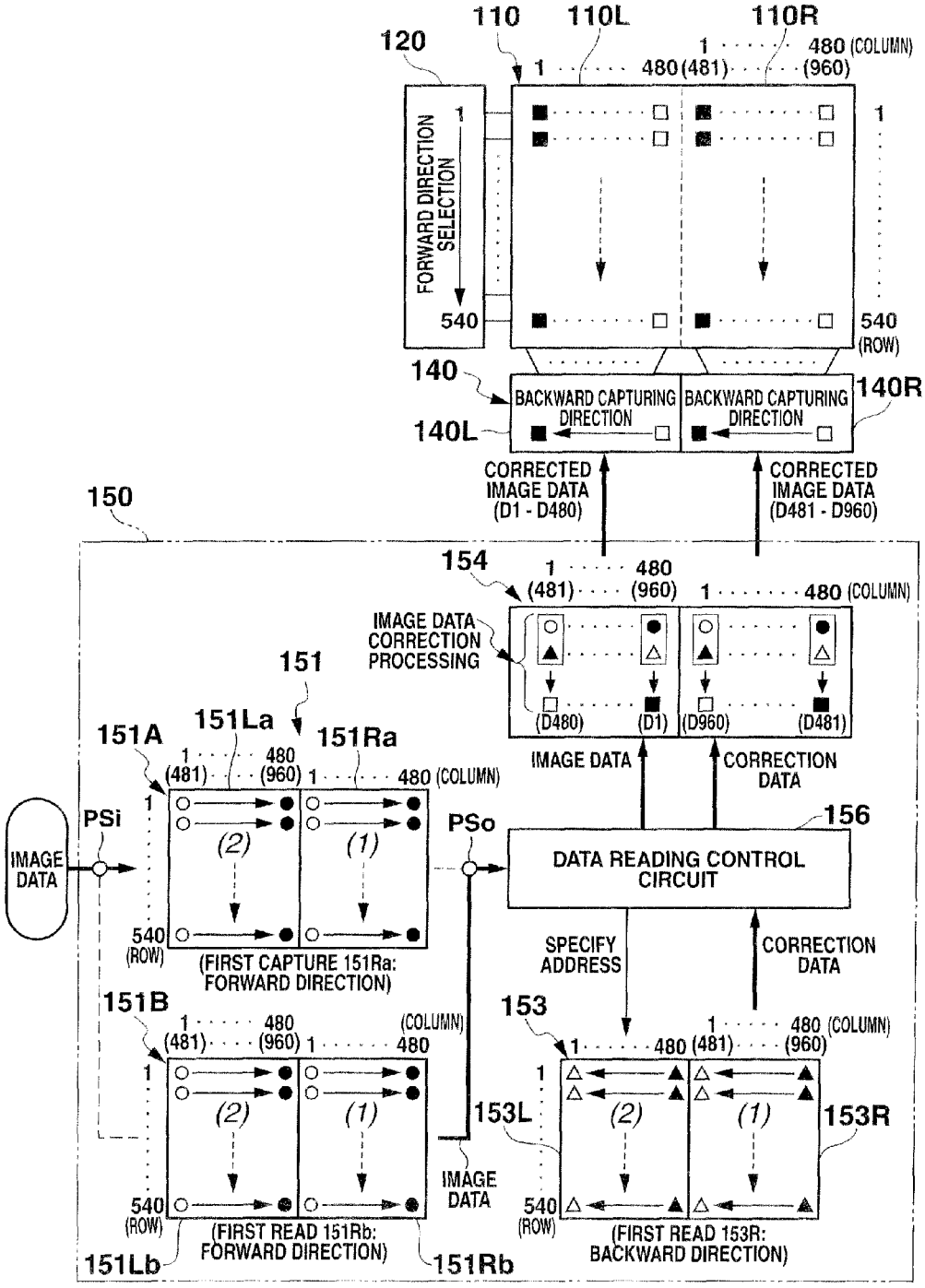
FIG. 22 is a schematic diagram illustrating a memory management method in the horizontally reversed display mode performed by the display device according to the second embodiment.

FIG. 22 is a schematic diagram illustrating a memory management method in the horizontally reversed display mode performed by the display device according to the present embodiment.

FIG. 23 is a schematic diagram illustrating relationship of addresses between each piece of image data and correction data used for correction processing, in the horizontally reversed display mode in the display device according to the present embodiment.

Description about the same configuration, method, and concept as those of the above normal display mode is simplified.

In the horizontally reversed display mode, the following series of operations are executed by the controller 150.

First, like the normal display mode explained above, at the system activation of the display device 100, the correction data corresponding to each pixel PIX for one screen arranged in the display panel 110 are transferred from the correction data storage circuit 152 to the first correction data memory circuit 153L and the second correction data memory circuit 153R of the correction data memory circuit 153 in advance, and the correction data are temporarily stored in the first correction data memory circuit 153L and the second correction data memory circuit 153R.

Subsequently, as shown in FIG. 22, the image data holding circuit 151 executes, in parallel, the operation of sequentially capturing the image data supplied as serial data from the display signal generation circuit 160 into one of the two memory circuits 151A, 151B via the switch contact point PSi and the operation of sequentially reading the image data held in the other of the memory circuits 151A, 151B via the switch contact point PSo to supply the image data to the image data correction circuit 154 in units of rows.

The image data holding circuit 151 causes the FIFO memories 151La and 151Ra or FIFO memories 151Lb and 151Rb constituting the memory circuits 151A, 151B to operate as separate memory regions. That is, for example, in the memory circuit 151A, first, the image data continuous in the direction extending from the first column to the 480th column, i.e., the last column, in the first row of the FIFO memory 151Ra (forward direction) are divided and captured, and subsequently, the image data continuous in the direction extending from the first column to the 480th column, i.e., the last column, (from the 481st column to the 960th column in the serial number) in the first row of the FIFO memory 151La (forward direction) are divided and captured.

The image data holding circuit 151 repeats this operation of each row in the forward direction from the first row to the 540th row, i.e., the last row, and holds the image data for one screen in any one of the two memory circuits 151A, 151B.

In parallel with the capturing operation of the image data, as shown in FIG. 22, the image data holding circuit 151 executes reading operation of the image data for sequentially reading the image data held in the other of the memory circuits 151A, 151B.

In this reading operation of the image data, the FIFO memories 151La and 151Ra or the FIFO memories 151Lb and 151Rb constituting the memory circuits 151A, 151B are caused to operate as separate memory regions, and the reading operation of the image data is executed in the same order and the same direction as those of the above capturing operation of the image data.

The read image data are supplied to the image data correction circuit 154 in units of rows (see arrows and circled numbers shown in the image data holding circuit 151 in FIG. 22).

On the other hand, as shown in FIG. 22, the correction data corresponding to pixels PIX, to which the image data corresponding to one row is supplied, captured into the image data correction circuit 154 via the image data holding circuit 151, among the correction data stored in the first correction data memory circuit 153L and the second correction data memory circuit 153R of the correction data memory circuit 153, are sequentially read, and the correction data are supplied to the image data correction circuit 154.

The correction data memory circuit 153 causes the first and second correction data memory circuits 153L, 153R constituting the correction data memory circuit 153 to operate as separate memory regions. That is, operation of sequentially reading the correction data in the direction extending from the 480th column, i.e., the last column, to the first column (from the 960th column to the 481st column in the serial number) (backward direction; second reading order) in the first row of the second correction data memory circuit 153R and subsequently sequentially reading the correction data in the direction extending from the 480th column, i.e., the last column, to the first column in the first row of the first correction data memory circuit 153L (backward direction; second reading order) is sequentially repeated in the direction extending from the first row to the 540th row, i.e., the last row, (forward direction) (see arrows and circled numbers shown in the correction data memory circuit 153 in FIG. 22).

Subsequently, the image data correction circuit 154 sequentially corrects the image data captured via the image data holding circuit 151, on the basis of the correction data according to the characteristic of each pixel PIX of the display panel 110 that are supplied from the correction data memory circuit 153.

As shown in the image data correction circuit 154 in FIG. 22 and as schematically shown in FIG. 23, the correction processing of the image data correction circuit 154 is executed by performing calculation on each pieces of image data corresponding to each column position from the first column to the 480th column and from the 481st column to the 960th column in each row (see addresses of the image data in FIG. 23), on the basis of a predetermined correction expression using each pieces of correction data corresponding to each pixel PIX from the 960th column to the 481st column and from the 480th column to the first column in each row of the display panel 110 (see addresses of the correction data in FIG. 23).

The FIFO memories 151La and 151Ra or 151Lb and 151Rb constituting the memory circuits 151A, 151B of the image data holding circuit 151 are caused to operate as separate memory regions. The image data of the serial data are sequentially captured and held in the forward direction in the order of the FIFO memories 151Ra, 151La or 151Rb, 151Lb, and are sequentially read in the forward direction in the order of the FIFO memories 151Ra, 151La or 151Rb, 151Lb.

The two correction data memory circuit, i.e., the first and second correction data memory circuits 153L, 153R constituting the correction data memory circuit 153, are caused to operate as separate memory regions, and the reading operation is performed in the backward direction in the order of the second correction data memory circuit 153R and the first correction data memory circuit 153L.

Then, the correction processing is executed on each piece of the read image data in one row (the image data in the first to the 480th columns at the side of the FIFO memory 151Ra or 151Rb (denoted as "R side" in the figure) and the first to the 480th columns at the side of the FIFO memory 151La or 151Lb (denoted as "L side" in the figure) (the 481st to the 960th column in the serial number)), using each piece of the correction data corresponding to one row sequentially read in the backward direction from the correction data memory circuit 153 (the correction data in the 480th to the first columns at the side of the second correction data memory circuit 153R (denoted as "R side" in the figure) (the 960th to the 481st columns in the serial number) and in the 480th to the first columns at the side of the first correction data memory circuit 153L (denoted as "L side" in the figure)).

Subsequently, the corrected image data (corrected image data D1 to D960) are transferred, pixel by pixel, to the data drivers 140L, 140R via the driver transfer circuit 155 in units of rows.

The data drivers 140L, 140R set the capturing direction of the corrected image data D1 to D960 to the backward direction on the basis of the data control signal (scan switching signal) supplied from the controller 150.

Accordingly, the corrected image data D1 to D960 are transferred via the driver transfer circuit 155 as follows. The corrected image data D1 to D480 corresponding to the pixels PIX from the first column to the 480th column arranged in the divided light emitting region 110L of the display panel 110 are transferred to the data driver 140L, and the corrected image data D481 to D960 corresponding to the pixels PIX from the first column to the 480th column arranged in the divided light emitting region 110R (from the 481st column to the 960th column in the serial number) are transferred to the data driver 140R.

At this occasion, the corrected image data D480 to D1 are sequentially captured, pixel by pixel, in the direction extending from the 480th column to the first column of the divided light emitting region 110L (backward direction; second capturing order) in the data driver 140L, and the corrected image data D960 to D481 are sequentially captured, pixel by pixel, in the direction extending from the 480th column to the first column of the divided light emitting region 110R (from the 960th column to the 481st column in the serial number) (backward direction; second capturing order) in the data driver 140R (see arrows shown in the data drivers 140L, 140R in FIG. 22).

Subsequently, the selection driver 120 sequentially applies the selection signal Ssel at the selective level to the selection lines Ls in the order from the first row to the 540th row, i.e., the last row, (forward direction; first scanning direction), and sets the pixel PIX in each row to the selective state in order.

Then, in synchronization with the timing when the pixel PIX in each row is set in the selective state, the data drivers 140L, 140R apply the gradation signal (gradation voltage Vdata) based on the captured corrected image data D1 to D960 corresponding to one row (from the 480 to the first columns and the 960th to the 481st columns in the serial number) to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the horizontally reversed display mode, as shown in the image data correction circuit 154, the data drivers 140L, 140R, and the display panel 110 in FIG. 22 and as schematically shown in FIG. 23, each gradation signal based on the corrected image data D1 to D960 obtained by correcting the image data corresponding to each column position from the 960th column to the first column in each row of the image information (see addresses of the image data in FIG. 23) using the correction data corresponding to each pixel PIX from the first column to the 960th column in each row of the display panel 110 (see addresses of the correction data in FIG. 23) is written to each pixel PIX from the first column to the 480th column in each row of the divided light emitting regions 110L, 110R of the display panel 110 (from the first column to the 480th column and from the 481st column to the 960th column in the serial number).

After this writing operation of the gradation signal is sequentially executed to the pixels PIX in each of all the rows of the display panel 110, the light emitting element (organic EL element OEL) provided on each pixel PIX emits light with the luminance gradation according to the gradation signal at a time, and as a result, the image information is displayed on the display panel 110. At this occasion, as shown in FIG. 21, the image information is displayed as the horizontally reversed image on the display panel 110.

(3) Vertically Reversed Display Mode

Figure 24:
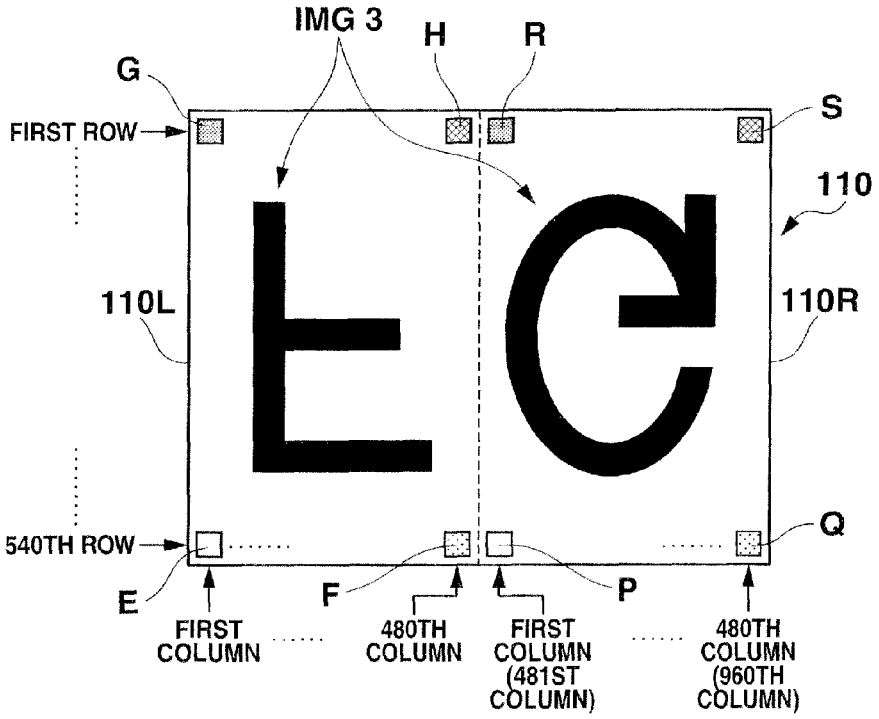
FIG. 24 is a figure illustrating a display form in a vertically reversed display mode, in which image information is displayed on the display panel in a vertically reversed manner during display drive operation performed by the display device according to the second embodiment.

FIG. 24 is a figure illustrating a display form in the vertically reversed display mode, in which image information is displayed on the display panel in a vertically reversed manner during display drive operation performed by the display device according to the present embodiment.

In FIG. 24, an IMG 3 is an example of image information displayed, in the vertically reversed display mode, in the display region of the display panel 110 on the basis of the same image data as that used in the normal display mode. The IMG 3 is a vertically reversed image obtained by vertically reversing the IMG 1 of FIG. 18.

As shown in FIG. 24, in the vertically reversed display mode, the display E based on the image data corresponding to the first row and the first column is displayed in the 540th row and the first column of the display panel 110 (the divided light emitting region 110L). The display F based on the image data corresponding to the first row and the 480th column is displayed at the position in the 540th row the 480th column of the display panel 110 (the divided light emitting region 110L). The display G based on the image data corresponding to the 540th row and the first column is displayed at the position in the first row the first column of the display panel 110 (the divided light emitting region 110L). The display H based on the image data corresponding to the 540th row and the 480th column is displayed at the position in the first row and the 480th column of the display panel 110 (the divided light emitting region 110L). The display P based on the image data corresponding to the first row and the 481st column is displayed at the position in the first row and the 480th column of the display panel 110 (the 540th row the first column in the divided light emitting region 110R). The display Q based on the image data corresponding to the first row and the 960th column is displayed at the posit in the 540th row and the 960th column of the display panel 110 (the 540th row and the 480th column in the divided light emitting region 110R). The display R based on the image data corresponding to the 540th row and the 481st column is displayed at the position in the first row and the 481st column of the display panel 110 (the first row and the first column in the divided light emitting region 110R). The display S based on the image data corresponding to the 540th row and the 960th column is displayed at the position in the first row and the 960th column of the display panel 110 (the first row and the 480th column in the divided light emitting region 110R).

Figure 25:
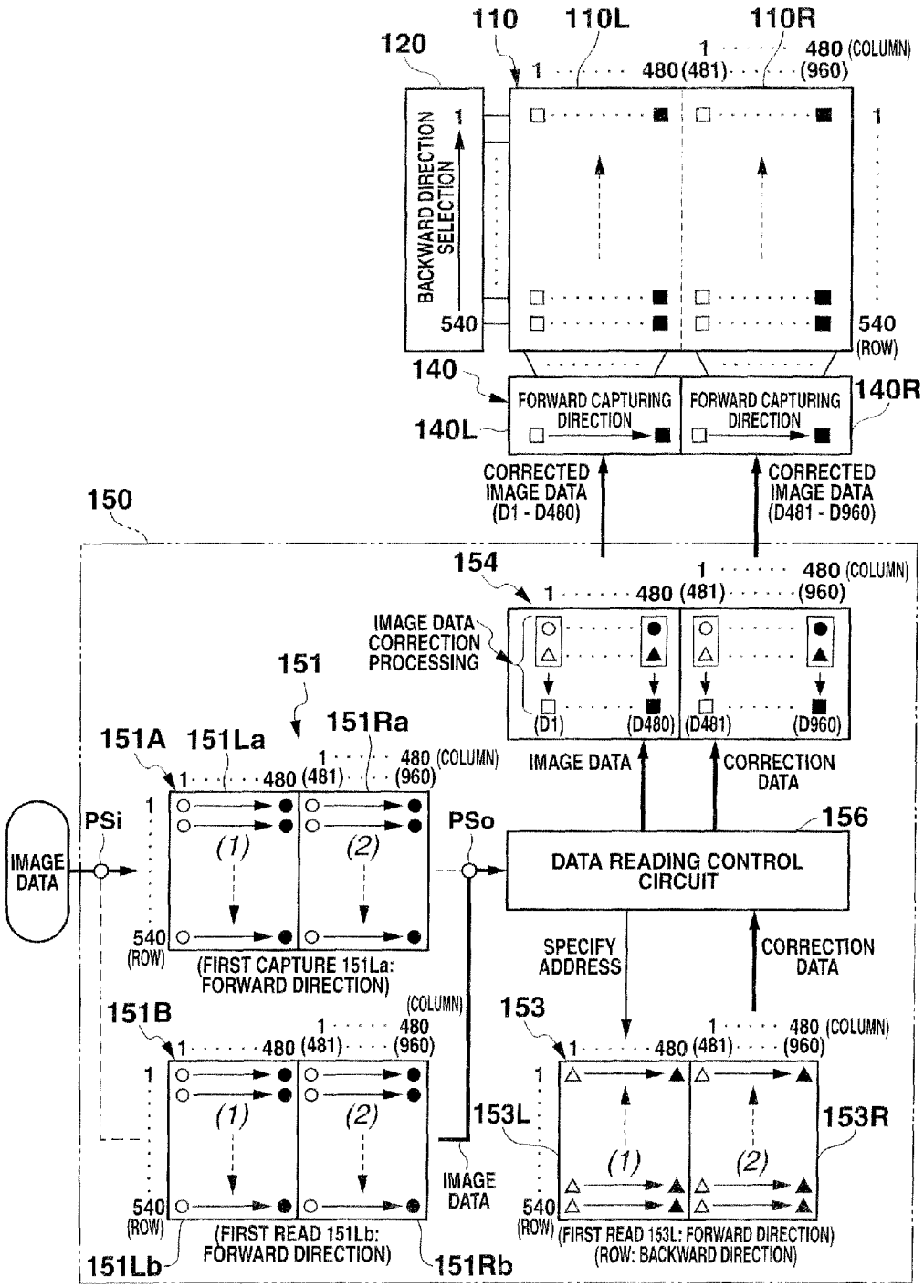
FIG. 25 is a schematic diagram illustrating a memory management method in the vertically reversed display mode performed by the display device according to the second embodiment.

FIG. 25 is a schematic diagram illustrating a memory management method in the vertically reversed display mode performed by the display device according to the present embodiment.

FIG. 26 is a schematic diagram illustrating relationship of addresses between each piece of image data and correction data used for correction processing, in the vertically reversed display mode in the display device according to the present embodiment.

Description about the same configuration, method, and concept as those of the above normal display mode and the horizontally reversed display mode is simplified.

In the vertically reversed display mode, the following series of operations are executed by the controller 150.

First, like the normal display mode explained above, at the system activation of the display device 100, the correction data corresponding to each pixel PIX for one screen arranged in the display panel 110 are transferred from the correction data storage circuit 152 to the first correction data memory circuit 153L and the second correction data memory circuit 153R of the correction data memory circuit 153 in advance, and the correction data are temporarily stored in the first correction data memory circuit 153L and the second correction data memory circuit 153R.

Subsequently, as shown in FIG. 25, like the above normal display mode, the image data holding circuit 151 executes, in parallel, the operation of sequentially capturing the image data supplied from the display signal generation circuit 160 into one of the two memory circuits 151A, 151B via the switch contact point PSi and the operation of sequentially reading the image data held in the other of the memory circuits 151A, 151B via the switch contact point PSo to supply the image data to the image data correction circuit 154 in units of rows.

The image data holding circuit 151 causes the FIFO memories 151La and 151Ra or FIFO memories 151Lb and 151Rb constituting the memory circuits 151A, 151B to visually operate as if they make a continuous, integrated memory region. That is, operation of sequentially capturing and holding the image data continuous in the direction extending from the first column to the 480th column, i.e., the last column, the FIFO memory 151La and subsequently from the first column to the 480th column, i.e., the last column, of the FIFO memory 151Ra (from the 481st column to the 960th column in the serial number) (forward direction) is repeated in each row from the first row to the 540th row, i.e., the last row, in the forward direction, and the image data for one screen are held in any one of the two memory circuits 151A, 151B.

In parallel with the capturing operation of the image data, the image data holding circuit 151 reads the image data held in the other of the memory circuits 151A, 151B in the same order and the same direction as those of the above capturing operation of the image data (see arrows and circled numbers shown in the image data holding circuit 151 in FIG. 25).

On the other hand, as shown in FIG. 25, the correction data corresponding to pixels PIX, to which the image data corresponding to one row is supplied, captured into the image data correction circuit 154 via the image data holding circuit 151, among the correction data stored in the first correction data memory circuit 153L and the second correction data memory circuit 153R of the correction data memory circuit 153, are sequentially read, and the correction data are supplied to image data correction circuit 154.

The correction data memory circuit 153 causes the first and second correction data memory circuits 153L, 153R constituting the correction data memory circuit 153 to visually operate as if they make a continuous, integrated memory region. That is, operation of sequentially reading the correction data in the direction extending from the first column to the 480th column, i.e., the last column, (forward direction; first reading order) in the 540th row, i.e., the last row, of the first correction data memory circuit 153L and subsequently sequentially reading the correction data in the direction extending from the first column to the 480th column, i.e., the last column, (from the 481st column to the 960th column in the serial number) in the 540th row, i.e., the last row, of the second correction data memory circuit 153R (forward direction; first reading order) is sequentially repeated in the direction extending from the 540th row, i.e., the last row, to the first row (backward direction) (see arrows and circled numbers shown in the correction data memory circuit 153 in FIG. 25).

Subsequently, the image data correction circuit 154 corrects the image data captured via the image data holding circuit 151, on the basis oaf the correction data according to the characteristic of each pixel. PIX of the display panel 110 that are supplied from the correction data memory circuit 153.

As shown in the image data correction circuit 154 in FIG. 25 and as schematically shown in FIG. 26, the correction processing of the image data correction circuit 154 is executed by performing calculation on each pieces of image data corresponding to each column position from the first column to the 480th column and from the 481st column to the 960th column in each row from the first row to the 540th row (see addresses of the image data in FIG. 26), on the basis of a predetermined correction expression using each pieces of correction data corresponding to each pixel PIX from the first column to the 480th column and from the 481st column to the 960th column in each row from the 540th row to the first row of the display panel 110 (see addresses of the correction data in FIG. 26).

Subsequently, the corrected image data (corrected image data D1 to D960) are transferred, pixel by pixel, to the data drivers 140L, 140R via the driver transfer circuit 155 in units of rows.

At this occasion, the corrected image data D1 to D960 transferred via the driver transfer circuit 155 are sequentially captured as follows. The corrected image data D1 to D480 are sequentially captured, pixel by pixel, in the direction extending from the first column to the 480th column of the divided light emitting region 110L (forward direction; first capturing order) in the data driver 140L, and the corrected image data D481 to D960 are sequentially captured, pixel by pixel, in the direction extending from the first column to the 480th column of the divided light emitting region 110R (from the 481st column to the 960th column in the serial number) (forward direction; first capturing order) in the data driver 140R (see arrows shown in the data drivers 140L, 140R in FIG. 25).

Subsequently, the selection driver 120 sequentially applies the selection signal Ssel at the selective level to the selection lines Ls in the order from the 540th row, i.e., the last row, to the first row (backward direction; second scanning direction), and sets the pixel PIX in each row to the selective state in order.

Then, in synchronization with the timing when the pixel PIX in each row is set in the selective state, the data drivers 140L, 140R apply the gradation signal (gradation voltage Vdata) based on the captured corrected image data D1 to D960 corresponding to one row (from the first to the 480th columns and from the 481st to the 960th columns in the serial number) to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the vertically reversed display mode, as shown in the image data correction circuit 154, the data drivers 140L, 140R, and the display panel 110 in FIG. 25 and as schematically shown in FIG. 26, each gradation signal based on the corrected image data D1 to D960 obtained by correcting the image data corresponding to each column position from the first column to the 960th column in each row from the first row to the 540th row of the image information (see addresses of the image data in FIG. 26) using the correction data corresponding to each pixel PIX from the first column to the 960th column in each row from the 540th row to the first row of the display panel 110 (see addresses of the correction data in FIG. 26) is written to each pixel PIX from the first column to the 480th column in each row from the 540th row to the first row of the divided light emitting regions 110L, 110R of the display panel 110 (from the first column to the 480th column and from the 481st column to the 960th column in the serial number).

After this writing operation of the gradation signal is sequentially executed to the pixels PIX in each of all the rows of the display panel 110, the light, emitting element (organic EL element (DEL) provided on each pixel PIX emits light with the luminance gradation according to the gradation signal at a time, and as a result, the image information is displayed on the display panel 110. At this occasion, as shown in FIG. 24, the image information is displayed as the vertically reversed image on the display panel 110.

(4) Horizontally and Vertically Reversed Display Mode

Figure 27:
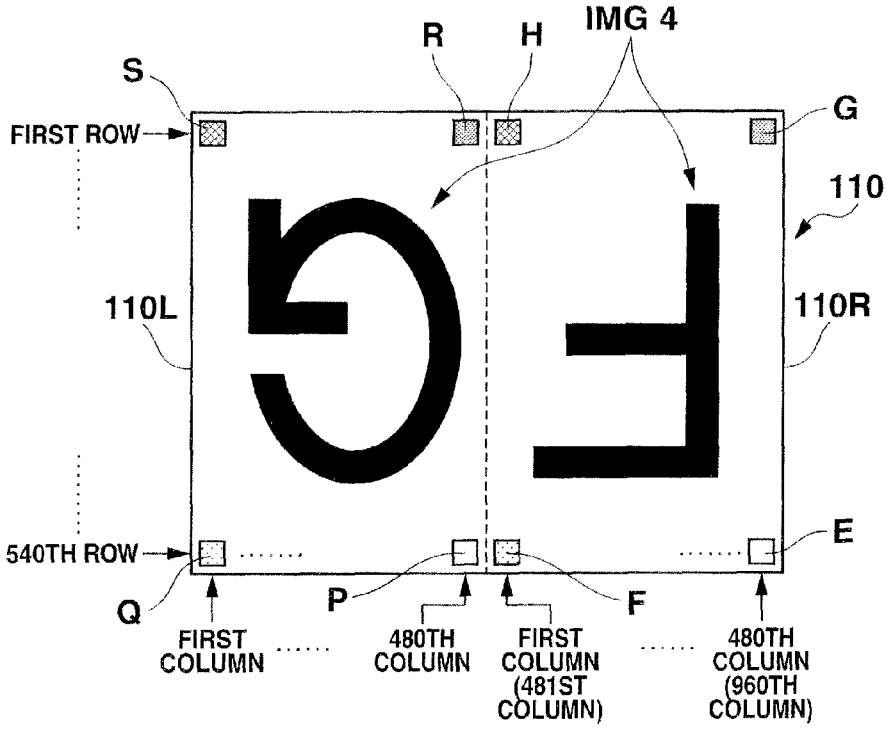
FIG. 27 is a figure illustrating a display form in a horizontally and vertically reversed display mode, in which image information is displayed on the display panel in a horizontally and vertically reversed manner during display drive operation performed by the display device according to the second embodiment.

FIG. 27 is a figure illustrating a display form in the horizontally and vertically reversed display mode, in which image information is displayed on the display panel in a horizontally and vertically reversed manner during display drive operation performed by the display device according to the present embodiment.

In FIG. 27, an INC 4 is an example of image information displayed, in the horizontally and vertically reversed display mode, in the display region of the display panel 110 on the basis of the same image data as that used in the normal display mode. The IMG 4 is a horizontally and vertically reversed image obtained by horizontally and vertically reversing the IMG 1 of FIG. 18.

As shown in FIG. 27, in the horizontally and vertically reversed display mode, the display E based on the image data corresponding to the first row and the first column is displayed in the 540th row and the 960th column of the display panel 110 (the 540th row and the 480th column in the divided light emitting region 110R).

The display F based on the image data corresponding to the first row and the 480th column is displayed at the position in the 540th row and the 481st column of the display panel 110 (the 540th row and the first column in the divided light emitting region 110R).

The display G based on the image data corresponding to the 540th row and the first column is displayed at the position in the first row and the 960th column of the display panel 110 (the first row and the 480th column in the divided light emitting region 110R).

The display H based on the image data corresponding to the 540th row and the 480th column is displayed at the position in the first row and the 481st column of the display panel 110 (the first row and the first column in the divided light emitting region 110R).

The display P based on the image data corresponding to the first row and the 481st column is displayed at the position in the 540th row and the 480th column of the display panel 110 (the divided light emitting region 110L).

The display Q based on the image data corresponding to the first row and the 960th column is displayed at the position in the 540th row and the first column of the display panel 110 (the divided light emitting region 110L). The display R based on the image data corresponding to the 540th row and the 481st column is displayed at the position in the first row and the 480th column of the display panel 110 (the divided light emitting region 110L).

The display S based on the image data corresponding to the 540th row and the 960th column is displayed at the position in the first row and the first column of the display panel 110 (the divided light emitting region 110L).

Figure 28:
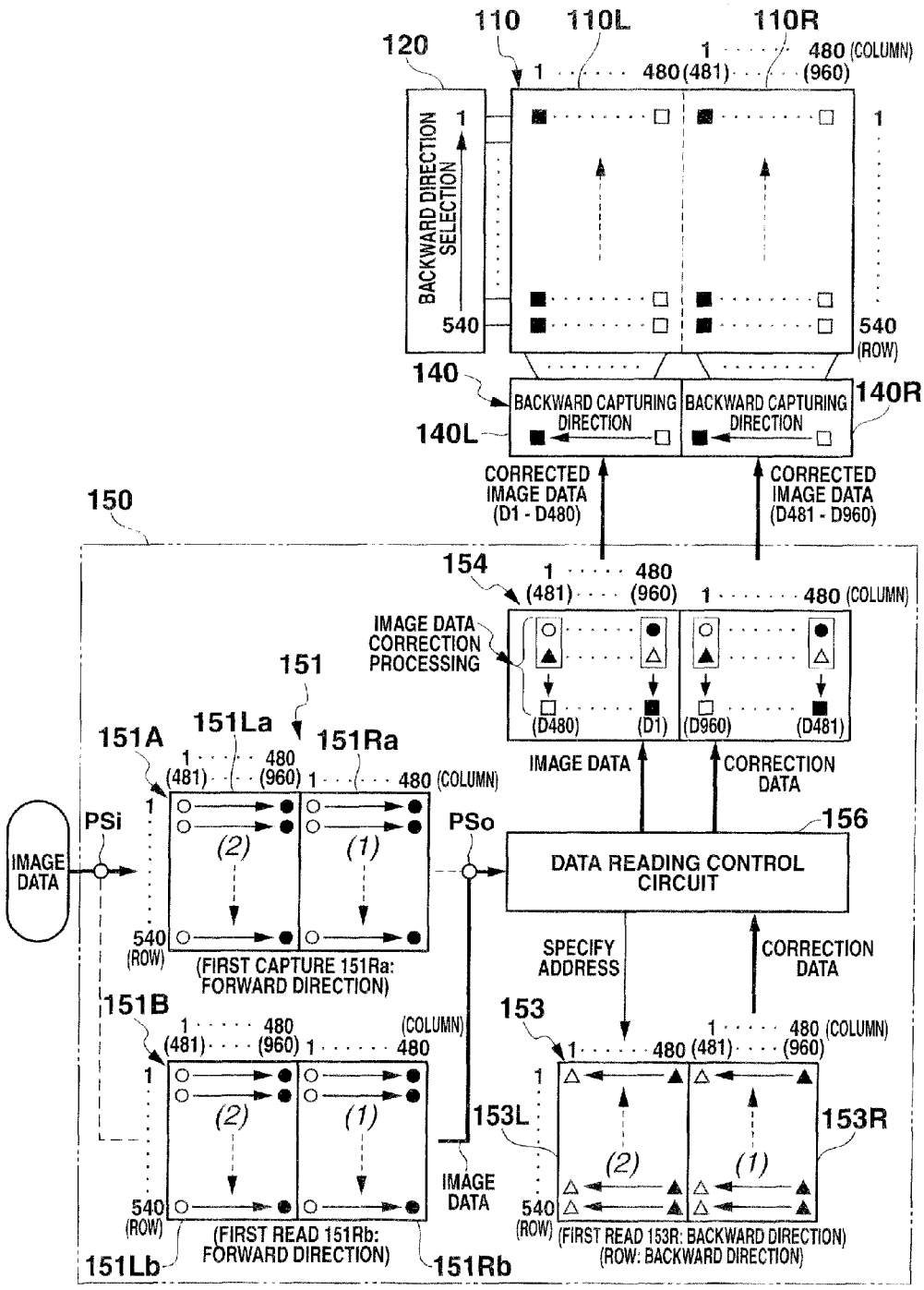
FIG. 28 is a schematic diagram illustrating a memory management method in the horizontally and vertically reversed display mode performed by the display device according to the second embodiment.

FIG. 28 is a schematic diagram illustrating a memory management method in the horizontally and vertically reversed display mode performed by the display device according to the present embodiment.

FIG. 29 is a schematic diagram illustrating relationship of addresses between each piece of image data and correction data used for correction processing, in the horizontally and vertically reversed display mode in the display device according to the present embodiment.

Description about the same configuration, method, and concept as those of the above normal display mode, the horizontally reversed display mode, and the vertically reversed display mode is simplified.

In the horizontally and vertically reversed display mode, the following series of operations are executed by the controller 150.

First, like the normal display mode explained above, at the system activation of the display device 100, the correction data corresponding to each pixel PIX for one screen arranged in the display panel 110 are transferred from the correction data storage circuit 152 to the first correction data memory circuit 153L and the second correction data memory circuit 153R of the correction data memory circuit 153 in advance, and the correction data are temporarily stored in the first correction data memory circuit 153L and the second correction data memory circuit 153R.

Subsequently, as shown in FIG. 28, like the above horizontally reversed display mode, the image, data holding circuit 151 executes, in parallel, the operation of sequentially capturing the image data supplied from the display signal generation circuit 160 into one of the two memory circuits 151A, 151B via the switch contact point PSi and the operation of sequentially reading the image data held in the other of the memory circuits 151A, 151B via the switch contact point PSo to supply the image data to the image data correction circuit 154 in units of rows.

The image data holding circuit 151 causes the FIFO memories 151La and 151Ra or FIFO memories 151Lb and 151Rb constituting the memory circuits 151A, 151B to operate as separate memory regions. That is, operation of dividing, capturing, and holding the image data continuous in the direction extending from the first column to the 480th column, i.e., the last column, of the FIFO memory 151Ra and subsequently from the first column to the 480th column, i.e., the last column, of the FIFO memory 151La (from the 481st column to the 960th column in the serial number) (forward direction) is repeated in each row from the first row to the 540th row, i.e., the last row, in the forward direction, and the image data for one screen are held in any one of the two memory circuits 151A, 151B.

In parallel with the capturing operation of the image data, the image data holding circuit 151 reads the image data held in the other of the memory circuits 151A, 151B in the same order and the same direction as those of the above capturing operation of the image data (see arrows and circled numbers shown in the image data holding circuit 151 in FIG. 28).

On the other hand, as shown in FIG. 28, the correction data corresponding to pixels PIX, to which the image data corresponding to one row is supplied, captured into the image data correction circuit 154 via the image data holding circuit 151, among the correction data stored in the first correction data memory circuit 133L and the second correction data memory circuit 153R of the correction data memory circuit 153, are sequentially read, and the correction data are supplied to image data correction circuit 154.

The correction data memory circuit 153 causes the first and second correction data memory circuits 153L, 153R constituting the correction data memory circuit 153 to operate as separate memory regions in the horizontally and vertically reversed display mode. That is, operation of sequentially reading the correction data in the direction extending from the 480th column, i.e., the last column, to the first column (from the 960th column to the 481st column in the serial number) (backward direction; second reading order) in the 540th row, i.e., the last row, of the second correction data memory circuit 153R and subsequently sequentially reading the correction data in the direction extending from the 480th column, i.e., the last column, to the first column in the 540th row, i.e., the last row, of the first correction data memory circuit 153L (backward direction; second reading order) is sequentially repeated in the direction extending from the 540th row, i.e., the last row, to the first row, (backward direction) (see arrows and circled numbers shown in the correction data memory circuit 153 in FIG. 28).

Subsequently, the image data correction circuit 154 sequentially corrects the image data captured via the image data holding circuit 151, on the basis of the correction data according to the characteristic of each pixel PIX of the display panel 110 that are supplied from the correction data memory circuit 153.

As shown in the image data correction circuit 154 in FIG. 28 and as schematically shown in FIG. 29, the correction processing of the image data correction circuit 154 is executed by performing calculation on each pieces of image data corresponding to each column position from the first column to the 480th column and from the 481st column to the 960th column in each row from the first row to the 540th row (see addresses of the image data in FIG. 29), on the basis of a predetermined correction expression using each pieces of correction data corresponding to each pixel PIX from the 960th column to the 481st column and the 480th column to the first column in each row from the 540th row to the first row of the display panel 110 (see addresses of the correction data in FIG. 29).

Subsequently, the corrected image data (corrected image data D1 to D960) are transferred, pixel by pixel, to the data drivers 140L, 140R via the driver transfer circuit 155 in units of rows.

In the horizontally and vertically reversed display mode, the data drivers 140L, 140R set the capturing direction of the corrected image data D1 to D960 to the backward direction on the basis of the data control signal (scan switching signal) supplied from the controller 150.

Accordingly, the corrected image data D1 to D960 transferred via the driver transfer circuit 155 are sequentially captured as follows. The corrected image data D480 to D1 corresponding to the pixels PIX from the first column to the 480th column arranged in the divided light emitting region 110L of the display panel 110 are sequentially captured, pixel by pixel, in the direction extending from the 480th column to the first column of the divided light emitting region 110L in the data driver 140L (backward direction; second capturing order), and the corrected image data D960 to D481 corresponding to the pixels PIX from the first column to the 480th column arranged in the divided light emitting region 110R (from the 481st column to the 960th column in the serial number) are sequentially captured, pixel by pixel, in the direction extending from the 480th column to the first column of the divided light emitting region 110R in the data driver 140R (from the 960th column to the 481st column in the serial number) (backward direction; second capturing order) (see arrows shown in the data drivers 140L, 140R in FIG. 28).

Subsequently, the selection driver 120 sequentially applies the selection signal Ssel at the selective level to the selection lines Ls in the order from the 540th row, i.e., the last row, to the first row (backward direction; second scanning direction), and sets the pixel PIX in each row to the selective state in order.

Then, in synchronization with the timing when the pixel PIX in each row is set in the selective state, the data drivers 140L, 140R apply the gradation signal (gradation voltage Vdata) based on the captured corrected image data D1 to D960 corresponding to one row (from the 480 to the first columns and the 960th to the 481st columns in the serial number) to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the horizontally and vertically reversed display mode, as shown in the image data correction circuit 154, the data drivers 140L, 140R, and the display panel 110 in FIG. 28 and as schematically shown in FIG. 29, each gradation signal based on the corrected image data D1 to D960 obtained by correcting the image data corresponding to each column position from the 960th column to the first column in each row from the first row to the 540th row of the image information (see addresses of the image data in FIG. 29) using the correction data corresponding to each pixel PIX from the first column to the 960th column in each row from the 540th row to the first row of the display panel 110 (see addresses of the correction data in FIG. 26) is written to each pixel PIX from the first column to the 480th column in each row from the 540th row to the first row of the divided light emitting regions 110L, 110R of the display panel 110 (from the first column to the 480th column and from the 481st column to the 960th column in the serial number).

After this writing operation of the gradation signal is sequentially executed to the pixels PIX in each of all the rows of the display panel 110, the light emitting element (organic EL element OEL) provided on each pixel PIX emits light with the luminance gradation according to the gradation signal at a time, and as a result, the image information is displayed on the display panel 110. At this occasion, as shown in FIG. 27, the image information is displayed as the horizontally and vertically reversed image on the display panel 110.

Like the above first embodiment, as described above, according to the display device 100 of the present embodiment, the memory management method can be achieved in which the correction data according to the a characteristic of each pixel PIX of the display panel 110 can be appropriately read/written to/from the memory circuit in accordance with various display forms (normal display and various kinds of reversed display S based on image information) with a simple and inexpensive device configuration.

In the present embodiment, the display panel 110 is divided into the two divided light emitting regions 110L, 110R, and the data drivers 140L, 140R which are driven at the same time are separately provided for the divided light emitting regions 110L, 110R, respectively, so that the data transfer speed can be reduced when the corrected image data D1 to D960 supplied from the controller 150 are captured. This allows a higher degree of flexibility in timing control of the drive control operation of the display device and reduced product cost of the display device when an inexpensive data driver is applied.

In the present embodiment, for the sake of explanation, the divided light emitting regions 110L, 110R which are made by equally dividing the display panel 110 into two parts has been explained for the sake of convenience. However, the present invention is not limited thereto. The display device according to the present invention may be configured such that, for example, a display panel 110 having pixels PIX in 960 columns which is the same number of columns as the above case may a divided light emitting region 110L having pixels arranged therein in 381 columns and divided light emitting region 110R having pixels arranged therein in 576 columns. In other words, the divided light emitting regions 110L, 110R may be unevenly divided. Further, the display panel 110 may be divided into two or more divided light emitting regions.

In this configuration, the number of columns for the pixels PIX arranged in each divided light emitting region set by dividing the display panel 110 can be set to any number. Therefore, the display device according to the present embodiment can be achieved simply and inexpensively by providing the same number columns as the number of output terminals of an existing (or general-purpose) data driver.

Third Embodiment

Subsequently, a third embodiment of a display device according to the present invention will be explained with reference to the drawings.

In the display device according to the present embodiment, the method for storing the correction data in the controller is different from the method for storing the correction data in the above second embodiment. Other than this difference, the display device according to the present embodiment has the same configuration as the display device according to the second embodiment explained above. In this explanation, description about the same configuration and control method as those of the second embodiment is omitted or simplified.

Figure 30:
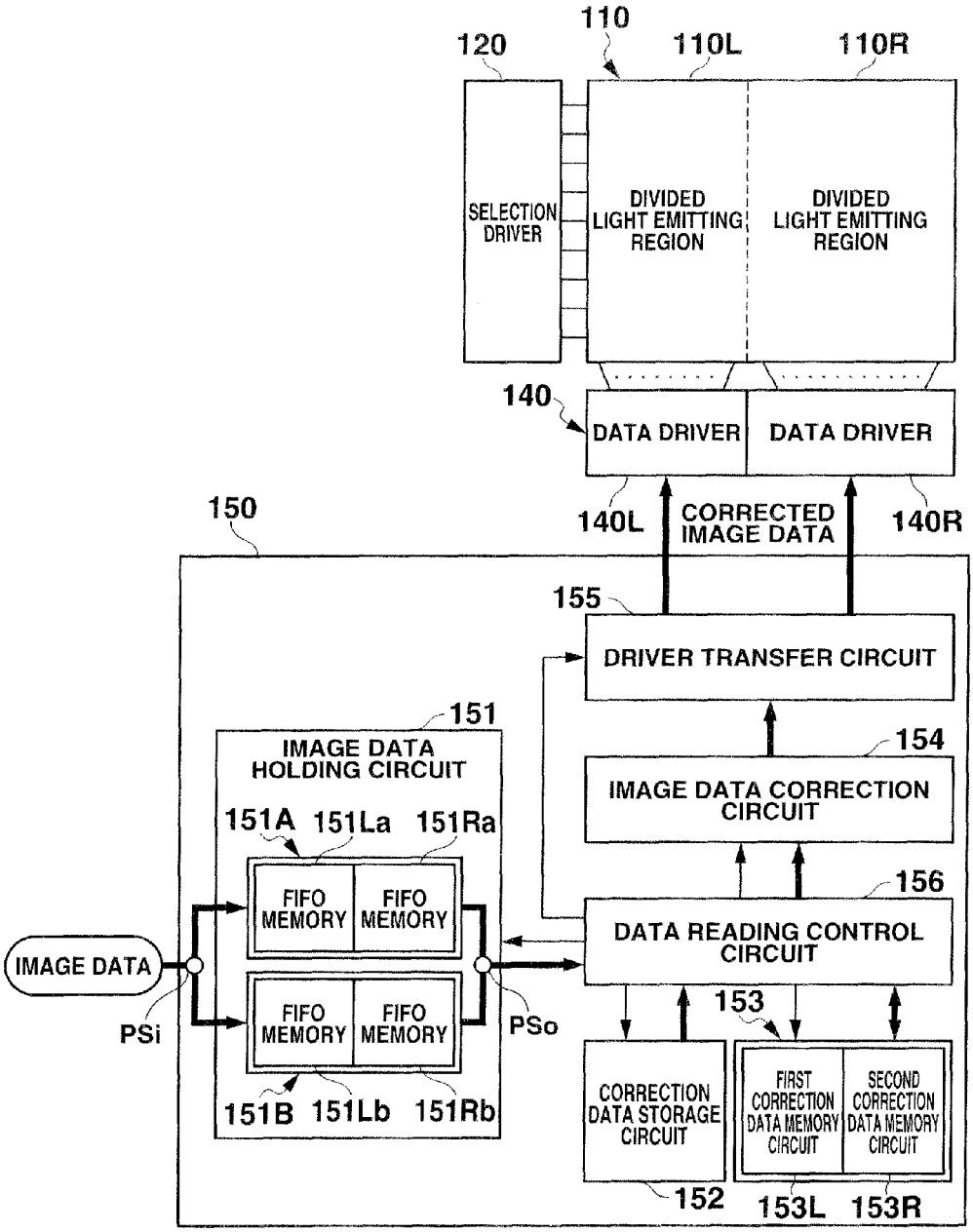
FIG. 30 is a schematic block diagram illustrating a third embodiment of a display device according to the present invention.

FIG. 30 is a schematic block diagram illustrating the third embodiment of the display device according to the present invention.

FIG. 30 shows a configuration for achieving the image data correction function and the memory management function of the controller applied to the display device according to the third embodiment.

The controller 150 includes an image data holding circuit 151, a correction data storage circuit 152, a correction data memory circuit 153, an image data correction circuit 154, a driver transfer circuit 155, and a data reading control circuit 156.

As shown in FIG. 30, in the display panel 110, a light emitting region in which a plurality of pixels PIX are arranged two-dimensionally is divided into two parts in the row direction, for example. Accordingly, the divided light emitting region 110L at the left side of the figure and the divided light emitting region 110R at the right side of the figure are set.

In the image data holding circuit 151, a memory circuit 151A having FIFO (First-In/First-Out) memories 151La, 151Ra and a memory circuit 151B having FIFO memories 151Lb, 151Rb are connected in parallel so as to correspond to the divided light emitting regions 110L, 110R divided and set in the above display panel 110, and the memory circuits 151A, 151B have memory regions corresponding to pixels PIX for one screen of the image information.

A switch contact point PSi is commonly provided at the input side of each of the memory circuits 151A, 151B, and a switch contact point PSo is commonly provided at the output side thereof.

Accordingly, operation of sequentially capturing the image data supplied as serial data from the display signal generation circuit 160 into one of the memory circuits 151A, 151B via the switch contact point PSi to hold one screen of image data and operation of sequentially reading the image data held in the memory circuits 151A, 151B in the other side via the switch contact point PSo to provide the image data to the later-explained image data correction circuit 154 are executed in parallel.

The above operation is alternately, repeatedly executed by the two memory circuits 151A, 151B, so that the image data are continuously captured screen by screen.

In the image data holding circuit 151 according to the present embodiment, when the image data are captured and held, the FIFO memories 151La and 151Ra or FIFO memories 151Lb and 151Rb constituting the memory circuits 151A, 151B are controlled and switched into a state for operating as separate memory regions and a state for operating as if they make a continuous, integrated memory region, visually, in accordance with the display form (display pattern) of the image information.

The read image data read from the image data holding circuit 151 are supplied to the image data correction circuit 154 via the data reading control circuit 156 in units of rows.

As described above, in the present embodiment, the image data holding circuit 151 includes two (or a plurality of) memory circuits 151A (FIFO memories 151La, 151Ra), 151B (FIFO memories 151Lb, 151Rb), which are connected in parallel.

Accordingly, in the present embodiment, the operation of capturing and holding the image data into one of the memory circuits 151A, 151B and the operation of sequentially reading the image data held in the other side can be executed in parallel, and the present embodiment can well support fast display driving, e.g., double speed display operation of image information (in particular, a motion picture).

The correction data storage circuit 152 has a nonvolatile memory, and for example, before the display drive operation of the display device 100, a plurality of types of correction data according to the characteristic of each pixel PIX arranged in the display panel 110 are obtained in advance, and the correction data are stored separately.

The method for acquiring correction data will be explained later.

In the correction data memory circuit 153, a first correction data memory circuit 153L and a second correction data memory circuit 153R having volatile memories are provided so as to correspond to the divided light emitting regions 110L, 110R divided and set in the above display panel 110.

In the correction data memory circuit 153, all or some of the plurality of types of correction data according to the characteristics of the pixels PIX arranged in the display panel 110 that are stored in the correction data storage circuit 152 are read, and are divided and captured into the memory regions of the first and second correction data memory circuits 153L, 153R.

When the correction data according to the characteristics of the pixels PIX arranged in the display panel 110 that are stored in the correction data storage circuit 152 are read and temporarily stored in the correction data memory circuit 153 according to the present embodiment (first and second correction data memory circuits 153L, 153R), the plurality of types of correction data corresponding to the pixels PIX are divided and held at a plurality of common addresses of the first and second correction data memory circuits 153L, 153R on the basis of a method for storing the correction data explained later.

On the other hand, when the correction data corresponding to the pixels PIX to which the image data captured via the image data holding circuit 151 are supplied are read, a common address of the first and second correction data memory circuits 153L, 153R is specified on the basis of a method for reading the correction data explained later in accordance with the display form (display pattern) of the image information, and operation of reading the correction data corresponding to the pixels PIX in the same column in each of the divided light emitting regions 110L and 110R is sequentially executed.

The read correction data are supplied to the image data correction circuit 154 via the data reading control circuit 156, explained later, in units of rows.

A method for reading the plurality of types of correction data according to the characteristic of each pixel PIX temporarily saved in the first and second correction data memory circuits 153L, 153R at a fast speed supporting, e.g., double speed display operation will be explained in detail when a driving control method (display drive method) of the display device is explained later.

Alternatively, the correction data storage circuit 152 may not be provided, and for example, the first and second correction data memory circuits 153L, 153R may have nonvolatile memories, so that the obtained correction data are directly saved to the first and second correction data memory circuits 153L, 153R.

The image data correction circuit 154 generates corrected image data obtained by correcting the image data of the serial data captured via the image data holding circuit 151 using the plurality of types of correction data according to the characteristic of each pixel PIX of the divided light emitting regions 110L and 110R of the display panel 110 that are read from the first and second correction data memory circuits 153L, 153R of the correction data memory circuit 153. The method for correcting the image data will be explained later.

In this case, in the image data correction circuit 154 according to the present embodiment, the image data sequentially read in a predetermined order from the FIFO memories 151La and 151Ra or the FIFO memories 151Lb and 151Rb constituting the memory circuits 151A, 151B of the above image data holding circuit 151 in accordance with the display form (display pattern) of the image information are captured in units of rows.

In the image data correction circuit 154, the correction data sequentially read for the divided light emitting regions 110L and 100R in a predetermined order from the above first and second correction data memory circuits 153L, 153R in accordance with the display form (display pattern) of the image information are sequentially captured in units of rows.

The correction processing is sequentially executed, pixel by pixel, for each of the divided light emitting regions 110L and 110R, on each piece of the image data, on the basis of the correction data associated in accordance with the display form of the image information.

The driver transfer circuit 155 transfers the image data (corrected image data D1 to Dq) generated and corrected by the image data correction circuit 154 to the data drivers 140L, 140R constituting the data driver 140 at a predetermined timing at a time.

The corrected image data D1 to Dq are output from the driver transfer circuit 155 as serial data for each row, and are sequentially captured and held in a predetermined order by the data drivers 140L, 140R.

The data reading control circuit 156 controls operations, i.e., the capturing operation of the image data in the memory circuits 151A, 151B of the image data holding circuit 151, the reading/writing (writing, reading) operation of the correction data in the correction data storage circuit 152 and the correction data memory circuit 153 (first and second correction data memory circuits 153L, 153R), the correction processing of the image data in the image data correction circuit 154 explained later, and the transfer processing of the corrected image data to the data driver 140 (data drivers 140L, 140R) in the driver transfer circuit 155.

Specific operation control in the data reading control circuit 156 will be explained later.

Like the above first and second embodiments, in FIG. 30, the image data read from the image data holding circuit 151 and transmitted to the image data correction circuit 154, the correction data read from the correction data storage circuit 152 and written to the correction data memory circuit 153, and the correction data read from the correction data memory circuit 153 are configured to be sent by way of the data reading control circuit 156. However, the present invention is not limited to this configuration.

Alternatively, the image data may be configured to be directly transmitted to the image data correction circuit 154. The correction data may directly be written from the correction data storage circuit 152 to the correction data memory circuit 153. The correction data read from the correction data memory circuit 153 may directly be transmitted to the image data correction circuit 154.

(Display Drive Method)

Subsequently, the display drive method for each display form (display pattern) of image information in the display device according to the present embodiment will be explained with reference to the drawings.

Like the above first and second embodiments, the display form includes (1) a normal display mode for displaying image information based on a video signal as an ordinary image, (2) a horizontally reversed display mode in which image information is displayed upon reversed horizontally, (3) a vertically reversed display mode in which image information is displayed upon reversed vertically, and (4) a horizontally and vertically reversed display mode in which image information is displayed upon reversed horizontally and vertically.

In this case, the memory management method with the controller 150 will mainly be explained.

Now, it is assumed that 960×540 pixels PIX are arranged in a matrix form in a row direction and a column direction in the light emitting region (display region) of the display panel 110.

It is assumed that the plurality of pixels PIN arranged in the display panel 110 are divided into in the horizontal direction of FIG. 30, and the pixels PIX in the first to 384th columns are arranged at the side of the divided light emitting region (the divided display region) 110L (left side) and the pixels PIX in the 385th to 960th columns are arranged at the side of the divided light emitting region (the divided display region) 110R (right side).

In accordance with the above configuration, it is assumed that the FIFO memories 151La, 151Ra and 151Lb, 151Rb constituting the memory circuits 151A, 152B, the first and second correction data memory circuits 153L, 153R constituting the correction data memory circuit 153, and the data drivers 140L, 140R constituting the data driver 140 respectively have memory regions or data holding circuits corresponding to the 384 pixels at the side of the divided light emitting region 110L and 576 pixels at the side of the divided light emitting region 110R.

It is also assumed that the image data are provided as a form corresponding to the matrix of 960 columns×540 rows of the display panel 110.

In the present embodiment, for the sake of explanation, the divided light emitting regions 110L, 110R which are made by dividing the display panel 110 into two parts with any given ratio (unevenly) for the sake of convenience will be explained. However, the present invention is not limited to this configuration. The display device according to the present invention may be configured such that the display panel 110 is equally divided into two parts so that, e.g., in the display panel 110 arranged with the pixels PIX in 960 columns, the number of columns in which the pixels PIX are arranged in the divided light emitting region 110L and the number of columns in which the pixels PIX are arranged in the divided light emitting region 110R are the same, e.g., 480 columns. The display panel 110 may be divided into three or more divided light emitting regions in an even or uneven manner.

The number of divided parts of the display panel 110 and the number of columns included in each divided light emitting region may be the number of columns corresponding to the same number of columns as the number of output terminals of an existing (or general-purpose) data driver. In this configuration, the display device according to the present embodiment can be achieved simply and inexpensively by using the existing (or general-purpose) data driver.

(1) Normal Display Mode

Figure 31:
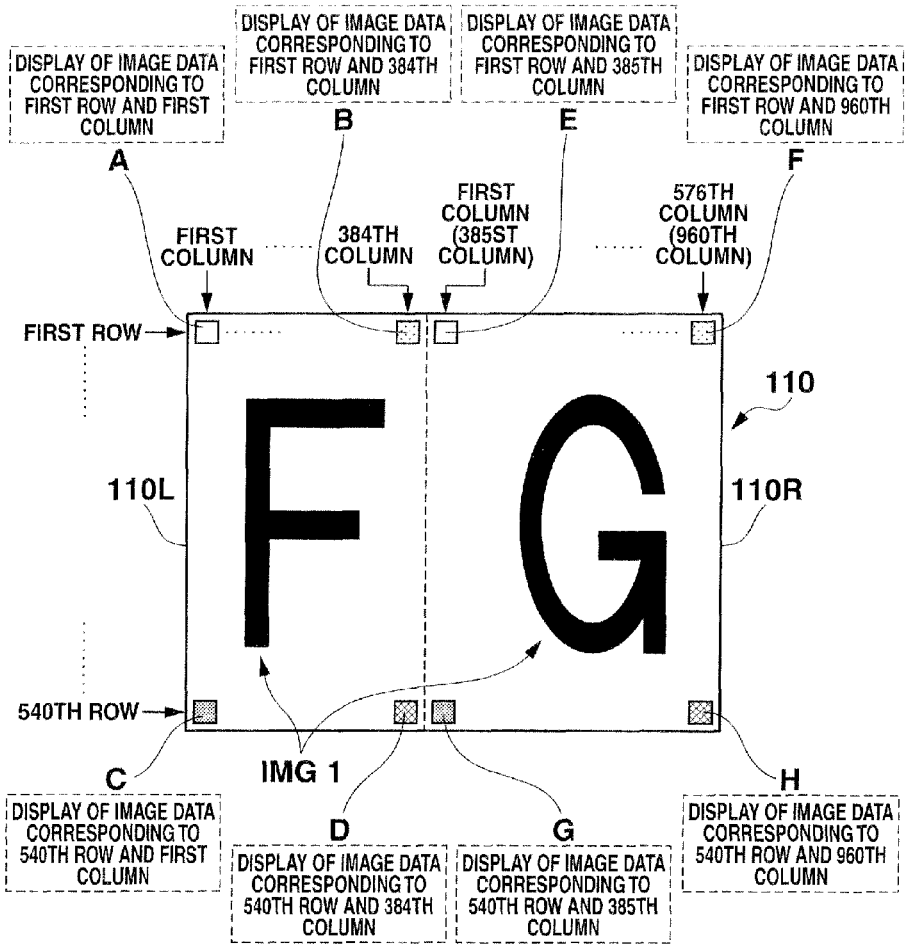
FIG. 31 is a figure illustrating a display form in a normal display mode, in which image information is displayed on the display panel in a normal manner during display drive operation performed by a display device according to the third embodiment.

FIG. 31 is a figure illustrating a display form in the normal display mode, in which image information is displayed on the display panel in a normal manner during display drive operation performed by a display device according to the present embodiment.

In FIG. 31, an IMG 1 is an example of image information displayed in the display region of the display panel 110 on the basis of image data in the normal display mode. It is assumed that the image information is the same image information as that shown in FIG. 31, and in the normal display mode, it is displayed as an ordinary image.

In FIG. 31, reference symbol A denotes a display of the image data corresponding to the first row and the first column of the display panel 110 (the divided light, emitting region 110L).

Reference symbol B denotes a display of the image data corresponding to the first row and the 384th column. Reference symbol C denotes a display of the image data corresponding to the 540th row and the first column.

Reference symbol D denotes a display of the image data corresponding to the 540th row and the 384th column. Reference symbol E denotes a display of the image data corresponding to the first row and the 385th column of the display panel 110 (the first row and the first column in the divided light emitting region 110R).

Reference symbol F denotes a display of the image data corresponding to the first row and the 960th column (the first row and the 576th column in the divided light emitting region 110R).

Reference symbol G denotes a display of the image data corresponding to the 540th row and the 385th column (the 540th row and the first column in the divided light emitting region 110R).

Reference symbol H denotes a display of the image data corresponding to the 540th row and the 960th column (the 540th row and the 576th column in the divided light emitting region 110R).

As shown in FIG. 31, in the normal display mode, the display A based on the image data corresponding to the first row and the first column is displayed in the first row and the first column of the display panel 110 (the divided light emitting region 110L).

The display B based on the image data corresponding to the first row and the 384th column is displayed at the position in the first row and the 384th column of the display panel 110 (the divided light emitting region 110L).

The display C based on the image data corresponding to the 540th row and the first column is displayed at the position in the 540th row and the first column of the display panel 110 (the divided light emitting region 110L).

The display D based on the image data corresponding to the 540th row and the 384th column is displayed at the position in the 540th row and the 384th column of the display panel 110 (the divided light emitting region 110L).

The display E based on the image data corresponding to the first row and the 385th column is displayed in the first row and the 385th column of the display panel 110 (the first row and the first column in the divided light emitting region 110R).

The display F based on the image data corresponding to the first row and the 960th column is displayed at the position in the first row and the 960th column of the display panel 110 (the first row and the 576th column in the divided light emitting region 110R).

The display G based on the image data corresponding to the 540th row and the 385th column is displayed at the position in the 540th row and the 385th column of the display panel 110 (the 540th row and the first column in the divided light emitting region 110R).

The display H based on the image data corresponding to the 540th row and the 960th column is displayed at the position in the 540th row and the 960th column of the display panel 110 (the 540th row and the 576th column in the divided light emitting region 110R).

Figure 32:
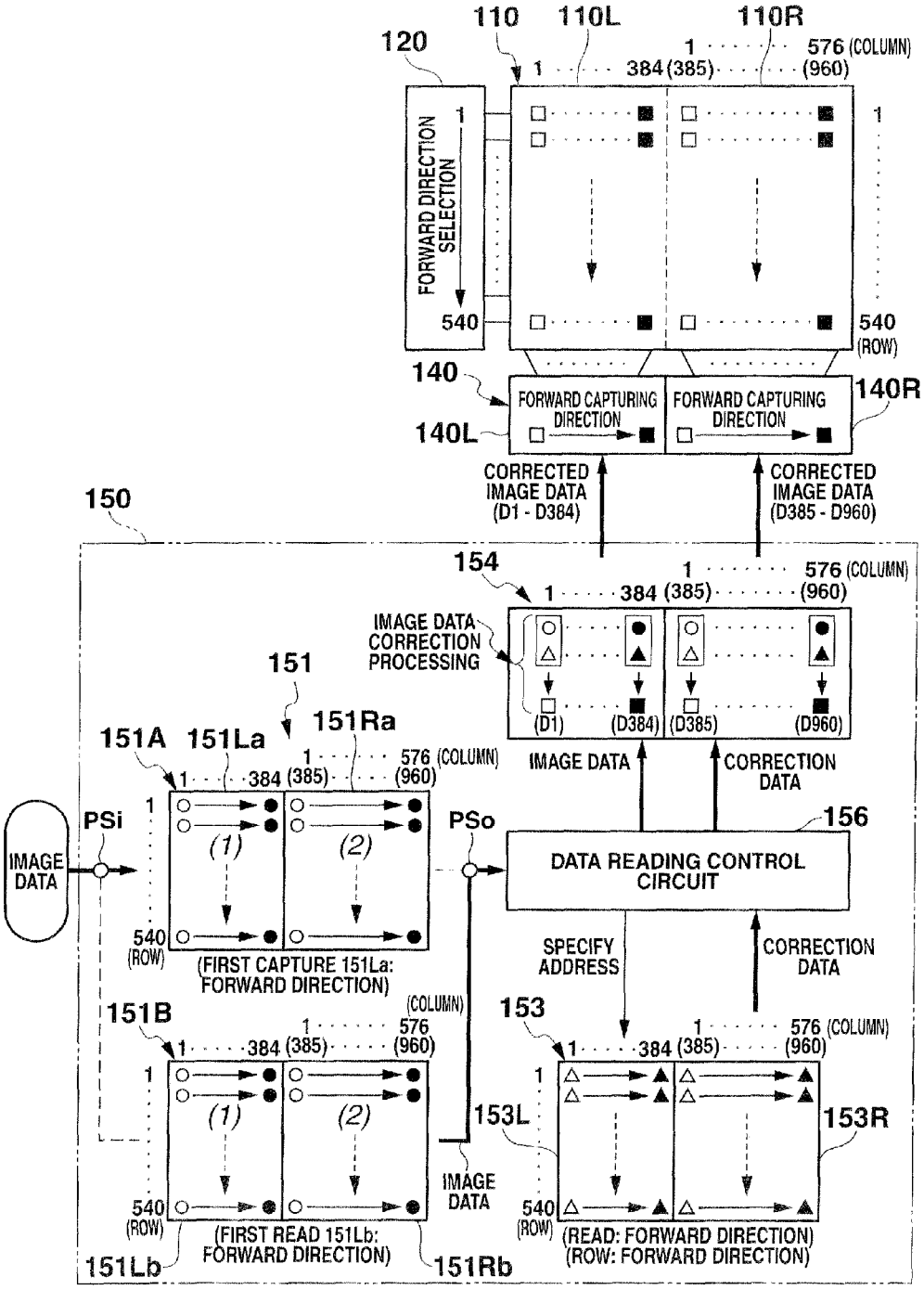
FIG. 32 is a schematic diagram illustrating a memory management method in the normal display mode performed by the display device according to the third embodiment.

FIG. 32 is a schematic diagram illustrating a memory management method in the normal display mode performed by the display device according to the present embodiment.

In FIG. 32, symbols are defined as follows for the sake of convenience in order to simplify the explanation about the memory management method.

In the figure, in the image data holding circuit 151 and the image data correction circuit 154, ○ (white circle) denotes image data corresponding to pixels PIX located in the first column (or the 385th column in the serial number) among the image data in each row (corresponding to one row) constituting the image information.

● (black circle) denotes image data corresponding to pixels PIX located in the 576th column or the 384th column, i.e., the last column, (or the 960th column in the serial number) in the image data. Arrows shown in the image data holding circuit 151 represents the capturing order (that is, capturing direction) or the reading order (that is, reading direction) of the image data.

In the correction data memory circuit 153 and the image data correction circuit 154 in FIG. 32, Δ (white triangle) denotes correction data according to the characteristics of the pixels PIX located in the first column (or the 385th column in the serial number) among the pixels PIX in each row (corresponding to one row) arranged in the display panel 110.

▲ (black triangle) denotes correction data according to the characteristics of the pixels PIX located in the 576th column or the 384th column, i.e., the last column, (or the 960th column in the serial number) among the pixels PIX.

Arrows shown in the correction data memory circuit 153 denote the reading order (that is, reading direction) of the correction data.

In the image data correction circuit 154, the data driver 140 (data drivers 140L, 140R), the display panel 110 in the FIG. 32, □ (white rectangle) denotes the corrected image data or the gradation signal supplied to pixels PIX located in the first column (or the 385th column in the serial number) among the corrected image data supplied to the pixels PIX in each row (corresponding to one row) arranged in the display panel 110.

■ (black rectangle) denotes corrected image data supplied to pixels PIX located in the 576th column or the 384th column, i.e., the last column, (or the 960th column in the serial number) among the corrected image data.

Arrows shown in the data drivers 140L, 140R denote the capturing order (that is, capturing direction) of the corrected image data supplied from the controller 150.

The above definition is commonly applied to each display form as listed below in the present embodiment.

In the normal display mode, the following series of operations are executed by the controller 150.

First, at the system activation of the display device 100, the data reading control circuit 156 of the controller 150 sequentially reads the correction data stored in the correction data storage circuit 152 corresponding to each pixel PIX arranged in the display panel 110 in advance, and the correction data are transferred to the first and second correction data memory circuits 153L, 153R of the correction data memory circuit 153, so that they are temporarily saved in the first and second correction data memory circuits 153L, 153R.

Then, on the basis of the method for storing the image data as explained below, the correction data of the pixels PIX for one screen of image information to be displayed on the display panel 110 are saved to predetermined addresses of the first and second correction data memory circuits 153L, 153R.

The method for storing the correction data in the correction data memory circuit will be explained with reference to the drawings in a concrete manner.

FIG. 33 is a schematic diagram illustrating an image showing how the correction data in the correction data memory circuit according to the present embodiment are stored.

In the present embodiment, for the sake of explanation, correction data $n_{th}$ for correcting fluctuation in a threshold voltage Vth of the drive transistor (the drive transistor) Tr13 arranged in each pixel PIX and a correction data $\Delta\beta\eta$ for correcting variation of both a current gain β and a light-emitting current efficiency η of each pixel PIX are used as the plurality of types of correction data according to the characteristics of the pixels PIX so as to correspond to the example of the driving control method of the display device explained later.

However, the present invention is not limited thereto. Other types of correction data may be used, and three types or more of correction data may be used.

For example, as shown in FIG. 33, the correction data transferred to the first and second correction data memory circuits 153L, 153R of the correction data memory circuit 153 from the correction data storage circuit 152 are stored as follows. Among the correction data corresponding to 960 pixels in one row (one line in the horizontal direction) of the display panel 110, the correction data $n_{th}$ and $\Delta\beta\eta$ of each color component (color pixel), i.e., red (R), green (G), blue (B), for 384 pixels corresponding to the pixels in the first to the 384th columns are stored at the side of the first correction data memory circuit 1532, and the correction data $n_{th}$ and $\Delta\beta\eta$ of each color component, i.e., RGB, for 576 pixels corresponding to the pixels in the 385th to the 960th columns are stored at the side of the second correction data memory circuit 153R.

For example, as shown in FIG. 33, when the first and second correction data memory circuits 153L, 153R have a memory regions capable of storing four pieces of correction data $n_{th}$, $\Delta\beta\eta$ at each address (that is, the first and second correction data memory circuits 153L, 153R are used as an integrated memory region, and have a memory capacity for storing eight pieces in total of correction data $n_{th}$, $\Delta\beta\eta$ at a common address (the same address)), the following method for storing the correction data $n_{th}$, $\Delta\beta\eta$ is actually applied.

First, correction data R0$n_{th}$, G0$n_{th}$, B0$n_{th}$ and R384$n_{th}$, G384$n_{th}$, B384$n_{th}$ according to the characteristics of the pixels PIX (more specifically, each color pixel of RGB) arranged in the first column of the first row of the divided light emitting region 110L and in the first column of the first row of the divided light emitting region 110R of the display panel 110

(the 385th column in the serial number) are stored in the same address "0" of the first and second correction data memory circuits 153L, 153R in such a manner that the correction data are stored adjacent to each other.

Likewise, correction data R1$n_{th}$, G1$n_{th}$, B1$n_{th}$ and R385$n_{th}$, G385$n_{th}$, B385$n_{th}$ according to the characteristics of the pixels PIX arranged in the second column of the first row of the divided light emitting region 110L and in the second column of the first row of the divided light emitting region 110R (the 386th column in the serial number) are stored in the same address "1" of the first and second correction data memory circuits 153L, 153R in such a manner that the correction data are stored adjacent to each other.

As described above, as shown in FIG. 33, according to the method for storing six pieces of correction data $n_{th}$ corresponding to each color component (R, G, B) for two pixels in one common address (the same address) of the first and second correction data memory circuits 153L, 153R, correction data R0$n_{th}$ to R383$n_{th}$, G0$n_{th}$ to G383$n_{th}$, B0$n_{th}$ to B383$n_{th}$, and R384$n_{th}$ to R767$n_{th}$, G384$n_{th}$ to G767$n_{th}$, B384$n_{th}$ to B767$n_{th}$ according to the characteristics of the pixels PIX arranged in the first to the 384th columns of the divided light emitting region 110L and the first to the 384th columns of the divided light emitting region 110R (the 385th to the 768th columns in the serial number) are respectively stored to the addresses "0" to "17F" of the first and second correction data memory circuits 153L, 153R.

As shown in FIG. 33, according to the method for storing three pieces of correction data $n_{th}$ corresponding to each color component (R, G, B) for one pixel in one address (the same address) of the second correction data memory circuit 153R of the first and second correction data memory circuits 153L, 153R, correction data R768$n_{th}$ to R959$n_{th}$, G768$n_{th}$ to G959$n_{th}$, B768$n_{th}$ to B959$n_{th}$ according to the characteristics of the pixels PIX arranged in the 385th to the 576th columns of the divided light emitting region 110R (the 769th to the 960th columns in the serial number) are respectively stored to the addresses "180" to "23F" of the second correction data memory circuit 153R.

The correction data $n_{th}$ are stored with an address specified so that the correction data $n_{th}$ are in the same order as the order of the pixels PIX in the divided light emitting regions 110L, 110R obtained by dividing the display panel 110 and the correction data $n_{th}$ can be read at a time in each color component of RGB of each pixel PIX.

On the other hand, for example, the correction data R0Δβη corresponding to the red color component (red color pixel) among the correction data R0Δβη, G0Δβη, B0Δβη according to the characteristics of the pixels PIX (color pixels of RGB) arranged in the first column of the first row of the divided light emitting region 110L of the display panel 110 and, for example, the correction data R384Δβη corresponding to the red color component (red color pixel) among the correction data R384Δβη, G384Δβη, B384Δβη according to the characteristics of the pixels PIX (color pixels of RGB) arranged in the first column of the first row (the 385th column in the serial number) of the divided light emitting region 110R are stored to the same address "0" of the first and second correction data memory circuits 153L, 153R storing the above correction data R0$n_{th}$, G0$n_{th}$, B0$n_{th}$ and R384$n_{th}$, G384$n_{th}$, B384$n_{th}$.

In this case, as described above, in the present embodiment each address has the memory capacity capable of storing eight pieces in total of correction data $n_{th}$, Δβη. Therefore, the correction data R0Δβη and R384Δβη are stored to the address "0" using a space area (memory region) at the address "0" storing the correction data R0$n_{th}$, G0$n_{th}$, B0$n_{th}$ and R384$n_{th}$, G384$n_{th}$, B384$n_{th}$. Likewise, the correction data R1Δβη and R385Δβη according to the characteristic of the red color component (red color pixel) of each pixel PIX arranged in the second column of the divided light emitting region 110L and the second column of the divided light emitting region 110R (the 386th column in the serial number) are stored to the space areas at the same address "1" of the first and second correction data memory circuits 153L, 153R.

In this manner, six pieces of correction data $n_{th}$ corresponding to each color component (R, G, B) of the two pixels as well as two pieces of correction data Δβη corresponding the particular color component (R) for the two pixels are stored to one common address (the same address) of the first and second correction data memory circuits 153L, 153R. Accordingly, as shown in FIG. 33, the correction data R0Δβη to R383Δβη and R384Δβη to R767Δβη according to the characteristic of the red color component (red color pixel) of each pixel PIX arranged in the first to the 384th columns of the divided light emitting region 110L and the first to the 384th columns of the divided light emitting region 110R (the 385th to 768th columns in the serial number) are stored to the space areas at the addresses "0" to "17F" of the first and second correction data memory circuits 153L, 153R, respectively.

Three pieces of correction data $n_{th}$ corresponding to each color component (R, G, B) of the above one pixel as well as one piece of correction data Δβη corresponding to the particular color component (R) for one pixel are stored to one address (the same address) of the second correction data memory circuit 153R of the first and second correction data memory circuits 153L, 153R. Accordingly, as shown in FIG. 33, the correction data R768Δβη to R959Δβη according to the characteristic of the red color component (red color pixel) of each pixel PIX arranged in the 385th to the 576th columns of the divided light emitting region 110R (the 769th to the 960th columns in the serial number) are stored to the space areas at the addresses "180" to "23F" of the second correction data memory circuit 153R, respectively.

The correction data Δβη according to the characteristic of the particular color component of each pixel PIX (in this case, red color component) are stored with an address specified so that the correction data Δβη are in the some order as the order of the pixels PIX in the divided light, emitting regions 110L, 110R obtained by dividing the display panel 110 and the correction data Δβη as well as the correction data $n_{th}$ can be read at a time in each color component of RGB of each pixel PIX.

Further, the correction data G0Δβη, B0Δβη and B1Δβη, B1Δβη corresponding to the green color component (green color pixel) and the blue color component (blue color pixel) except the red color component (red color pixel) among the correction data R0Δβη, G0Δβη, B0Δβη and R1Δβη, G1Δβη, B1Δβη according to the characteristics of the pixels PIX (color pixels of RGB) arranged in the first and second columns in the first row of the divided light emitting region 110L of the display panel 110 and the correction data G384Δβη, B384Δβη and G385Δβη, B385Δβη corresponding to the green color component (green color pixel) and the blue color component (blue color pixel) except the red color component (red color pixel) among the correction data R384Δβη, G384Δβη, B384Δβη and R385Δβη, G385Δβη, B385Δβη according to the characteristics of the pixels PIX (color pixels of RGB) arranged in the first column in the first row of the divided light emitting region 1108 (the 385th column in the serial number) and the second column thereof (the 386th column in the serial number) are stored at the same address "4C000" of the first and second correction data memory circuits 153L, 153R in such a manner that they are stored adjacent to each other.

Likewise, the correction data G2Δβη, B2Δβη, the correction data G3Δβη, B3Δβη, the correction data G386Δβη, B386Δβη, and the correction data G387Δβη, B387Δβη according the characteristics of the green color component (green color pixel) and the blue color component (blue color pixel) of each pixel PIX arranged in the third column and the fourth column of the divided light emitting region 110L, the third column of the divided light emitting region 1108 (the 387th column in the serial number), and the fourth column (the 387th column in the serial number) are stored to the same address "4C001" of the first and second correction data memory circuits 153L, 153R in such a manner that they are stored adjacent to each other.

As described above, eight, pieces of correction data Δβη corresponding to two pixels each for different colored components (G, B), i.e., four pixels in total, are stored to one common address (the same address) of the first and second correction data memory circuits 153L, 153R. Accordingly, as shown in FIG. 33, the correction data G0Δβη to G383Δβη and B0Δβη to B383Δβη and the correction data G384Δβη to G767Δβη and B384Δβη to B767Δβη according to the characteristics of the green color component (green color pixel) and the blue color component (blue color pixel) of each pixel PIX arranged in the first to the 384th column of the divided light emitting region 110L and the first to the 384th column of the divided light emitting region 110R (the 385th to the 768th columns in the serial number) are stored to the addresses "4C000" to "4C0BF" of the first correction data memory circuit 153L and the second correction data memory circuit 153R, respectively.

Four pieces of correction data Δβη corresponding to the different color components (G, B) for the two pixels are stored to one address (the same address) of the second correction data memory circuit 153R of the first and second correction data memory circuits 153L, 153R. Accordingly, as shown in FIG. 33, the correction data G768Δβη to G959Δβη and B768Δβη to B959Δβη according to the characteristics of the green color component (green color pixel) and the blue color component (blue color pixel) of each pixel PIX arranged in the 385th to the 576th columns of the divided light emitting region 110R (the 769th to the 960th columns in the serial number) are stored to the addresses "4C0C0" to "4C11F" of the second correction data memory circuit 153R, respectively.

The correction data Δβη according to the characteristic of the particular color component of each pixel PIX (in this case, red color component) are stored with an address specified so that the correction data Δβη are in the same order as the order of the pixels PIX in the divided light emitting regions 110L, 110R obtained by dividing the display panel 110 and the correction data Δβη as well as the correction data $n_{th}$ can be read at a time in each color component of RGB of each pixel PIX.

The correction data Δβη according to the characteristic of color components other than the particular color component (in this case, the green and blue color components) of each pixel PIX are stored with an address specified so that the correction data Δβη are in the same order as the order of the pixels PIX in the divided light emitting regions 110L, 110R obtained by dividing the display panel 110 and the correction data Δβη for two adjacent pixels PIX can be read at a time.

The processing for storing, at the predetermined addresses, the correction data $n_{th}$ and Δβη corresponding to the pixels PIX corresponding to one row of the display panel 110 (one line in the horizontal direction; denoted as L1 in FIG. 33) as described above is executed on all the rows (the first to the 540th rows; L1 to L540) of the display panel 110, so that the correction data of the pixels PIX for one screen of the image information displayed on the display panel 110 are saved in the first and second correction data memory circuits 153L, 153R of the correction data memory circuit 153.

The actions and the effects resulting from the use of the above method for storing the correction data will be explained in detail in the method for reading the correction data explained later.

Subsequently, as shown in FIG. 32, the data reading control circuit 156 sequentially captures and holds the image data of the digital signal supplied as the serial data from the display signal generation circuit 160 into any one of the two memory circuits 151A, 151B provided in the image data holding circuit 151 via the switch contact point PSi.

At this occasion, in the normal display mode, the image data holding circuit 151 causes the FIFO memories 151La and 151Ra or the FIFO memories 151Lb and 151Rb constituting the memory circuits 151A, 151B to visually operate as if they make a continuous, integrated memory region. That is, for example, in the memory circuit 151A, first, the image data continuous in the direction extending from the first column to the 384th column, i.e., the last column, (forward direction) in the first row of the FIFO memory 151La and subsequently the image data continuous in the direction extending from the first column (or the 385th column in the serial number) to the 576th column, i.e., the last column, (or the 960th column in the serial number) (forward direction) in the first row of the FIFO memory 151Ra are sequentially captured and stored.

The image data holding circuit 151 repeats this operation of each row in the forward direction from the first row to the 540th row, i.e., the last row, and holds the image data for one screen in any one of the two memory circuits 151A, 151B.

In parallel with the capturing operation of the image data, as shown in FIG. 32, the image data holding circuit 151 executes reading operation of the image data for sequentially reading the image data held in the other of the memory circuits 151A, 151B via the switch contact point PSo.

In this reading operation of the image data, the FIFO memories 151La and 151Ra or the FIFO memories 151Lb and 151Rb constituting the memory circuits 151A, 151B are caused to visually operate as if they make continuous, integrated memory region, and the reading operation of the image data is executed in the same order and the same direction as those of the above capturing operation of the image data. The read image data are supplied to the image data correction circuit 154 in units of rows (see arrows and circled numbers shown in the image data holding circuit 151 in FIG. 32).

On the other hand, as shown in FIG. 32, the data reading control circuit 156 sequentially reads the correction data corresponding to pixels PIX, to which the image data corresponding to one row is supplied, captured into the image data correction circuit 154 via the image data holding circuit 151, among the correction data stored in the first correction data memory circuit 153L and the second correction data memory circuit 153R of the correction data memory circuit 153, and the correction data are supplied to image data correction circuit 154 in units of rows.

The correction data read from the correction data memory circuit 153 are conceptually, sequentially read from the first and second correction data memory circuits 153L, 153R in the direction extending from the first row to the 540th row, i.e., the last row (forward direction) of the display panel 110 and in the direction extending from the first column to the last column in each row (forward direction) (see arrows shown in the correction data memory circuit 153 in FIG. 32).

The method for reading the correction data from the correction data memory circuit in the normal display mode will be explained with reference to the drawings in a concrete manner.

Figure 34:
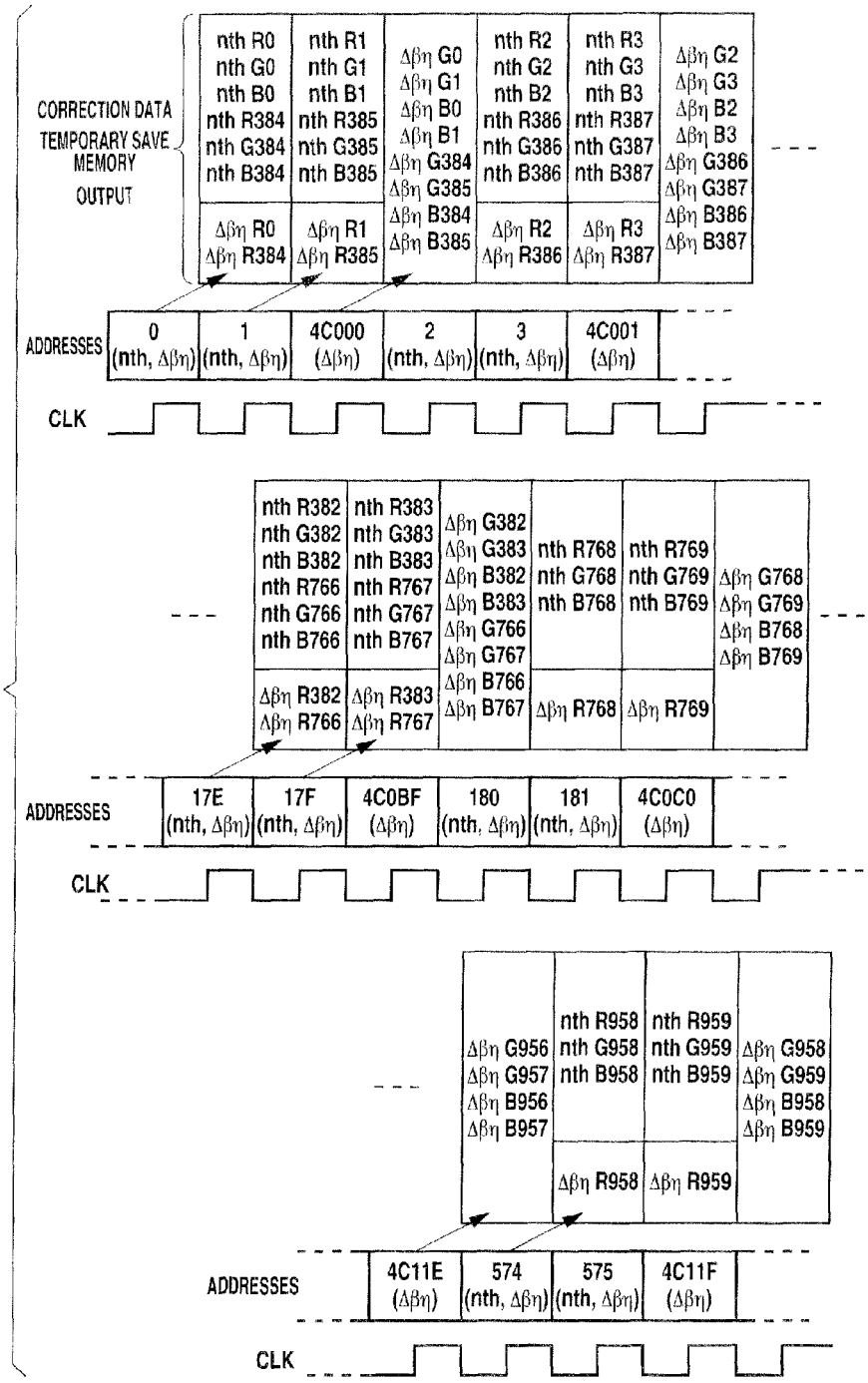
FIG. 34 is an operation timing chart illustrating a method for reading correction data from a correction data memory circuit in the normal display mode performed by the display device according to the third embodiment.

FIG. 34 is an operation timing chart illustrating a method for reading correction data from the correction data memory circuit in the normal display mode performed by the display device according to the present embodiment.

In this case, the method of reading the correction data $n_{th}$ and Δβη stored in the predetermined addresses of the correction data memory circuit 153 (the first and second correction data memory circuits 153L, 153R) according to the above storage method (see FIG. 33) will be explained.

FIG. 34 shows the continuous operation timing divided into three stages for the sake of illustration.

For example, the correction data denoted as "R0$n_{th}$", "R0Δβη" in FIG. 33 and in the specification are denoted as "$n_{th}$ R0", "Δβη R0" in FIG. 34 for the sake of convenience, in order to give attention to the types of correction data read from the correction data memory circuit 153 for the sake of explanation.

The operation timing in FIG. 34 shows a case where, with respect to an operation clock CLK specifying a particular address, the correction data at the address are read at an operation clock CLK in a subsequent timing. However, it is to be understood that the present invention is not limited thereto.

As shown in FIG. 34, for example, the method for reading the correction data $n_{th}$ and Δβη stored in the first and second correction data memory circuits 153L, 153R of the correction data memory circuit 153 is performed as follows. First, in synchronization with the correction data-reading operation clock CLK, the data reading control circuit 156 specifies the address "0" of the first and second correction data memory circuits 153L, 153R, thereby reading the correction data R0$n_{th}$, G0$n_{th}$, B0$n_{th}$ and R0Δβη corresponding to the pixels PIX in the first column in the first row of the divided light emitting region 110L of the display panel 110 and the correction data R384$n_{th}$, G384$n_{th}$, 8384$n_{th}$ and R384Δβη corresponding to the pixels PIX of the first column in the first row of the divided light emitting region 110R (the 385th column in the serial number).

Subsequently, in synchronization with a subsequent operation clock CLK, the address "1" of the first and second correction data memory circuits 153L, 153R is specified, whereby the correction data R1$n_{th}$, G1$n_{th}$, B1$n_{th}$ and R1Δβη corresponding to the pixels PIX in the second column in the first row of the divided light emitting region 110L and the correction data R385$n_{th}$, G385$n_{th}$, B385$n_{th}$ and R385Δβη corresponding to the pixels PIX in the second column in the first row of the divided light emitting region 110R (the 386th column in the serial number) are read out.

Subsequently, in synchronization with a subsequent operation clock CLK, the address "4C000" of the first and second correction data memory circuits 153L, 153R is specified, whereby the correction data G0Δβη, G1Δβη, B0Δβη, B1Δβη corresponding to the pixels PIX in the first and second columns in the first row of the divided light emitting region 110L and the correction data and G384Δβη, G385Δβη, B384Δβη, B385Δβη corresponding to the first column of the first row of the divided light emitting region 110R (the 385th column in the serial number) and the second column (the 386th column in the serial number) are read out.

Likewise, in synchronization with a subsequent operation clock CLK, the address "2" of the first and second correction data memory circuits 153L, 153R is specified, whereby the correction data R2$n_{th}$, G2$n_{th}$, B2$n_{th}$ and R2Δβη corresponding to the pixels PIX in the third column in the first row of the divided light emitting region 110L of the display panel 110 and the third column in the first row of the divided light emitting region 110R (the 387th column in the serial number) and the correction data R386$n_{th}$, G386$n_{th}$, R386$n_{th}$ and R386Δβη corresponding to the pixels PIX in the third column in the first row of the divided light emitting region 110R (the 387th column in the serial number) are read out.

Subsequently, in synchronization with a subsequent operation clock CLK, the address "3" of the first and second correction data memory circuits 153L, 153R is specified, whereby the correction data R3$n_{th}$, G3$n_{th}$, B3$n_{th}$ and R3Δβη and the correction data R387$n_{th}$, G387$n_{th}$, B387$n_{th}$ and R387Δβη corresponding to the pixels PIX in the fourth column in the first row of the divided fight emitting region 110L and the fourth column in the first row of the divided light emitting region 110R (the 388th column in the serial number) are read out.

Subsequently, in synchronization with a subsequent operation clock CLK, the address "4C001" of the first and second correction data memory circuits 153L, 153R is specified, whereby the correction data G2Δβη, G3Δβη, B2Δβη, B3Δβη and the correction data and G386Δβη, G387Δβη, B386Δβη, B387Δβη corresponding to the pixels PIX in the third column and the fourth column in the first row of the divided light emitting region 110L and the third column (the 387th column in the serial number) and the fourth column (the 388th column in the serial number) in the first row of the divided light emitting region 110R are read out.

As described above, according to the method for reading the 12 pieces (24 pieces in total) of correction data $n_{th}$ and Δβη corresponding to color component (R, G, B) for each of the two pixels of the divided light emitting regions 110L and 110R (four pixels in total) at every three common addresses (every three clocks) of the first and second correction data memory circuits 153L, 153R, the addresses "0" to "17F" and the addresses "4C000" to "4C0BF" are specified in a predetermined order in synchronization with each operation clock CLK as shown in FIG. 34, so that the correction data R0$n_{th}$ to R383$n_{th}$, the correction data G0$n_{th}$ to G383$n_{th}$, the correction data B0$n_{th}$ to B383$n_{th}$, and the correction data R0Δβη to R383Δβη, the correction data G0Δβη to G383Δβη, the correction data B0Δβη to B383Δβη corresponding to the pixels PIX arranged in the first to the 384th column of the divided light emitting region 110L stored in the first correction data memory circuit 153L and the correction data R384$n_{th}$ to R767$n_{th}$, the correction data G384$n_{th}$ to G767$n_{th}$, the correction data B384$n_{th}$ to B767$n_{th}$, and the correction data R384Δβη to R767Δβη the correction data G384Δβη to G767Δβη, the correction data B384Δβη to B767Δβη corresponding to the pixels PIX arranged in the first to the 384th columns of the divided light emitting region 110R (the 385th to the 768th columns in the serial number) stored in the second correction data memory circuit 153R are sequentially read out (first reading order).

Thereafter, as shown in FIG. 34, in synchronization with a subsequent operation clock CLK, the address "180" of the first and second correction data memory circuits 153L, 153R is specified, whereby the correction data R768$n_{th}$, G768$n_{th}$, B768$n_{th}$ and R768Δβη corresponding to the pixels PIX in the 385th column in the first row of the divided light emitting region 110R of the display panel 110 (the 769th column in the serial number).

Subsequently, in synchronization with a subsequent operation clock CLX, the address "181" of the first and second correction data memory circuits 153L, 153R is specified, whereby the correction data R769$n_{th}$, G769$n_{th}$, B769$n_{th}$ and R769Δβη corresponding to the pixels PIX in the 386th column in the first row of the divided light emitting region 110R (the 770th column in the serial number) are read out.

Subsequently, in synchronization with a subsequent operation clock CLK, the address "4C0C0" of the first and second correction data memory circuits 153L, 153R is specified, whereby the correction data G768Δβη, G769Δβη, B768Δβη, B769Δβη corresponding to the pixels PIX in the 385th column (the 769th column in the serial number) and the 386th column (the 770th column in the serial number) in the first row of the divided light emitting region 110R are read out.

As described above, according to the method for reading the six pieces (12 pieces in total) of correction data $n_{th}$ and Δβη corresponding to color component (R, G, B) for the two pixels of the divided light emitting region 110R at every three addresses (every three operation clocks) of the second correction data memory circuit 153R of the first and second correction data memory circuits 153L, 153R, the addresses "180" to "23F" and the addresses "4C0C0" to "4C11F" are specified in a predetermined order in synchronization with each operation clock CLK as shown in FIG. 34, so that the correction data R768$n_{th}$ to R959$n_{th}$, the correction data G768$n_{th}$ to G959$n_{th}$, the correction data B768$n_{th}$ to B959$n_{th}$, and the correction data R768Δβη to R959Δβη, the correction data G768Δβη to G959Δβη, the correction data B768Δβη to B959Δβη corresponding to the pixels PIX arranged in the 385th to the 576th columns of the divided light emitting region 110R (the 769th to the 960th columns in the serial number) stored in the second correction data memory circuit 153R are sequentially read out (first reading order).

The correction data $n_{th}$ and Δβη corresponding to the pixels PIX corresponding to one row of the display panel 110 (one line in horizontal direction; L1) are read by repeating operation of reading the two pixels each, i.e., four pixels in total, of correction data $n_{th}$ and Δβη respectively from the first and second correction data memory circuits 153L, 153R at every three operation clocks. Then, the correction data $n_{th}$ and Δβη for one pixel are sequentially supplied to the image data correction circuit 154 from each of the first and second correction data memory circuits 153L, 153R in the order starting from the first column (forward direction).

This reading processing of the correction data is sequentially executed until the correction data corresponding to the pixels PIX from the first column to the 384th column are read in the first correction data memory circuit 153L and until the correction data corresponding to the pixels PIX from the first column (the 385th column in the serial number) to the 576th column (the 960th column in the serial number) are read in the second correction data memory circuit 153R.

Then, this reading processing of the correction data is sequentially executed for all the rows (the first to the 540th row; L1 to L540) of the display panel 110, so that the correction data of each pixel for one screen of the image information displayed on the display panel 110 is sequentially supplied to the image data correction circuit 154 at a predetermined timing in units of rows corresponding to each of the divided light emitting regions 110L, 110R of the display panel 110.

As described above, according to the method for reading the correction data according to the present embodiment, a group of addresses is sequentially specified to the correction data memory circuit 153 storing the correction data according to the above storage method (see FIG. 33) in synchronization with a group of operation clocks in units of a predetermined number (in this case, three), so that a plurality of types (in this case, two types) of correction data corresponding to up to the number larger than the above predetermined number of pixels PIX (in this case, four pixels PIX) can be read from the first and second correction data memory circuits 153L, 153R.

Therefore, as compared a generally-available method for reading one pixel of correction data for each operation clock, the plurality of types of correction data can be read at a fast speed. This allows continuous supply of the correction data to the image data correction circuit 154 at a fast speed.

Subsequently, the image data correction circuit 154 sequentially corrects, pixel by pixel, the image data at each column position of one row captured via the image data holding circuit 151, on the basis of the correction data according to the characteristics of the pixels PIX in each column of one row that are supplied from the correction data memory circuit 153 in association with each of the divided light emitting regions 110L, 110R.

Relationship of image data and correction data used in the image data correction processing performed by the image data correction circuit 154 in the normal display mode will be explained with reference to the drawings in a concrete manner.

FIG. 35 is a schematic diagram illustrating relationship of addresses between each piece of image data and correction data used for correction processing, in the normal display mode in the display device according to the present embodiment.

As shown in the image data correction circuit 154 in FIG. 32 and as schematically shown in FIG. 35, in the normal display mode, the correction processing of the image data correction circuit 154 is executed by performing calculation on each pieces of image data corresponding to each column position from the first column to the 960th column (see addresses of the image data in FIG. 35), on the basis of a predetermined correction expression using each pieces of correction data corresponding to each pixel PIX from the first column to the 960th column in each row of the display panel 110 (see addresses of the correction data in FIG. 35).

The FIFO memories 151La and 151Ra or 151Lb and 151Rb constituting the memory circuits 151A, 151B of the image data holding circuit 151 are caused to operate as the integrated memory region. The image data of the serial data are sequentially captured and held in the forward direction in the order of the FIFO memories 151La, 151Ra or 151Lb, 151Rb.

Likewise, the image data are sequentially read in the forward direction in the order of the FIFO memories 151La, 151Ra or 151Lb, 151Rb.

Then, for each of the first to the 384th column of the read image data corresponding to one row (the image data in the first to the 384th columns at the side of the FIFO memory 151La or 151Lb (denoted as "L side" in the FIG. 35) and the first to the 576th columns at the side of the FIFO memory 151Ra or 151Rb (denoted as "R side" in the FIG. 35), predetermined addresses are specified based on the method for reading the correction data explained above, from the two correction data memory circuits, i.e., the first and second correction data memory circuits 153L, 153R constituting the correction data memory circuit 153. Accordingly, the correction processing is sequentially executed using each piece of the correction data corresponding to one row sequentially read in the forward direction from the first column of the first and second correction data memory circuits 153L, 153R (the correction data in the first to the 384th columns at the side of the first correction data memory circuit 153L (denoted as "L side" in the figure) and the first to the 576th columns at the side of the second correction data memory circuit 153R (denoted as "R side" in the figure) (the 385th to the 960th columns in the (serial number)).

The example of the correction processing method for the image data will be explained in detail using the example of the driving control method for the display device explained later.

Subsequently, the corrected image data (corrected image data D1 to Dq: q=960) are transferred by the data reading control circuit 156, pixel by pixel, to the data drivers 140L, 140R via the driver transfer circuit 155 in units of rows.

The corrected image data D1 to D960 transferred via the driver transfer circuit 155 of the controller 150 are transferred as follows. The corrected image data D1 to D384 corresponding to the pixels PIX from first column to the 384th column arranged in the divided light emitting region 110L of the display panel 110 are transferred to the data driver 140L. The corrected image data D385 to D960 corresponding to the pixels PIX from first column to the 576th column arranged in the divided light emitting region 110R (from the 385th column to the 960th column in the serial number) are transferred to the data driver 140R.

At this occasion, in the normal display mode, the corrected image data D1 to D384 are sequentially captured, pixel by pixel, in the direction extending from the first column to the 384th column of the divided light emitting region 110L (forward direction; first capturing order) in the data driver 140L, and the corrected image data D385 to D960 are sequentially captured, pixel by pixel, in the direction extending from the first column to the 576th column of the divided light emitting region 110R (from the 385th column to the 960th column in the serial number) (forward direction; first, capturing order) in the data driver 140R (see arrows shown in the data drivers 140L, 140R in FIG. 32).

Subsequently, the selection driver 120 sequentially applies the selection signal Ssel at the selective level to the selection lines Ls in the order from the first row to the 540th row, i.e., the last row, (forward direction; first scanning direction), and sets the pixel PIX in each row to the selective state in order.

Then, in synchronization with the timing when the pixel PIX in each row is set in the selective state, the data drivers 140L, 140R apply the gradation signal (gradation voltage Vdata) based on the captured corrected image data D1 to D960 corresponding to one row (from the first to the 384th columns and from the 385th to the 960th columns in the serial number) to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the normal display mode, as shown in the image data correction circuit 154, the data drivers 140L, 140R, and the display panel 110 in FIG. 32 and as schematically shown in FIG. 35, each gradation signal based on the corrected image data D1 to D960 obtained by correcting the image data corresponding to each column position from the first column to the 960th column in each row of the image information (see addresses of the image data in FIG. 35) using the correction data corresponding to each pixel PIX from the first column to the 960th column in each row of the display panel 110 (see addresses of the correction data in FIG. 35) is written to each pixel PIX from the first column to the 384th column in each row of each of the divided light emitting region 110L and from the first column to the 576th column in each row of each of the divided light emitting region 110R of the display panel 110 (from the 385th column to the 960th column in the serial number).

After this writing operation of the gradation signal is sequentially executed to the pixels PIX in each of all the rows of the display panel 110, the power supply voltage Vsa at the predetermined light-emitting level is applied to each pixel PIX, so that the light emitting element (organic Et element OEL) provided on each pixel PIX emits light with the luminance gradation according to the gradation signal at a time, and as a result, the image information is displayed on the display panel 110.

At this occasion, as shown in FIG. 31, the image information is displayed as the ordinary image on the display panel 110.

Like the above first embodiment, when it is not necessary to correct the image data, e.g., when the display device is in initial state such as factory default state or when correction data according to characteristic of each pixel PIX are not obtained, the image data are transferred to the data driver 140 via the driver transfer circuit 155 without correcting the image data (that is, bypassing the image data correction circuit 154).

(2) Horizontally Reversed Display Mode

Figure 36:
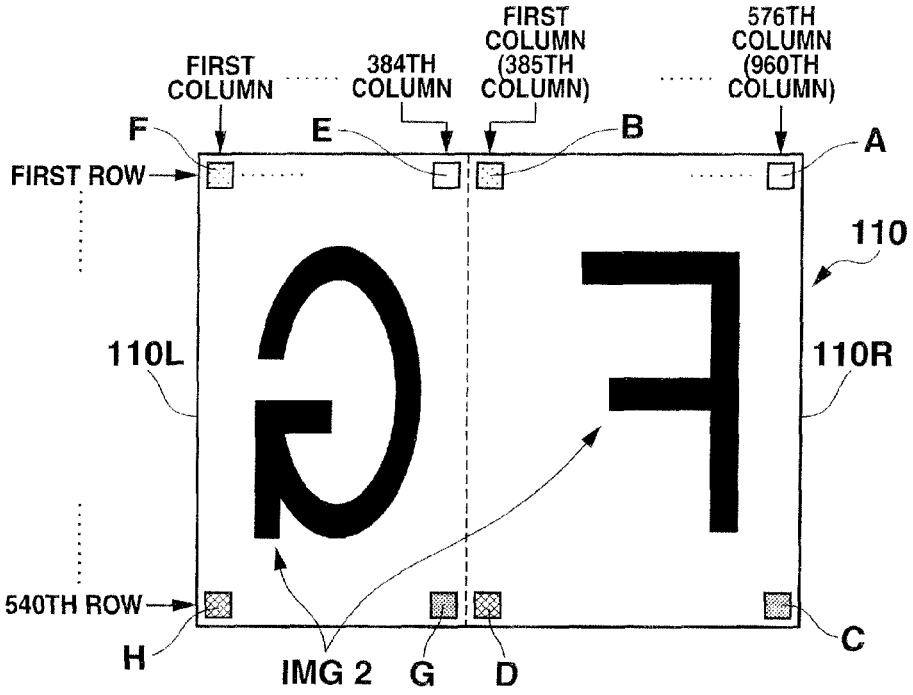
FIG. 36 is a figure illustrating a display form in a horizontally reversed display mode in which image information is displayed on the display panel in a horizontally reversed manner during display drive operation performed by the display device according to the third embodiment.

FIG. 36 is a figure illustrating a display form in the horizontally reversed display mode in which image information is displayed on the display panel in a horizontally reversed manner during display drive operation performed by the display device according to the present embodiment.

In FIG. 36, an IMG 2 is an example of image information displayed, in the horizontally reversed display mode, in the display region of the display panel 110 on the basis of the same image data as that used in the normal display mode. The IMG 2 is a horizontally reversed image obtained by horizontally reversing the IMG 1 of FIG. 31.

As shown in FIG. 36, in the horizontally reversed display mode, the display A based on the image data corresponding to the first row and the first column is displayed in the first row and the 960th column of the display panel 110 (the first row and the 576th column in the divided light emitting region 110R).

The display B based on the image data corresponding to the first row and the 384th column is displayed at the position in the first row and the 385th column of the display panel 110 (the first row and the first column in the divided light emitting region 110R).

The display C based on the image data corresponding to the 540th row and the first column is displayed at the position in the 540th row and the 960th column of the display panel 110 (the 540th row and the 576th column in the divided light emitting region 110R).

The display D based on the image data corresponding to the 540th row and the 384th column is displayed at the position in the 540th row and the 385th column of the display panel 110 (the 540th row and the first column in the divided light emitting region 110R).

The display E based on the image data corresponding to the first row and the 385th column is displayed at the position in the first row and the 384th column of the display panel 110 (the divided light emitting region 110L).

The display F based on the image data corresponding to the first row and the 960th column is displayed at the position in the first row and the first column of the display panel 110 (the divided light emitting region 110L).

The display G based on the image data corresponding to the 540th row and the 385th column is displayed in the 540th row and the 384th column of the display panel 110 (the divided light emitting region 110L).

The display H based on the image data corresponding to the 540th row and the 960th column is displayed at the position in the 540th row and the first column of the display panel 110 (the divided light emitting region 110L).

Figure 37:
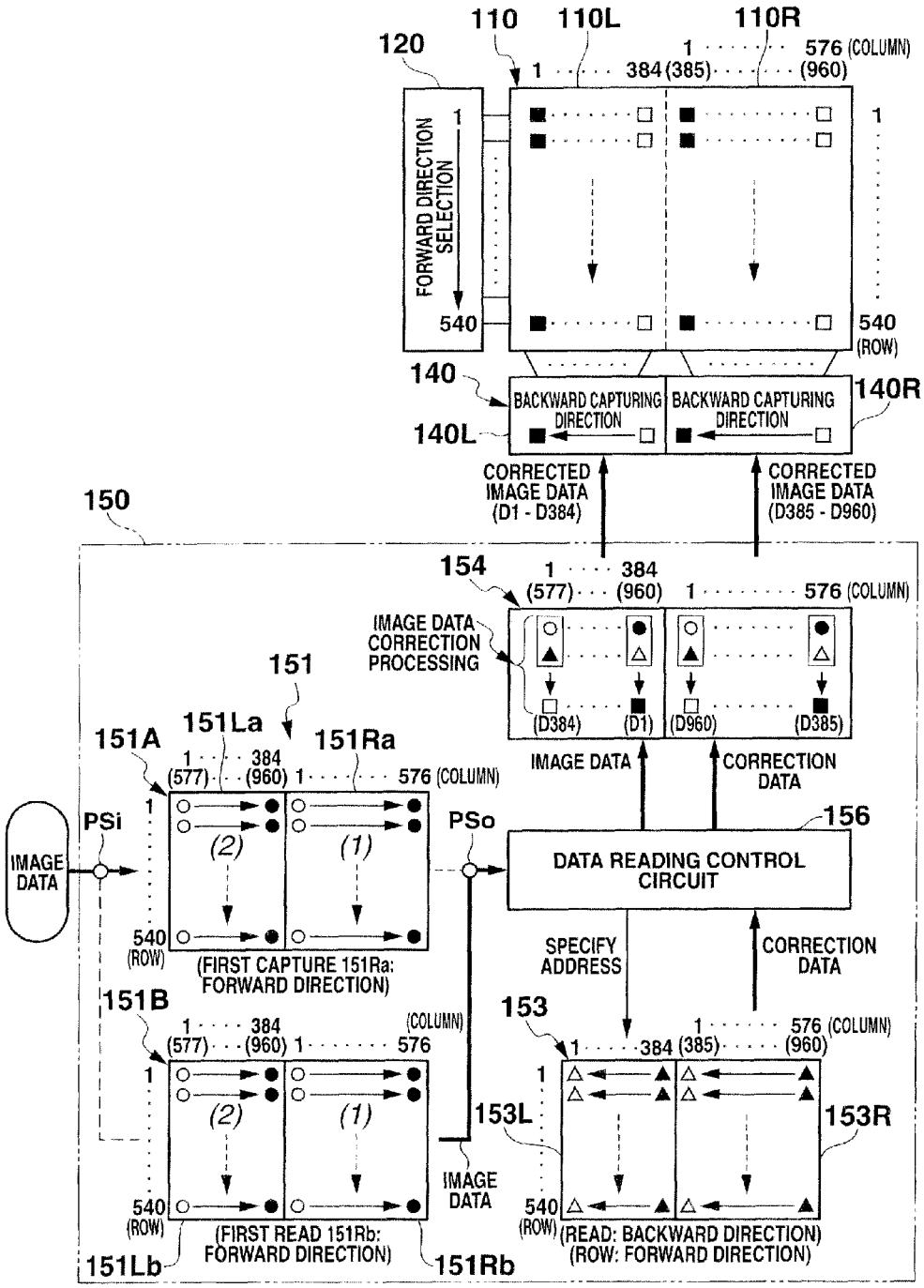
FIG. 37 is a schematic diagram illustrating a memory management method in the horizontally reversed display mode performed by the display device according to the third embodiment.

FIG. 37 is a schematic diagram illustrating a memory management method in the horizontally reversed display mode performed by the display device according to the present embodiment.

Description about the same configuration, method, and concept as those of the above normal display mode is simplified.

In the horizontally reversed display mode, the following series of operations are executed by the controller 150.

First, like the normal display mode explained above, at the system activation of the display device 100, the correction data corresponding to each pixel PIX for one screen arranged in the display panel 110 are transferred from the correction data storage circuit 152 to the first and second correction data memory circuits 153L, 153R of the correction data memory circuit 153 in advance, and the correction data are temporarily stored in the first and second correction data memory circuits 153L, 153R.

In this case, on the basis of the method for storing the correction data as explained above in the normal display mode (see FIG. 33), the correction data of the pixels PIX for one screen of the image information displayed on the display panel 110 are saved to predetermined addresses of the first and second correction data memory circuits 153L, 153R.

Subsequently, as shown in FIG. 37, the image data holding circuit 151 executes, in parallel, the operation of sequentially capturing the image data supplied as serial data from the display signal generation circuit 160 into one of the two memory circuits 151A, 151B via the switch contact point PSi and the operation of sequentially reading the image data held in the other of the memory circuits 151A, 151B via the switch contact point PSo to supply the image data to the image data correction circuit 154 in units of rows.

At this occasion, the image data holding circuit 151 causes the FIFO memories 151La and 151Ra or FIFO memories 151Lb and 151Rb constituting the memory circuits 151A, 151B to operate as separate memory regions in the horizontally reversed display mode. That is, for example, in the memory circuit 151A, first, the image data are captured in the direction extending from the first column to the 576th column, i.e., the last column, in the first row of the FIFO memory 151Ra (forward direction), and subsequently, the image data are captured in the direction extending from the first column to the 384th column, i.e., the last column, (from the 577th column to the 960th column in the serial number) in the first row of the FIFO memory 151La (forward direction) are captured. Then, the continuous image data are divided, captured, and stored.

The image data holding circuit 151 repeats this operation of each row in the forward direction from the first row to the 540th row, i.e., the last row, and holds the image data for one screen in any one of the two memory circuits 151A, 151B.

In parallel with the capturing operation of the image data, as shown in FIG. 37, the image data holding circuit 151 executes reading operation of the image data for sequentially reading the image data held in the other of the memory circuits 151A, 151B.

In this reading operation of the image data, the FIFO memories 151La and 151Ra or the FIFO memories 151Lb and 151Rb constituting the memory circuits 151A, 151B are caused to operate as separate memory regions, and the reading operation of the image data is executed in the same order and the same direction as those of the above capturing operation of the image data. The read image data are supplied to the image data correction circuit 154 in units of rows (see arrows and circled numbers shown in the image data holding circuit 151 in FIG. 37).

On the other hand, as shown in FIG. 37, the correction data corresponding to pixels PIX, to which the image data corresponding to one row is supplied, captured into the image data correction circuit 154 via the image data holding circuit 151, among the correction data stored in the first and second correction data memory circuits 153L, 153R of the correction data memory circuit 153 are sequentially read, and the correction data are supplied to image data correction circuit 154 in units of rows.

The correction data read from the correction data memory circuit 153 are conceptually, sequentially read from the first and second correction data memory circuits 153L, 153R in the direction extending from the first row to the 540th row, i.e., the last row (forward direction) of the display panel 110 and in the direction extending from the last column to the first column in each row (backward direction) (see arrows shown in the correction data memory circuit 153 in FIG. 37).

The method for reading the correction data from the correction data memory circuit in the horizontally reversed display mode will be explained with reference to the drawings in a concrete manner.

Figure 38:
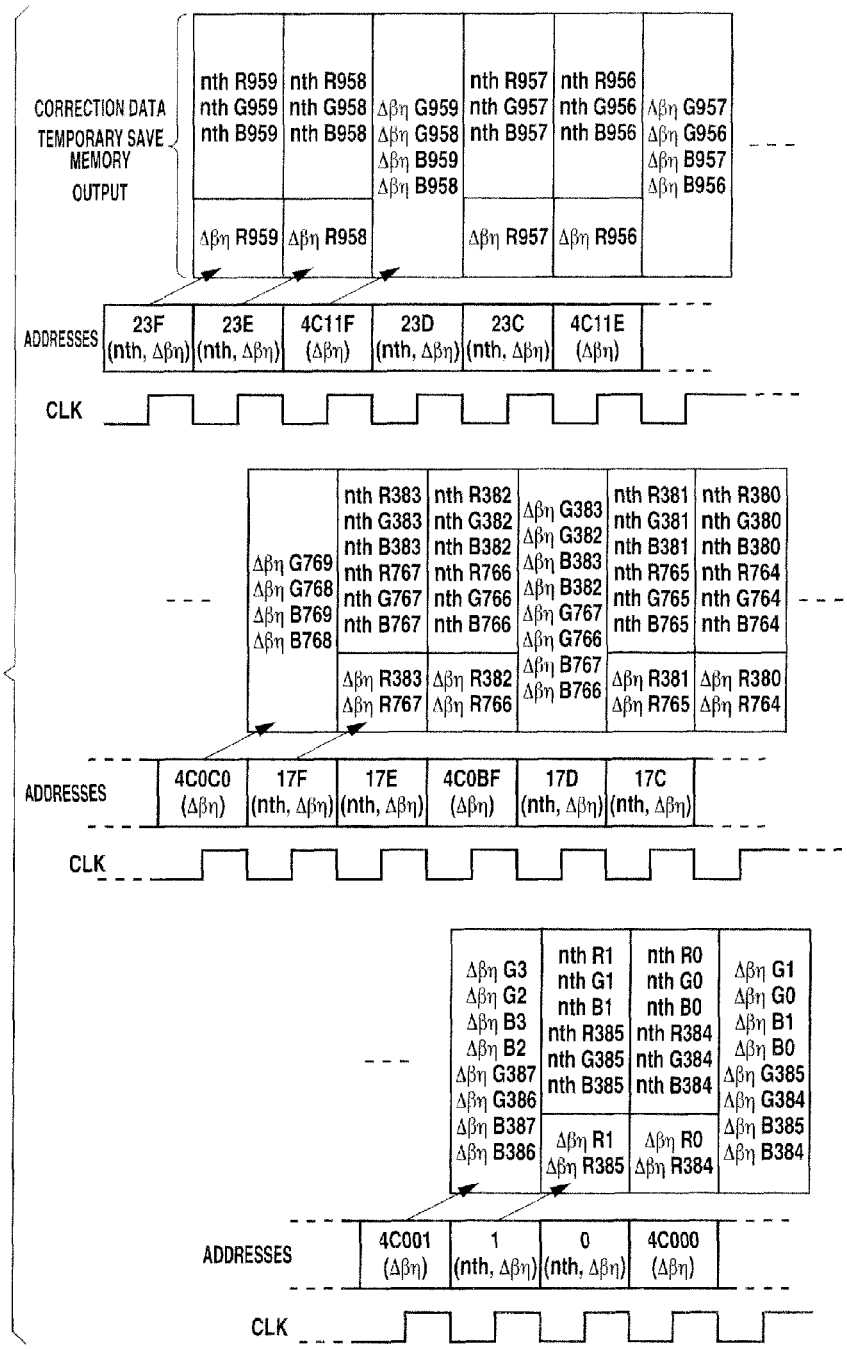
FIG. 38 is an operation timing chart illustrating a method for reading correction data from a correction data memory circuit in a horizontally reversed display mode performed by the display device according to the third embodiment.

FIG. 38 is an operation timing chart illustrating a method for reading correction data from a correction data memory circuit in a horizontally reversed display mode performed by the display device according to the present embodiment.

In this case, the method of reading the correction data $n_{th}$ and $\Delta\beta\eta$ stored in the predetermined addresses of the correction data memory circuit 153 (first and second correction data memory circuits 153L, 153R) according to the above storage method (see FIG. 33) will be explained.

FIG. 38 shows the continuous operation timing divided into three stages for the sake of illustration.

For example, the correction data denoted as "R0$n_{th}$", "R0$\Delta\beta\eta$" in FIG. 33 and in the specification are denoted as "$n_{th}$ R0", "$\Delta\beta\eta$ R0" in FIG. 38 for the sake of convenience, in order to give attention to the types of correction data read from the correction data memory circuit 153 for the sake of explanation.

The operation timing in FIG. 38 shows a case where, with respect to an operation clock CLK specifying a particular address, the correction data at the address are read at an operation clock CLK in a subsequent timing. However, it is to be understood that the present invention is not limited thereto.

As shown in FIG. 38, for example, the method for reading the correction data $n_{th}$ and $\Delta\beta\eta$ stored in the first and second correction data memory circuits 153L, 153R of the correction data memory circuit 153 is performed as follows. First, in synchronization with the correction data-reading operation clock CLK, the data reading control circuit 156 specifies the address "23F" of the first and second correction data memory circuits 153L, 153R, thereby reading the correction data R959$n_{th}$, G959$n_{th}$, B959$n_{th}$ and R959$\Delta\beta\eta$ corresponding to the pixels PIX of the 576th column in the first row of the divided light emitting region 110R of the display panel 110 (the 960th column in the serial number).

Subsequently, in synchronization with a subsequent operation clock CLK, the address "23E" of the first and second correction data memory circuits 153L, 153R is specified, whereby the correction data P958$n_{th}$, G958$n_{th}$, B958$n_{th}$ and R958$\Delta\beta\eta$ corresponding to the pixels PIX in the 575th column in the first row of the divided light emitting region 110R (the 959th column in the serial number) are read out.

Subsequently, in synchronization with a subsequent operation clock CLK, the address "4C11F" of the first and second correction data memory circuits 153L, 153R is specified, whereby the correction data G959$\Delta\beta\eta$, G958$\Delta\beta\eta$, B959$\Delta\beta\eta$, B958$\Delta\beta\eta$ corresponding to the pixels PIX in the 575h column (the 959th column in the serial number) and the 576th column (the 960th column in the serial number) in the first row of the divided light emitting region 110R.

Likewise, in synchronization with a subsequent operation clock CLK, the address "23D" of the first and second correction data memory circuits 153L, 153R is specified, whereby the correction data R957$n_{th}$, G957$n_{th}$, B957$n_{th}$ and R957Δβη corresponding to the pixels PIX in the 574th column in the first row of the divided light emitting region 110R of the display panel 110 (the 958th column in the serial number).

Subsequently, in synchronization with a subsequent operation clock CLK, the address "23C" of the first and second correction data memory circuits 153L, 153R is specified, whereby the correction data R956$n_{th}$, G956$n_{th}$, B956$n_{th}$ and R956Δβη corresponding to the pixels PIX in the 573th column in the first row of the divided light emitting region 110R (the 957th column in the serial number) are read out.

Subsequently, in synchronization with a subsequent operation clock CLK, the address "4C11E" of the first and second correction data memory circuits 153L, 153R is specified, whereby the correction data G957Δβη, G956Δβη, B957Δβη, B956Δβη corresponding to the pixels PIX in the 574th column (the 958th column in the serial number) and the 573th column (the 957th column in the serial number) in the first row of the divided light emitting region 110R.

As described above, according to the method for reading the six pieces each (12 pieces in total) of correction data $n_{th}$ and Δβη corresponding to each color component (R, G, B) for the two pixels of the divided light emitting region 110R at every three addresses (every three operation clocks) of the second correction data memory circuit 153R of the first and second correction data memory circuits 153L, 153R, the addresses "23F" to "180" and the addresses "4C11F" to "4C0C0" are specified in a predetermined order in synchronization with each operation clock CLK as shown in FIG. 38, so that the correction data R959$n_{th}$ to R768$n_{th}$, the correction data G959$n_{th}$ to G768$n_{th}$, the correction data B959$n_{th}$ to B768$n_{th}$, and the correction data R959Δβη to R768Δβη, the correction data G959Δβη to G768Δβη, the correction data B959Δβη to B768Δβη corresponding to the pixels PIX arranged in the 576th to the 385th columns of the divided light emitting region 110R (the 960th to the 769th columns in the serial number) stored in the second correction data memory circuit 153R are sequentially read out (second reading order).

Thereafter, as shown in FIG. 38, in synchronization with a subsequent operation clock CLK, the address "17F" of the first and second correction data memory circuits 153L, 153R is specified, whereby the correction data R767$n_{th}$, G767$n_{th}$, B767$n_{th}$ and R767Δβη corresponding to the pixels PIX in the 384th column in the first row of the divided light emitting region 110R (the 768th column in the serial number) and the correction data R383$n_{th}$, G383$n_{th}$, B383$n_{th}$ and R383Δβη corresponding to the pixels PIX in the 384th column in the first row of the divided light emitting region 110L of the display panel 110.

Subsequently, in synchronization with a subsequent operation clock CLK, the address "17E" of the first and second correction data memory circuits 153L, 153R is specified, whereby the correction data R382$n_{th}$, G382$n_{th}$, B382$n_{th}$ and R382Δβη corresponding to the pixels PIX in the 383rd column in the first row of the divided light emitting region 110L and the correction data R766$n_{th}$, G766$n_{th}$, B766$n_{th}$ and R766Δβη corresponding to the pixels PIX in the 383rd column in the first row of the divided light emitting region 110R (the 767th column in the serial number) are read out.

Subsequently, in synchronization with a subsequent operation clock CLK, the address "4C0BF" of the first and second correction data memory circuits 153L, 153R is specified, whereby the correction data G383Δβη, G382Δβη, B383Δβη, B382Δβη corresponding to the pixels PIX in the 384th column and the 383rd column in the first row of the divided light emitting region 110L and the correction data and G767Δβη, G766Δβη, B767Δβη, B766Δβη corresponding to the pixels PIX and the 384th column (the 768th column in the serial number) and the 383rd column (the 767th column in the serial number) in the first row of the divided light emitting region 110R are read out.

As described above, according to the method for reading the 12 pieces (24 pieces in total) of correction data $n_{th}$ and Δβη corresponding to each color component (R, G, B) for each of the two pixels of the divided light emitting regions 110L and 110R (four pixels in total) at every three common addresses (every three clocks) of the first and second correction data memory circuits 153L, 153R, the addresses "17F" to "0" and the addresses "4C0BF" to "4C000" are specified in a predetermined order in synchronization with each operation clock CLK as shown in FIG. 38, that the correction data R383$n_{th}$ to R0$n_{th}$, the correction data G383$n_{th}$ to G0$n_{th}$, the correction data B383$n_{th}$ to B0$n_{th}$, and the correction data R383Δβη to R0Δβη, the correction data G383Δβη to G0Δβη, the correction data B383Δβη to B0Δβη corresponding to the pixels PIX arranged in the 384th to the first column of the divided light emitting region 110L stored in the first correction data memory circuit 153L and the correction data R767$n_{th}$ to R384$n_{th}$, the correction data G767$n_{th}$ to G384$n_{th}$, the correction data B767$n_{th}$ to B384$n_{th}$, and the correction data R767Δβη to R384Δβη, the correction data G767Δβη to G384Δβη, the correction data B767Δβη to B384Δβη corresponding to the pixels PIX arranged in the 384th to the first columns of the divided light emitting region 110R (the 768th to the 385th columns in the serial number) stored in the second correction data memory circuit 153R are sequentially read out (second reading order).

The correction data $n_{th}$ and Δβη corresponding to the pixels PIX corresponding to one row of the display panel 110 (one line in horizontal direction; L1) are read by repeating operation of reading the two pixels each, i.e., four pixels in total, of correction data $n_{th}$ and Δβη respectively from the first and second correction data memory circuits 153L, 153R at every three operation clocks. Then, the correction data $n_{th}$ and Δβη for one pixel are sequentially supplied to the image data correction circuit 154 from each of the first and second correction data memory circuits 153L, 153R in the order starting from the last column (backward direction).

This reading processing of the correction data is sequentially executed until the correction data corresponding to the 576th column (the 960th column in the serial number) to the first column (the 385th column in the serial number) are read in the second correction data memory circuit 153R and until the correction data corresponding to the pixels PIX from the 384th column to the first column are read in the first correction data memory circuit 153L.

Then, this reading processing of the correction data is sequentially executed for all the rows (the first to the 540th row; L1 to L540) of the display panel 110, so that the correction data of each pixel for one screen of the image information displayed on the display panel 110 is sequentially supplied to the image data correction circuit 154 at a predetermined timing in units of rows corresponding to each of the divided light emitting regions 110L, 110R of the display panel 110.

As described above, according to the method for reading the correction data according to the present embodiment, a group of addresses is sequentially specified to the correction data memory circuit 153 storing the correction data according to the above storage method (see FIG. 33) in synchronization with a group of operation clocks in units of a predetermined number (in this case, three), so that a plurality of types (in this case, two types) of correction data corresponding to up to the number larger than the above predetermined number of pixels PIX or more (in this case, four pixels PIX) can be read from the first and second correction data memory circuits 153L, 153R.

Therefore, as compared a generally-available method for reading one pixel of correction data for each operation clock, the plurality of types of correction data can be read at a fast speed. This allows continuous supply of the correction data to the image data correction circuit 154 at a fast speed.

Subsequently, the image data correction circuit 154 sequentially corrects, pixel by pixel, the image data at each column position of one row captured via the image data holding circuit 151, on the basis of the correction data according to the characteristics of the pixels PIX in each column of one row that are supplied from the correction data memory circuit 153 in association with each of the divided light emitting regions 110L, 110R.

Relationship of image data and correction data used in the image data correction processing performed by the image data correction circuit 154 in the horizontally reversed display mode will be explained with reference to the drawings in a concrete manner.

FIG. 39 is a schematic diagram illustrating relationship of addresses between each piece of image data and correction data used for correction processing, in the horizontally reversed display mode in the display device according to the present embodiment.

As shown in the image data correction circuit 154 in FIG. 37 and as schematically shown in FIG. 39, in the horizontally reversed display mode, the correction processing of the image data correction circuit 154 is executed by performing calculation on each pieces of image data corresponding to each column position from the first column to the 384th column and from the 385th column to the 960th column in each row (see addresses of the image data in FIG. 39), on the basis of a predetermined correction expression using each pieces of correction data corresponding to each pixel PIX from the 960th column to the 577th column and from the 576th column to the first column in each row of the display panel 110 (see addresses of the correction data in FIG. 39).

The FIFO memories 151La and 151Ra or 151Lb and 151Rb constituting the memory circuits 151A, 151B of the image data holding circuit 151 are caused to operate as separate memory regions. The image data of the serial data are sequentially captured and held in the forward direction in the order of the FIFO memories 151Ra, 151La or 151Rb, 151Lb. Likewise, for each piece of the image data corresponding to one row sequentially read in the forward direction in the order of the FIFO memories 151Ra, 151La or 151Rb, 151Lb (the image data in the first to the 576th columns at the side of the FIFO memory 151Ra or 151Rb (denoted as "R side" in the FIG. 39) and the first to the 384th columns at the side of the FIFO memory 151La or 151Lb (denoted as "L side" in the FIG. 39) (the image data from the 577th to the 960th columns in the serial number)), predetermined addresses are specified based on the method for reading the correction data explained above, from the two correction data memory circuits, i.e., the first and second correction data memory circuits 153L, 153R constituting the correction data memory circuit 153. Accordingly, the correction processing is executed each piece of the correction data in the 576th to the first columns (the 960th to the 385th columns in the serial number) of the correction data corresponding to one row sequentially read in the backward direction from the last column of each of the first and second correction data memory circuits 153L, 153R at the side of the second correction data memory circuit 153R (denoted as "R side" in the figure) and in the 384th to the first column at the side of the first correction data memory circuit 153L (denoted as "L side" in the figure).

Subsequently, the corrected image data (corrected image data D1 to D960) are transferred, pixel by pixel, to the data drivers 140L, 140R via the driver transfer circuit 155 in units of rows.

In the horizontally reversed display mode, the data drivers 140L, 140R set the capturing direction of the corrected image data D1 to 0960 to the backward direction on the basis of the data control signal (scan switching signal) supplied from the controller 150.

Accordingly, the corrected image data D1 to 0960 are transferred via the driver transfer circuit 155 as follows. The corrected image data D1 to 9384 corresponding to the pixels PIX from the first column to the 384th column arranged in the divided light emitting region 110L of the display panel 110 are transferred to the data driver 1405, and the corrected image data D385 to D960 corresponding to the pixels PIX from the first column to the 576th column arranged in the divided light emitting region 110R (from the 385th column to the 960th column in the serial number) are transferred to the data driver 140R.

At this occasion, the corrected image data D384 to D1 are sequentially captured, pixel by pixel, in the direction extending from the 384th column to the first column of the divided light emitting region 110L (backward direction; second capturing order) in the data driver 140L, and the corrected image data D960 to D385 are sequentially captured, pixel by pixel, in the direction extending from the 576th column to the first column of the divided light emitting region 110R (from the 960th column to the 385th column in the serial number) (backward direction; second capturing order) in the data driver 140R (see arrows shown in the data drivers 140L, 140R in FIG. 37).

Subsequently, the selection driver 120 sequentially applies the selection signal Ssel at the selective level to the selection lines Ls in the order from the first row to the 540th row, i.e., the last row, (forward direction; first scanning direction), and sets the pixel PIX in each row to the selective state in order.

Then, in synchronization with the timing when the pixel PIX in each row is set in the selective state, the data drivers 140L, 140R apply the gradation signal (gradation voltage Vdata) based on the captured corrected image data D1 to D960 corresponding to one row (from the 384th to the first columns and from the 960th to the 385th columns in the serial number) to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the horizontally reversed display mode, as shown in the image data correction circuit 154, the data drivers 140L, 140R, and the display panel 110 in FIG. 37 and as schematically shown in FIG. 39, each gradation signal based on the corrected image data D1 to 0960 obtained by correcting the image data corresponding to each column position from the 960th column to the first column in each row of the image information (see addresses of the image data in FIG. 39) using the correction data corresponding to each pixel PIX from the 960th column to the first column in each row of the display panel 110 (see addresses of the correction data in FIG. 39) is written to each pixel PIX from the first column to the 384th column in each row of the divided light emitting region 110L of the display panel 110 and from the first column to the 576th column in each row of the divided light emitting region 110R (from the 385th column to the 960th column in the serial number).

After this writing operation of the gradation signal is sequentially executed to the pixels PIX in each of all the rows of the display panel 110, the light emitting element (organic EL element OEL) provided on each pixel PIX emits light with the luminance gradation according to the gradation signal at a time, and as a result, the image information is displayed on the display panel 110.

At this occasion, as shown in FIG. 36, the image information is displayed as the horizontally reversed image on the display panel 110.

(3) Vertically Reversed Display Mode

Figure 40:
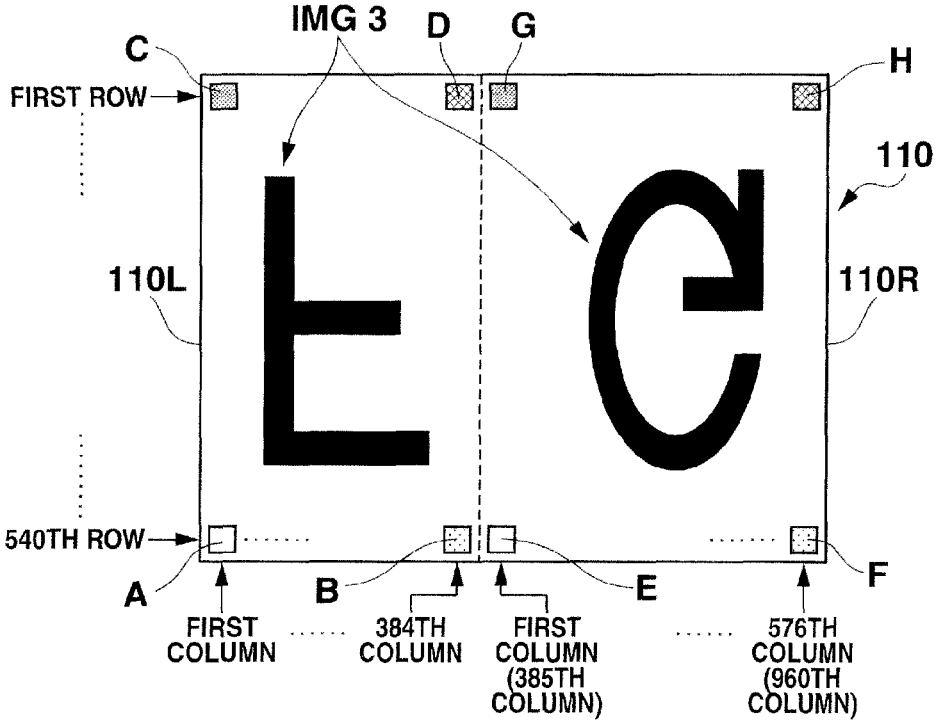
FIG. 40 is a figure illustrating a display form in a vertically reversed display mode, in which image information is displayed on the display panel in a vertically reversed manner during display drive operation performed by the display device according to the third embodiment.

FIG. 40 is a figure illustrating a display form in a vertically reversed display mode, in which image information is displayed on the display panel in a vertically reversed manner during display drive operation performed by the display device according to the present embodiment.

In FIG. 40, an IMG 3 is an example of image information displayed, in the vertically reversed display mode, in the display region of the display panel 110 on the basis of the same image data as that used in the normal display mode. The IMG 3 is a vertically reversed image obtained by vertically reversing the IMG 1 of FIG. 31.

As shown in FIG. 40, in the vertically reversed display mode, the display A based on the image data corresponding to the first row and the first column is displayed in the 540th row and the first column of the display panel 110 (the divided light emitting region 110L).

The display B based on the image data corresponding to the first row and the 384th column is displayed at the position in the 540th row and the 384th column of the display panel 110 (the divided light emitting region 110L).

The display C based on the image data corresponding to the 540th row and the first column is displayed at the position in the first row and the first column of the display panel 110 (the divided light emitting region 110L).

The display ID based on the image data corresponding to the 540th row and the 384th column is displayed at the position in the first row and the 384th column of the display panel 110 (the divided light emitting region 110L).

The display E based on the image data corresponding to the first row and the 385th column is displayed at the position in the first row and the 385th column of the display panel 110 (the 540th row the first column in the divided light emitting region 110R).

The display F based on the image data corresponding to the first row and the 960th column is displayed at the position in the 540th row and the 960th column of the display panel 110 (the 540th row and the 576th column in the divided light emitting region 110R).

The display G based on the image data corresponding to the 540th row and the 385th column is displayed at the position in the first row and the 385th column of the display panel 110 (the first row and the first column in the divided light emitting region 110R).

The display H based on the image data corresponding to the 540th row and the 960th column is displayed at the position in the first row and the 960th column of the display panel 110 (the first, row and the 576th column in the divided light emitting region 110R).

Figure 41:
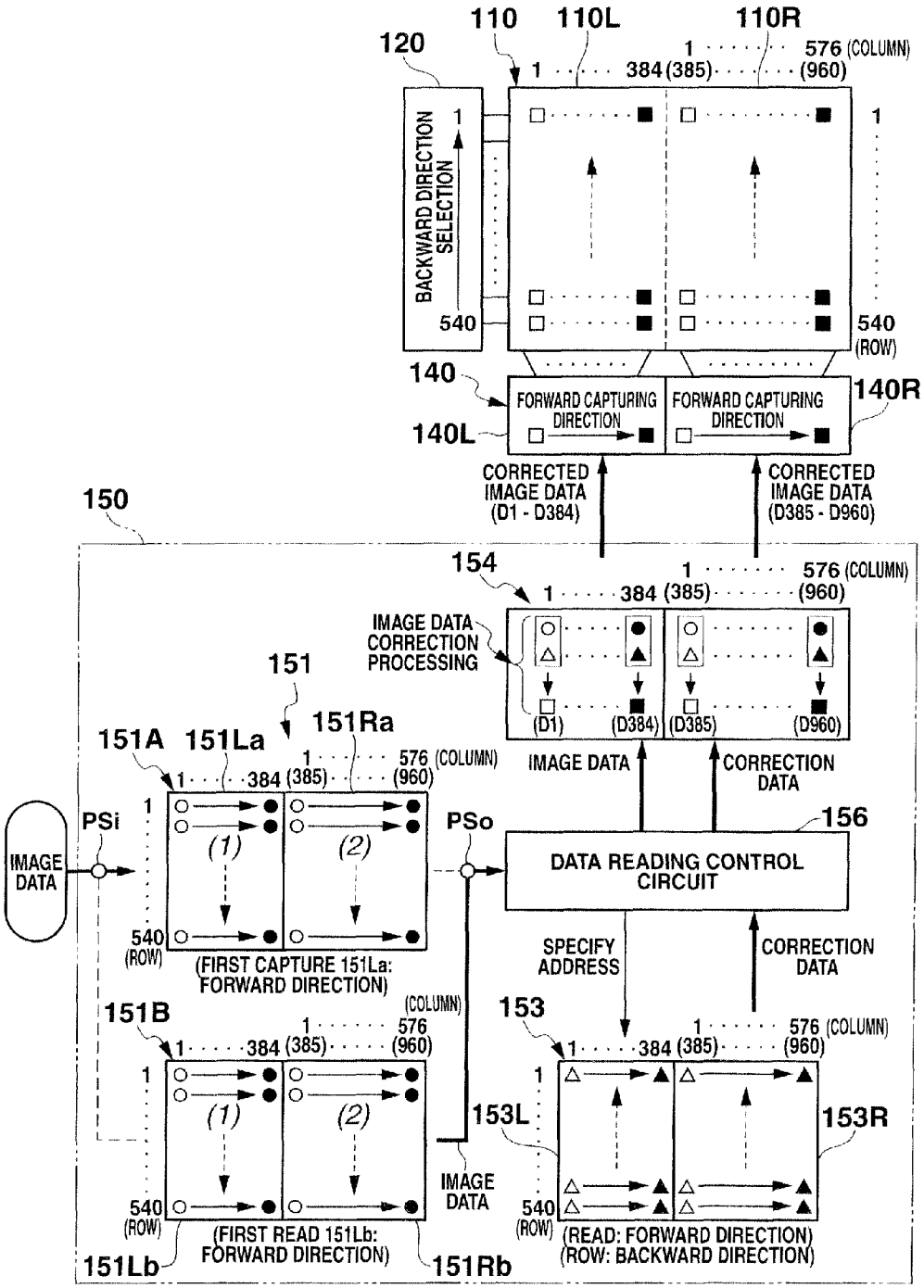
FIG. 41 is a schematic diagram illustrating a memory management method in the vertically reversed display mode performed by the display device according to the third embodiment.

FIG. 41 is a schematic diagram illustrating a memory management method in the vertically reversed display mode performed by the display device according to the present embodiment. FIG. 42 is a schematic diagram illustrating relationship of addresses between each piece of image data and correction data used for correction processing, in the vertically reversed display mode in the display device according to the present embodiment. It should be noted that description about the same configuration, method, and concept as those of the above normal display mode and the horizontally reversed display mode is simplified.

In the vertically reversed display mode, the following series of operations are executed by the controller 150.

First, like the normal display mode explained above, at the system activation of the display device 100, the correction data corresponding to each pixel PIX for one screen arranged in the display panel 110 are transferred from the correction data storage circuit 152 to the first and second correction data memory circuits 153L, 153R of the correction data memory circuit 153 in advance, and the correction data are temporarily stored in the first and second correction data memory circuits 153L, 153R.

In this case, on the basis of the method for storing the correction data as explained above in the normal display mode (see FIG. 33), the correction data of the pixels PIX for one screen of the image information displayed on the display panel 110 are saved to predetermined addresses of the first and second correction data memory circuits 153L, 153R.

Subsequently, as shown in FIG. 41, like the above normal display mode, the image data holding circuit 151 executes, in parallel, the operation of sequentially capturing the image data supplied from the display signal generation circuit 160 into one of the two memory circuits 151A, 151B via the switch contact point PSi and the operation of sequentially reading the image data held in the other of the memory circuits 151A, 151B via the switch contact point PSo to supply the image data to the image data correction circuit 154 in units of rows.

The image data holding circuit 151 causes the FIFO memories 151La and 151Ra or FIFO memories 151Lb and 151Rb constituting the memory circuits 151A, 151B to visually operate as if they make a continuous, integrated memory region. That is, operation of sequentially capturing and holding the image data continuous in the direction extending from the first column to the 384th column, i.e., the last column, of the FIFO memory 151La and subsequently from the first column to the 576th column, i.e., the last column, of the FIFO memory 151Ra (from the 385th column to the 960th column in the serial number) (forward direction) is repeated in each row from the first row to the 540th row, i.e., the last row, in the forward direction, and the image data for one screen are held in any one of the two memory circuits 151A, 151B.

In parallel with the capturing operation of the image data, the image data holding circuit 151 reads the image data held in the other of the memory circuits 151A, 151B in the same order and the same direction as those of the above capturing operation of the image data (see arrows and circled numbers shown in the image data holding circuit 151 in FIG. 41).

On the other hand, as shown in FIG. 41, the correction data corresponding to pixels PIX, to which the image data corresponding to one row is supplied, captured into the image data correction circuit 154 via the image data holding circuit 151, among the correction data stored in the first and second correction data memory circuits 153L, 153R of the correction data memory circuit 153 are sequentially read, and the correction data are supplied to image data correction circuit 154. In this case, in the vertically reversed display mode, the correction data read from the correction data memory circuit 153 are conceptually, sequentially read from the first and second correction data memory circuits 153L, 153R in the direction extending from the 540th row, i.e., the last row, to the first row (backward direction) of the display panel 110 and in the direction extending from the first column to the last column in each row (forward direction) (see arrows shown in the correction data memory circuit 153 in FIG. 41).

The method for reading the correction data corresponding to the pixels PIX in each row from the correction data memory circuit 153 is the same as the method shown in the above normal display mode (see FIG. 34).

Subsequently, the image data correction circuit 154 sequentially corrects, pixel by pixel, the image data at each column position of one row captured via the image data holding circuit 151, on the basis of the correction data according to the characteristics of the pixels PIX in each column of one row that are supplied from the correction data memory circuit 153.

As shown in the image data correction circuit 154 in FIG. 41 and as schematically shown in FIG. 42, the correction processing of the image data correction circuit 154 is executed by performing calculation on each pieces of image data corresponding to each column position from the first column to the 384th column and from the 385th column to the 960th column in each row from the first row to the 540th row (see addresses of the image data in FIG. 42), on the basis of a predetermined correction expression using each pieces of correction data corresponding to each pixel PIX from the first column to the 384th column and from the 385th column to the 960th column in each row from the 540th row to the first row of the display panel 110 (see addresses of the correction data in FIG. 42).

Subsequently, the corrected image data (corrected image data D1 to D960) are transferred, pixel by pixel, to the data drivers 140L, 140R via the driver transfer circuit 155 in units of rows.

The corrected image data D1 to D960 transferred via the driver transfer circuit 155 are sequentially captured as follows. The corrected image data D1 to D384 are sequentially captured, pixel by pixel, in the direction extending from the first column to the 384th column of the divided light emitting region 110L (forward direction; first capturing order) in the data driver 140L, and the corrected image data D385 to D960 are sequentially captured, pixel by pixel, in the direction extending from the first column to the 576th column of the divided light emitting region 110R (from the 385th column to the 960th column in the serial number) (forward direction; first capturing order) in the data driver 140R (see arrows shown in the data drivers 140L, 140R in FIG. 41).

Subsequently, the selection driver 120 sequentially applies the selection signal Ssel at the selective level to the selection lines Ls in the order from the 540th row, i.e., the last row, to the first row (backward direction; second scanning direction), and sets the pixel PIX in each row to the selective state in order.

In synchronization with the timing when the pixel PIX in each row is set in the selective state, the data drivers 140L, 140R apply the gradation signal (gradation voltage Vdata) based on the captured corrected image data D1 to D960 corresponding to one row (from the first to the 384th columns and from the 385th to the 960th columns in the serial number) to the data line Ld arranged in each column of the display panel 110 at a time.

Accordingly, the voltage component according to the gradation signal is held in each pixel PIX in the row set in the selective state by way of each data line Ld (that is, the gradation signal is written).

In this case, in the vertically reversed display mode, as shown in the image data correction circuit 154, the data drivers 140L, 140R, and the display panel 110 in FIG. 41 and as schematically shown in FIG. 42, each gradation signal based on the corrected image data D1 to D960 obtained by correcting the image data corresponding to each column position from the first column to the 960th column in each row from the first row to the 540th row of the image information (see addresses of the image data in FIG. 42) using the correction data corresponding to each pixel PIX from the first column to the 960th column in each row from the 540th row to the first row of the display panel 110 (see addresses of the correction data in FIG. 42) is written to each pixel PIX from the first column to the 384th column in each row of the divided light emitting region 110L of the display panel 110 and from the first column to the 576th column in each row of the divided light emitting region 110R (from the 385th column to the 960th column in the serial number).

After this writing operation of the gradation signal is sequentially executed to the pixels PIX in each of all the rows of the display panel 110, the light emitting element (organic EL element OEL) provided on each pixel PIX emits light with the luminance gradation according to the gradation signal at a time, and as a result, the image information is displayed on the display panel 110.

At this occasion, as shown in FIG. 40, the image information is displayed as the vertically reversed image on the display panel 110.

(4) Horizontally and Vertically Reversed Display Mode

Figure 43:
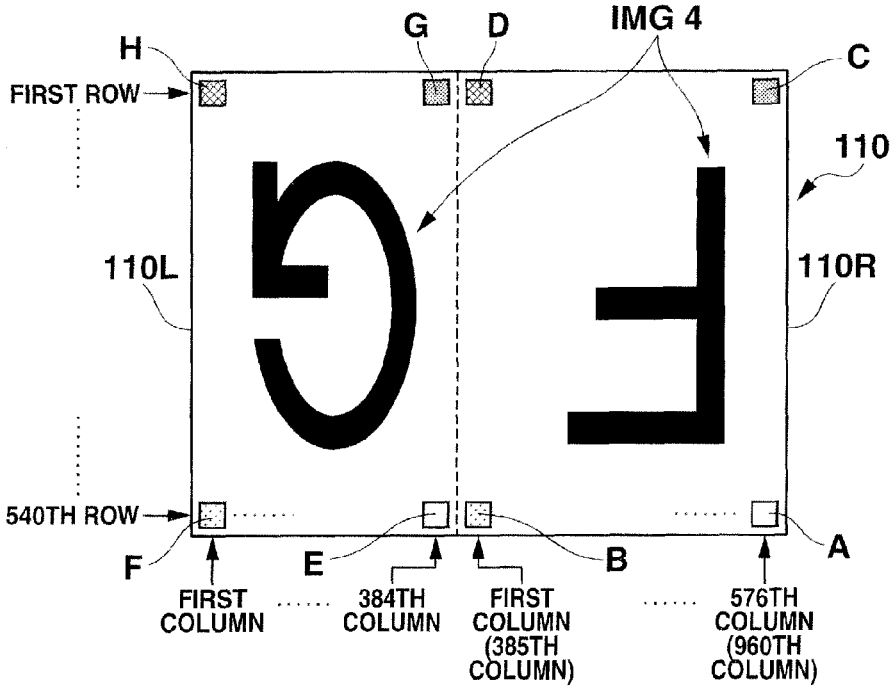
FIG. 43 is a figure illustrating a display form in a horizontally and vertically reversed display mode, in which image information is displayed on the display panel in a horizontally and vertically reversed manner during display drive operation performed by the display device according to the third embodiment.

FIG. 43 is a figure illustrating a display form in a horizontally and vertically reversed display mode, in which image information is displayed on the display panel in a horizontally and vertically reversed manner during display drive operation performed by the display device according to the present embodiment.

In FIG. 43, an IMG 4 is an example of image information displayed, in the horizontally and vertically reversed display mode, in the display region of the display panel 110 on the basis of the same image data as that used in the normal display mode. The IMG 4 is a horizontally and vertically reversed image obtained by horizontally and vertically reversing the IMG 1 of FIG. 31.

As shown in FIG. 43, in the horizontally and vertically reversed display mode, the display A based on the image data corresponding to the first row and the first column is displayed in the 540th row and the 960th column of the display panel 110 (the 540th row and the 576th column in the divided light emitting region 110R).

The display B based on the image data corresponding to the first row and the 384th column is displayed at the position in the 540th row and the 385th column of the display panel 110 (the 540th row and the first column in the divided light emitting region 110R).

The display C based on the image data corresponding to the 540th row and the first column is displayed at the position in the first row and the 960th column of the display panel 110 (the first row and the 576th column in the divided light emitting region 110R).

The display E based on the image data corresponding to the 540th row and the 384th column is displayed at the position in the first row and the 385th column of the display panel 110 (the first row and the first column in the divided light emitting region 110R).

The display E based on the image data corresponding to the first row and the 385th column is displayed at the position in the 540th row and the 384th column of the display panel 110 (the divided light emitting region 110L).

The display F based on the image data corresponding to the first row and the 960th column is displayed at the position in the 540th row and the first column of the display panel 110 (the divided light emitting region 110L).

The display G based on the image data corresponding to the 540th row and the 385th column is displayed in the first row and the 384th column of the display panel 110 (the divided light emitting region 110L).

The display H based on the image data corresponding to the 540th row and the 960th column is displayed at the position in the first row and the first column of the display panel 110 (the divided light emitting region 110L).

Figure 44:
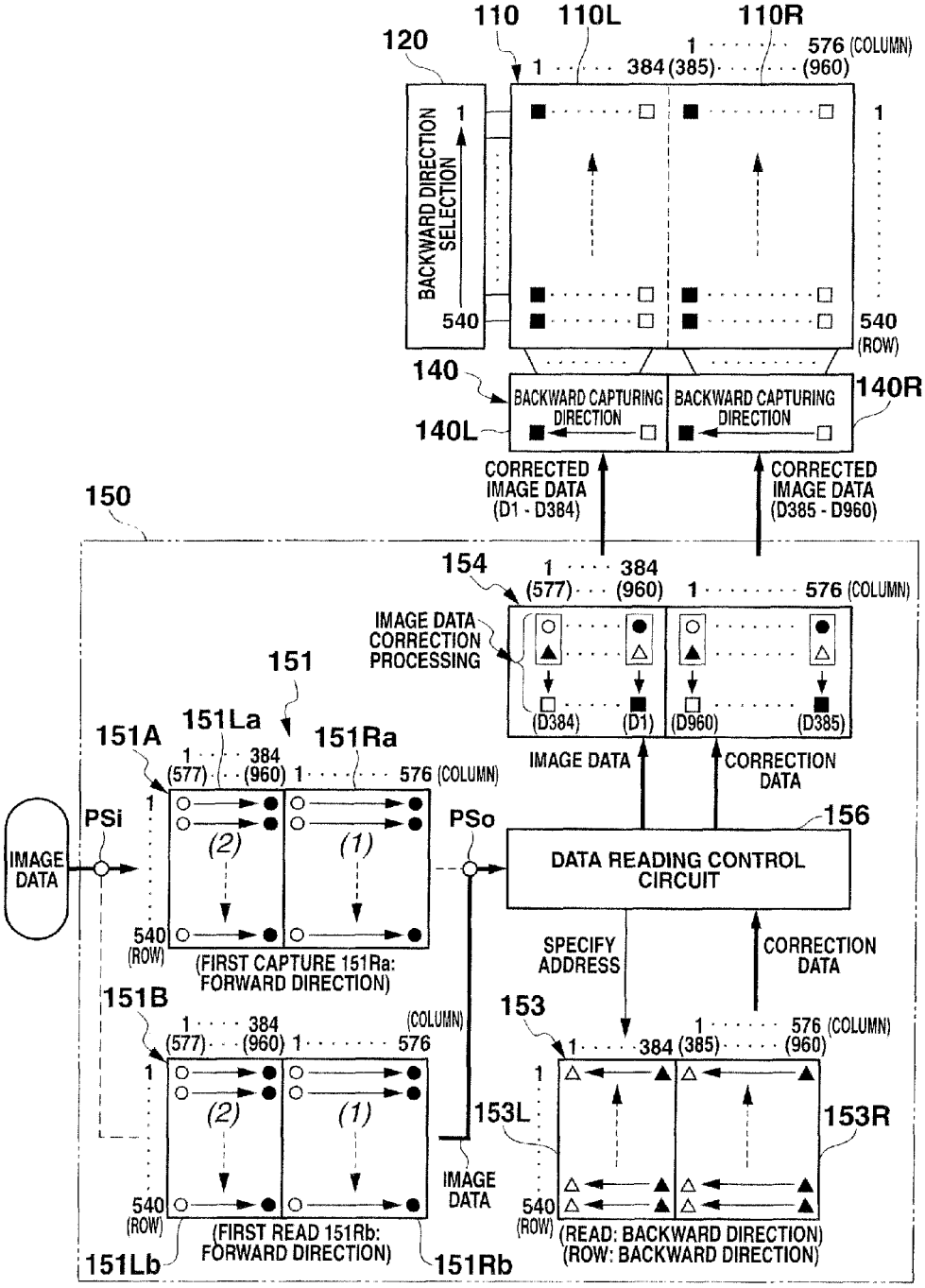
FIG. 44 is a schematic diagram illustrating a memory management method in the horizontally and vertically reversed display mode performed by the display device according to the third embodiment.

FIG. 44 is a schematic diagram illustrating a memory management method in the horizontally and vertically reversed display mode performed by the display device according to the present embodiment.

FIG. 45 is a schematic diagram illustrating relationship of addresses between each piece of image data and correction data used for correction processing, in the horizontally and vertically reversed display mode in the display device according to the present embodiment.

It should be noted that description about the same configuration, method, and concept as those of the above normal display mode, the horizontally reversed display mode, and the vertically reversed display mode is simplified.

In the horizontally and vertically reversed display mode, the following series of operations are executed by the controller 150.

First, like the normal display mode explained above, at the system activation of the display device 100, the correction data corresponding to each pixel PIX for one screen arranged in the display panel 110 are transferred from the correction data storage circuit 152 to the first and second correction data memory circuits 153L, 153R of the correction data memory circuit 153 in advance, and the correction data are temporarily stored in the first and second correction data memory circuits 153L, 153R.

On the basis of the method for storing the correction data as explained above in the normal display mode (see FIG. 33), the correction data of the pixels PIX for one screen of the image information displayed on the display panel 110 are saved to predetermined addresses of the first and second correction data memory circuits 153L, 153R.

Subsequently, as shown in FIG. 44, like the above horizontally reversed display mode, the image data holding circuit 151 executes, in parallel, the operation of sequentially capturing the image data supplied from the display signal generation circuit 160 into one of the two memory circuits 151A, 151B via the switch contact point PSi and the operation of sequentially reading the image data held in the other of the memory circuits 151A, 151B via the switch contact point PSo to supply the image data to the image data correction circuit 154 in units of rows.

The image data holding circuit 151 causes the FIFO memories 151La and 151Ra or FIFO memories 151Lb and 151Rb constituting the memory circuits 151A, 151B to operate as separate memory regions. That is, operation of dividing, capturing, and holding the image data continuous in the direction extending from the first column to the 576th column, i.e., the last column, of the FIFO memory 151Ra and subsequently from the first column to the 384th column, i.e., the last column, of the FIFO memory 151La (from the 577th column to the 960th column in the serial number) (forward direction) is repeated in each row from the first row to the 540th row, i.e., the last row, in the forward direction, and the image data for one screen are held in any one of the two memory circuits 151A, 151B.

In parallel with the capturing operation of the image data, the image data holding circuit 151 reads the image data held in the other of the memory circuits 151A, 151B in the same order and the same direction as those of the above capturing operation of the image data (see arrows and circled numbers shown in the image data holding circuit 151 in FIG. 44).

On the other hand, as shown in FIG. 44, the correction data corresponding to pixels PIX, to which the image data corresponding to one row is supplied, captured into the image data correction circuit 154 via the image data holding circuit 151, among the correction data stored in the first and second correction data memory circuits 153L, 153R of the correction data memory circuit 153 are sequentially read, and the correction data are supplied to image data correction circuit 154 in units of rows.

In the horizontally and vertically reversed display mode, the correction data read from the correction data memory circuit 153 are conceptually, sequentially read from the first and second correction data memory circuits 153L, 153R in the direction extending from the 540th row, i.e., the last row, to the first row (forward direction) of the display panel 110 like the above vertically reversed display mode and in the direction extending from the last column to the first column in each row (backward direction) like the above horizontally reversed display mode (see arrows shown in the correction data memory circuit 153 in FIG. 44).

The method for reading the correction data corresponding to the pixels PIX in each row from the correction data memory circuit 153 is the same as the method shown in the above horizontally reversed display mode (see FIG. 38).

Subsequently, the image data correction circuit 154 sequentially corrects, pixel by pixel, the image data at each column position of one row captured via the image data holding circuit 151, on the basis of the correction data according to the characteristics of the pixels PIX in each column of one row that are supplied from the correction data memory circuit 153 in association with each of the divided light emitting regions 110L, 110R.

As shown in the image data correction circuit 154 in FIG. 44 and as schematically shown in FIG. 45, the correction processing of the image data correction circuit 154 is executed by performing calculation on each pieces of image data corresponding to each column position from the first column to the 384th column and from the 385th column to the 960th column in each row from the first row to the 540th row (see addresses of the image data in FIG. 45), on the basis of a predetermined correction expression using each pieces of correction data corresponding to each pixel PIX from the 960th column to the 577th column and from the 576th column to the first column in each row of the display panel 110 (see addresses of the correction data in FIG. 45).

Subsequently, the corrected image data (corrected image data D1 to D960) are transferred, pixel by pixel, to the data drivers 140L, 140R via the driver transfer circuit 155 in units of rows.

In this case, in the horizontally and vertically reversed display mode, the data drivers 140L, 140R set the capturing direction of the corrected image data D1 to D960 to the backward direction on the basis of the data control signal (scan switching signal) supplied from the controller 150.

Accordingly, the corrected image data D1 to D960 transferred via the driver transfer circuit 155 are sequentially captured as follows. The corrected image data D384 to D1 corresponding to the pixels PIX from the first column to the 384th column arranged in the divided light emitting region 110L of the display panel 110 are sequentially captured, pixel by pixel, in the direction extending from the 384th column to the first column of the divided light emitting region 110L in the data driver 140L (backward direction; second capturing order), and the corrected image data D960 to D385 corresponding to the pixels PIX from the first column to the 576th column arranged in the divided light emitting region 110R of the display panel 110 (from the 385th column to the 960th column in the serial number) are sequentially captured, pixel by pixel, in the direction extending from the 480th column to the first column of the divided light emitting region 110R in the data driver 140R (from the 960th column to the 481st column in the serial number) (backward direction; second capturing order) (see arrows shown in the data drivers 140L, 140R in FIG. 44).

Subsequently, the selection driver 120 sequentially applies the selection signal Ssel at the selective level to the selection lines Ls in the order from the 540th row, i.e., the last row, to the first row (backward direction; second scanning direction), and sets the pixel PIX in each row to the selective state in order.

Then, in synchronization with the timing when the pixel PIX in each row is set in the selective state, the data drivers 140L, 140R apply the gradation signal (gradation voltage Vdata) based on the captured corrected image data D1 to D960 corresponding to one row (from the 384th to the first columns and from the 960th to the 385th columns in the serial number) to the data line Ld arranged in each column of the display panel 110 at a time. Accordingly, the voltage component according to the gradation signal is held in each pixel PIX in the row set in the selective state by way of each data line Ld (that is, the gradation signal is written).

In this case, in the horizontally and vertically reversed display mode, as shown in the image data correction circuit 154, the data drivers 140L, 140R, and the display panel 110 in FIG. 44 and as schematically shown in FIG. 45, each gradation signal based on the corrected image data D1 to D960 obtained by correcting the image data corresponding to each column position from the first column to the 960th column in each row from the first row to the 540th row of the image information (see addresses of the image data in FIG. 45) using the correction data corresponding to each pixel PIX from the 960th column to the first column in each row from the 540th row to the first row of the display panel 110 (see addresses of the correction data in FIG. 42) is written to each pixel PIX from the first column to the 384th column in each row of the divided light emitting region 110L of the display panel 110 and from the first column to the 576th column in each row of the divided light emitting region 110R (from the 385th column to the 960th column in the serial number).

After this writing operation of the gradation signal is sequentially executed to the pixels PIX in each of all the rows of the display panel 110, the light emitting element (organic EL element OEL) provided on each pixel PIX emits light with the luminance gradation according to the gradation signal at a time, and as a result, the image information is displayed on the display panel 110.

At this occasion, as shown in FIG. 43, the image information is displayed as the horizontally and vertically reversed image on the display panel 110.

As described above, according to the display device 100 of the present embodiment, the memory management method can be achieved in which the plurality of types of correction data according to the characteristics of the pixels PIX of the display panel 110 can be appropriately read from the memory circuit at a fast speed in accordance with various display forms (normal display and various kinds of reversed display based on image information).

Accordingly, according to the present embodiment, for example, in accordance with a display switch signal that is input from the outside of the display device 100 (for example, a signal based on pivoting angle or direction of the display device 100, switch operation of the image display performed by a user, or the like), display drive for the image information displayed on the display panel 110 can be achieved with a high quality image at a fast speed suitable for motion picture reproduction, e.g., double speed display operation and in various kinds of display forms (display patterns) by using a simple method for appropriately switching the reading direction, of the correction data in the controller 150, the capturing direction of the corrected image data in the data driver 140, and the row selection direction in the selection driver 120 (the display drive method for the display device including the memory management method for the correction data).

In this case, the display switch signal is based on, for example, a detection signal of an angle and a direction of the display panel. Therefore, even when a movable (variable angle type) or pivoting type display panel (monitor panel) is changed to any angle or direction in an electronic device such as a digital video camera and a digital camera, image information can be displayed with high visibility in the normal display or various kinds of reversed displays (display in a horizontally reversed manner, display in a vertically reversed manner, and the like) in accordance with the display switch signal defined in advance on the basis of the angle and the like of the display panel.

In the above series of drive control operations of the display device, the memory management function (memory management control) performed in the controller 150 can be executed on the basis of the vertical synchronization signal and the horizontal synchronization signal included in the timing signal supplied from the display signal generation circuit 160 to the controller 150, and therefore, the memory management function (memory management control) can apply simple and inexpensive device configuration without relying on any micro processing unit (MPU).

In the present embodiment, the display panel 110 is divided into the two (a plurality of) divided light emitting regions 110L, 110R, and the data drivers 140L, 140R which are driven at the same time are separately provided for the divided light emitting regions 110L, 110R, respectively, so that the data transfer speed when the corrected image data D1 to D960 supplied from the controller 150 are captured can be reduced. This allows a higher degree of flexibility in timing control of the drive control operation of the display device as well as reduced product cost of the display device by applying inexpensive data driver.

In the present embodiment, it is to be understood that the settings of the memory regions (memory capacity) and the addresses in the first and second correction data memory circuits 153L, 153R, the types and the numbers of correction data, the number of operation clocks serving as a unit, and the like, which as shown in the method for storing and reading the correction data in the correction data memory circuit 153, are merely examples for the sake of explanation. In short, the drive control method performed by the display device according to the present invention may be configured in other ways and may use other methods, as long as by specifying a group of addresses in synchronization with a predetermined number of operation clocks, the correction data are stored and read so that the correction data corresponding to pixels PIX whose numbers are larger than the predetermined number can be read.

<Specific Example of Display Device and Driving Control Method Therefor>

Subsequently, the configuration and the method applied to the image data correction function in the display device as shown in the above embodiments will be explained with reference to the drawings in a concrete manner. In this case, in particular, the configuration and the method concerning the acquiring operation of the correction data and the correction operation of the image data that can be applied to the display device according to the above embodiments will be mainly explained.

(Specific Example of Display Device)

First, an example of configuration of the display device according to the present invention (example) will be explained.

In the display device according to the present example, the data driver has the following features in the display device 100 (see FIG. 1) as shown in the above embodiments.

The data driver 140 includes not only the data driver function as shown in the above embodiments but also the voltage detection function, and these functions are configured to be switched based on the data control signal provided by the controller 150.

The voltage detection function executes operation of applying a detection voltage Vdac having a specific voltage value to the pixel PIX as a characteristic parameter acquiring operation target, through each data line Ld at the time of the later-described correction data (characteristic parameter) acquiring operation, fetching a voltage Vd in each data line Ld after elapse of a predetermine natural relaxation time t as data line detection voltage Vmeas(t), and converting the fetched voltage into digital data, i.e., detection data $n_{meas}$ (t), to be output to the controller 150.

(Data Driver)

Figure 46:
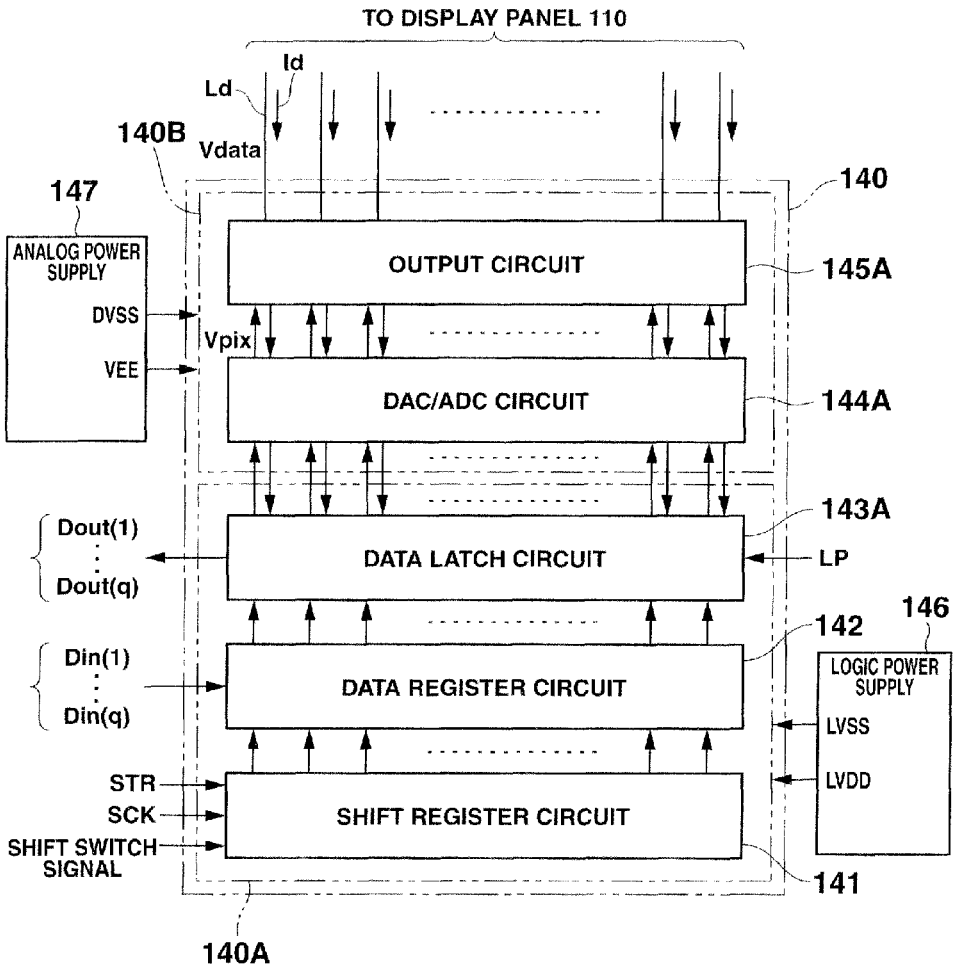
FIG. 46 is a schematic block diagram illustrating an example of a data driver applied to an example of the display device according to the present invention.

FIG. 46 is a schematic block diagram illustrating an example of a data driver applied to the example of the display device according to the present invention.

In this case, the same configuration as those of the above data driver (see FIG. 2) are denoted with the same reference numerals, and description thereabout is simplified.

Figure 47:
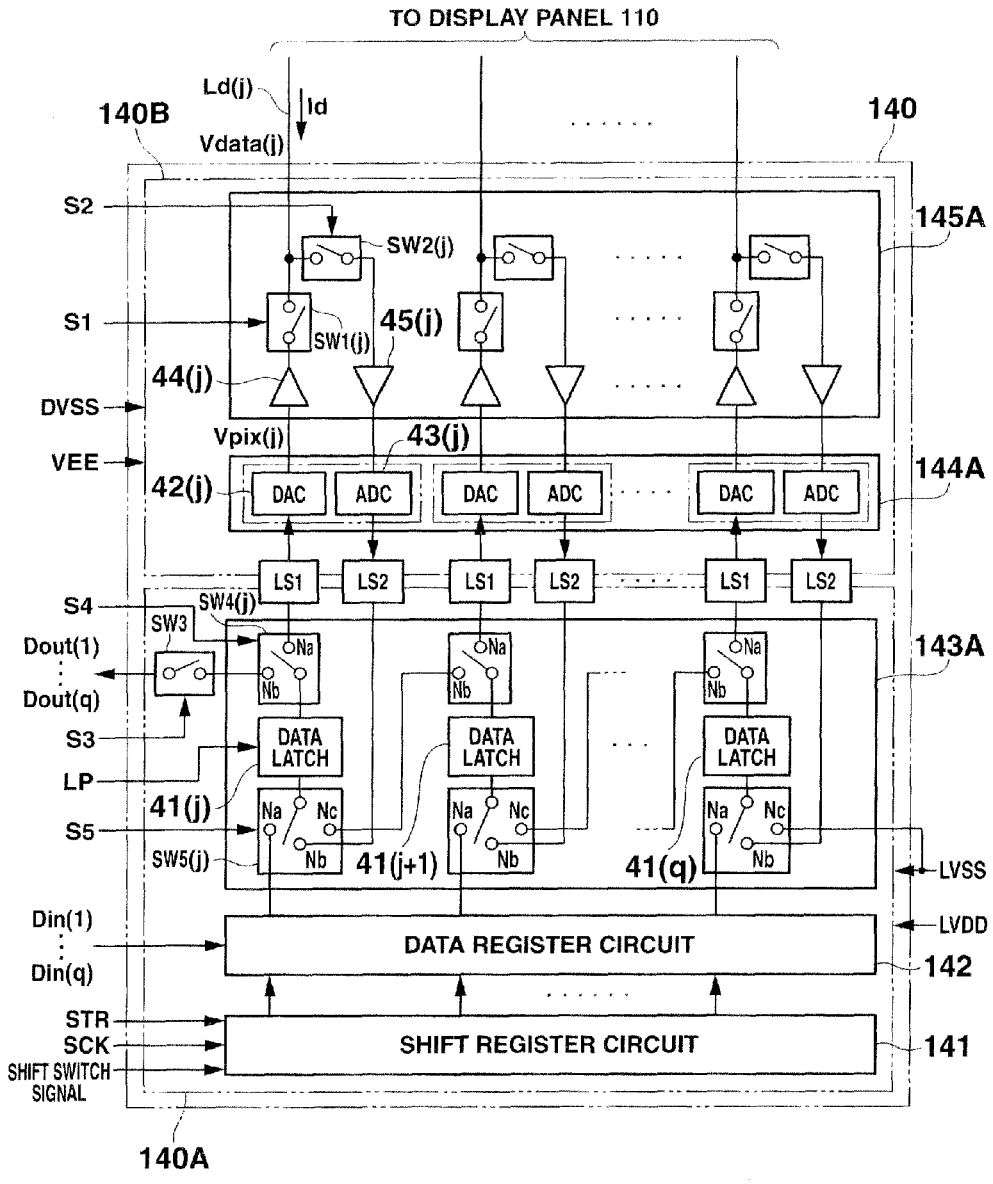
FIG. 47 is a schematic circuit configuration diagram illustrating an example of configuration of an essential portion of the data driver according to an example of the present invention.

FIG. 47 is a schematic circuit configuration diagram illustrating an example of configuration of an essential portion of the data driver as shown in FIG. 46.

In this case, only some of the number of columns (q) of the pixels PIX arranged in the display panel 110 are shown, and illustration is simplified.

In the explanation below, the configuration in the data driver 140 arranged in the data line Ld in the j-th column (a positive integer satisfying $1 \leq j \leq q$) will be explained in detail. In FIG. 47, the shift register circuit and the data register circuit are shown in a simplified manner for the sake of illustration.

For example, as shown in FIG. 46, the data driver 140 mainly includes a shift register circuit 141, a data register circuit 142, a data latch circuit 143A, a DAC/ADC circuit 144A, and an output circuit 145A.

An internal circuit 140A including the shift register circuit 141, the data register circuit 142, and the data latch circuit 143 executes a later-described image data capturing operation and a detection data transmitting operation based on power supply voltages LVSS and LVDD supplied from a logic power supply 146.

An internal circuit 140B including a DAC/ADC circuit 144A and an output circuit 145 executes a later-described gradation signal generating and outputting operation and a data line voltage detection operation based on power supply voltages DVSS and VEE supplied from an analog power supply 147.

In the present example, the shift register circuit 141 and data register circuit 142 have the same configurations as those as shown in the above embodiments, and description thereabout is omitted.

In the figure, the image data Din (1) to Din (q) supplied to the data register circuit 142 correspond to the corrected image data D1 to Dq supplied from the controller 150 as shown in the above embodiments, and are assumed to include not only the corrected image data but also image data that need not be corrected.

The data latch circuit 143A holds the pieces of image data Din(1) to Din(q) corresponding to one row captured to the data register circuit 142 in accordance with respective columns based on the data control signal (a data latch pulse signal LP) and supplies the pieces of image data Din(1) to Din(q) to the later-described DAC/ADC circuit 144A at predetermined timings at the time of a display operation (the image data capturing operation and the gradation signal generating and outputting operation).

The data latch circuit 143 holds the detection data $n_{meas}$(t) according to each data line voltage Vmeas (t) captured through the DAC/ADC circuit 144A and then outputs the detection data $n_{meas}$(t) at a predetermined timing as serial data, at the time of the later-described characteristic parameter acquiring operation (the detection data transmitting operation and the data line voltage detecting operation). Then, the data are stored to an external memory (a detection data memory circuit of a data memory circuit MEM arranged in the controller 150, explained later).

As shown in FIG. 47, the data latch circuit 143A specifically includes data latches 41(*j*) and connection changeover switches SW4(*j*) and SW5(*j*) that are provided in accordance with the respective columns, and a data output switch SW3.

The data latch 41(*j*) holds (latches) digital data fed through the switch SW5(*j*) at, e.g., a rising timing of the data latch pulse signal LP.

The switch SW5(*j*) is subjected to changeover control to selectively connect either of the data register circuit 142 on a connection point Na side, an ADC 43(*j*) of the DAC/ADC circuit 144A on a connection point Nb side, or the data latch 41(*j*+1) in an adjacent column (j+1) on a connection point Nc side to the data latch 41(*j*) based on a data control signal (a changeover control signal S5) fed from the controller 150.

As a result, when the switch SW5(*j*) is set to be connected to the connection point Na side, image data Din(j) supplied from the data register circuit 142 is held in the data latch 41(*j*).

When the switch SW5(*j*) is set to be connected to the connection point Nb side, the detection data $n_{meas}$(t) according to the data line voltage Vd (the data line detection voltage Vmeas(t)) captured to the ADC43(*j*) of the DAC/ADC circuit 144A from the data line Ld(j) is held in the data latch 41(*j*).

When the switch SW5(*j*) is set to be connected to the connection point Nc side, the detection data $n_{meas}$(t) held in the data latch 41(*j*+1) through the switch SW4(*j*+1) in the adjacent column (j+1) is held in the data latch 41(*j*).

It is to be noted that the power supply voltage LVSS of the logic power supply 146 is connected with the connection point Nc of the switch SW5(*q*) provided in the last column (q).

The switch SW4(*j*) is subjected to changeover control to selectively connect either of the DAC 42(*j*) of the DAC/ADC circuit 144A on the connection point Na side or the switch SW3 on the connection point Nb side, (or the switch SW5(*j*−1) in the adjacent column (j−1)) to the data latch 41(*j*) based on the data control signal (a changeover control signal S4) supplied from the controller 150.

As a result, when the switch SW4(*j*) is set to be connected to the Na side, image data Din(j) held in the data latch 41(*j*) is supplied to the DAC 42(*j*) of the DAC/ADC circuit 144A.

When the switch SW4(*j*) is set to be connected to the connection point Nb side, the detection data $n_{meas}$(t) according to the data line detection voltage Vmeas(t) held in the data latch 41(*j*) is output to the external memory through the switch SW3.

When the switches SW4(*j*) and SW5(*j*) of the data latch circuit 143A are subjected to changeover control based on the data control signals (changeover control signals S4, S5) fed from the controller 150 and the data latches 41(1) to 41(*q*) in the adjacent columns are connected to each other in series, the switch SW3 is controlled to enter into a conductive state based on the data control signals (a changeover control signal S3 and the data latch pulse signal LP).

As a result, the pieces of detection data $n_{meas}$(t) according to the data line voltages Vmeas(t) held in the data latches 41(1) to 41(*q*) in the respective columns are sequentially captured as serial data through the switch SW3 to be output to the external memory.

Figure 48A:
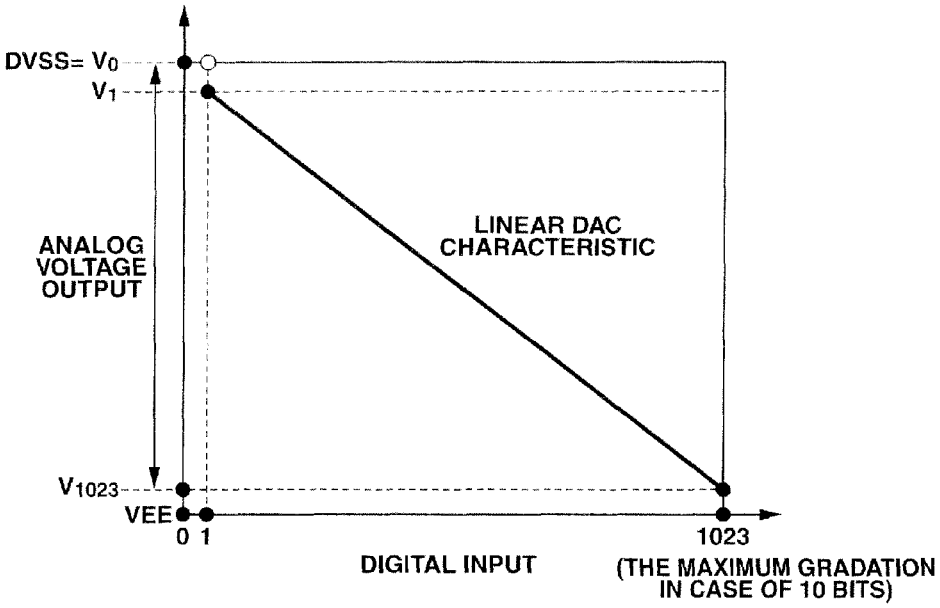
FIG. 48 is a figure illustrating input/output characteristics of a digital-analog conversion circuit (DAC) and an analog-digital conversion circuit (ADC) applied to a data driver according to an example of the present invention.
Figure 48B:
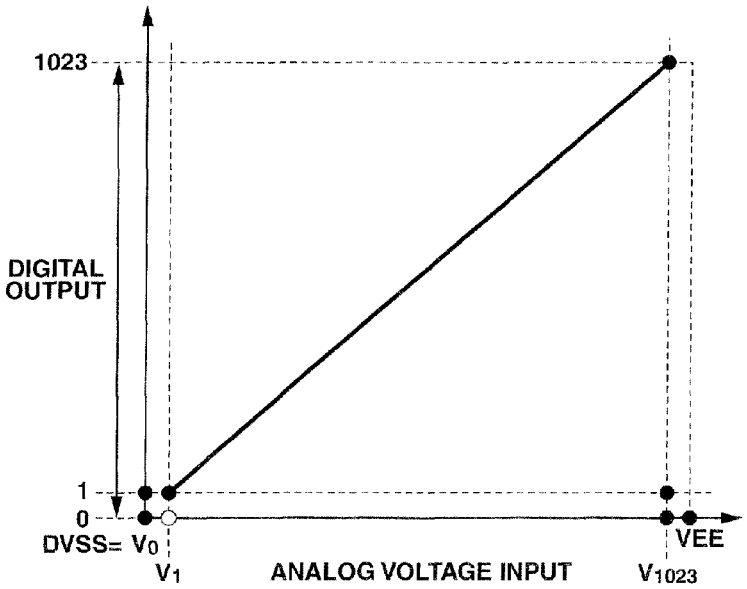

FIGS. 48A and 48B are figures illustrating input/output characteristics of a digital-analog conversion circuit (DAC) and an analog-digital conversion circuit (ADC) applied to the data driver according to the present example.

FIG. 48A is a figure illustrating input and output characteristics of the DAC applied to the present example.

FIG. 48B is a figure illustrating input and output characteristics of the ADC applied to the present example.

In this case, an example of the input and output characteristics of the digital-analog conversion circuit and the analog-digital conversion circuit when the number of input and output bits in a digital signal is 10 will be described.

As shown in FIG. 47, the DAC/ADC circuit 144A includes linear voltage digital-analog conversion circuits (DACs; voltage application circuits) 42(*j*) and analog-digital conversion circuits (ADCs; detection data acquisition circuits) 43(*j*) in accordance with the respective columns.

The DAC 42(*j*) converts image data Din(j) of digital data held in the data latch circuit 143A into an analog signal voltage Vpix to be output to the output circuit 145A.

In this case, as shown in FIG. 48A, in the DAC 42(*j*) provided in each column, conversion characteristics (the input and output characteristics) of an analog signal voltage to be output with respect to input digital data has linearity.

That is, as shown in, e.g., FIG. 48A, the DAC 42(*j*) converts digital data (0, 1, . . . , 1023) comprising 10 bits (i.e., 1024 gradations) into an analog signal voltage (V0, V1, . . . , V1023) set with the linearity.

This analog signal voltage (V0 to V1023) is set within a range of the power supply voltages DVSS to VEE supplied from the later-described analog power supply 147, and an analog signal voltage value V0 that is converted when a value of input digital data is "0" (0 gradation) is set to become the power supply voltage DVSS on a high-potential, for example. Furthermore, an analog signal voltage value V1023 that is converted when a value of digital data is "1023" (a 1023-gradation level; a maximum gradation) is set to become higher than a power supply voltage VEE on a low-potential and close to the power supply voltage VEE.

The ADC 43(*j*) converts the data line voltage Vmeas(t) comprising an analog signal voltage captured from the data line LAW into detection data $n_{meas}$(t) of digital data to be transmitted to the data latch 41(*j*).

In this case, as shown in FIG. 48B, in the ADC 43(*j*) provided in each column, conversion characteristics (input and output characteristics) of output digital data with respect to an input analog signal voltage have linearity.

Additionally, the ADC 43(*j*) is set in such a manner that a bit width of digital data at the time of voltage conversion becomes equal to that in the above DAC 42(*j*). That is, a voltage width with respect to a least significant bit (1 LSB; an analog resolution) in the ADC 43(*j*) is set to be equal to a value in the DAC 42(*j*).

For example, as shown in FIG. 48B, the ADC 43(*j*) converts the analog signal voltage (V0, V1, V1023) set in a range of the power supply voltages DVSS to VEE into digital data (0, 1, . . . , 1023) each comprising 10 bits (the 1024 gradations) set with the linearity.

The ADC 43(*j*) is set in such a manner that a value of digital data is converted into "0" (the 0 gradation level) when a voltage value of an input analog signal voltage is V0 (=DVSS), for example. The ADC 43(*j*) is set in such a manner that a voltage value of an analog signal voltage is converted into a digital signal value "1023" (the 1023 gradation level; the maximum gradation) when it is higher than the power supply voltage VEE and equal to the analog signal voltage V1023 that is a voltage value near the power supply voltage VEE.

In the present example, the internal circuit 140A including the shift register circuit 141, the data register circuit 142, and the data latch circuit 143A is configured as a low-breakdown voltage circuit, and the internal circuit 140B including the DAC/ADC circuit 144A and the later-described output circuit 145A is configured as a high-breakdown voltage circuit.

Therefore, a level shifter LS1(*j*) is provided between the data latch circuit 143A (the switch SW4(*j*)) and the DAC 42(*j*) of the DAC/ADC circuit 144A as a voltage adjustment circuit from the low-breakdown voltage internal circuit 140A to the high-breakdown voltage internal circuit 140B.

Further, a level shifter LS2(*j*) is provided between the ADC 43(*j*) of the DAC/ADC circuit 144A and the data latch circuit 143A (the switch SW5(*j*)) as a voltage adjustment circuit from the high-breakdown voltage internal circuit 1408 to the low-breakdown voltage internal circuit 140A.

As shown in FIG. 47, the output circuit 145A includes buffers 44(*j*) and switches SW1(*j*) (connection changeover circuits) that are configured to output gradation signal to the data lines Ld(j) corresponding to the respective columns and switches SW2(*j*) and buffers 45(*j*) that are configured to capture a data line voltage Vd (the data line detection voltage Vmeas(t)).

The buffer 44 (*j*) amplifies an analog signal voltage Vpix(j) generated by converting the image data Din(j) using the DAC 42(*j*) into analog to a predetermined signal level, and generates a gradation voltage Vdata (j).

The switch SW1(*j*) controls application of the gradation voltage Vdata(j) to the data line Ld(j) based on the data control signal (a changeover control signal S1) supplied from the controller 150.

The switch SW2(*j*) controls capture of a data line voltage Vd (the data line detection voltage Vmeas(t)) based on the data control signal (a changeover control signal S2) supplied from the controller 150.

The buffer 45(*j*) amplifies the data line voltage Vmeas(t) captured through the switch SW2(*j*) to a predetermined signal level, and transmits the data line voltage Vmeas(t) to the ADC43 (*j*).

The logic power supply 146 supplies the low-potential power supply voltage LVSS and the high-potential power supply voltage LVDD comprising logic voltages that are used to drive the internal circuit 140A including the shift register circuit 141, the data register circuit 142 and the data latch circuit 143A in the data driver 140.

The analog power supply 147 supplies the high-potential power supply voltage DVSS and the low-potential power supply voltage VEE comprising analog voltages that are used to drive the internal circuit 140B including the DAC 42(*j*) and the ADC 43(*j*) of the DAC/ADC circuit 144A and the buffers 44(*j*) and 45(*j*) the output circuit 145A.

It is to be noted that, in the data driver 140 depicted in FIG. 46 and FIG. 47, the control signals that are used to control operations of the respective units are input to the data latch 41 and the switches SW1 to SW5 provided in accordance with the data line Ld(j) in the j-th column (corresponding to the first column in the drawing). In the present example, it is needless to say that these control signals are input to a configuration according to each column in common.

(Controller)

Figure 49:
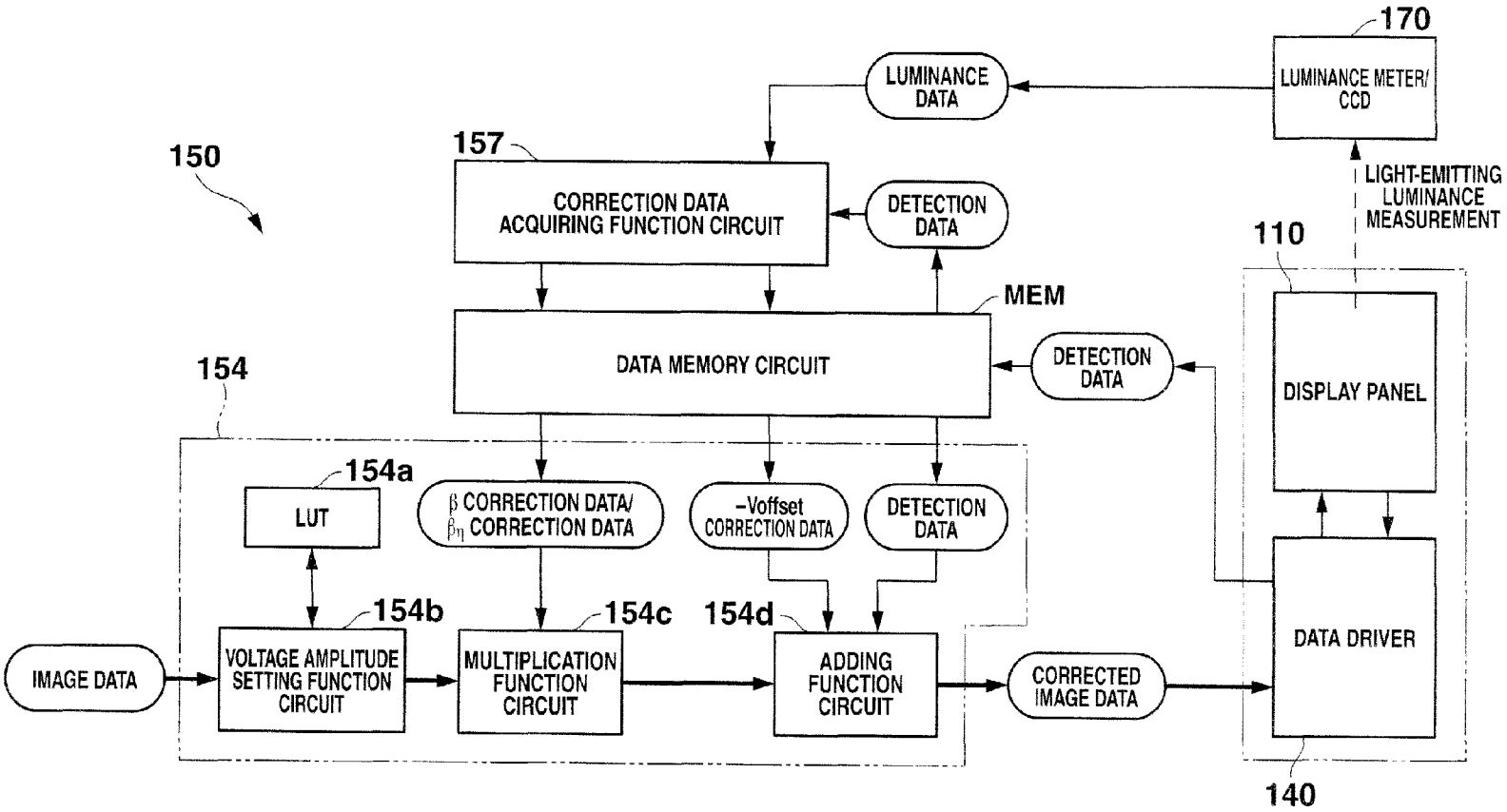
FIG. 49 is a functional block diagram illustrating an image data correction function of a controller applied to the display device according to the example of the present invention.

FIG. 49 is a functional block diagram illustrating an image data correction function of a controller applied to the display device according to the present example.

It is to be noted that, in FIG. 49, flows of data between respective functional blocks are all indicated by solid arrows for the sake of illustration. Any one of these data flows is actually activated in accordance with an operating state of the controller as will be described later.

As described above, the controller 150 includes the driver control function, the image data correction function, and the memory management function.

The controller 150 uses these functions to supply the selection control signal, the power supply control signal, and the data control signal, thereby controlling (1) operation of causing each of the selection driver 120, the power supply driver 130, and the data driver 140 to operate at a predetermined timing and acquiring characteristic parameters of the pixels PIX of the display panel 110 (characteristic parameter acquiring operation), (2) operation of correcting the image data corrected on the basis of the characteristic parameters of the pixels PIX (image data correction operation), and (3) operation of displaying desired image information on the display panel 110 by causing the pixels PIX to emit light with luminance gradations according to the corrected image data (display operation).

Since the memory management function of the controller 150 has been explained in detail in the above embodiments, it is simplified in the explanation below.

In the characteristic parameter acquiring operation, the controller 150 acquires various kinds of correction data (characteristic parameter) on the basis of the detection data concerning change of the characteristic of each pixel PIX detected by way of the data driver 140 (which will be explained later in detail) and the luminance data detected for each pixel PIX (which will be explained later in detail).

In the image data correction operation and display operation, the controller 150 corrects the image data supplied from the outside on the basis of the correction data acquired in the characteristic parameter acquiring operation, and the corrected image data are supplied to the data driver 140 as the corrected image data.

In this case, the image data correction operation is executed by the image data correction circuit 154 arranged in the controller 150 as shown in the above embodiments.

For example, as shown in FIG. 49, the controller 150 mainly includes a data memory circuit MEM, an image data correction circuit 154 as shown in the above embodiments, and a correction data acquiring function circuit 157 in order to execute each operation explained above.

The data memory circuit MEM is a general term including the correction data storage circuit 152 and correction data memory circuit 153 as shown in the above embodiments and further including the detection data memory circuit for saving the detection data output from the data driver 140.

The detection data memory circuit provided in the data memory circuit MEM stores the detection data of the pixels PIX transmitted from the data driver 140 in association with the pixels PIX, and during adding processing performed by the above adding function circuit 154*d* and during correction data acquisition processing performed by the correction data acquiring function circuit 157, the detection data memory circuit reads and outputs the detection data.

The correction data storage circuit 152 provided in the data memory circuit MEM stores the correction data acquired by the correction data acquiring function circuit 157 in association with each pixel PIX.

During multiplication processing performed by the multiplication function circuit 154*c* and during adding processing performed by the adding function circuit 154*d*, the correction data memory circuit 153 reads the correction data stored in the correction data storage circuit 152 in advance and temporarily saves the correction data. In accordance with arithmetic processing of the image data (correction processing), the correction data are read as necessary, and are output to the image data correction circuit 154.

More specifically, as shown in FIG. 49, the image data correction circuit 154 includes a voltage amplitude setting function circuit 154*b* having a look up table (LUT) 154*a*, a multiplication function circuit 154*c*, and an adding function circuit 154*d*.

The voltage amplitude setting function circuit 154*b* looks up the look up table 154*a* for the image data of digital data supplied from the outside (for example, the above display signal generation circuit 160), thereby converting the image data into voltage amplitudes corresponding to respective colors, i.e., red (R), green (G), blue (B). A maximum value of the voltage amplitude converted by the voltage amplitude setting function circuit 154*b* is set to be equal to or below the value obtained by subtracting a correction amount based on the characteristic parameter of each pixel from a maximum value of the input range of the DAC 42.

Figure 50:
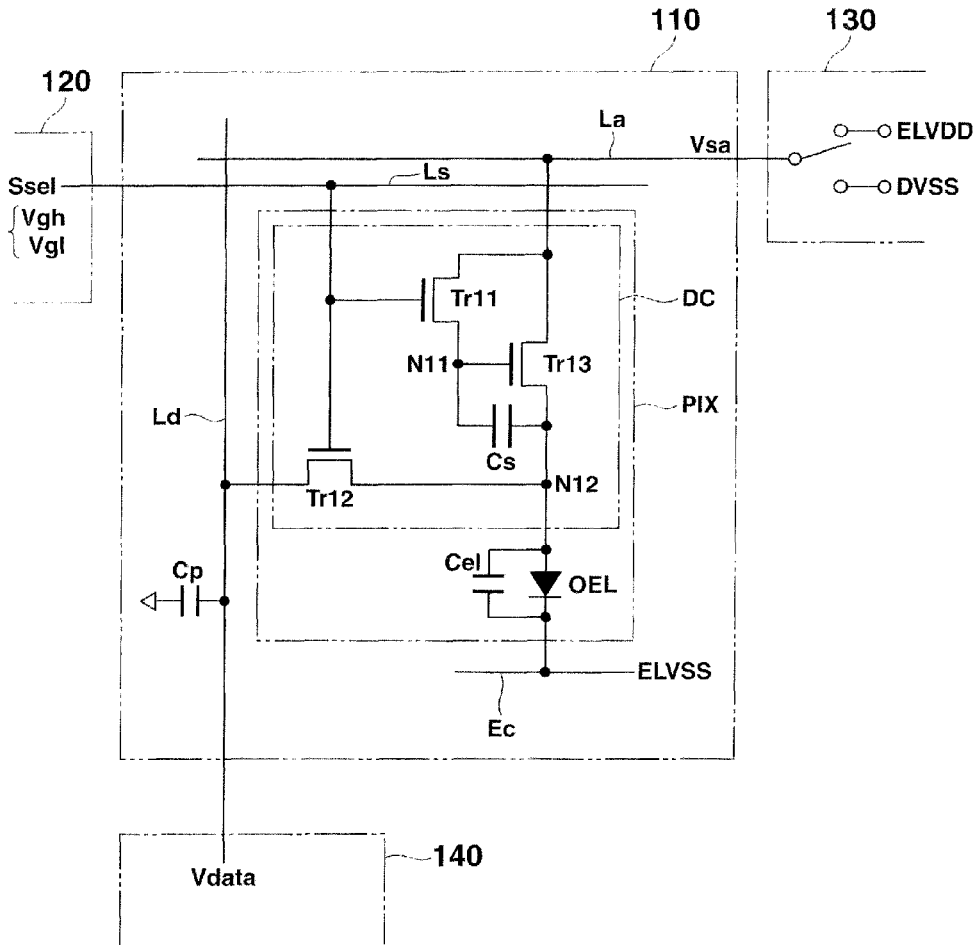
FIG. 50 is a circuit configuration diagram illustrating an example of a pixel applied to the display device according to the example of the present invention.

In this case, as for the look up table 154*a* looked up by the voltage amplitude setting function circuit 154*b*, a conversion table (a gamma table) is previously set to correct fluctuation in light-emitting voltage caused by a parasitic capacitance (a capacitance component) added to a drive transistor provided in each pixel PIX shown in the above embodiments (see FIG. 4 or 50). Moreover, the voltage amplitude setting function circuit 154*b* has a through function or a bypass path for outputting input digital data as it is. Additionally, at the time of a characteristic parameter acquiring operation to which a later-described auto-zero method is applied, input digital data is set to be output as it is without being subjected to the voltage amplitude conversion processing using the look up table 154*a*.

The multiplication function circuit 154*c* multiplies image data by correction data $\Delta\beta$ of a current gain $\beta$ obtained based on detection data concerning change in characteristic of each pixel PIX or correction data $\Delta\beta\eta$ of the current gain $\beta$ including a correction component $\Delta\eta$ of a light-emitting current efficiency $\eta$ based on luminance data Lv detected in regard to each pixel PIX.

The addition function circuit 154*d* adds the detection data concerning change in characteristic of each pixel PIX and the compensation voltage component (an offset voltage) of the threshold voltage Vth to the image data multiplied by the correction data $\Delta\beta$ or the correction data $\Delta\beta\eta$ in the multiplication function circuit 154*c* to effect correction. Then, this corrected image data are supplied to the data drier 140 as correction image data via the driver transfer circuit 155 as shown in the above embodiments.

The correction data acquiring function circuit 157 acquires the current gain $\beta$, the light-emitting current efficiency $\eta$, and the correction data of the threshold voltage Vth, on the basis of the detection data concerning change of the characteristic of each pixel PIX and luminance data detected in each pixel PIX.

The luminance data of each pixel PIX are measured as follows. For example, the luminance meter or the CCD camera (luminance measuring circuit) 170 is used to measure a light-emitting luminance of each pixel PIX when the display panel 110 is caused to perform light-emitting operation on the basis of the image data of the predetermined luminance gradations. It should be noted that a specific method for measuring the luminance data will be explained later.

In the controller 150 as shown in FIG. 49, the correction data acquiring function circuit 157 may be an arithmetic device provided outside of the controller 150.

In the controller 150 as shown in FIG. 49, the correction data storage circuit 152, the correction data memory circuit 153, and the detection data memory circuit may be provided separately as long as the data memory circuit MEM stores the detection data and the correction data in association with each pixel PIX.

At least some of these memories may be provided outside of the controller 150.

As shown in the above embodiments, for example, the image data supplied to the controller 150 are obtained by extracting a luminance gradation signal component from a video signal in the display signal generation circuit 160 and forming the luminance gradation signal component as serial data of a digital signal for each of the display panel 110, and further, the image data are read in the image data holding circuit 151 in a predetermined order according to the display form of the image information and division setting of the display panel 110.

(Pixel)

FIG. 50 is a circuit configuration diagram illustrating an example of a pixel applied to the display device according to the present example. In this case, the same circuit configuration as the pixel PIX as shown in the above embodiments (see FIG. 4) is shown, and the signal voltages applied to the selection line Ls, the power supply line La, and the common electrode Ec will be explained.

As shown in FIG. 50, like the pixel PIX as shown in the above embodiments, the pixel applied to the display panel 110 according to the present example is arranged near each intersecting point of the selection lines Ls and the power supply lines La and the data lines Ld. For example, the pixel PIX includes an organic EL element OEL as a light-emitting element and a light-emitting drive circuit DC including transistors Tr11 to Tr13 and a capacitor Cs.

The selection signal Ssel of the selective level (for example, high level; Vgh) or the non-selective level (for example, low level; Vgl) is applied to the selection line Ls connected with the gate terminals of the transistors Tr11 and Tr12 from the selection driver 120.

The power supply voltage Vsa at the light-emitting level ELVDD or the non-light-emitting level DVSS is applied from the power supply driver 130 to the power supply line La connected with the drain terminal of the transistor Tr11 and the drain terminal of the transistor Tr13.

The common electrode Ec is connected with a voltage source like the above embodiments, and a predetermined reference voltage ELVSS (for example, ground potential GND; corresponding to the above reference voltage Vsc) is applied to the common electrode Ec.

In the pixel PIX shown in FIG. 50, a pixel capacitance Cel is present in the organic EL element OEL in addition to the capacitor Cs. Moreover, a wiring parasitic capacitance Cp is present on the data line Ld.

In the pixel PIX having the above circuit configuration (see FIG. 50), a relationship between a power supply voltage Vsa (ELVDD, DVSS) applied to the power supply line La from the power supply driver 130, a voltage ELVSS applied to a common electrode Ec, and the power supply voltage VEE supplied to the data driver 140 from the analog power supply 147 is set to satisfy, e.g., the following conditions.

$$\left.\begin{array}{l} DVSS < ELVDD \\ DVSS = ELVSS \\ VEE < ELVSS \end{array}\right\} \quad (1)$$

(Specific Example of Driving Control Method)

Subsequently, the driving control method performed in the display device according to the example will be explained in a concrete manner.

The drive control operation performed by the display device according to the example includes the characteristic parameter acquiring operation and the display operation including the image data correction operation.

In the characteristic parameter acquiring operation, a parameter that is used to compensate fluctuation in light-emitting characteristic in each pixel PIX arranged in the display panel 110 is acquired. More specifically, the characteristic parameter acquiring operation executes an operation of acquiring a parameter that is used to correct fluctuation in the threshold voltage Vth of the transistor (the drive transistor) Tr13 provided in the light-emitting drive circuit DC of each pixel PIX, a parameter that is used to correct variation of the current gain β in each pixel PIX, and a parameter that is used to correct variation of the light-emitting efficiency η of the organic EL element OEL in each pixel PIX.

In the display operation including the image data correction operation, correction image data are generated by correcting image data of digital data on the basis of the characteristic parameter (correction data) acquired by the characteristic parameter acquiring operation in accordance with each pixel PIX, a gradation voltage Vdata according to the correction image data are generated, and the data are written into each pixel PIX.

As a result, each pixel PIX (the organic EL element OEL) emits light in an original luminance gradation according to the image data obtained by compensating fluctuation or variation in light emitting characteristics (the threshold voltage Vth and the current gain β of the transistor Tr13, the light-emitting current efficiency η of the organic EL element OEL) in each pixel PIX.

Hereinafter, each operation will now be explained in a concrete manner.

(Characteristic Parameter Acquiring Operation)

First, description will be given as to a peculiar technique that is applied to the characteristic parameter acquiring operation according to the present example. Then, an operation of acquiring characteristic parameters that are used to compensate the threshold voltage Vth and the current gain β in each pixel PIX by using this technique will be described. Subsequently, an operation of acquiring a characteristic parameter that is used to compensate the light-emitting current efficiency q will be explained.

First, description will be first given as to voltage-current (V-I) characteristics of the light-emitting drive circuit DC when image data are written into the pixel PIX having the light-emitting drive circuit DC depicted in FIG. 50 from the data driver 140 via the data line Ld (the gradation voltage Vdata according to the image data are applied).

Figure 51:
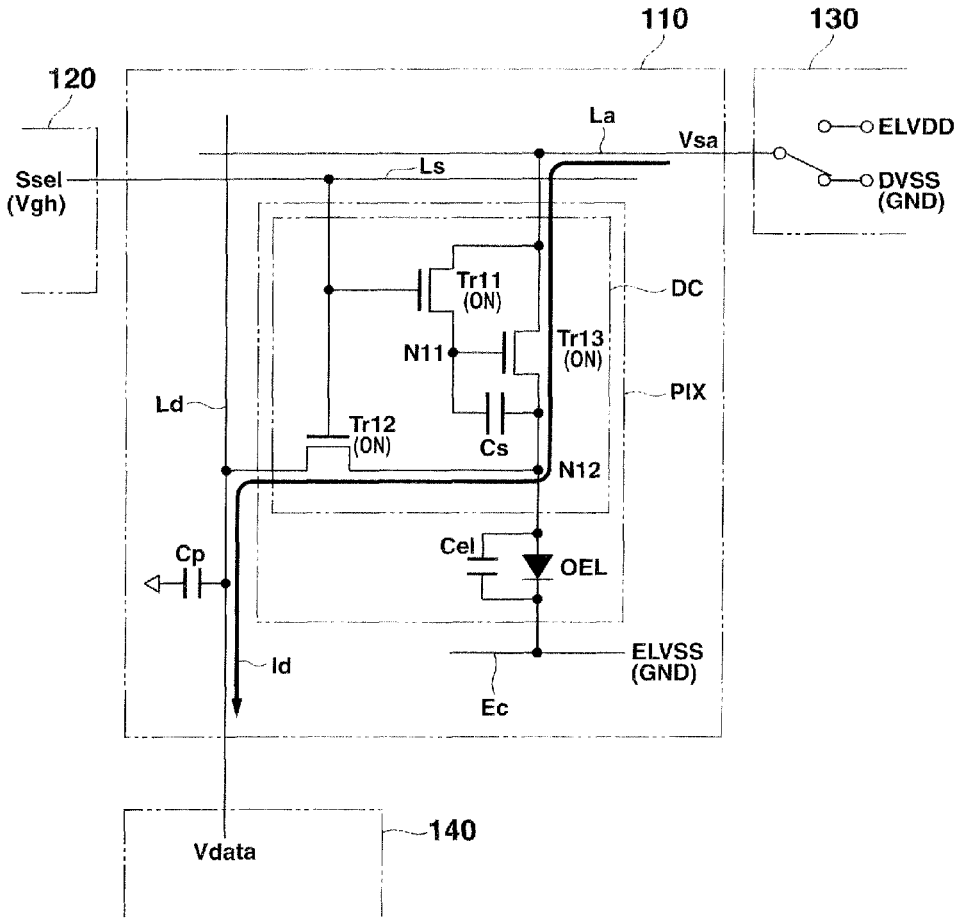
FIG. 51 is an operating state figure during writing operation of image data at a pixel to which a light emitting drive circuit according to the example of the present invention is applied.

FIG. 51 is an operating state figure during writing operation of image data at a pixel to which a light emitting drive circuit according to the present example is applied.

Figure 52:
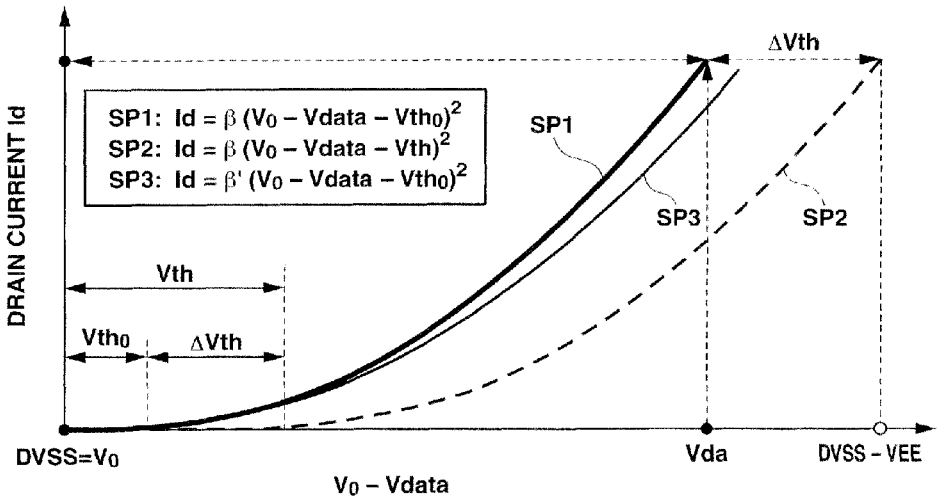
FIG. 52 is a figure illustrating voltage-current characteristics during writing operation at a pixel to which the light emitting drive circuit according to the example of the present invention is applied.

FIG. 52 is a figure illustrating voltage-current characteristics during writing operation at a pixel to which the light emitting drive circuit according to the present example is applied.

In the operation of writing the image data into the pixel PIX according to the present example, as shown in FIG. 51, the pixel PIX is set to a selective state by applying a selection signal Ssel at a selective level (for example, a high level; Vgh) from the selection driver 120 via the selection line Ls.

At this occasion, the transistors Tr11 and Tr12 of the light-emitting drive circuit DC attain ON-state, whereby the gate and drain terminals of the transistor Tr13 are short-circuited to attain a diode connection state.

In this selective state, a power supply voltage Vsa (=DVSS) at a non-light-emitting level is applied from the power supply driver 130 through the power supply line La.

Furthermore, a gradation voltage Vdata having a voltage value according to the image data is applied to the data line Ld from the data driver 140. The gradation voltage Vdata is set to a voltage value lower than the power supply voltage DVSS that is applied from the power supply driver 130.

Therefore, when the power supply voltage DVSS is set to 0 V (the ground potential GND), the gradation voltage Vdata is set to a negative voltage value.

As a result, as shown in FIG. 51, a drain current Id according to the gradation voltage Vdata flows in a direction of the data line Ld from the power supply driver 130 through the power supply line La and the transistors Tr13 and Tr12 of the pixel PIX (the light-emitting drive circuit DC).

Here, since the voltage ELVSS and the power supply voltage DVSS applied to the cathode (the cathode electrode) of the organic EL element OEL are set to the same voltage value like the condition (1) and they are both 0 V (the ground potential GND), a reverse bias is applied to the organic EL element OEL, and the light-emitting operation is not performed.

Now, circuit characteristics of the light-emitting drive circuit DC in this case will now be verified. Where Vth0 denotes a threshold voltage of the transistor Tr13 and β denotes a current gain in an initial state in which the threshold voltage Vth of the transistor Tr13 as the drive transistor does not fluctuate in the light-emitting drive circuit DC and the current gain β in the light-emitting drive circuit DC does not vary, a current value of the drain current Id depicted in FIG. 51 can be represented by the following Expression (2).

$$Id=\beta(V0-V\text{data}-Vth0)^2 \quad (2)$$

In this expression, both the current gain β of a design value or typical value in the light-emitting drive circuit DC and the initial threshold voltage Vth0 of the transistor Tr13 are constant values.

Furthermore, V0 denotes a power supply voltage Vsa (=DVSS) on a non-light-emitting level applied from the power supply driver 130, and a voltage (V0−Vdata) corresponds to a potential difference that is applied to a circuit configuration in which current paths of the drive transistors Tr13 and Tr12 are connected in series.

Relationship (V-I characteristics) between a value of the voltage (V0−Vdata) applied to the light-emitting drive circuit DC at this moment and a current value of the drain current Id flowing through the light-emitting drive circuit DC is represented as a characteristic line SP1 in FIG. 52.

Where Vth (=Vth0+LVth) denotes a threshold voltage after fluctuation (threshold voltage shift; fluctuation amount is denoted as ΔVth) occurs in element characteristics of the transistor Tr13 due to a change with time, circuit characteristics of the light-emitting drive circuit DC vary as represented by the following Expression (3).

In this case, Vth is a constant. The voltage-current (V-I) characteristics of the light-emitting drive circuit DC at this occasion are represented as a characteristic line SP2 in FIG. 52.

$$Id\beta=(V0-V\text{data}-Vth)^2 \quad (3)$$

Where β' denotes a current gain when the current gain β varies in the initial state represented by Expression (2), circuit characteristics of the light-emitting drive circuit DC can be represented by the following Expression (4).

$$Id=\beta'(V0-V\text{data}-Vth0)^2 \quad (4)$$

In this expression, β' is a constant. The voltage-current (V-I) characteristics of the light-emitting drive circuit DC at this occasion are represented as a characteristic line SP3 in FIG. 52.

It is to be noted that the characteristic line SP3 in FIG. 52 indicates the voltage-current (V-I) characteristics of the light-emitting drive circuit DC when the current gain β' in Expression (4) is smaller than the current gain β depicted in Expression (2).

In Expressions (2) and (4), where βtyp denotes a current gain of the design value or the typical value, Δβ is a parameter (correction data) used to correct the current gain β' to this value.

At this occasion, correction data Δβ are given to each light-emitting drive circuit DC in such a manner that a multiplied value of the current gain β' and the correction data Δβ becomes the current gain βtyp of the design value (i.e., in such a manner that β'×Δβ→βtyp is achieved).

Further, in the present example, based on the voltage-current characteristics (Expressions (2) to (4) and FIG. 52) of the light-emitting drive circuit DC, the threshold voltage Vth of the transistor Tr13 and a characteristic parameter required to correct the current gain β' are acquired by using the following peculiar technique.

In this specification, the following technique is referred to as an "auto-zero method" for the sake of convenience.

According to the technique (the auto-zero method) applied to the characteristic parameter acquiring operation in the present example, in the pixel PIX having the light-emitting drive circuit DC depicted in FIG. 50, a predetermined detection voltage Vdac is first applied to the data line Ld by using a data driver function of the data driver 140 at the selective state.

Thereafter, the data line Ld is set to a high-impedance (HZ) state to naturally alleviate a potential in the data line Ld.

Furthermore, a voltage Vd (the data line detection voltage Vmeas(t)) in the data line Ld after effecting this natural relaxation for a certain period of time (relaxation time t) is captured by using a voltage detecting function of the data driver 140, and is converted into the detection data $n_{meas}(t)$ of digital data.

In the present example, this relaxation time t is set to different times (timings; t0, t1, t2, t3) to execute, a plurality of times, capture of the data line detection voltage Vmeas(t) and conversion into the detection data $n_{meas}(t)$.

Figure 53:
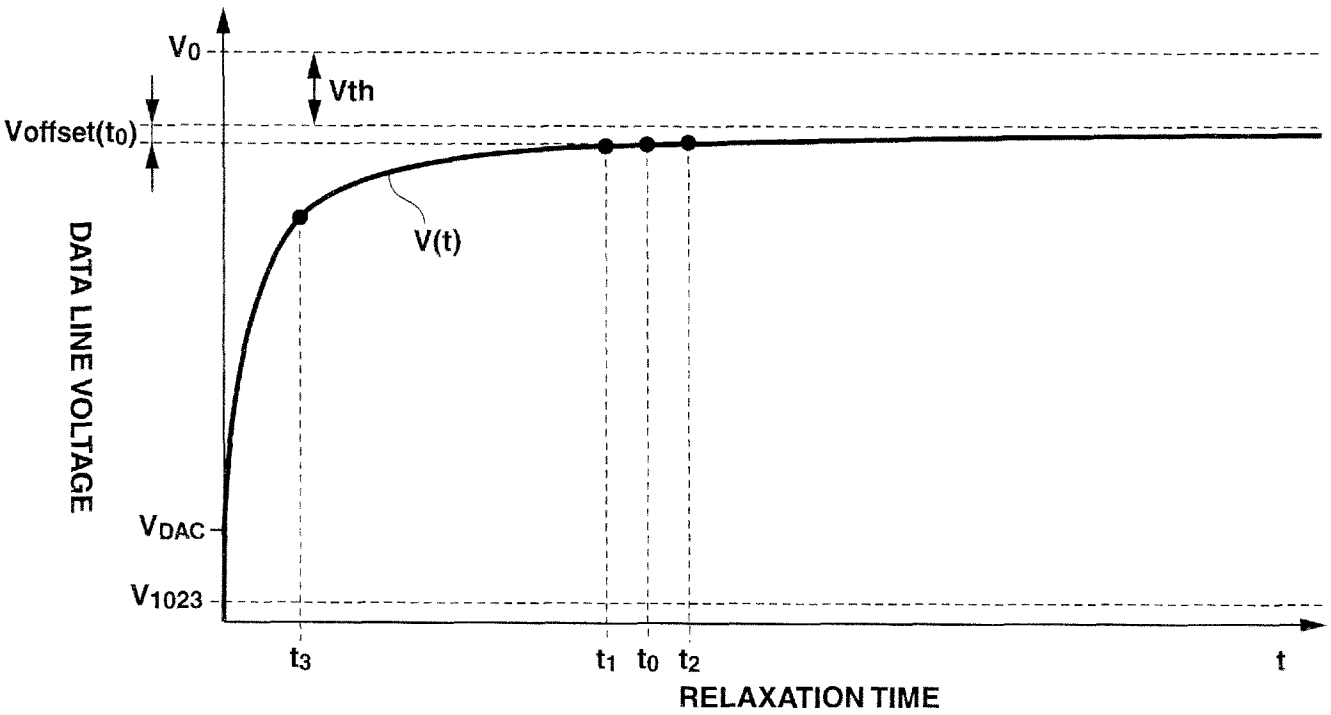
FIG. 53 is a figure illustrating change of a data line voltage according to a method applied to characteristic parameter acquiring operation according to the example of the present invention (auto-zero method)

FIG. 53 is a figure illustrating change of a data line voltage (a transient curve) according to a method applied to characteristic parameter acquiring operation according to the present example (auto-zero method).

More specifically, in the characteristic parameter acquiring operation using the auto-zero method, the pixel PIX is first set to the selective state, and the detection voltage Vdac is applied to the data line Lb from the data driver 140 in such a manner that a voltage exceeding the threshold voltage of the transistor Tr13 of the light-emitting drive circuit DC is applied between the gate and source terminals (between the connection points N11 and N12) of the transistor Tr13 in this state.

At this occasion, in a write operation with respect to the pixel PIX, since the power supply voltage DVSS (=V0; the ground potential CND) at the non-light-emitting level is applied to the power supply line La from the power supply driver 130, a voltage corresponding to a potential difference (V0−Vdac) is applied to the part between the gate and source terminals of the transistor Tr13.

Therefore, the detection voltage Vdac is set to a voltage satisfying the condition V0−Vdac>Vth. Further, the detection voltage Vdac is set to a voltage value that is lower than the power supply voltage DVSS and has a negative polarity with respect to the power supply voltage ELVSS (the ground potential GND) applied to the common electrode Ec connected to the cathode of the organic EL element OEL.

As a result, the drain current Id according to the detection voltage Vdac flows in the data line id direction from the power supply driver 130 via the power supply line La and the transistors Tr13 and Tr12. At this occasion, the capacitor Cs connected to the part between the gate and the source (between the connection points N11 and N12) of the transistor Tr13 is charged with a voltage according to the detection voltage Vdac.

Subsequently, the data input side (the data driver 140 side) of the data line id is set to the high-impedance (HZ) state.

The voltage with which the capacitor Cs is charged is maintained at a voltage according to the detection voltage Vdac immediately after the data line Ld is set to the high-impedance state. Therefore, a voltage Vgs between the gate and the source of the transistor Tr13 is maintained at a voltage with which the capacitor Cs is charged.

As a result, the transistor Tr 13 maintains the ON-state immediately after the data line Ld is set to the high-impedance state, whereby the drain current Id flows through the part between the drain and the source of the transistor Tr13.

A potential at the source terminal (the connection point N12) of the transistor Tr13 gradually increases to approximate a potential at the drain terminal side with elapse of time, and a current value of the drain current Id flowing between the drain and the source of the transistor Tr13 is reduced.

With this reduction, a part of the electric charge stored in the capacitor Cs is discharged, whereby a voltage between both ends of the capacitor Cs (the voltage Vgs between the gate and the source of the transistor Tr13) is gradually decreased.

As a result, as shown in FIG. 53, the voltage Vd in the data line Ld gradually increases from the detection voltage Vdac with elapse of time to converge on a voltage (V0−Vth) obtained by subtracting the threshold voltage Vth of the transistor Tr13 from the voltage at the drain terminal side of the transistor Tr13 (the power supply voltage DVSS of the power supply line La (=V0)) (natural relaxation).

Furthermore, in such natural relaxation, when the drain current Id finally stops flowing between the drain and the source of the transistor Tr13, the discharge of the electric charge stored in the capacitor Cs stops. At this occasion, gate voltage of the transistor Tr13 (the voltage Vgs between the gate and the source) becomes the threshold voltage Vth of the transistor Tr13.

In this case, in a state in which the drain current Id does not flow between the drain and the source of the transistor Tr13 of the light-emitting drive circuit DC, the voltage between the drain and the source of the transistor Tr12 becomes substantially zero, and hence the data line voltage Vd becomes substantially equal to the threshold voltage Vth of the transistor Tr13 at the end of the natural relaxation.

In the transient curve depicted in FIG. 53, the data line voltage Vd converges on the threshold voltage Vth (=|V0−Vth|; V0=0 V) of the transistor Tr13 with elapse of time (the relaxation time t). The data line voltage Vd unboundedly gradually approximates the threshold voltage Vth. However, it does not become completely equal to the threshold voltage Vth in theory even if the relaxation time t is set to a sufficiently long time.

Such a transient curve (a behavior of the data line voltage Vd caused due to the natural relaxation) can be represented by the following Expression (11).

$$Vd = V_{meas}(t) = V_0 - Vth - \frac{V_0 - Vdac - Vth}{(\beta/C)t(V_0 - Vdac - Vth) + 1} \tag{11}$$

In Expression (11), C denotes a sum total of capacitance components added to the data line Ld in the circuit configuration of the pixel PIX depicted in FIG. 50, and it is expressed as C=Cel+Cs+Cp (Cel; a pixel capacitance, Cs; a capacitor capacitance, Cp; a wiring parasitic capacitance).

It is to be noted that the detection voltage Vdac is defined as a voltage value satisfying conditions in the following Expression (12).

$$\left.\begin{aligned} Vdac &:= V_1 - \Delta V \times (n_d - 1) \\ V_0 - Vdac &- \mathrm{Vth_max} > O \end{aligned}\right\} \tag{12}$$

In Expression (12), Vth_max represents a compensation limit value of the threshold voltage Vth of the transistor Tr13.

In this case, nd is defined as initial digital data (digital data required to specify the detection voltage Vdac) input to the DAC 42 in the DAC/ADC circuit 144 of the data driver 140, and d is selected from any value satisfying the condition in Expression (12) from 1 to 1023 when the digital data rid comprising 10 bits.

ΔV is defined as a bit width (a voltage width corresponding to 1 bit) of the digital data, and it is represented like the following Expression (13) when the digital data nd consists of 10 bits.

$$\Delta V := \frac{V_1 - V_{1023}}{1022} \tag{13}$$

Further, in Expression (11), the data line voltage Vd (the data line detection voltage Vmeas(t)), a convergence value V0-Vth of the data line voltage Vd, and a parameter β/C comprising the current gain β and a sum total C of the capacitance components are defined as represented by the following Expressions (14) and (15).

A digital output (detection data) from the ADC 43 with respect to the data line voltage Vd (the data line detection voltage Vmeas(t)) at the relaxation time t is defined as $n_{meas}$(t), and digital data of the threshold voltage Vth is defined as $n_{th}$.

$$\left.\begin{aligned} Vmeas(t) &:= V_1 - \Delta V \times (n_{meas} - 1) \\ V_0 - Vth &:= V_1 - \Delta V \times (n_{th} - 1) \end{aligned}\right\} \quad (14)$$

$$\xi := (\beta / C) \cdot \Delta V \quad (15)$$

Furthermore, based on the definitions represented by Expressions (14) and (15), when Expression (11) is substituted by relationship between actual digital data (image data) rid input to the DAC 42 and digital data (detection data) $n_{meas}$(t) subjected to analog-digital conversion by the ADC 43 to be actually output in the DAC/ADC circuit 144 of the data driver 140, the following Expression (16) can be obtained.

$$n_{meas}(t) = n_{th} + \frac{n_d - n_{th}}{\xi \cdot t \cdot (n_d - n_{th}) + 1} \quad (16)$$

In Expressions (15) and (16), ξ is a digital representation of the parameter β/C in an analog value, and ξ·t is nondimensional.

In this case, it is determined that a threshold voltage Vth0 at the initial stage in which fluctuation (Vth shift) does not occur in the threshold voltage Vth of the transistor Tr13 is approximately 1 V.

At this occasion, when two different relaxation times t=t1 and t2 are set to satisfy the condition $\xi \cdot t \cdot (nd - n_{th}) >> 1$, a compensation voltage component (an offset voltage) Voffset(t0) according to fluctuation in threshold voltage of the transistor Tr13 can be expressed by the following Expression (17).

$$V_{offset}(t_0) = \frac{\Delta V}{\xi \cdot t_0} = \Delta V \cdot (n_1 - n_2) \cdot \frac{t_2 \cdot t_1}{t_2 - t_1} \cdot \frac{1}{t_0} \quad (17)$$

In Expression (17), n1 and n2 are digital data (detection data) $n_{meas}$ (t1), $n_{meas}$ (t2) that are output from the ADC 43 when the relaxation time t is set to t1 or t2 in Expression (16).

Based on Expressions (16) and (17), the digital data $n_{th}$ of the threshold voltage Vth of the transistor can be represented like the following Expression (18) by using digital data $n_{meas}$ (t0) that are output from the ADC 43 at the relaxation time t=t0.

Digital data digital Voffset of the offset voltage Voffset can be presented like the following Expression (19).

In Expressions (18) and (19), <ξ> is an average value of all pixels of ξ that is a digital value of the parameter β/C. In this case, in regard to <ξ>, a fractional part is not taken into consideration.

$$n_{th} = n_{meas}(t_0) - \frac{1}{\langle \xi \rangle \cdot t_0} \quad (18)$$

$$\frac{1}{\langle \xi \rangle \cdot t_0} = \text{digital } V_{offset} \quad (19)$$

Therefore, according to Expression (18), $n_{th}$ that is digital data (correction data) used to correct the threshold voltage Vth can be obtained for all pixels.

Further, in the transient curve as shown in FIG. 53, variation in the current gain β can be represented as shown in the following Expression (20) by solving Expression (16) in regard to ξ based on digital data (detection data) $n_{meas}$(t3) that are output from the ADC 43 when the relaxation time t is set to t3.

The time t3 is set to a time that is sufficiently shorter than t0, t1 and t2 used in Expressions (17) and (18).

$$\xi \cdot t_3 = \frac{n_d - n_{meas}(t_3)}{[n_{meas}(t_3) - n_{th}] \cdot [n_d - n_{th}]} \quad (20)$$

When attention is paid to ξ in Expression (20) to design the display panel (a light-emitting panel) in such a manner that sum totals C of capacitance components of the respective data lines Ld become equal to ξ and a bit width ΔV of the digital data is previously determined as represented by Expression (13), ΔV and C in Expression (15) that determines ξ become constants.

Furthermore, where desired set values of ξ and β are denoted as ξ typ and βtyp, respectively, a multiplication correction value Δξ that is used to correct variation in ξ of the light-emitting drive circuit DC of each pixel in the display panel 110, i.e., digital data (correction data) Δβ that is used to correct variation in the current gain β, can be defined as shown in the following Expression (21) if a square term of the variation is ignored.

$$\begin{aligned} \Delta\xi &:= 1 - \frac{\xi - \xi_{typ}}{2\xi} \\ &= 1 - \frac{\beta - \beta_{typ}}{2\beta} \\ &= \Delta\beta \end{aligned} \quad (21)$$

Therefore, the correction data $n_{th}$ (a first characteristic parameter) that is used to correct fluctuation in the threshold voltage Vth and the correction data Δβ (a second characteristic parameter) that is used to correct variation in the current gain β in the light-emitting drive circuit DC can be obtained by detecting the data line voltage Vd (the data line detection voltage Vmeas(t)) more than once while changing the relaxation time t in the series of auto-zero method based on Expressions (18) and (21).

It is to be noted that the processing for acquiring the correction data $n_{th}$ and Δβ is executed by the correction data acquiring function circuit 157 of such a controller 150 as depicted in FIG. 49.

Subsequently, in the controller 150 as depicted in FIG. 49 based on the correction data $n_{th}$ and Δβ calculated by Expressions (18) and (21), a series of arithmetic processing described below are executed with respect to specific image data supplied from the outside (which will be referred to as "luminance measurement digital data" for the sake of convenience) nd to generate luminance measurement image data nd_brt, and the generated data are input to the data driver 140 to cause the display panel 110 (the pixel PIX) to voltage drive.

More specifically, as a generation method for the luminance measurement image data $n_{d_brt}$, variation correction for the current gain β (Δβ multiplication correction) and fluctuation correction for the threshold voltage Vth ($n_{th}$ addition correction) are executed with respect to the luminance measurement digital data nd.

First, the multiplication function circuit 154*c* of the controller 150 multiplies the digital data nd by the correction data Δβ required to correct variation in the current gain β ($n_d \times \Delta\beta$).

Subsequently, the addition function circuit 154*d* adds the correction data $n_{th}$ required to correct fluctuation in the threshold voltage Vth to the multiplied digital data ($n_d \times \Delta\beta$) ($(n_d \times \Delta\beta)+n_{th}$).

Further, the digital data ($(n_d \times \Delta\beta)+n_{th}$) subjected to the correction processing supplied as the luminance measurement image data $n_{d_brt}$ to the data register circuit 142 of the data driver 140.

The data driver 140 uses the DAC 42 of the DAC/ADC circuit 144 to convert the luminance measurement image data $n_{d_brt}$ captured to the data register circuit 142 into an analog signal voltage.

In this case, as shown in FIG. 48, since input and output characteristics (conversion characteristics) of the DAC 42 and the ADC 43 are set to become equal to each other, a luminance measurement gradation voltage Vbrt generated by the DAC 42 is defined as shown in the following Expression (22) based on the definition shown in Expression (14). This gradation voltage Vbrt is supplied to the pixel PIX through the data line Ld.

$$Vbrt=V1-\Delta V(n_{d_brt}-1)) \tag{22}$$

When the luminance measurement gradation voltage Vbrt is generated by executing a series of correction processings with respect to specific image data as described above and the generated voltage is written into the display panel 110, a current value of a light-emitting drive current Iem flowing through the organic EL element OEL from the light-emitting drive circuit DC of each pixel PIX can be set to a fixed value without being affected by variation in the current gain β or fluctuation in the threshold voltage Vth of the drive transistor.

Furthermore, in such a state, the display panel 110 is caused to emit light, whereby a light-emitting luminance Lv ($cd/m^2$) of each pixel PIX is measured.

In this case, as the luminance measuring method for each pixel PIX, the following technique can be applied, for example.

That is, as an example of the luminance measuring method for each pixel PIX, first, each pixel PIX arranged in the display panel 110 is concurrently caused to emit light in a luminance gradation according to the luminance measurement gradation voltage Vbrt.

Subsequently, as shown in FIG. 49, a luminance meter or the CCD camera 160 arranged on an exit face side of the display panel 110 is used to take an image of the display panel 110.

In this case, the luminance meter or the COD camera 160 has a higher degree of resolution than a size of each pixel PIX arranged in the display panel 110.

A region corresponding to each pixel PIX obtained from an acquired image signal is associated with luminance data output from the luminance meter or the CCD camera 160.

When a predetermined number of pieces of high luminance data are extracted from a plurality of luminance data for the respective pixels PIX and an average value of luminance values of such pieces of data is calculated, the light-emitting luminance (a luminance value) Lv in each pixel PIX is determined.

In this case, where η denotes a light-emitting current efficiency of the organic FL element OEL, the following expression holds: η=(luminance)/(current density) Therefore, if a current value of the light-emitting drive current flowing through each pixel PIX is fixed, variation in the light-emitting luminance Lv in the display panel 110 can be regarded as variation in the light-emitting current efficiency η.

Furthermore, where desired set values of the light-emitting luminance Lv and the light-emitting current efficiency η are denoted as Lvtyp and ηtyp, respectively, a multiplication correction value ΔLv required to correct variation in the light-emitting luminance Lv of each pixel PIX in the display panel 110, i.e., digital data (correction data; a third characteristic parameter) Δη required to correct variation in the light-emitting current efficiency η, can be defined as shown in the following Expression (23) if a square term of the variation is ignored.

Therefore, the correction data Δη of the light-emitting current efficiency η can be obtained based on the light-emitting luminance Lv measured in regard to each pixel PIX as described above.

In this case, the arithmetic processing for the correction data Δη required to correct variation in the light-emitting luminance Lv shown in Expression (23) is executed based on the same sequence as that of the arithmetic processing for the correction data Δβ required to correct variation in the current gain β as shown in Expression (21).

$$\begin{aligned} \Delta Lv &:= 1 - \frac{Lv - Lv_{typ}}{2Lv} \\ &= 1 - \frac{\eta - \eta_{typ}}{2\eta} \\ &= \Delta\eta \end{aligned} \tag{23}$$

Correction data Δβη used to correct the variations in both the current gain β and the light-emitting efficiency η is defined as shown in the following Expression (24) by multiplying the pieces of correction data Δβ and Δη obtained from Expressions (21) and (23).

$$\Delta\beta_\eta := \Delta\eta \times \Delta\beta \tag{24}$$

The correction data $n_{th}$ and Δβη calculated by the above Expressions (18), (24) are stored (memorized) at the address corresponding to each pixel PIX in the correction data storage circuit 152 of the data memory circuit MEM.

As shown in the above embodiments, in the display operation including the image data correction operation explained later, the correction data are read in advance from the correction data storage circuit 152 and are temporarily saved in the correction data memory circuit 153, and thereafter, the correction data are read, row by row, in association with the image data to be corrected.

The read correction data are used by the image data correction circuit 154 when correction for variation in the current gain β (Δβ multiplication correction), correction for variation in the light-emitting current efficiency η (Δη multiplication correction), and correction for fluctuation in the threshold voltage Vth ($n_{th}$ addition correction) are performed with respect to the image data $n_d$ input from the outside of the display device 100 to generate corrected image data $n_{d\text{-}comp}$ in a later-described display operation.

As a result, since the gradation voltage Vdata having an analog voltage value according to the corrected image data $n_{d\text{-}comp}$ are supplied to each pixel PIX from the data driver 140 through the data line Ld, the organic EL element OEL of each pixel PIX can be caused to emit light in a desired luminance gradation without being affected by variation in the current gain β or the light-emitting current efficiency η or fluctuation in the threshold voltage Vth of the drive transistor, thereby realizing an excellent and uniform light-emitting state.

Subsequently, the characteristic parameter acquiring operation to which the above auto-zero method is applied will be explained in association with the device configuration according to the present example. In the explanation below, description about operation equivalent to the above characteristic parameter acquiring operation will be simplified.

First, the correction data $n_{th}$ required to correct fluctuation in the threshold voltage Vth in the drive transistor in each pixel PIX and the correction data Δβ required to correct variation in the current gain β in each pixel PIX are acquired.

Figure 54:
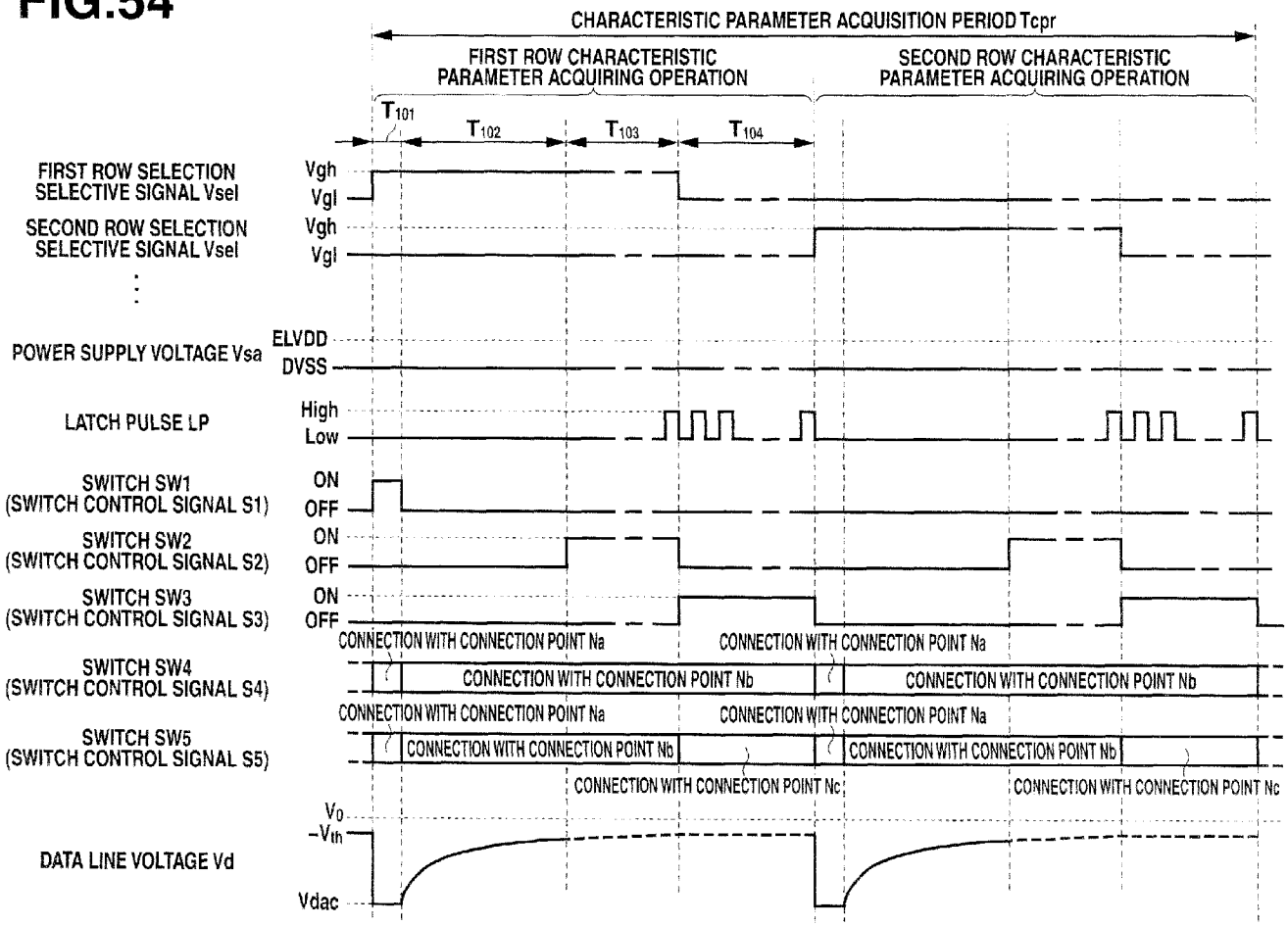
FIG. 54 is a timing chart (part 1) illustrating characteristic parameter acquiring operation performed by the display device according to the example of the present invention.

FIG. 54 is a timing chart (part 1) illustrating characteristic parameter acquiring operation performed by the display device according to the present example.

Figure 55:
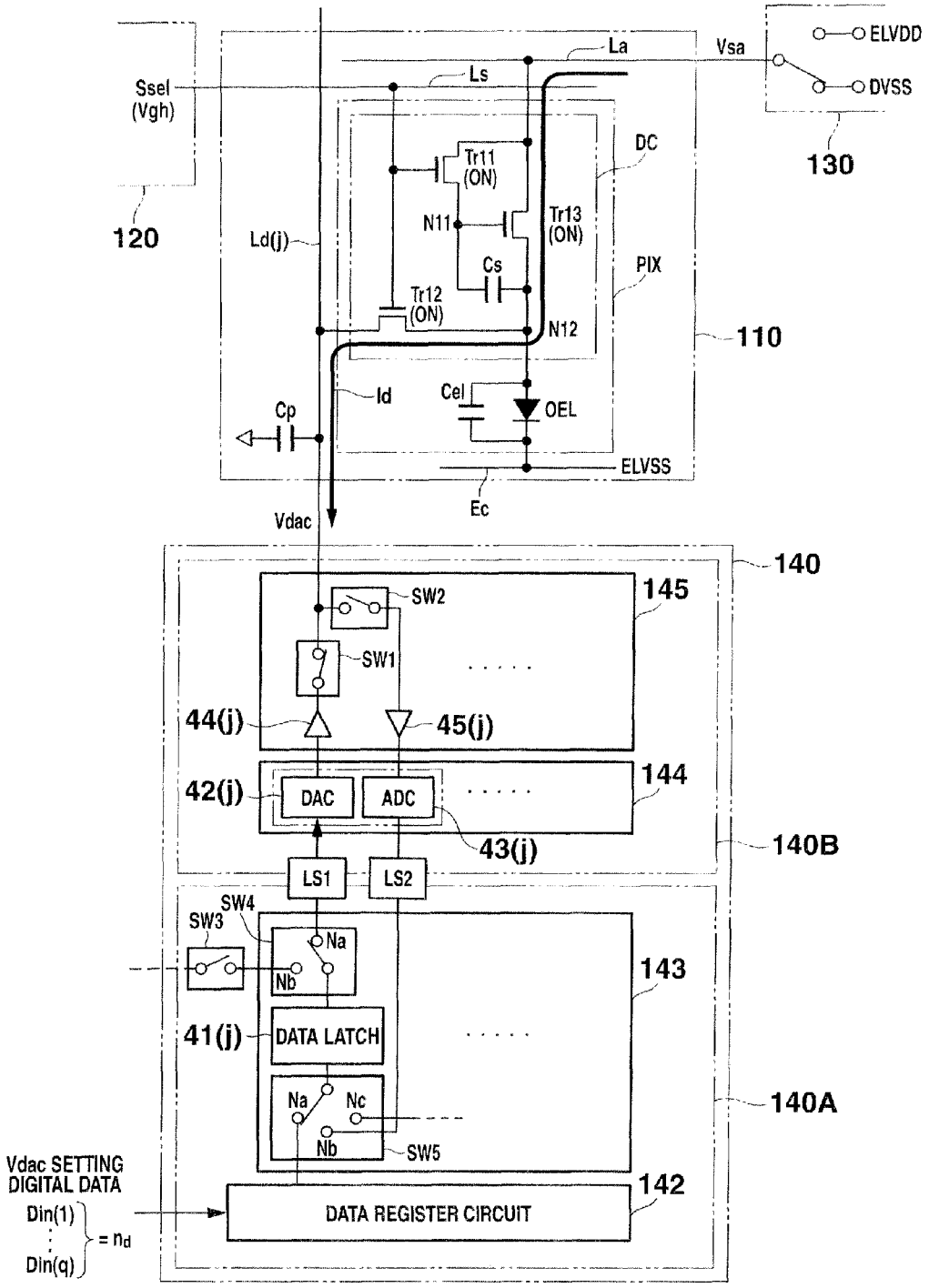
FIG. 55 is a schematic diagram illustrating operation of detection voltage application operation performed by the display device according to the example of the present invention.

FIG. 55 is a schematic diagram illustrating operation of detection voltage application operation performed by the display device according to the present example.

Figure 56:
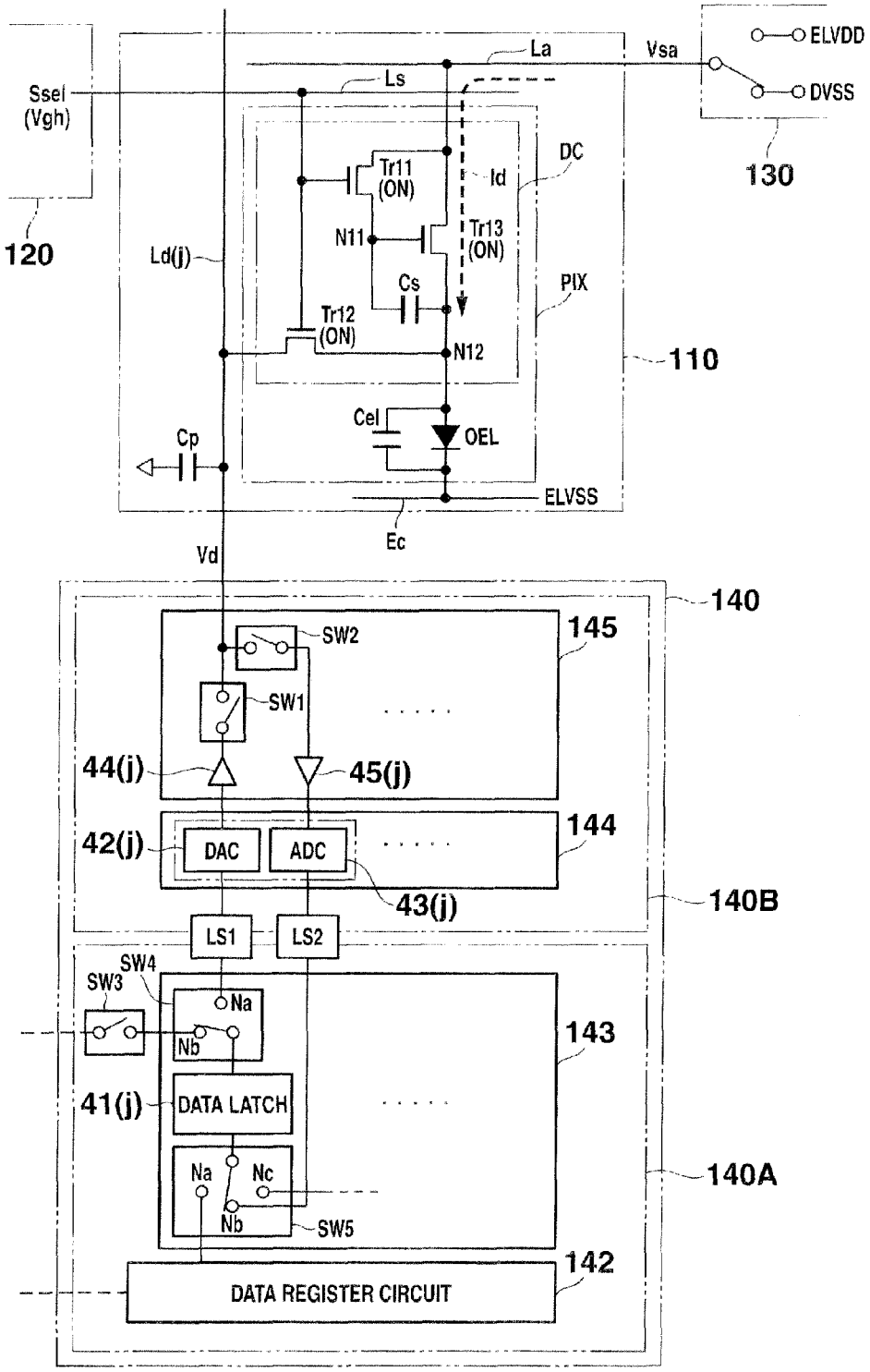
FIG. 56 is a schematic diagram illustrating operation of natural relaxation operation in the display device according to the example of the present invention.

FIG. 56 is a schematic diagram illustrating operation of natural relaxation operation in the display device according to the present example.

Figure 57:
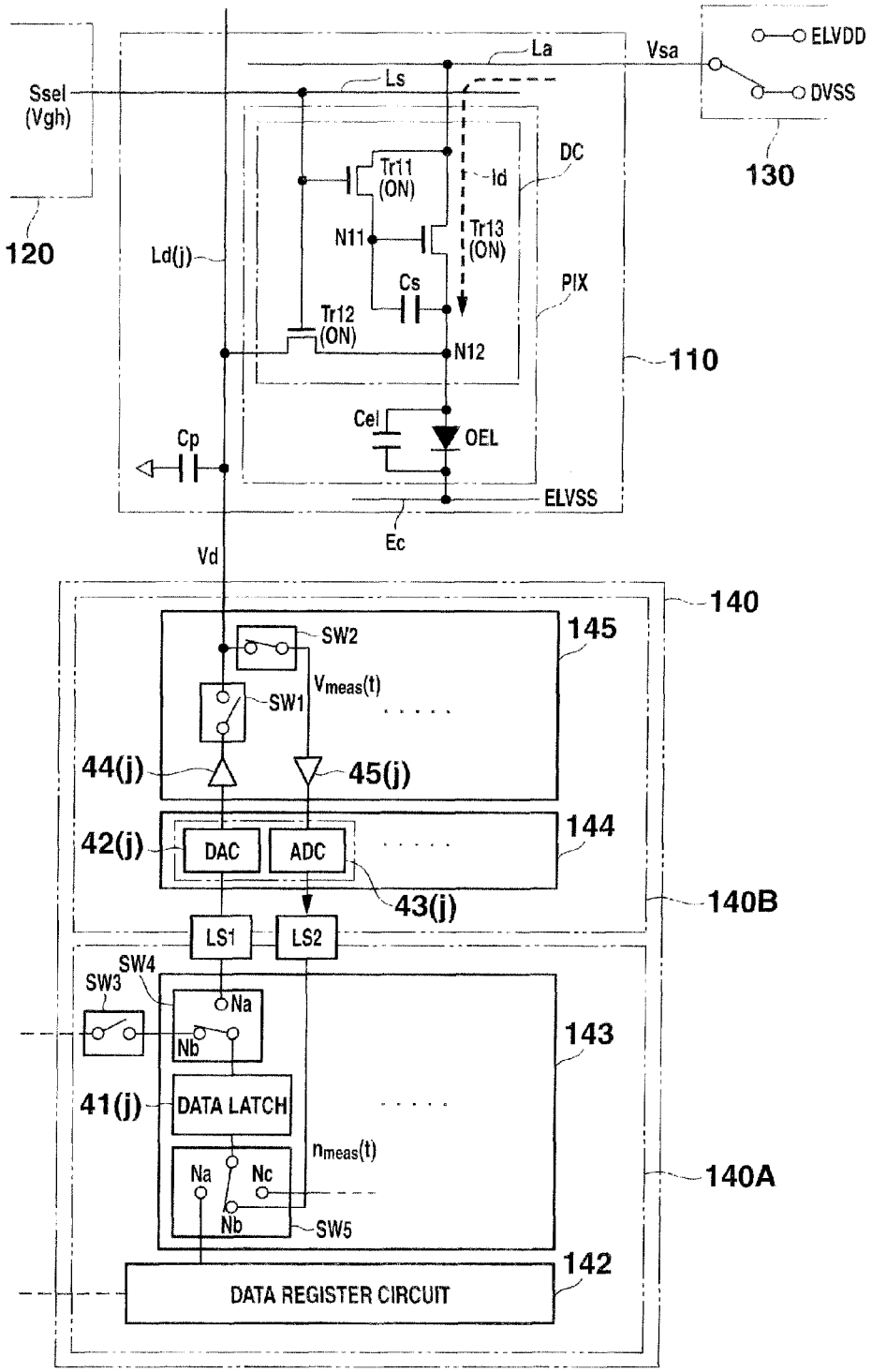
FIG. 57 is a schematic diagram illustrating operation of data line voltage detection operation in the display device according to the example of the present invention.

FIG. 57 is a schematic diagram illustrating operation of data line voltage detection operation in the display device according to the present example.

Figure 58:
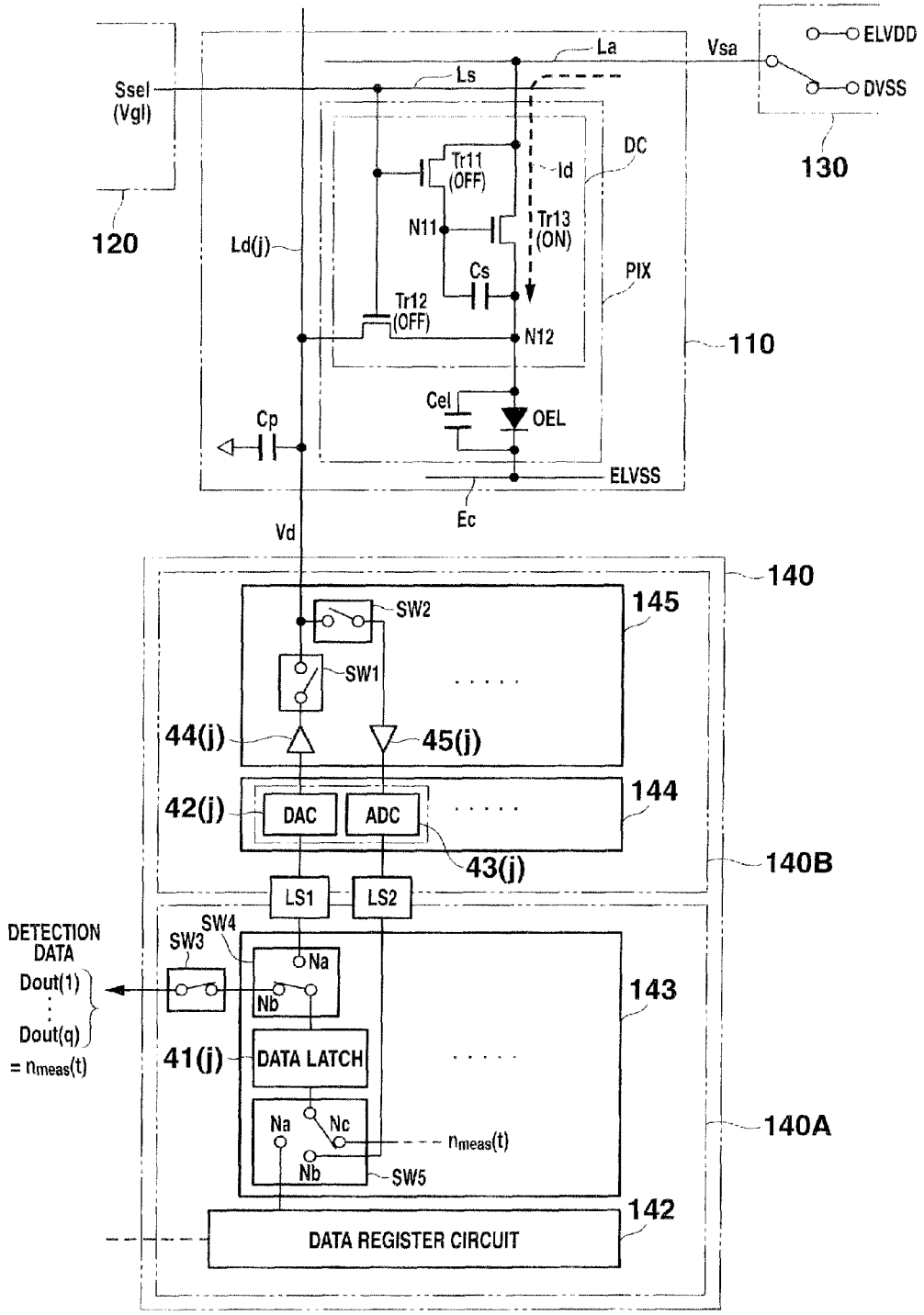
FIG. 58 is a schematic diagram illustrating operation of detection data transmitting operation in the display device according to the example of the present invention.

FIG. 58 a schematic diagram illustrating operation of detection data transmitting operation in the display device according to the present example.

In this case, in FIGS. 55 to 58, the shift register circuit 141 is omitted as an element of the data driver 140 for the sake of illustration.

Figure 59:
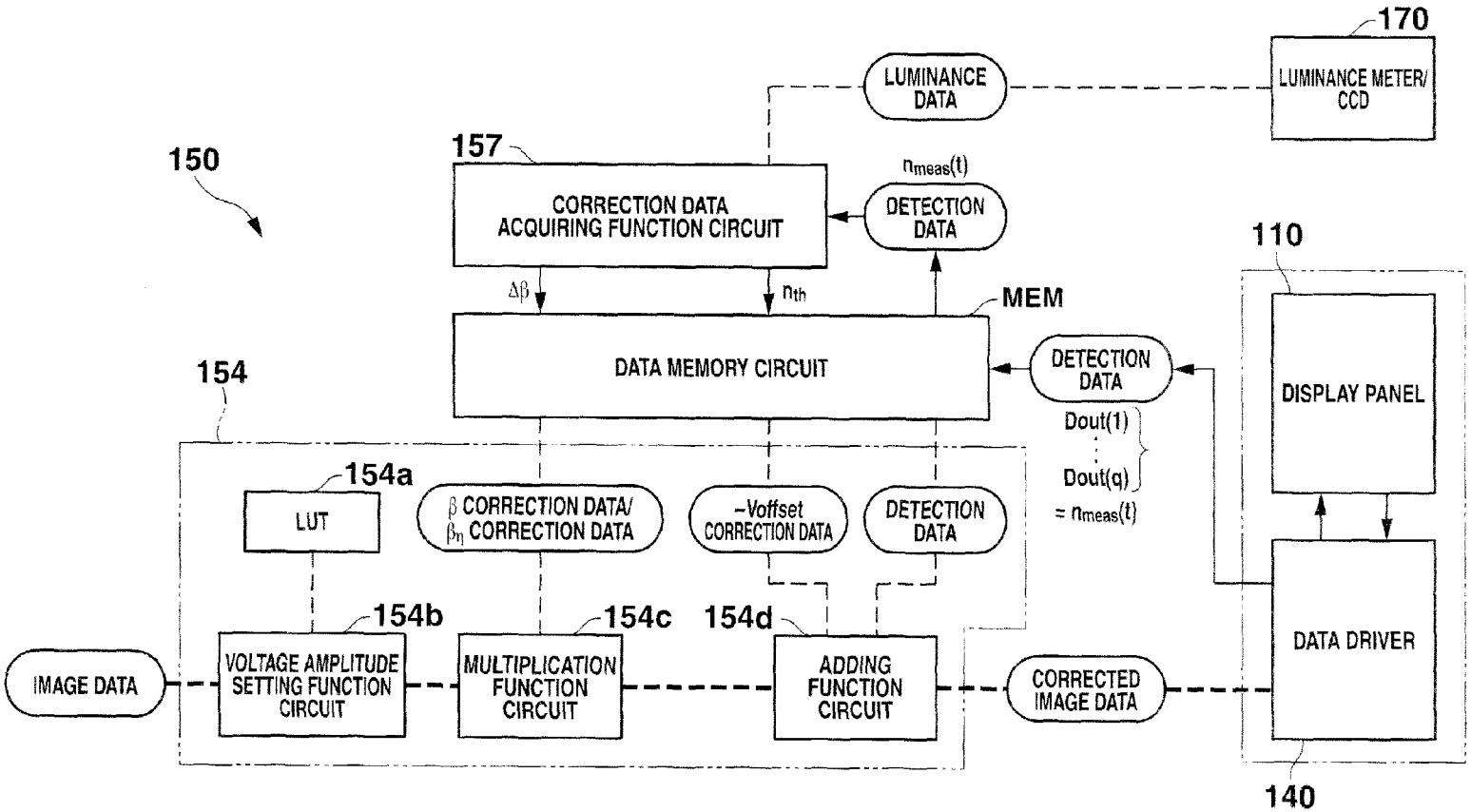
FIG. 59 is a functional block diagram illustrating correction data calculation operation in the display device according to the example of the present invention.

FIG. 59 is a functional block diagram illustrating correction data calculation operation in the display device according to the present example.

In the characteristic parameter (correction data $n_{th}$ and Δβ) acquiring operation according to the present example, as shown in FIG. 54, a predetermined characteristic parameter acquisition period Tcpr includes a detection voltage application period. T101, natural relaxation period. T102, a data line voltage detection period T103, and a detection data transmission period T104 in accordance with each pixel PIX in each row.

In this case, the natural relaxation period T102 corresponds to the relaxation time t. FIG. 54 shows a case where the relaxation time t is set to one specific time for the sake of illustration.

As described above, in the present example, the relaxation time t is changed to detect the data line voltage Vd (the data line detection voltage Vmeas(t)) more than once. Therefore, in practice, data line voltage detecting operation (the data line voltage detection period T103) and detection data transmitting operation (the detection data transmission period T104) are repeatedly executed in accordance with each different relaxation time t (=t0, t1, t2, or t3) in the natural relaxation period T102.

First, in the detection voltage application period T101, the pixel PIX (the pixel PIX in the first row in the drawing) as a characteristic parameter acquiring operation target is set in the selective state as shown in FIGS. 54 and 55.

That is, the selection signal Ssel at the selective level (for example, the high level; Vgh) is applied to the selection line Ls connected with this pixel PIX from the selection driver 120, and the power supply voltage Vsa at the non-light-emitting level (low level; DVSS=the ground potential GND) is applied to the power supply line La from the power supply driver 130.

Further, in this selective state, the switch SW1 provided in the output circuit 145 of the data driver 140 attains ON-state based on the changeover control signal S1 supplied from the controller 150, thereby connecting the data line Ld(j) with the DAC 42(*j*) of the DAC/ADC 144.

The switch SW2 provided in the output circuit 145 attains OFF-state based on the changeover control signals S2 and S3 supplied from the controller 150, and the switch SW3 connected with the connection point Nb of the switch SW4 attains OFF-state.

The switch SW4 provided in the data latch circuit 143 is set to be connected to the connection point Na based on the changeover control signal S4 fed from the controller 150, and the switch SW5 is set to be connected to the connection point Na based on the changeover control signal S5.

The digital data $n_d$ required to generate the detection voltage Vdac having a predetermined voltage value is sequentially captured to the data register circuit 142 from the outside of the data driver 140 and held in the data latch 41(*j*) through the switch SW5 corresponding to each column.

Thereafter, the digital data $n_d$ held in the data latch 41(*j*) is input to the DAC 42(*j*) of the DAC/ADC circuit 144 through the switch SW4 to be converted into analog, and the converted data are applied to the data line Ld(j) of each column as the detection voltage Vdac.

In this case, as described above, the detection voltage Vdac is set to a voltage value satisfying the condition of Expression (12).

In the present example, since the power supply voltage DVSS applied from the power supply driver 130 is set to the ground potential GND, the detection voltage Vdac is set to a negative voltage value.

In this case, the digital data $n_d$ required to generate the detection voltage Vdac is previously stored in a memory provided in, e.g., the controller 150.

As a result, the transistors Tr11 and Tr12 provided in the light-emitting drive circuit DC constituting the pixel PIX maintain ON-state, and the power supply voltage Vsa (=GND) at the non-light-emitting level is applied to the gate terminal of the transistor Tr13 and one end side (the connection point N11) of the capacitor Cs through the transistor Tr11.

The detection voltage Vdac applied to the data line Ld(j) is applied to the source terminal of the transistor Tr13 and the other end side (a contact point N12) of the capacitor Cs via the transistor Tr12.

When a potential difference larger than the threshold voltage Vth of the transistor Tr13 is applied to the part between the gate and source terminals (i.e., both the ends of the capacitor Cs) of the transistor Tr13 in this manner, the transistor Tr13 maintains the ON-state, whereby the drain current Id according to this potential difference (the voltage Vgs between the gate and the source) flows.

At this occasion, since a potential (the detection voltage Vdac) of the source terminal of the transistor Tr13 is set to be lower than a potential (the ground potential GND) at the drain terminal of the same, the drain current Id flows in a direction of the data driver 140 from the power supply voltage line La through the transistor Tr13, the connection point N12, the transistor Tr12, and the data line Ld (j).

Accordingly, both the ends of the capacitor Cs connected to the part between the gate and the source of the transistor Tr13 are charged with a voltage according to the potential difference based on the drain current Id.

At this occasion, since a voltage lower than the voltage ELVES (=GND) applied to the cathode (the common electrode Ec) is applied to the anode (the connection point N12) of the organic EL element OEL, a current does not flow through the organic EL element nor this element does not emit light.

Subsequently, during the natural relaxation period T102 after the completion of the detection voltage application period T101, the data line Ld(j) are disconnected from the data driver 140 and output of the detection voltage Vdac from the DAC 44(*j*) is stopped by turning off the switch SW1 of the data driver 140 based on the changeover control signal S1 fed from the controller 150 in a state in which the pixel PIX is held in the selective state as depicted in FIGS. 54, 56.

Like the above detection voltage application period T101, the switches SW2 and SW3 are turned off, the switch SW4 is set to be connected to the contact Nb, and the switch SW5 is set to be connected with the contact Nb.

As a result, since the transistors Tr11 and Tr12 maintain the ON state, in the pixel PIX (the light-emitting drive circuit DC), an electrical connection state with the data line Ld(j) is maintained, whereas the application of the voltage to the data line Ld(j) is interrupted; hence the other end side (the connection point N12) of the capacitor Cs is set to the high-impedance state.

In this natural relaxation period T102, the transistor Tr13 maintains the ON state by using the voltage with which the capacitor Cs (between the gate and the source of the transistor Tr13) is charged during the above detection voltage application period T101, whereby flow of the drain current Id continues.

The potential at the source terminal side of the transistor Tr13 (the connection point N12; the other end side of the capacitor Cs) gradually increases to approximate the threshold voltage Vth of the transistor Tr13.

As a result, as shown in FIG. 53, the potential in the data line Ld(j) also changes to converge on the threshold voltage Vth of the transistor Tr13.

It is to be noted that, as to the potential of the anode (the connection point N12) of the organic EL element OEL, since a voltage lower than the voltage ELVES (=GND) applied to the cathode (the common electrode Ec) is applied during this natural relaxation period T102, a current does not flow through the organic EL element OEL, nor this element does not emit light.

Subsequently, during the data line voltage detection period T103, as shown in FIGS. 54, 57, the switch SW2 of the data driver 140 is turned on based on the changeover control signal S2 supplied from the controller 150 in a state in which the pixel PIX is maintained in the selective state when the predetermined relaxation time t has elapsed in the natural relaxation period T102.

At this occasion, the switches SW1 and SW3 are turned off, the switch SW4 is set to be connected to the contact Nb, and the switch SW5 is set, to be connected to the contact Nb.

Consequently, the data line Ld(j) is connected with the ABC 43(*j*) of the DAC/ADC 144, and the data line voltage Vd when the predetermined relaxation time t has elapsed in the natural relaxation period T102 is captured into the ADC 43(*j*) through the switch SW2 and the buffer 45(*j*).

The data line voltage Vd captured to the ADC 43(*j*) at this occasion corresponds to the data line detection voltage Vmeas(t) shown in the Expression (11).

The data line detection voltage Vmeas(t) that has been captured to the ADC 43(*j*) and comprising an analog signal voltage is converted into detection data $n_{meas}(t)$ of digital data by the ADC 43(*j*) based on the Expression (14), and the converted data are held in the data latch 41(*j*) via the switch SW5.

Subsequently, during the detection data transmission period T104, as shown in FIGS. 54, 58, the pixel PIX is set to the non-selective state.

The selection signal Ssel at the non-selective level (for example, the low level; Vgl) is applied to the selection line Ls from the selection driver 120.

In this non-selective state, the switch SW5 provided at an input stage of the data latch 41(*j*) of the data driver 140 is set to be connected to the contact Nc and the switch SW4 provided at the output stage of the data latch 41(*j*) of the same is set to be connected to the contact Nb based on the changeover control signals 34 and S5 provided by the controller 150.

The switch SW3 is turned on based on the changeover control signal S3. At this occasion, the switches SW1 and SW2 are turned off based on the changeover control signals S1 and S2.

As a result, the data latches 41(*j*) in columns adjacent to each other are connected in series though the switches SW4 and SW5 and connected to the data memory circuit MEM provided in the controller 150 via the switch SW3.

Furthermore, the pieces of detection data $n_{meas}(t)$ held in the data latches 41(*j*+1) (see FIG. 47) in the respective columns are sequentially transferred to the adjacent data latches 41(*j*) based on the data latch pulse signal LP supplied from the controller 150.

As a result, the detection data $n_{meas}(t)$ of the pixels PIX corresponding to one row is output as serial data, and stored in a predetermined memory region of the detection data memory circuit of the data memory circuit MEM provided in the controller 150 in association with each pixel PIX as shown in FIG. 59.

In this case, since fluctuation amount of the threshold voltage Vth of the transistor Tr13 provided in the light-emitting drive circuit DC of each pixel PIX differs depending on, e.g., a drive history (a light emission history) in each pixel PIX and the current gain β also varies in each pixel PIX, the data memory circuit MEM (detection data memory circuit) stores the detection data $n_{meas}(t)$ peculiar to each pixel PIX.

In the present example, the data line voltage detecting operation and the detection data transmitting operation in the above series of operations are set to different relaxation times t (=t0, t1, t2, or t3) to be executed with respect to each pixel PIX more than once.

In the operation of detecting a data line voltage at each different relaxation time t, the detection voltage may be applied only once and the data line voltage detecting operation and the detection data transmitting operation may be executed more than once at different timings (the relaxation time t=t0, t1, t2, or t3) during a period in which the natural relaxation continues, or the series of operations, i.e., the application of the detection voltage, the natural relaxation, the data line voltage detection, and the detection data transmission, may be executed more than once while changing the relaxation time t, as described above.

The above-described characteristic parameter acquiring operation for the pixels PIX in the respective rows are repeated, whereby the pieces of detection data $n_{meas}(t)$ for multiple times are stored in the data memory circuit MEM (detection data memory circuit) of the controller 150 with respect to all pixels PIX arranged in the display panel 110.

Subsequently, the operation of calculating the correction data $n_{th}$ required to correct the threshold voltage Vth of the transistor (the drive transistor) Tr13 of each pixel PIX and the correction data Δβ required to correct the current gain β is executed based on the detection data $n_{meas}(t)$ of each pixel PIX.

More specifically, as shown in FIG. 59, first, the detection data $n_{meas}(t)$ of each pixel PIX stored in the data memory circuit MEM (detection data memory circuit) are read to the correction data acquiring function circuit 157 provided to the controller 150.

Then, the correction data acquiring function circuit 157 calculates the correction data $n_{th}$ (more specifically, the detection data $n_{mean}(t0)$ and an offset voltage ($-Voffset=-1/\xi \cdot t0$) that specify the correction data $n_{th}$) and the correction data $\Delta\beta$ based on Expressions (15) to (21) in accordance with the characteristic parameter acquiring operation using the auto-zero method.

The calculated pieces of correction data $n_{th}$ and $\Delta\beta$ are stored in a predetermined memory region of the correction data storage circuit 152 of the data memory circuit MEM in association with each pixel PIX.

Subsequently, the correction data $\Delta\eta$ required to correct variation in the light-emitting current efficiency $\eta$ in each pixel PIX is acquired by using the pieces of correction data $n_{th}$ and $\Delta\beta$.

Figure 60:
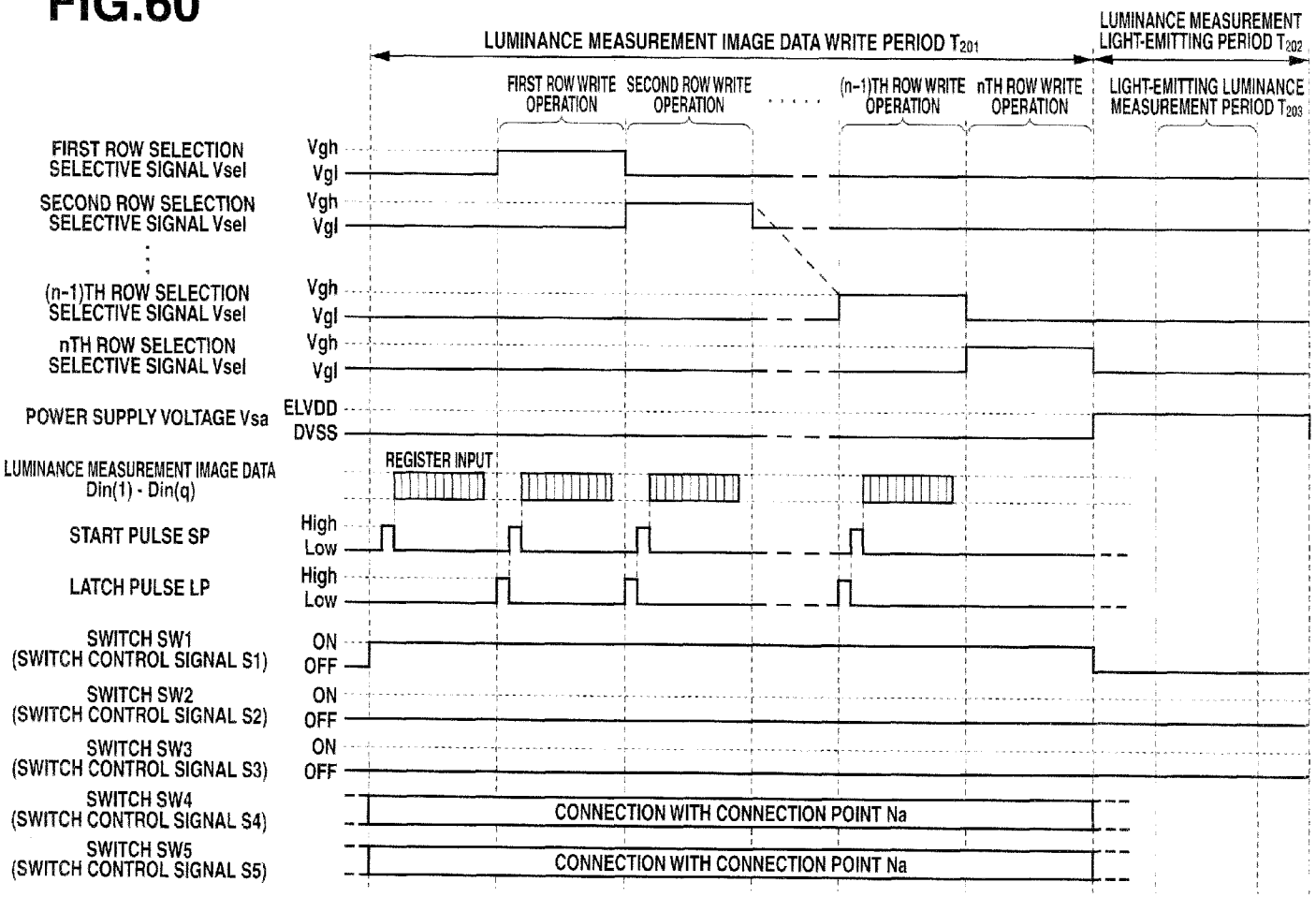
FIG. 60 is a timing chart (part 2) illustrating characteristic parameter acquiring operation performed by the display device according to the example of the present invention.

FIG. 60 is a timing chart (part 2) illustrating characteristic parameter acquiring operation performed by the display device according to the present example.

Figure 61:
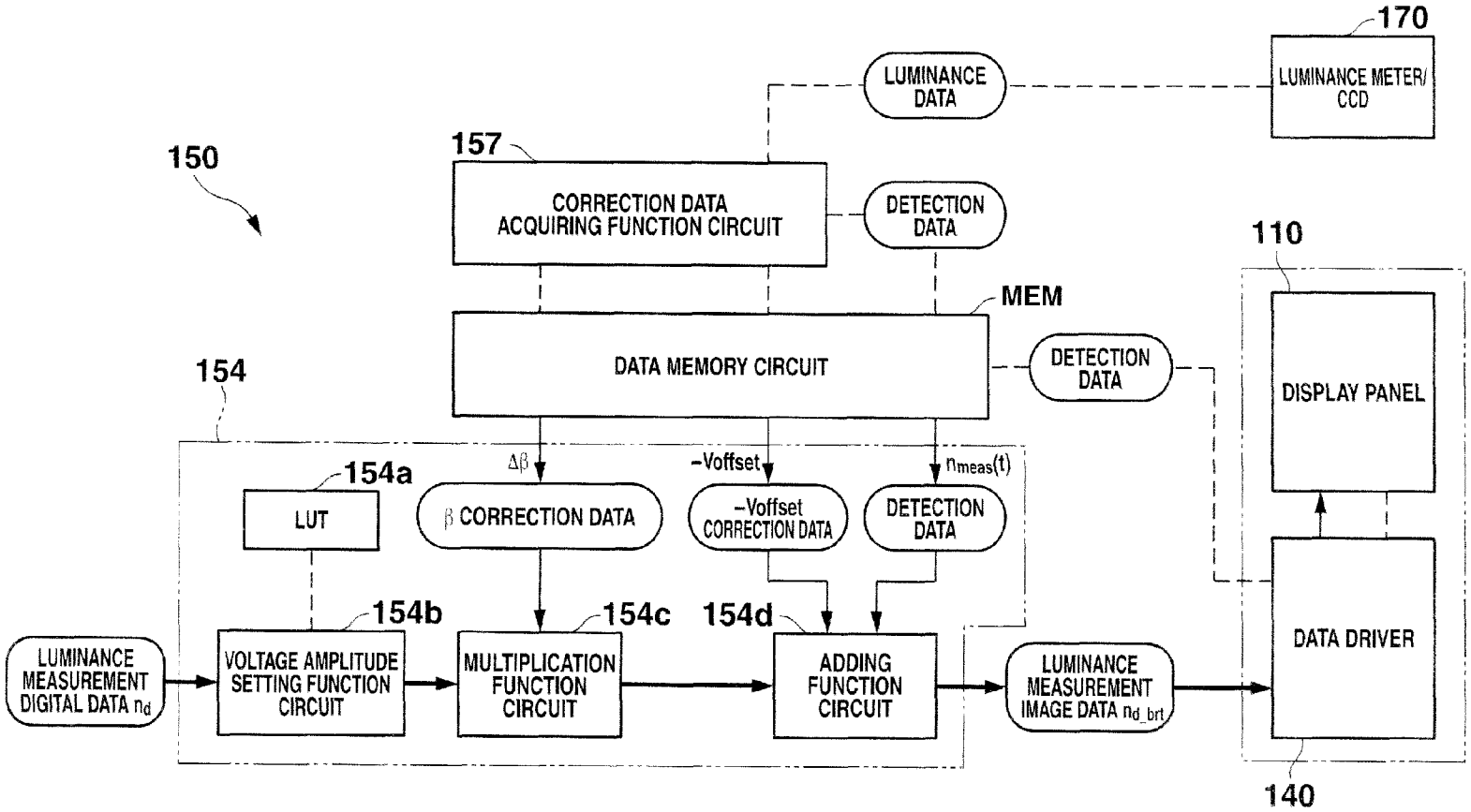
FIG. 61 is a functional block diagram illustrating generation operation of luminance measurement image data in the display device according to the example of the present invention.

FIG. 61 is a functional block diagram illustrating generation operation of luminance measurement image data in the display device according to the present example.

Figure 62:
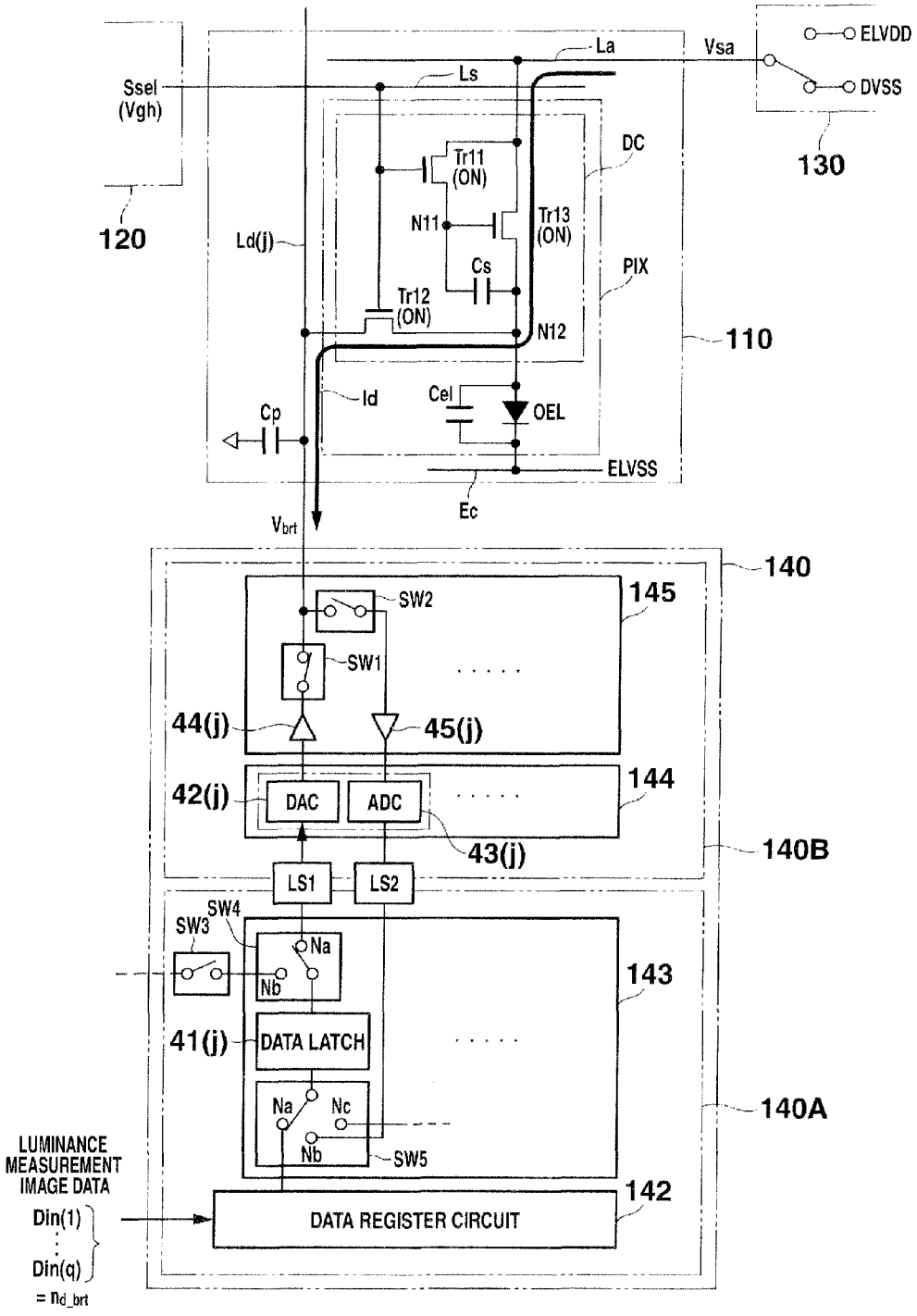
FIG. 62 is a schematic diagram illustrating operation of writing operation of the luminance measurement image data in the display device according to the example of the present invention.

FIG. 62 is a schematic diagram illustrating operation of writing operation of the luminance measurement image data in the display device according to the present example.

Figure 63:
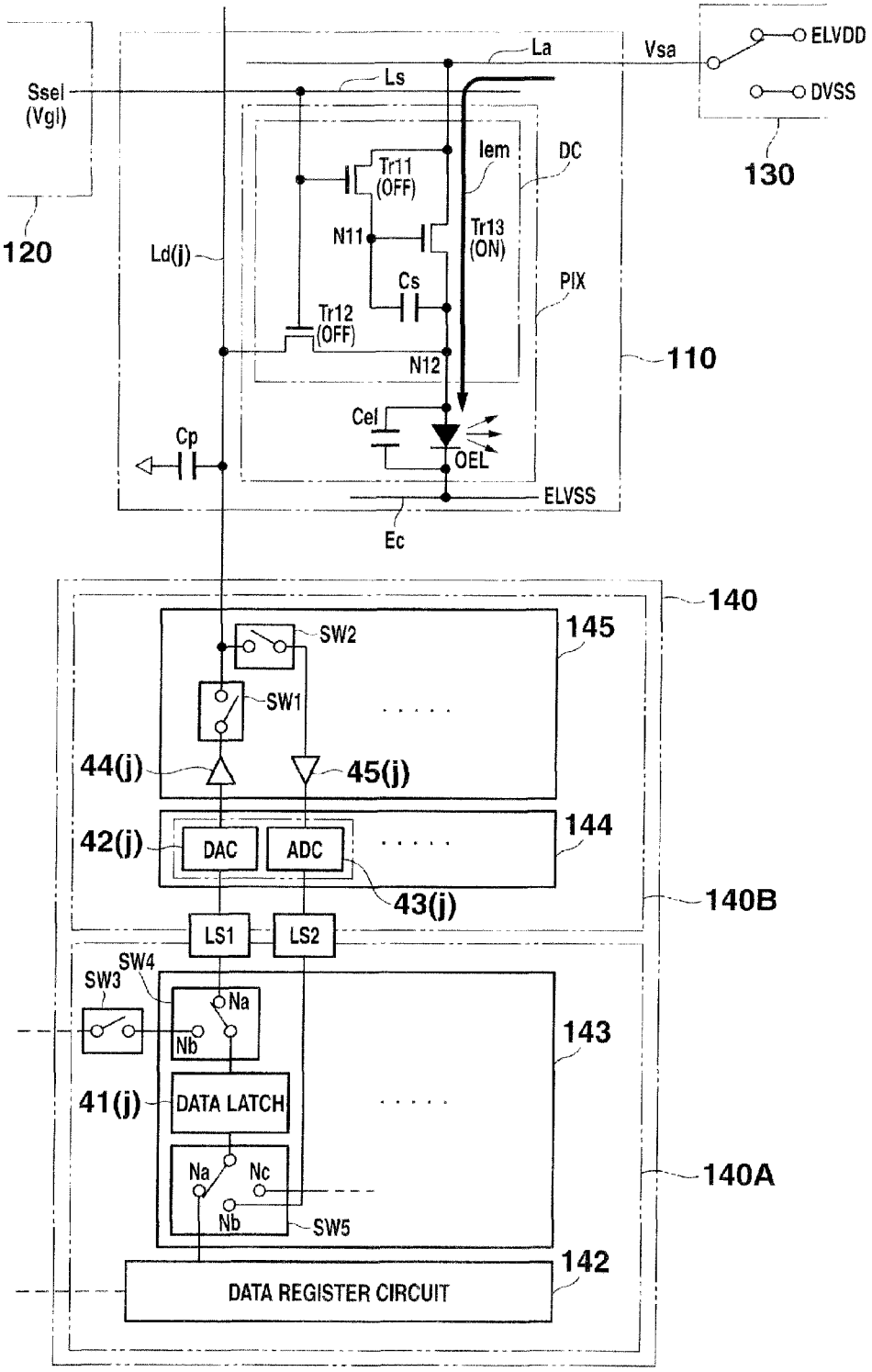
FIG. 63 is a schematic diagram illustrating operation of light-emitting operation of measuring brightness in the display device according to the example of the present invention.

FIG. 63 is a schematic diagram illustrating operation of light-emitting operation of measuring brightness in the display device according to the present example.

Figure 64:
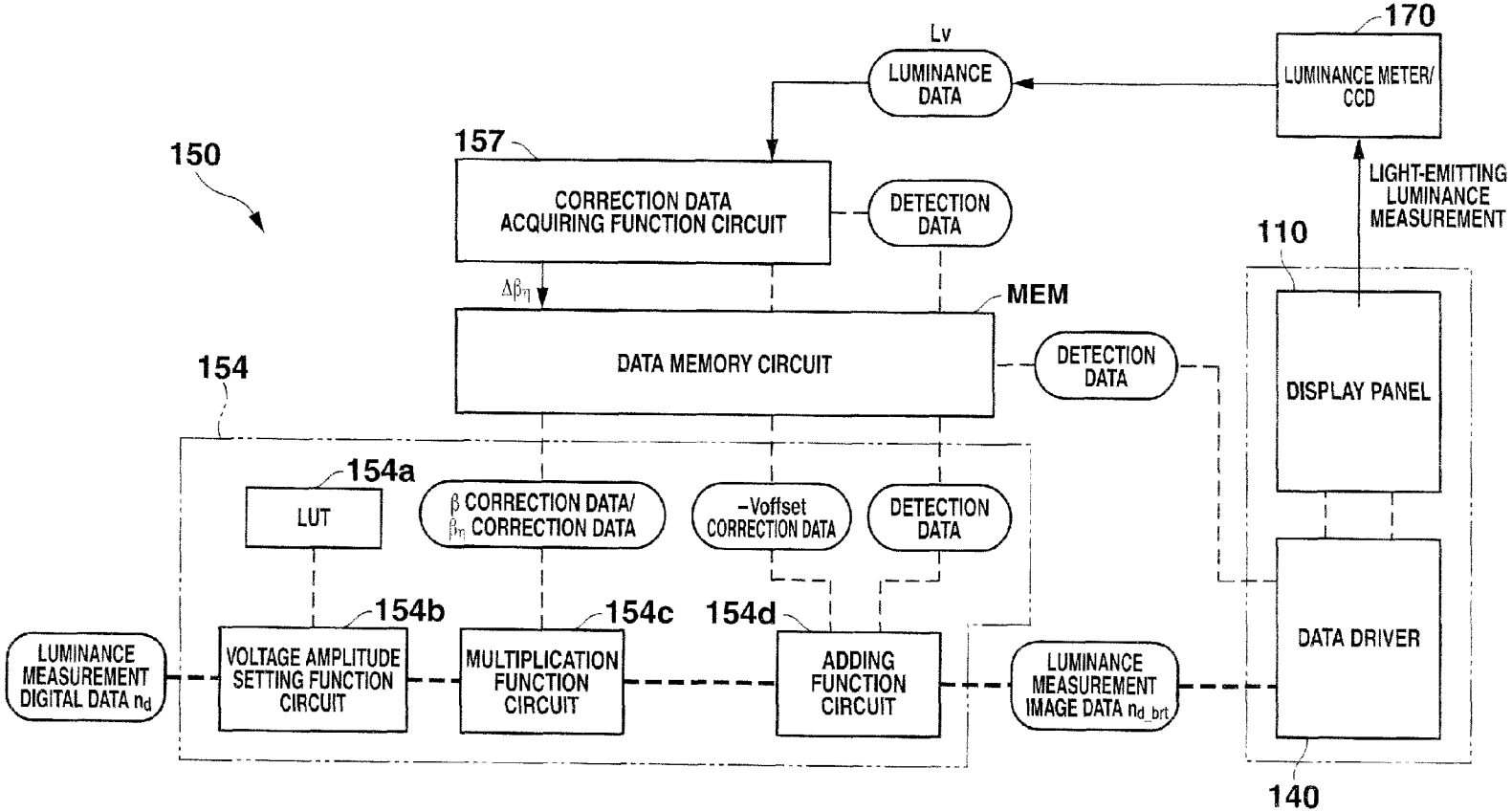
FIG. 64 is a functional block diagram (part 2) illustrating the correction data calculation operation according to the example of the present invention.

FIG. 64 is a functional block diagram (part 2) illustrating the correction data calculation operation according to the present example.

In this case, in FIGS. 62, 63, the shift register circuit 141 is omitted as an element of the data driver 140 for the sake of illustration.

As shown in FIG. 60, the characteristic parameter (the correction data $\Delta\eta$) acquiring operation according to the present example includes a luminance measurement image data write period T201 in which luminance measurement image data according to each pixel PIX in each row are generated and written, a luminance measurement light-emitting period T202 in which each pixel PIX is caused to emit light in a luminance gradation according to the luminance measurement image data, and a light-emitting luminance measurement period T203 in which a light-emitting luminance of each pixel is measured. In this case, the light-emitting luminance measuring operation is executed during the luminance measurement light-emitting period T202.

In the luminance measurement image data write period T201, the luminance measurement image data generating operation and the luminance measurement image data write operation for each pixel PIX are executed.

In the luminance measurement image data generating operation, the controller 150 corrects predetermined luminance measurement digital data $n_d$ by using the pieces of correction data $\Delta\beta$ and $n_{th}$ acquired by the characteristic parameter acquiring operation to generate luminance measurement image data $n_{d_brt}$.

More specifically, as shown in FIG. 61, first, the correction data $\Delta\beta$ each pixel stored in the correction data storage circuit 152 of the data memory circuit MEM of the controller 150 is read out via the correction data memory circuit 153.

The multiplication function circuit 154*c* multiplies the digital data $n_d$ supplied from the outside of the controller 150 by the read correction data $\Delta\beta$.

Subsequently, based on Expressions (18) and (19), the detection data $n_{meas}(t0)$ and the offset voltage ($-Voffset=-1/\xi \cdot t0$) that specify the correction data $n_{th}$ stored in the correction data storage circuit 152 of the data memory circuit MEM are read via the correction data memory circuit 153.

Subsequently, the addition function circuit 154*d* adds the read detection data $n_{meas}(t0)$ and offset voltage ($-Voffset$) to the digital data ($n_d \times \Delta\beta$) subjected to the multiplication processing. When the above-described correction processing is executed, the luminance measurement image data $n_{d_brt}$ are generated and supplied to the data driver 140.

In the luminance measurement image data write operation with respect to each pixel PIX, like the above detection voltage applying operation (the detection voltage application period T101), the pixel PIX as a write target is set to the selective state, and the luminance measurement gradation voltage Vbrt according to the luminance measurement image data $n_{d_brt}$ is written through the data line Ld(j) in this state.

More specifically, as shown in FIGS. 60 and 62, the selection signal Ssel at the selective level (for example, the high level; Vgh) is first applied to the selection line Ls connected with the corresponding pixel PIX, and the power supply voltage Vsa at the non-light-emitting level (low level; DVSS=the ground potential GND) is applied to the power supply line La.

In this selective state, when the switch SW1 is turned on and the switches SW4 and SW5 are set to be connected to the contact Nb, the luminance measurement image data $n_{d_brt}$ supplied from the controller 150 is sequentially captured into the data register circuit 142 and held in the data latch 41(*j*) of each column.

The held image data $n_{d_brt}$ are converted into analog data by the DAC 42(*j*) to be applied to the data line Ld(j) of each column as the luminance measurement gradation voltage Vbrt.

As described above, the luminance measurement gradation voltage Vbrt is set to a voltage value satisfying the condition of the Expression (22).

As a result, in the light-emitting drive circuit DC constituting the pixel PIX, the power supply voltage Vsa (=GND) at the non-light-emitting level is applied to the gate terminal of the transistor Tr13 and one end side (connection point N11) of the capacitor Cs. The luminance measurement gradation voltage Vbrt is applied to the source terminal of the transistor Tr13 and the other end side (the connection point N12) of the capacitor Cs.

Therefore, the drain current Id according to a potential difference (the voltage Vgs between the gate and the source) produced between the gate and source terminals of the transistor Tr13 flows, and both the ends of the capacitor Cs is charged with a voltage (≈Vbrt) according to the potential difference based on the drain current Id.

At this occasion, since the voltage lower than that in the cathode (the common electrode Ec) of the organic EL element OEL is applied to the anode (the connection point N12) of the same, the current does not flow through the organic EL element OEL, nor this element does not emit light.

Subsequently, during the luminance measurement light-emitting period T202, as shown in FIG. 60, the respective pixels PIX are concurrently caused to emit light in a state in which the pixels PIX in the respective rows are set to the non-selective state.

More specifically, as shown in FIG. 63, the selection signal Ssel at the non-selective level (for example, the low level; Vgl) is applied to the selection line Ls connected with all pixels PIX arranged in the display panel 110, and the power supply voltage Vsa at the light-emitting level (the high level; ELVDD>GND) is applied to the power supply line La.

As a result, the transistors Tr11 and Tr12 provided in the light-emitting drive circuits DC of each pixel PIX are turned off, and the light-emitting voltage with which the capacitor Cs connected to the part between the gate and the source of the transistor Tr13 is charged is maintained.

Therefore, the voltage Vgs between the gate and the source of the transistor Tr13 is held by the light-emitting voltage (≈Vbrt) with which the capacitor Cs is charged, the transistor Tr13 is turned on to pass the drain current Id, and the potential at the source terminal (the connection point N12) of the transistor Tr13 increases.

Then, the potential at the source terminal (the connection point N12) of the transistor Tr13 increases to a level higher than the voltage ELVSS (=GND) applied to the cathode (the common electrode Ec) of the organic EL element OEL, and a forward bias is thereby applied to the organic EL element OEL. As a result, the light-emitting drive current Iem flows in a direction of the common electrode Ec from the power supply line La through the transistor tr13, the connection point N12, and the organic EL element OEL.

Since this light-emitting drive current Iem is specified based on a voltage value of the emitting voltage (≈Vbrt) that has been written in the pixel PIX in the luminance measurement image data write operation and held between the gate and the source of the transistor Tr13, the organic EL element OEL emits light in a luminance gradation according to the luminance measurement image data $n_{d_brt}$.

In this case, the luminance measurement image data $n_{d_brt}$ is subjected to the correction for variation in the current gain β and the correction for fluctuation in the threshold voltage Vth of the drive transistor on the basis of the pieces of correction data Δβ and $n_{th}$ acquired in association with each pixel in the characteristic parameter acquiring operation.

Therefore, when the luminance measurement image data $n_{d_brt}$ having the same luminance gradation value is written into each pixel PIX, the light-emitting current Iem flowing through the organic EL element OEL from the light-emitting drive circuit DC of each pixel PIX is set to a substantially constant value without being affected by variation in the current gain β and fluctuation in the threshold voltage Vth of the drive transistor.

Subsequently, during the light-emitting luminance measurement period T203 set in the luminance measurement light-emitting period T202, an operation of measuring a light-emitting luminance of each pixel PIX and an operation of calculating the correction data Δη required to correct the light-emitting current efficiency η of each pixel PIX are executed.

In the light-emitting luminance measuring operation, as shown in FIGS. 60, 64, the light-emitting drive current Iem having substantially the same current value is set to flow through the organic EL element OEL in each pixel PIX on the display panel 110 and caused to emit light, and the luminance meter or the CCD camera 160 provided on the exit face side of the display panel 110 is used to measure a light-emitting luminance Lv of each pixel PIX as digital data.

The measured light-emitting luminance Lv is transmitted to the correction data acquiring function circuit 157 of the controller 150.

In the operation of calculating the correction data Δη, first, the correction data acquiring function circuit 157 provided in the controller 150 calculates correction data Δη on the basis of the above Expressions (23), (24), and calculates the correction data Δβη obtained on the basis of not only the above correction data Δβ but also the correction data Δη.

The arithmetic processing of the correction data Δη as shown in the Expression (23) is executed in the same sequence as the arithmetic processing of the correction data Δβ as shown in the above Expression (21).

The calculated correction data Δβη are stored in a predetermined storage region in the correction data storage circuit 152 of the data memory circuit MEM in association with each pixel PIX like the detection data $n_{meas}(t)$ and the correction data $n_{th}$.

(Display Operation)

Subsequently, in the display operation (the light-emitting operation) of the display device according to the present example, the image data are corrected using the correction data $n_{th}$, Δβη, and each pixel PIX is caused to emit light in a desired luminance gradation.

Figure 65:
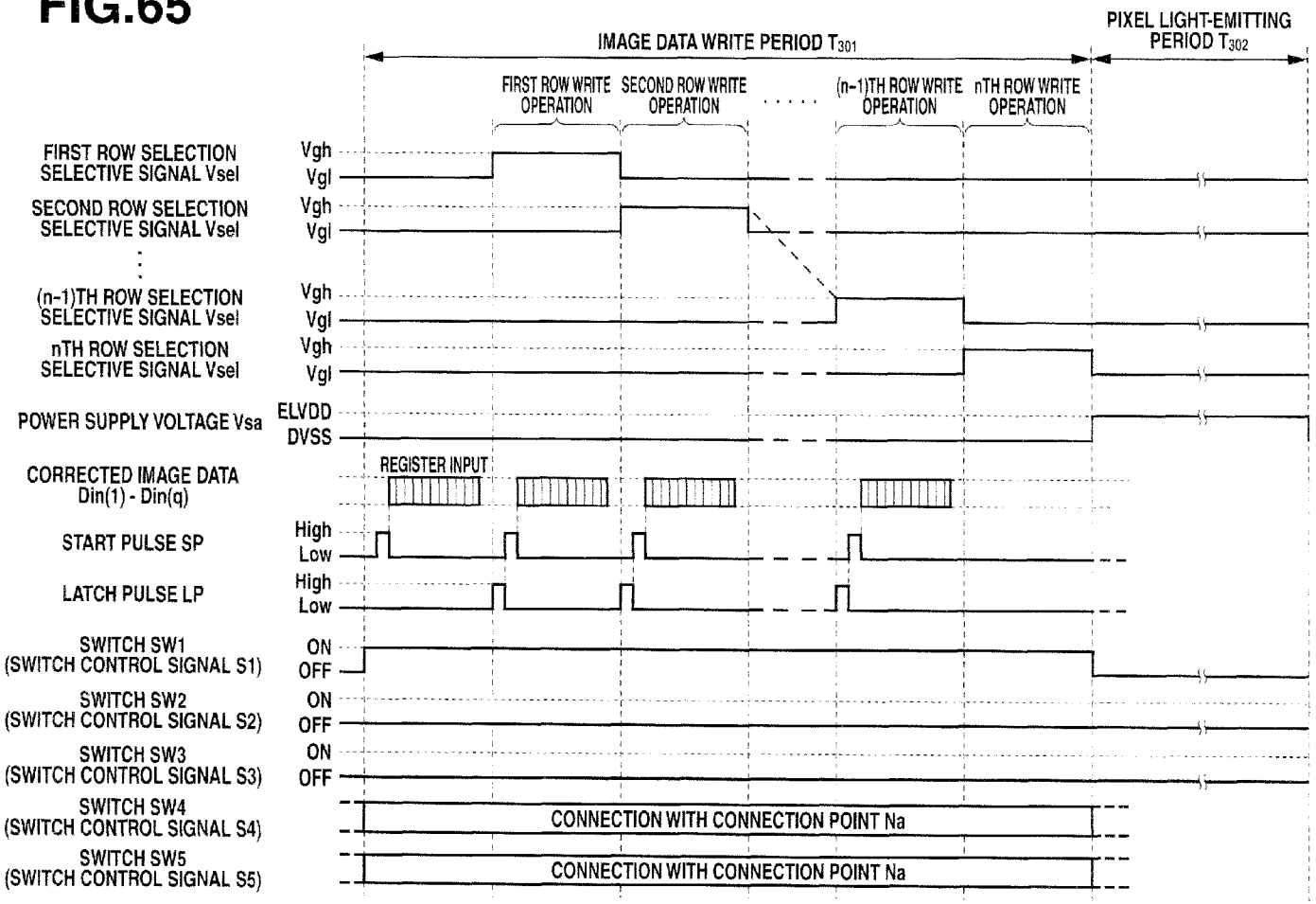
FIG. 65 is a timing chart illustrating light-emitting operation performed by the display device according to the example of the present invention.

FIG. 65 is a timing chart illustrating light-emitting operation performed by the display device according to the present example.

Figure 66:
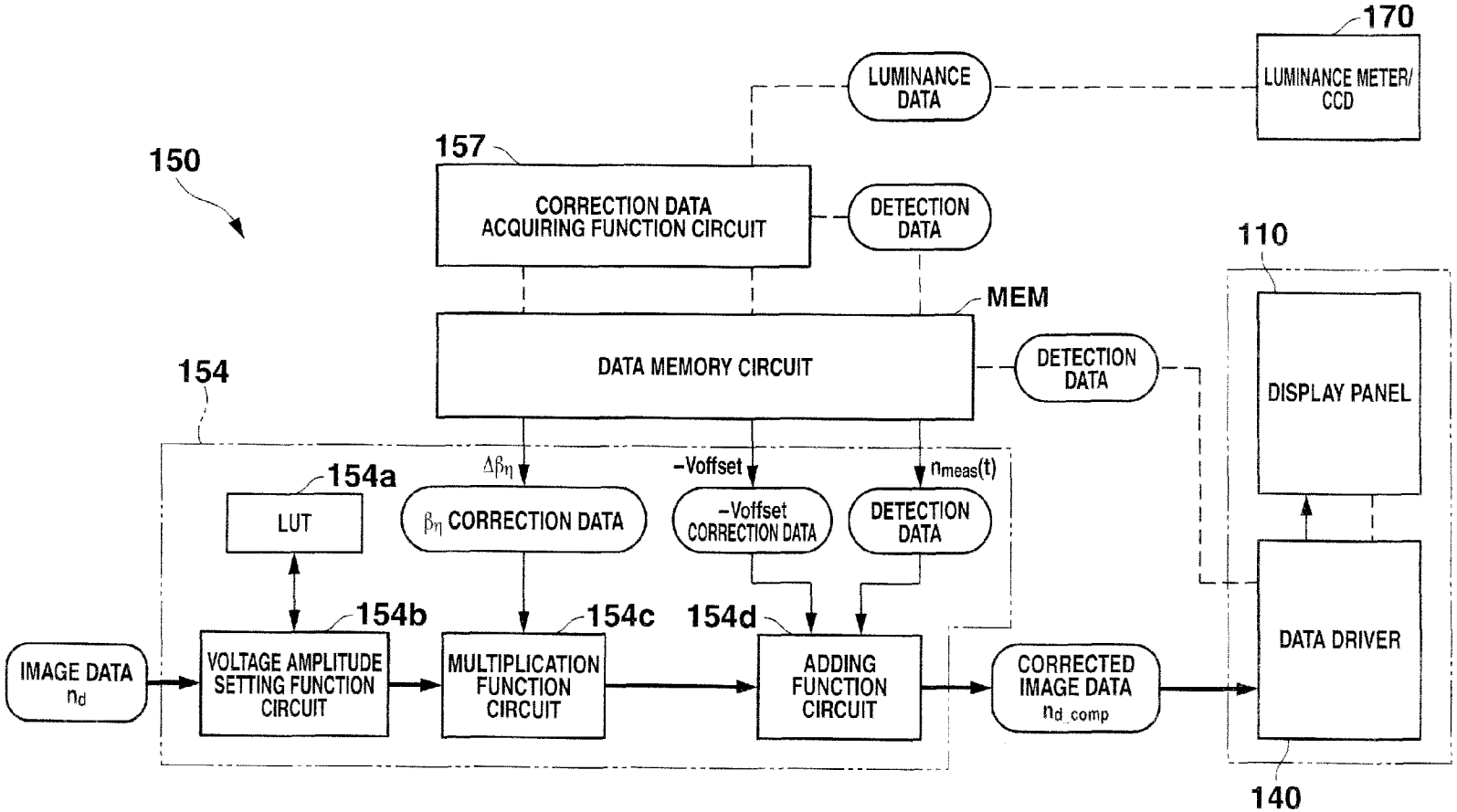
FIG. 66 is a functional block diagram illustrating correction operation of image data in the display device according to the example of the present invention.

FIG. 66 is a functional block diagram illustrating correction operation of image data in the display device according to the present example.

Figure 67:
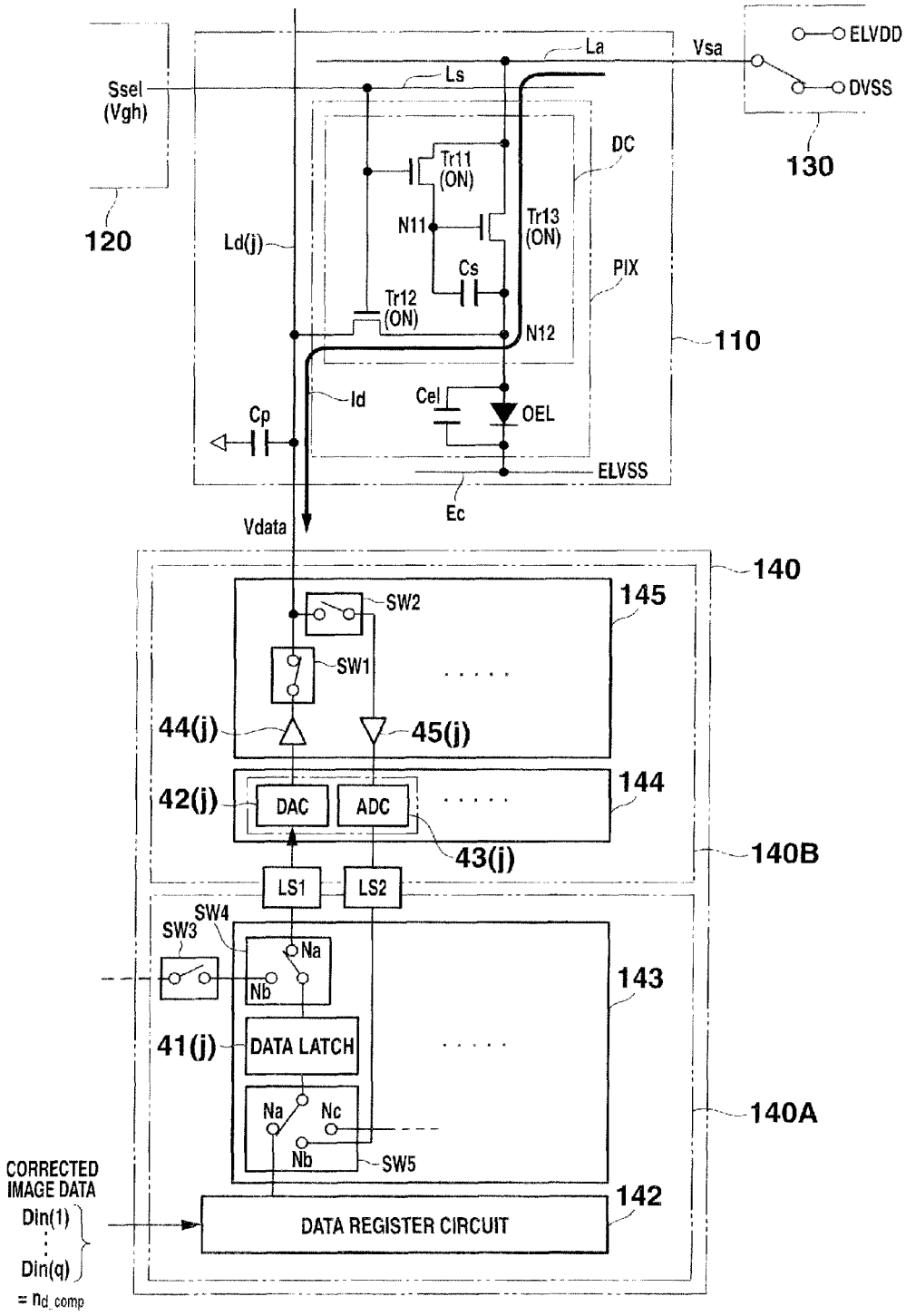
FIG. 67 is a schematic diagram illustrating operation of writing operation of the corrected image data in the display device according to the example of the present invention.

FIG. 67 is a schematic diagram illustrating operation of writing operation of the corrected image data in the display device according to the present example.

Figure 68:
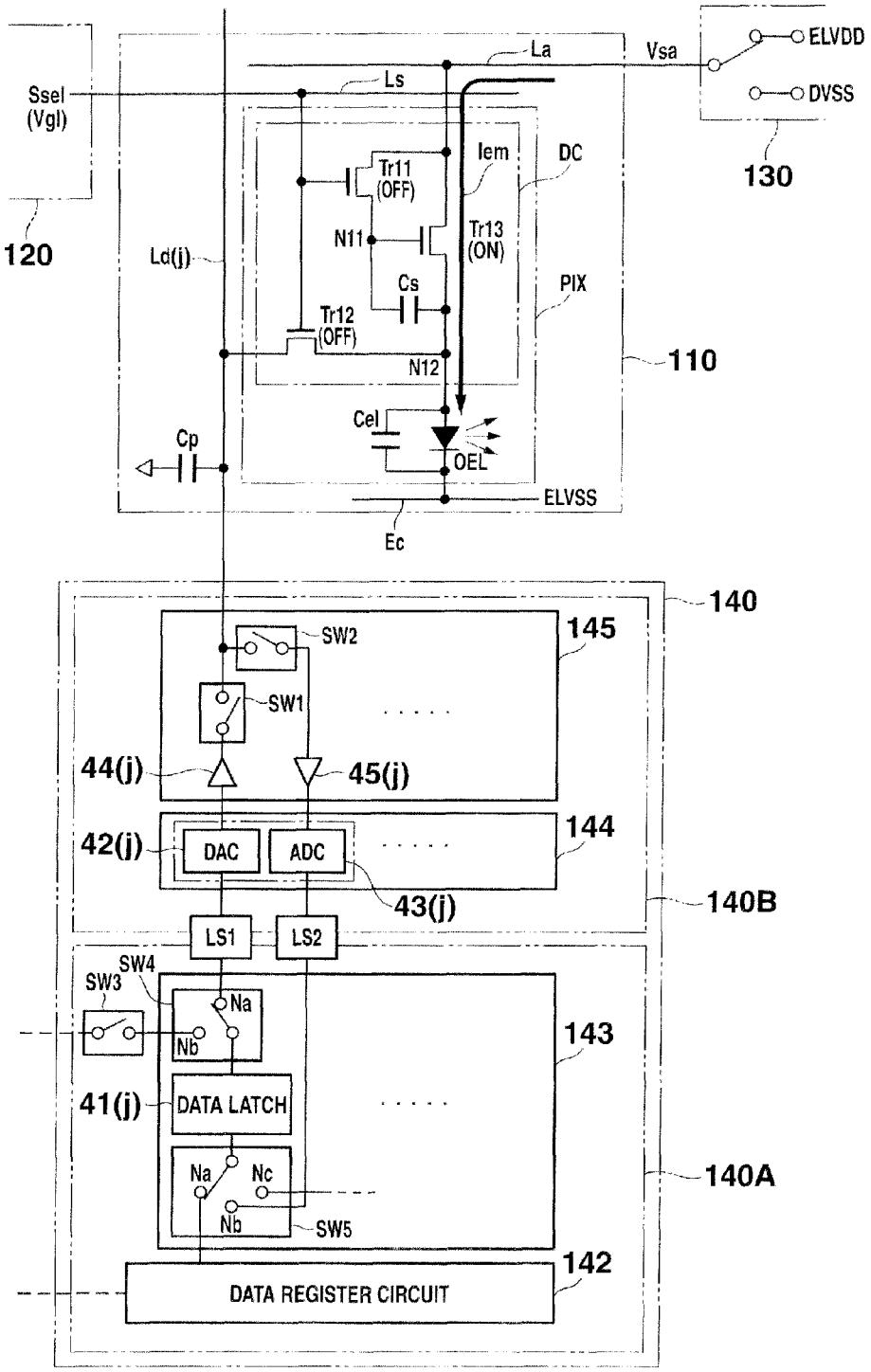
FIG. 68 is a schematic diagram illustrating operation of light-emitting operation performed by the display device according to the example of the present invention.

FIG. 68 is a schematic diagram illustrating operation of light-emitting operation performed by the display device according to the present example.

In this case, in FIGS. 67, 68, the shift register circuit 141 is omitted as an element of the data driver 140 for the sake of illustration.

As shown in FIG. 65, the display operation according to the present example includes an image data write period T301 in which desired image data are generated and written in accordance with each pixel PIX in each row and a pixel light-emitting period T302 in which each pixel PIX is caused to emit light in a luminance gradation according to the image data.

In the image data write period T301, corrected image data generating operation and corrected image data write operation with respect to each pixel PIX are executed.

In the corrected image data generating operation, the controller 150 corrects predetermined image data $n_d$ of digital data by using the pieces of correction data Δβ, Δη and $n_{th}$ acquired by the characteristic parameter acquiring operation and supplies the corrected image data $n_{d_comp}$ to the data driver 140.

More specifically, as shown in FIG. 66, the voltage amplitude setting function circuit 154*b* looks up the look up table 154*a* to set a voltage amplitude according to each color component of RGB with respect to image data $n_d$ that are supplied from the outside of the controller 150 and includes a luminance gradation value of each color of RGB.

Subsequently, the correction data Δβη corresponding to each pixel stored in the correction data storage circuit 152 of the data memory circuit MEM are read out via the correction data memory circuit 153, and the multiplication function circuit 154*c* multiplies the image data $n_d$ subjected to voltage setting and the read correction data Δβη ($n_d \times \Delta\beta\eta$).

Subsequently, the detection data $n_{meas}(t0)$ and the offset voltage ($-Voffset=-1/\xi \cdot t0$) specifying the correction data $n_{tb}$ stored in the correction data storage circuit 152 of the data memory circuit MEM are read out via the correction data memory circuit 153, and the adding function circuit 154*d* adds the read detection data $n_{meas}(t0)$ and offset voltage (−Voffset) to the multiplied digital data ($n_d \times \Delta\beta\eta$) ($(n_d \times \Delta\beta)+n_{meas}(t0)-Voffset=(n_d \times \Delta\beta)+n_{th}$).

The corrected image data $n_{d_comp}$ are generated and supplied to the data driver 140 via the driver transfer circuit 155 (see the above embodiments) by executing the series of correction processings.

In the corrected image data write operation with respect to each pixel PIX, the pixel PIX as a write target is set to the selective state, and a gradation voltage Vdata according to the corrected image data $n_{d_comp}$ are written through the data line Ld(j) in this state.

More specifically, as shown in FIGS. 65, 67, the selection signal Ssel at the selective level (for example, the high level; Vgh) is first applied to the selection line Ls connected with the corresponding pixel PIX, and the power supply voltage Vsa at the non-light-emitting level (low level; DVSS=the ground potential GND) is applied to the power supply line La.

In this selective state, when the switch SW1 is turned on and the switches SW4 and SW5 are set to be connected to the connection point. Nb, the corrected image data $n_{d_comp}$ supplied from the controller 150 are sequentially captured into the data register circuit 142 and held in the data latch 41(*j*) according to each column.

The held image data $n_{d_camp}$ are converted into analog by the DAC 42(*j*) to be applied to the data line Ld(j) of each column as the gradation voltage Vdata.

In this case, the gradation voltage Vdata are defined as shown in the following Expression (25) based on the definition shown in the Expression (14).

$$V\text{data}=V1-\Delta V(n_{d_comp}-1)) \quad (25)$$

As a result, in the light-emitting drive circuit DC constituting the pixel PIX, the power supply voltage Vsa (=GND) at the non-light-emitting level is applied to the gate terminal of the transistor Tr13 and one end side (connection point N11) of the capacitor Cs. The gradation voltage Vdata according to the corrected image data $n_{d_comp}$ are applied to the source terminal of the transistor Tr13 and the other end side (the connection point N12) of the capacitor Cs.

Therefore, the drain current Id according to a potential difference (the voltage Vgs between the gate and the source) produced between the gate and source terminals of the transistor Tr13 flows, and both the ends of the capacitor Cs is charged with a light-emitting voltage (≈Vdata) corresponding to the potential difference based on the drain current Id.

At this occasion, since the voltage lower than that in the cathode (the common electrode Ec) of the organic EL element OEL is applied to the anode (the connection point N12) of the same, the current does not flow through the organic EL element OEL, nor this element does not emit light.

Subsequently, as shown in FIG. 65, in the pixel light-emitting period T302, the respective pixels PIX are concurrently caused to emit light in a state in which the pixels PIX in the respective rows are set to the non-selective state.

More specifically, as shown in FIG. 68, the selection signal Ssel at the non-selective level (for example, the low level; Vgl) is applied to the selection line Ls connected with all pixels PIX arranged in the display panel 110, and the power supply voltage Vsa at the light-emitting level (the high level; ELVDD>GND) is applied to the power supply line La.

As a result, the transistors Tr11 and Tr12 provided in the light-emitting drive circuits DC of each pixel PIX are turned off, and the light-emitting voltage (≈Vdata; voltage Vgs between the gate and the source) with which the capacitor Cs connected to the part between the gate and the source of the transistor Tr13 is charged is maintained.

Therefore, when the drain current Id flows through the transistor Tr13 and the potential at the source terminal (the connection point N12) of the transistor Tr13 increases to a level higher than the voltage ELVSS (=GND) applied to the cathode (the common electrode Ec) of the organic EL element. OEL, the light-emitting drive current Iem flows through the organic EL element OEL from the light-emitting drive circuit DC.

Since this light-emitting drive current Iem is specified based on a voltage value of the light-emitting voltage (≈Vdata) held between the gate and the source of the transistor Tr13 in the corrected image data write operation, the organic EL element OEL emits light in a luminance gradation according to the luminance measurement image data $n_{d_comp}$.

In the above embodiments, after the completion of the luminance measurement image data or corrected image data write operation with respect to the pixel PIX in a specific row (e.g., the first row) but before the completion of the image date write operation with respect to the pixels PIX in other rows (the second and subsequent rows), the pixel PIX in this row is set to the retention state in the operation of acquiring the correction data Δη and the display operation as shown in FIGS. 60, 65.

In the retention state, the selection signal Ssel at the non-selective level is applied to the selection line Ls in the corresponding row to set the pixel PIX to the non-selective state, and the power supply voltage Vsa at the non-light-emitting level is applied to the power supply line La to set the non-light-emitting state.

A set time of this retention state differs depending on each row as depicted in FIGS. 60, 65. Additionally, when performing drive control for operating the pixel PIX to emit light immediately after the completion of the luminance measurement image data or corrected image data write operation with respect to the pixel PIX on each row, the retention state may not be set.

As described above, the display device according to the present invention (including the display drive device) and the correction data acquiring operation that can be applied to the driving control method therefor have a technique of executing, a plurality of times at different timings (relaxation times), the series of characteristic parameter acquiring operations for capturing the data line voltage and converting the data into the detection data of digital data (auto-zero method).

As a result, the parameter for appropriately correcting fluctuation in the threshold voltage of the drive transistor of each pixel and variation in the current gain of each pixel can be acquired and stored in advance.

Therefore, according to the present example, since the correction processing for compensating fluctuation in the threshold voltage of each pixel and variation in the current gain can be performed with respect to image data written into each pixel of the display panel, the light-emitting element (the organic EL element) can emit light in an original luminance gradation according to image data regardless of the change of characteristic of each pixel and the state of variation of the characteristics, thus realizing the active organic EL drive system having excellent light-emitting characteristics and a uniform image quality.

Further, the present embodiment has a technique of measuring light-emitting luminance of each pixel in a state in which the uniform light-emitting drive current flows through each pixel. As a result, a parameter for correcting variation in the light-emitting current efficiency between the respective pixels can be acquired, and correction data obtained by adding a parameter concerning correction of variation in the light-emitting current efficiency to a parameter concerning correction of variation in the current again between the respective pixels can be acquired and stored.

Therefore, according to the present example, since the correction processing for compensating fluctuation in the threshold voltage of each pixel and variation in the current gain and the light-emitting current efficiency can be performed with respect to the image data written into each pixel, the light-emitting element (the organic EL element) can be caused to emit light in an original luminance gradation according to image data regardless of a change in characteristics or variation in characteristic of each pixel.

Accordingly, since the processing for calculating correction data required to correct variation in the current gain including the light-emitting current efficiency and processing for calculating correction data required to compensate fluctuation in the threshold voltage of the drive transistor can be executed based on the series of sequences in the controller 150 including the single correction data acquiring function circuit 157, it is not necessary to provide individual configurations (functional circuits) according to contents of the correction data arithmetic processing, thus simplifying the device configuration of the display device.

In the above example, the method for acquiring the correction data ($n_{th}$, $\Delta\beta$) for correction fluctuation and variation of the light emitting characteristics (the threshold voltage Vth and the current gain $\beta$ of the transistor Tr13, and the light-emitting current efficiency $\eta$ of the organic EL element OEL) in each pixel PIX using the auto-zero method has been explained. However, the present invention is not limited thereto.

For example, in the design stage of the display panel 110 and each pixel PIX, the above characteristic parameter acquiring operation and the display operation including the image data correction operation may be executed using a parameter K calculated based on the parasitic capacitance applied to the drive transistor. The parameter K is multiplied by the detection data concerning change of characteristics of the pixels PIX and the compensation voltage component (offset voltage) of the threshold voltage Vth of the drive transistor, so that the parameter K is used in the correction processing.

In the above characteristic parameter acquiring operation, for example, the parameter K is set to 1.0. On the other hand, in the display operation including the image data correction operation, the parameter K is set to, for example, 1.1. Accordingly, the variation of the light-emitting voltage Vel caused by the parasitic capacitance applied to the transistor Tr13 (drive transistor) of each pixel PIX can be corrected.

<Example of Application to Electronic Device>

Subsequently, an electronic device to which the display device as shown in the above embodiments and example is applied will be explained with reference: to the drawings.

A display device 100 having the configuration and the method as shown in the above embodiments and example can be applied well as a display device for various electronic devices such as a digital video camera, a personal computer, and a mobile phone.

Figure 69A:
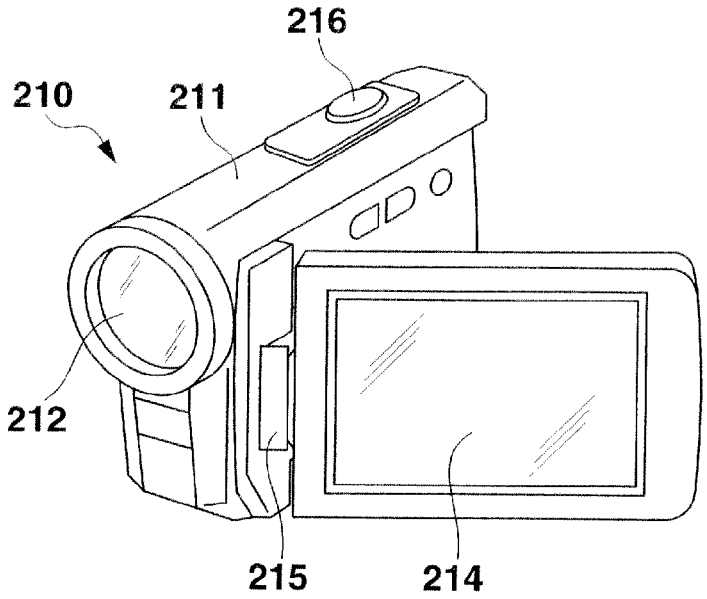
FIG. 69 is a perspective view illustrating an example of configuration of a digital video camera to which the display device according to the present invention is applied.
Figure 69B:
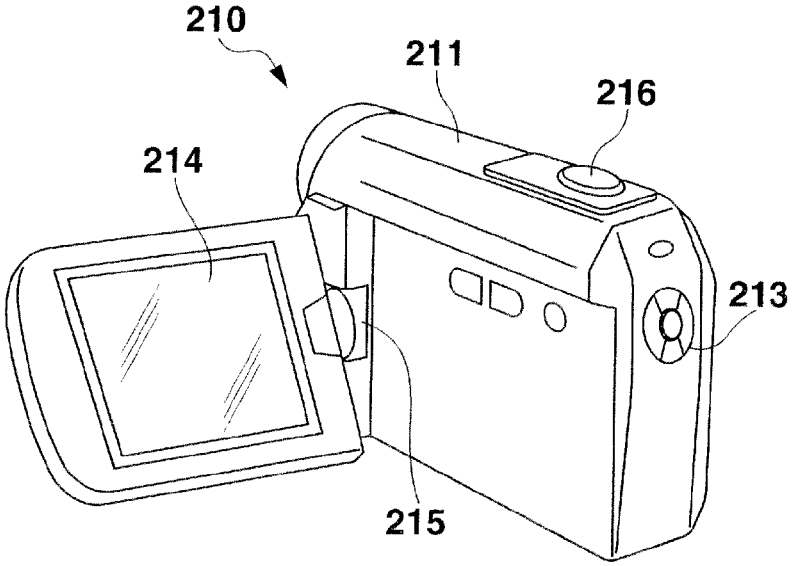

FIG. 69 is a perspective view illustrating an example of configuration of a digital video camera to which the display device according to the present invention is applied.

Figure 70A:
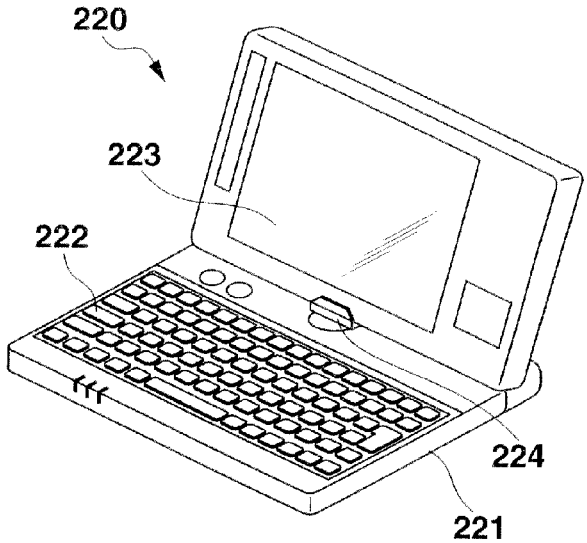
FIG. 70 is a perspective view illustrating an example of configuration of a personal computer to which the display device according to the present invention is applied.
Figure 70B:
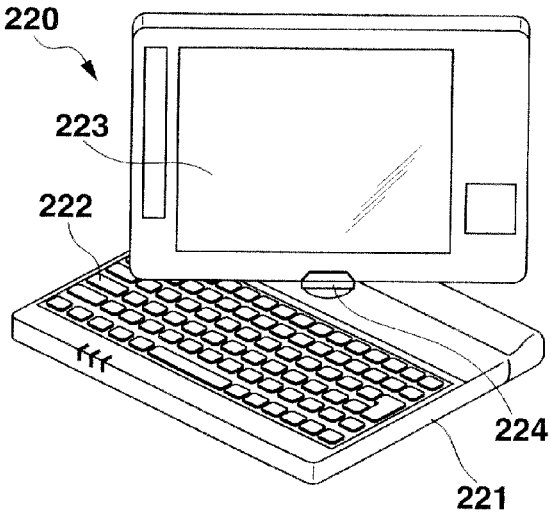
Figure 70C:
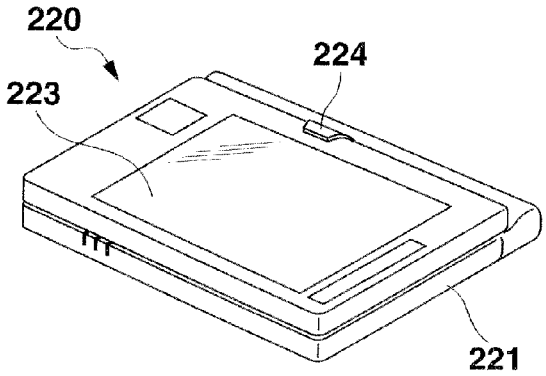

FIG. 70 is a perspective view illustrating an example of configuration of personal computer to which the display device according to the present invention is applied.

Figure 71A:
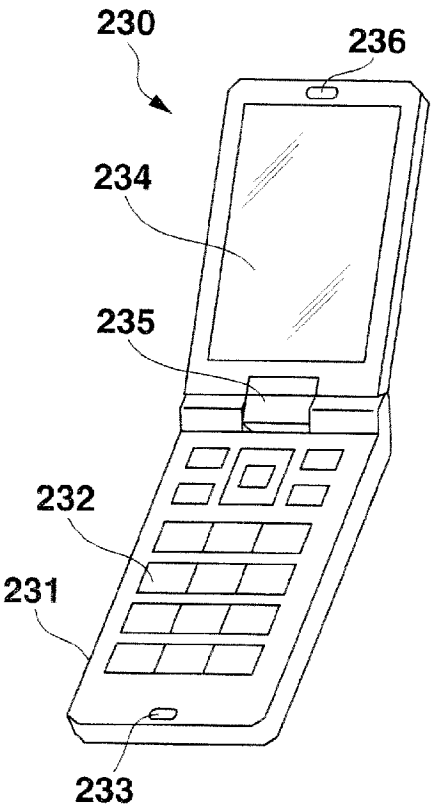
FIG. 71 is a perspective view illustrating an example of configuration of a mobile phone to which the display device according to the present invention is applied.
Figure 71B:
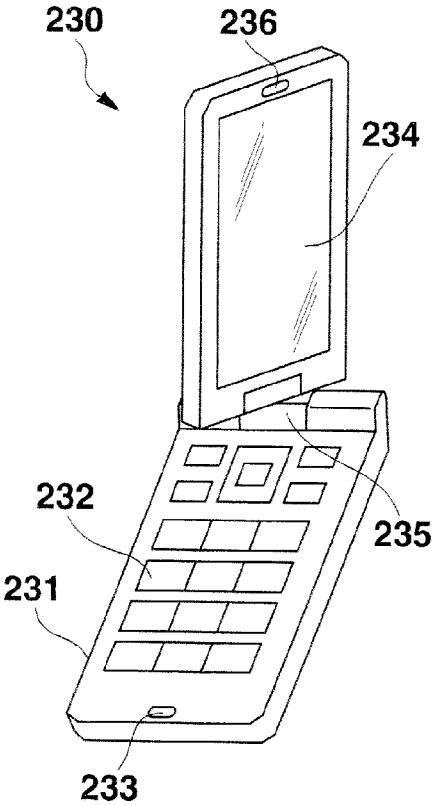
Figure 71C:
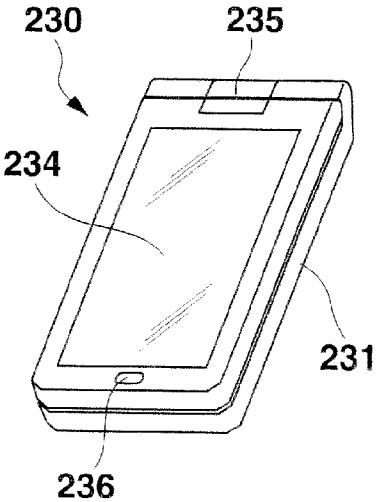

FIG. 71 is a perspective view illustrating an example of configuration of a mobile phone to which the display device according to the present invention is applied.

In FIG. 69, a digital video camera 210 includes a main body unit 211, a lens unit 212, an operation unit 213, a display unit 214 to which the display device 100 having the configuration and the method shown in the above embodiments and example is applied, a hinge portion 215, and a recording start/stop button 216.

The digital video camera 210 includes a mechanism for pivoting the display unit 214 about the hinge portion 215 to any angle with respect to the main body unit 211.

In this configuration, with the simple configuration and method, captured images including motion pictures can be displayed on the display unit 214 in the normal display and various kinds of reversed display modes in a preferable manner, in accordance with the pivoting angle of the display unit 214 with respect to the main body unit 211 or based on the image switch operation of the operation unit 213, and the light emitting element of each pixel emits light in an appropriate luminance gradation in accordance with image data, so that high quality image with uniform image quality can be realized.

In FIG. 70, a personal computer 220 includes a main body unit 221, a keyboard 222, a display unit 223 to which the display device 100 having the configuration and the method shown in the above embodiments and example is applied, and hinge portion 224.

The personal computer 220 includes a mechanism for pivoting the display unit 223 about the hinge portion 224 to any angle with respect to the main body unit 221.

In this case, with the simple configuration and method, captured images including motion pictures can be displayed on the display unit 223 in the normal display and various kinds of reversed display modes in a preferable manner, in accordance with the pivoting angle of the display unit 223 with respect to the main body unit 221 or based on the image switch operation of the operation unit 222 and the like, and the light emitting element of each pixel emits light in an appropriate luminance gradation in accordance with image data, so that high quality image with uniform image quality can be realized.

In FIG. 71, a mobile phone 230 includes a main body unit 231, an operation unit 232, a speaker 233, a display unit 234 to which the display device 100 having the configuration and the method shown in the above embodiments and example is applied, a hinge portion 235, and a microphone 236.

The mobile phone 230 includes a mechanism for pivoting the display unit 234 about the hinge portion 235 to any angle with respect to the main body unit 231.

In this case, with the simple configuration and method, captured images including motion pictures can be displayed on the display unit 234 in the normal display and various kinds of reversed display modes in a preferable manner, in accordance with the pivoting angle of the display unit 234 with respect to the main body unit 231 or based on the image switch operation of the operation unit 232 and the like, and the light emitting element of each pixel emits light in an appropriate luminance gradation in accordance with image data, so that high quality image with uniform image quality can be realized.

In the explanation about the above example of electronic devices to which the display device according to the present invention is applied, the display unit has a so-called two-axis pivoting hinge mechanism so as to freely pivot with respect to the main body of the device. However, the present invention is not limited thereto.

For example, the present invention can also be applied in a preferable manner when, for example, a captured image taken by a rear camera is displayed as a horizontally reversed image on the display unit of a car-mounted monitor installed near the driver's seat, e.g., when an image of rear view of a car is displayed on a car-mounted monitor.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display drive device that displays image information according to image data in a display region of a display panel in which a plurality of pixels are two-dimensionally arranged in a plurality of rows and a plurality of columns, the display drive device comprising:

at least one correction data memory circuit that stores a plurality of pieces of correction data according to characteristics of the plurality of pixels in association with positions where the pixels are arranged in the display panel;

a data reading control circuit that sets a reading order of the plurality of pieces of correction data stored in the correction data memory circuit to an order corresponding to a display form that is set externally, the set display form being any one of a plurality of display forms in which directions of the image information are different with respect to the display region, and reads the plurality of pieces of correction data from the correction data memory circuit in the set reading order of the correction data;

an image data correction circuit that associates the image data with each of the plurality of pieces of correction data which are read by the data reading control circuit, and generates a plurality of pieces of corrected image data obtained by correcting the image data using the respective corresponding correction data; and an image data writing circuit that fetches the plurality of pieces of corrected image data associated with a plurality of pixels arranged along a row direction of the display panel to generate a plurality of gradation signals based on the plurality of pieces of corrected image data and writes the plurality of gradation signals to each of the plurality of pixels;

wherein the display form is set to any one of a normal display mode for displaying an ordinary image in the display region in a usual direction, a vertically reversed display mode for displaying a vertically reversed image obtained by vertically reversing the ordinary image in the display region, a horizontally reversed display mode for displaying a horizontally reversed image obtained by horizontally reversing the ordinary image in the display region, and a vertically and horizontally reversed display mode for displaying a vertically and horizontally reversed image obtained by vertically and horizontally reversing the ordinary image in the display region; and wherein:

(a) when the display form is set to the normal display mode or the vertically reversed display mode, (i) a fetching order of the plurality of pieces of corrected image data by the image data writing circuit is set to an order along a first direction in the row direction of the display panel, and (ii) the reading order of the plurality of pieces of correction data corresponding to the plurality of pixels arranged in the row direction of the display panel by the data reading control circuit is set to an order along the first direction;

(b) when the display form is set to the horizontally reversed display mode or the vertically and horizontally reversed display mode, (i) the fetching order of the plurality of pieces of corrected image data by the image data writing circuit is set to an order along a second direction which is an opposite direction to the first direction, and (ii) the reading order of the plurality of pieces of correction data corresponding to the plurality of pixels arranged in the row direction of the display panel by the data reading control circuit is set to an order along the second direction;

(c) when the display form is set to the normal display mode or the horizontally reversed display mode, (i) a writing order of the plurality of pieces of corrected image data to the plurality of pixels arranged along the row direction of the display panel by the image data writing circuit is set to an order along a third direction in a column direction of the display panel, and (ii) the reading order of the plurality of pieces of correction data corresponding to the plurality of pixels arranged in the row direction of the display panel by the data reading control circuit is set to an order along the third direction; and (d) when the display form is set to the vertically reversed display mode or the vertically and horizontally reversed display mode, (i) the writing order of the plurality of pieces of corrected image data to the plurality of pixels arranged along the row direction of the display panel by the image data writing circuit is set to an order along a fourth direction which is an opposite direction to the third direction, and (ii) the reading order of the plurality of pieces of correction data corresponding to the plurality of pixels arranged in the row direction of the display panel by the data reading control circuit is set to an order along the fourth direction.

2. The display drive device according to claim 1, further comprising at least one image data holding circuit that captures the image data corresponding to the plurality of pixels, wherein the data reading control circuit sets a capturing order of the image data into the image data holding circuit and a reading order of the image data which are captured in the image data holding circuit so that the capturing order of the image data and the reading order of the image data are set to orders corresponding to the display form.

3. The display drive device according to claim 2, wherein the image data holding circuit includes two FIFO memories connected in parallel, and each of the FIFO memories includes memory regions corresponding to the plurality of pixels arranged in the display panel, wherein the data reading control circuit performs control so as to execute, in parallel, an operation for capturing the image data into one of the FIFO memories in the set capturing order and an operation for reading the image data which are captured in the other of the FIFO memories in the set reading order and supplying the image data to the image data correction circuit.

4. The display drive device according to claim 2, wherein the display region is divided into a plurality of divided display regions, a plurality of the image data holding circuits and a plurality of the correction data memory circuits are respectively provided for the plurality of display regions, and the data reading control circuit sets, in accordance with the display form, the capturing order and the reading order of the image data in each of the image data holding circuits and the reading order of the correction data in each of the correction data memory circuits.

5. The display drive device according to claim 1, wherein the correction data memory circuit has a predetermined number of addresses, and stores the plurality of pieces of correction data corresponding to the plurality of pixels in the respective addresses, and the data reading control circuit specifies the addresses of the correction data memory circuit in an order based on the set reading order of the correction data, and performs control so as to read the respective correction data from the correction data memory circuit in the set reading order of the correction data.

6. The display drive device according to claim 5, wherein the display region is divided into a plurality of divided display regions, a plurality of the correction data memory circuits are respectively provided for the plurality of display regions, the correction data memory circuits store the plurality of pieces of correction data in association with an arrangement of the respective pixels in the respective divided display regions, and the data reading control circuit reads, in parallel, the plurality of pieces of correction data corresponding to the plurality of pixels included in a same row in each of the divided display regions from each of the correction data memory circuits by specifying a same address in the respective correction data memory circuits.

7. The display drive device according to claim 1, wherein each pixel includes a light emitting element and a drive transistor for controlling a current supplied to the light emitting element, and the correction data include a data value for correcting fluctuation of a threshold voltage of the drive transistor of each pixel and a data value for correcting variation of a current gain and a light-emitting current efficiency of the light emitting element in each pixel.

8. A display device that displays image information according to image data, comprising:

a display panel that includes a display region in which a plurality of pixels are two-dimensionally arranged in a plurality of rows and a plurality of columns; and a display drive device that displays the image information in the display region of the display panel, wherein the display drive device comprises:

at least one correction data memory circuit that stores a plurality of pieces of correction data according to characteristics of the plurality of pixels in association with positions where the pixels are arranged in the display panel;

a data reading control circuit that sets a reading order of the plurality of pieces of correction data stored in the correction data memory circuit to an order corresponding to the display form that is set externally, the set display form being any one of a plurality of display forms in which directions of the image information are different with respect to the display region, and reads the plurality of pieces of correction data from the correction data memory circuit in the set reading order of the correction data;

an image data correction circuit that associates the image data with the plurality of pieces of correction data which are read by the data reading control circuit, and generates a plurality of pieces of corrected image data obtained by correcting the image data using the respective corresponding correction data; and an image data writing circuit that fetches the plurality of pieces of corrected image data associated with a plurality of pixels arranged along a row direction of the display panel to generate a plurality of gradation signals based on the plurality of pieces of corrected image data and writes the plurality of gradation signals to each of the plurality of pixels;

wherein the display form is set to any one of a normal display mode for displaying an ordinary image in the display region in a usual direction, a vertically reversed display mode for displaying a vertically reversed image obtained by vertically reversing the ordinary image in the display region, a horizontally reversed display mode for displaying a horizontally reversed image obtained by horizontally reversing the ordinary image in the display region, and a vertically and horizontally reversed display mode for displaying a vertically and horizontally reversed image obtained by vertically and horizontally reversing the ordinary image in the display region; and wherein:

(a) when the display form is set to the normal display mode or the vertically reversed display mode, (i) a fetching order of the plurality of pieces of corrected image data by the image data writing circuit is set to an order along a first direction in the row direction of the display panel, and (ii) the reading order of the plurality of pieces of correction data corresponding to the plurality of pixels arranged in the row direction of the display panel by the data reading control circuit is set to an order along the first direction;

(b) when the display form is set to the horizontally reversed display mode or the vertically and horizontally reversed display mode, (i) the fetching order of the plurality of pieces of corrected image data by the image data writing circuit is set to an order along a second direction which is an opposite direction to the first direction, and (ii) the reading order of the plurality of pieces of correction data corresponding to the plurality of pixels arranged in the row direction of the display panel by the data reading control circuit is set to an order along the second direction;

(c) when the display form is set to the normal display mode or the horizontally reversed display mode, (i) a writing order of the plurality of pieces of corrected image data to the plurality of pixels arranged along the row direction of the display panel by the image data writing circuit is set to an order along a third direction in a column direction of the display panel, and (ii) the reading order of the plurality of pieces of correction data corresponding to the plurality of pixels arranged in the row direction of the display panel by the data reading control circuit is set to an order along the third direction; and (d) when the display form is set to the vertically reversed display mode or the vertically and horizontally reversed display mode, (i) the writing order of the plurality of pieces of corrected image data to the plurality of pixels arranged along the row direction of the display panel by the image data writing circuit is set to an order along a fourth direction which is an opposite direction to the third direction, and (ii) the reading order of the plurality of pieces of correction data corresponding to the plurality of pixels arranged in the row direction of the display panel by the data reading control circuit is set to an order along the fourth direction.

9. The display device according to claim 8, wherein the display drive device further comprises at least one image data holding circuit that captures the image data corresponding to the plurality of pixels, and wherein the data reading control circuit controls a capturing order of the image data into the image data holding circuit and a reading order of the image data which are captured in the image data holding circuit so that the capturing order of the image data and the reading order of the image data are set to orders corresponding to the display form.

10. The display device according to claim 9, wherein the display region is divided into a plurality of divided display regions, a plurality of the image data holding circuits and a plurality of the correction data memory circuits are respectively provided for the plurality of display regions, and the data reading control circuit sets, in accordance with the display form, the capturing order and the reading order of the image data in each of the image data holding circuits and the reading order of the correction data in each of the correction data memory circuits.

11. The display device according to claim 8, wherein the image data writing circuit comprises:

a selection driver that sequentially sets the pixels arranged along each row of the display panel to a selective state; and at least one data driver configured to capture the corrected image data, generate the plurality of gradation signals according to the corrected image data, and supply the gradation signals to a plurality of data lines connected to the plurality of pixels and arranged corresponding to each column, wherein a selecting order of the pixels in each row in the selection driver is as follows:

when the display form is the normal display mode or the horizontally reversed display mode, the selecting order is set to a first selecting order along the third direction, and when the display form includes the vertically reversed display mode, the selecting order of the pixels in each row is set to a second selecting order along the fourth direction.

12. The display device according to claim 8, wherein the correction data memory circuit has a predetermined number of addresses, and stores the plurality of pieces of correction data corresponding to the plurality of pixels in the respective addresses, and the data reading control circuit specifies the addresses of the correction data memory circuit in an order based on the set reading order of the correction data, and performs control so as to read the respective correction data from the correction data memory circuit in the set reading order of the correction data.

13. The display device according to claim 12, wherein the display region is divided into a plurality of divided display regions, a plurality of the correction data memory circuits are respectively provided for the plurality of display regions, the correction data memory circuits store the plurality of pieces of correction data in association with an arrangement of the pixels in the respective divided display regions, and the data reading control circuit reads, in parallel, the plurality of pieces of correction data corresponding to the plurality of pixels included in a same row in each of the divided display regions from each of the correction data memory circuits by specifying a same address in the correction data memory circuits.

14. The display device according to claim 8, wherein each pixel includes a light emitting element and a drive transistor for controlling a current supplied to the light emitting element, and the correction data include a data value for correcting fluctuation of a threshold voltage of the drive transistor of each pixel and a data value for correcting variation of a current gain and a light-emitting current efficiency of the light emitting element in each pixel.

15. An electronic device in which a display device according to claim 8 is implemented in a display unit for displaying the image information.

16. A driving control method for a display device that displays image information according to image data in a display region of a display panel in which a plurality of pixels are two-dimensionally arranged in a plurality of rows and a plurality of columns, the driving control method comprising:

setting a reading order of a plurality of pieces of correction data from at least one correction data memory circuit that stores the plurality of pieces of correction data according to characteristics of the plurality of pixels in association with positions where the pixels are arranged in the display panel, so that the reading order of the plurality of pieces of correction data is set to an order corresponding to a display form that is set externally, the set display form being any one of a plurality of display forms in which directions of the image information are different with respect to the display region;

reading the plurality of pieces of correction data from the correction data memory circuit in the set reading order;

associating the image data with each of the plurality of pieces of correction data which are read, and generating a plurality of pieces of corrected image data obtained by correcting the image data using the respective corresponding correction data; and fetching the plurality of pieces of corrected image data associated with a plurality of pixels arranged along a row direction of the display panel to generate a plurality of gradation signals based on the plurality of pieces of corrected image data and writing the plurality of gradation signals to each of the plurality of pixels of the display panel to display the image information on the display panel in the display form;

wherein the display form is set to any one of a normal display mode for displaying an ordinary image in the display region in a usual direction, a vertically reversed display mode for displaying a vertically reversed image obtained by vertically reversing the ordinary image in the display region, a horizontally reversed display mode for displaying a horizontally reversed image obtained by horizontally reversing the ordinary image in the display region, and a vertically and horizontally reversed display mode for displaying a vertically and horizontally reversed image obtained by vertically and horizontally reversing the ordinary image in the display region; and wherein:

(a) when the display form is set to the normal display mode or the vertically reversed display mode, (i) a fetching order of the plurality of pieces of corrected image data is set to an order along a first direction in a row direction of the display panel, and (ii) the reading order of the plurality of pieces of correction data corresponding to the plurality of pixels arranged in the row direction of the display panel is set to an order along the first direction;

(b) when the display form is set to the horizontally reversed display mode or the vertically and horizontally reversed display mode, (i) the fetching order of the plurality of pieces of corrected image data is set to an order along a second direction which is an opposite direction to the first direction, and (ii) the reading order of the plurality of pieces of correction data corresponding to the plurality of pixels arranged in the row direction of the display panel is set to an order along the second direction;

(c) when the display form is set to the normal display mode or the horizontally reversed display mode, (i) a writing order of the plurality of pieces of corrected image data to the plurality of pixels arranged along the row direction of the display panel is set to an order along a third direction in a column direction of the display panel, and (ii) the reading order of the plurality of pieces of correction data corresponding to the plurality of pixels arranged in the row direction of the display panel is set to an order along the third direction; and (d) when the display form is set to the vertically reversed display mode or the vertically and horizontally reversed display mode, (i) the writing order of the plurality of pieces of corrected image data to the plurality of pixels arranged along the row direction of the display panel is set to an order along a fourth direction which is an opposite direction to the third direction, and (ii) the reading order of the plurality of pieces of correction data corresponding to the plurality of pixels arranged in the row direction of the display panel is set to an order along the fourth direction.

17. The driving control method for the display device according to claim 16, further comprising storing the plurality of pieces of correction data corresponding to the plurality of pixels in respective addresses of the correction data memory circuit, wherein the reading the plurality of pieces of correction data includes specifying the addresses of the correction data memory circuit in an order based on the set reading order of the correction data, and reading the correction data from the correction data memory circuit in the set reading order of the correction data.

18. The driving control method for the display device according to claim 17, wherein the display region is divided into a plurality of divided display regions, a plurality of the correction data memory circuits are respectively provided for the plurality of display regions, the correction data memory circuits store the plurality of pieces of correction data in association with an arrangement of the pixels in the respective divided display regions, and the reading the plurality of pieces of correction data includes an operation for reading, in parallel, the plurality of pieces of correction data corresponding to the plurality of pixels included in a same row in each of the divided display regions from each of the correction data memory circuits by specifying a same address in the correction data memory circuits.

* * * * *